US005598783A

United States Patent [19]

Lund

[11] Patent Number: 5,598,783

[45] Date of Patent: Feb. 4, 1997

[54] INTEGRATED TRANSPORTATION SYSTEM INCLUDING TRANSFER VEHICLES

[75] Inventor: VanMetre Lund, Northbrook, Ill.

[73] Assignee: Autran Corp., Northbrook, Ill.

[21] Appl. No.: 475,750

[22] Filed: Jun. 7, 1995

[51] Int. Cl.[6] ..... B61L 3/18

[52] U.S. Cl. ..... 104/88.04; 104/31; 104/48; 104/124; 104/130.07; 104/139; 104/298; 104/299; 104/300; 246/28 R; 246/29 R; 246/63 R; 246/182 R; 364/426.05; 364/424.027; 414/228; 414/537

[58] Field of Search ..... 104/27, 28, 29, 104/30, 31, 48, 50, 88.03, 88.04, 88.05, 124, 125, 130.01, 130.07, 139, 295, 298, 299, 300, 301; 246/28 R, 29 R, 31, 63 R, 63 C, 65, 73, 182 R; 364/424.02, 426.05; 414/234, 228, 239, 498, 241, 537, 343, 344, 345

[56] References Cited

U.S. PATENT DOCUMENTS

| | | | |
|---|---|---|---|
| 3,368,496 | 2/1968 | Falk et al. | 104/31 |
| 3,748,466 | 1/1973 | Sibley et al. | 246/63 C |
| 3,979,091 | 9/1976 | Gagnon et al. | 246/63 C |
| 4,538,950 | 9/1985 | Shiomi et al. | 104/48 |
| 4,665,830 | 5/1987 | Anderson et al. | 104/124 |
| 4,671,185 | 6/1987 | Anderson et al. | 104/130.07 |
| 4,766,547 | 8/1988 | Modery et al. | 104/88.04 |
| 4,991,516 | 2/1991 | Rixen et al. | 104/139 |
| 5,138,952 | 8/1992 | Low | 104/130.07 |
| 5,289,778 | 3/1994 | Romine | 104/88.04 |

*Primary Examiner*—S. Joseph Morano

[57] ABSTRACT

A system is provided that uses small carrier vehicles that operate along electrified guideways and use standardized connections to automatically carry passenger cabins, freight loads and automobile platforms to desired destinations. The connections may include electrical connections for power and communication and they are made to upper ends of posts that extend from front and rear portions of each carrier vehicle and up through a narrow centrally located slot in the guideway. Transfer vehicles operate to transfer loads between the carrier vehicles and storage positions and may be controlled to move in either of two transverse directions or to rotate in a turntable operation. Control circuitry is provided to obtain highly reliable control of vehicle speed and of starting, stopping and merge operations.

25 Claims, 57 Drawing Sheets

213
410
318
299
401
23
398
399
400
411
415
416
406
404
434
435
25
24
420
251
426
422
421
419
430
432
427
423
414
417
413
412
433
402
429
428
407
405
408

251
213
318
419
420
421
422
426
427
428
429
430
432
433
413
414
415
417
411
400
404
434
435
399

959
1019
RECEIVER
1018
1020
1021
1022
RECEIVER
MEMORY
1011
1017
1016
TRANSMITTER
1015
1013
TRANSMITTER
1014
PROCESSOR
1010
1012
COMMUNICATION LINK
962

963
1007
1008
961
TRANSCEIVER
1005
TRANSCEIVER
1006
1026
1028
1000
PROCESSOR
1004
COMMUNICATION LINK
1003
COMMUNICATION LINK
962
1002
COMMUNICATION LINK
965
MEMORY
1001

+3000
+2250
1043
+1500
1046
+750
1040
0
1041
-750
1042
-1500
1044
DISTANCE IN FEET
0
5
10
15
20
25
30
TIME IN SECONDS 1032
1031
1033
1034
1035
1036
MERGE CONTROL UNIT
1030
1037
1038

INTEGRATED TRANSPORTATION SYSTEM INCLUDING TRANSFER VEHICLES

BACKGROUND OF THE INVENTION

1. Field of the Invention

This invention relates to a transportation system and more particularly to a system usable for transportation of people as well as automobiles and other freight loads with very high safety, efficiency, speed and convenience, with capital costs and fuel, labor and other operating costs being minimized and with minimal adverse environmental effects. The system is compatible with existing systems and is readily integrated therewith.

2. Background of the Prior Art

Conventional rail systems have become increasingly costly to construct, maintain and operate with the result that their use for transport of freight interurban passenger travel has been supplanted to a large degree by use of trucks and automobiles. For public transportation in cities, rail-supported street cars have been replaced by buses which have been used less and less as a result of the increased use of automobiles for personal travel. The resulting truck and automobile traffic over streets and highways is a problem of increasing magnitude.

Systems known as "Intelligent Vehicle Highway Systems" are now being proposed for reducing certain problems associated with automobiles and are receiving considerable attention, but it appears that they may be very expensive and the degree to which such systems will be successful is open to question. Systems have been also been used or proposed using automatically operated and driver-less vehicles supported on elevated "monorail" guideways, but such systems have generally been limited to use on a small scale in special applications and have not enjoyed widespread success.

SUMMARY OF THE INVENTION

This invention was evolved with the general object of overcoming disadvantages of prior transportation systems and of providing a practical system for general use in transportation of people and freight in urban and interurban use.

Another object of the invention is to provide a transportation system which is compatible with existing transportation systems.

A further object of the invention is to provide a transportation system which makes practical use of existing technology and which is so constructed as to allow for expansion and for the use of improvements which may reasonably be expected in the future from advancing technology.

Important aspects of the invention relate to the recognition and discovery of problems with systems and proposed systems of the prior art and to an analysis of what is necessary to overcome such problems and otherwise provide an improved transportation system.

Major problems with street-highway systems arise from roadways which are difficult and expensive to maintain. They must withstand exposure to precipitation and wide temperature variations and are on an earth that is inherently unstable due to underground movements and due to seasonal freezing and thawing effects, especially in northern climates. They must also present large areas of high strength, capable of withstanding repeated applications of momentary forces from a tire, which may be that of a heavy truck, to a relatively small area at any point across the width of each lane thereof.

Another problem is that to deal with unavoidable and potentially quite severe variations in road surfaces, automobiles and trucks must have well designed wheel suspensions and they must have tires which cause large energy losses and generate noise at very high levels during high speed travel.

Additional problems result from the very real possibility of collisions. Automobiles must have a relatively heavy outer shell together with seat belts and air bags to protect occupants, and considerable nervous stress and strain is placed on drivers who must be constantly alert.

Rail systems, with steel wheels rolling on steel tracks, avoid the requirement for tires and avoid the energy losses and some of the noise generation associated therewith. However, prior art rail systems have used very heavy locomotives pulling trains of heavy cars, making bridges and elevated supports very expensive and thereby requiring that tracks be supported from the earth through most of their length. The support of rails through wooden ties and a ballast of coarse gravel or crushed rock has reduced but not eliminated the problems with earth instabilities. Derailments have not been uncommon and there have been many fatalities from collisions with automobiles and trucks at crossings.

High speed trains and so called "light rail" systems which have been used or proposed for carrying passengers have been patterned after conventional rail systems and have had relatively heavy and expensive constructions. For handling of freight, longer and longer trains have been used to more efficiently utilize operating personnel, but increased costs have resulted from the need to load, move and assemble a large number of cars of a long train before departure and to disassemble, move and unload the cars upon arrival at a destination.

Personal transportation systems have also been proposed, using small vehicles carrying a single person and automatically controlled to move from one stop to another along an elevated guideway in an urban setting, but such systems have not been as practical and economically attractive as would be desirable and have not enjoyed substantial success.

There has been little or no recognition of the potential economic advantages to be obtained from using automatically controlled light weight vehicles moving on an elevated guideway, particularly with respect to handling transportation of freight loads as well as passengers.

A system constructed in accordance with the invention has similarities to proposed personal transportation systems in that it uses vehicles of small load capacity moving on an elevated guideway under automatic control, but differs from prior known systems with respect to handling of freight as well as passengers and with respect being directed to handling interurban as well as urban transportation. The system provides for automatic control of both vehicles carrying freight and vehicles carrying passengers over both short and long distances and in a manner such that loads can be distributed throughout the day and night to make highly efficient use of a common guideway.

With particular regard to handling of freight loads, it is recognized that a substantial reduction in operating costs per ton-mile is realized from automatic control without an operator, that vehicle construction and maintenance costs are reduced by using light weight vehicles, and that energy costs are minimized by using wheels rolling on tracks and by using an efficient aerodynamic design.

The costs of construction and maintenance associated with a guideway are also minimized, even though the guideway is elevated. In terms of handling a given tonnage of loads per day, such costs are comparable with if not substantially less than those associated with conventional rail systems or conventional street-highway systems. The load presented by a single light weight vehicle is quite low and through automatic control and particularly when handling freight loads which may be moved at any time of a day or night, a great many vehicles can be moved every day over a given length of an elevated guideway. Thus a given length of a light weight elevated guideway can carry more tonnage per day and cost less to construct and operate than the same length of a conventional lane of a highway or a conventional railway, when operated under typical conditions in which the number of vehicles handled per day is a small fraction of the capacity of the highway lane or railway.

In addition, a light weight elevated guideway can be constructed along existing streets and highways or along existing railways without substantial interference therewith and without requiring large land-acquisition expenditures. Such a guideway can also be constructed at relatively low costs in hilly or mountainous regions where the costs for a conventional highway or railway would prohibitively high.

Other advantages to be obtained from use of automated vehicles on an elevated guideway will become apparent after considering details of construction and operation of a system as disclosed herein, especially with respect to safety and convenience and most especially in a system for wide scale general urban and interurban use in carrying both freight and people.

With regard to convenience for passengers, a person or a small group of persons can board a small vehicle at a nearby point to leave in a short time and to be speedily and safely carried to a point close to a final destination, either in the same city or in a distant city. There is no need to use local transportation such as an automobile, a local transit bus or a taxi to travel to a train or bus station or airport and then wait for departure at a scheduled or delayed time of a train, bus or airplane which carries a large number of passengers to a distant destination and the again use a local transportation system to get to a point near the final destination.

In handling of freight, it is possible to obviate the present time-consuming and expensive labor-intensive processes of assembling a large load from many original loads which are typically quite small, carrying the large load to a distant destination and then disassembling the large load into the original loads for delivery to respective recipients.

There are a number of factors to consider with regard to the choice of size of an automated vehicle. A small size is desirable to minimize the size and cost of the required guideway but too small a size may increase costs in that a number of vehicles may cost somewhat more to construct and operate than a single larger vehicle of the same total load capacity. A small size is also desirable, and a larger size unnecessary, for transporting a single person or other small load from one point to another. At the same time, it is frequently desirable to transport a larger number of persons or a larger freight load. For example, important advantages result from having the capability of efficiently and automatically carrying an automobile, or a small mobile home or office of similar size, especially for long distance travel.

In a transportation system as illustrated herein, a vehicle is provided which may have a maximum load capacity of on the order of 5000 pounds, sufficient for hauling of a conventional automobile or similar load but small enough to permit economic construction of a guideway which is elevated and isolated from other traffic. A load capacity of this magnitude facilitates use with and transition from the existing transportation system in that guideways of the system can be constructed between cities along existing highway or railroad rights of way, for immediate productive use in carrying loads including automobiles which may be fully loaded.

It should be understood, of course, that the invention is not limited to any particular size of vehicle and may include vehicles having a smaller load-carrying capacity. For example, a vehicle having a load-carrying capacity of on the order of 1000 pounds could carry up to 4 or 5 persons and the vast majority of items carried by freight which are or can be broken down into small loads.

In accordance with important features of the invention, a generally tubular guideway is provided having vehicle support surfaces which are in a protected location therewithin to be subjected to minimal contact by falling rain or snow. The tubular guideway also supports electrical rails for engagement by contact shoes carried by a vehicle, to convey electrical power to or from the vehicle, such electrical rails also being in a protected location and being subjected to minimal contact with falling rain or snow. For communication of control and other signals between the guideway and the vehicle, rails at a protected location within the guideway may be engaged by contact shoes carried by the vehicle. In the alternative, a wireless coupling is provided including electrical conductors within the guideway which are inductively coupled to devices carried by the vehicle. With such inductive coupling, reliable transmission is achieved at very low power levels and the radiation of signals to the outside of the guideway as well as interference from signals radiated into the guideway are minimized, since induction fields are much greater than radiation fields at distances which are small in relation to wavelength or conductor length. In addition, the space within the guideway is isolated through the use of conductive materials in the walls of the guideway.

The generation of acoustic noise within the guideway is minimized by using steel wheels rolling on steel track, and the guideway inherently minimizes outward transmission of any noise which is generated. In addition, the guideway provides a support for positioning of sound absorbing materials to attenuate any such noise.

An important feature of the invention relates to the provision an automated vehicle which includes load connect structures for selective connection of any of a number of types of loads thereto and which is operable with or without connection to a load. In an illustrated vehicle which is movable in a tubular guideway, the load connect structure is in the form of a pair of pads on the upper end of posts which project upwardly through a slot in the upper wall of the guideway and to a connector which can be secured to any desired type of body. The slot is preferably quite narrow to minimize entrance of precipitation into the guideway.

Such construction of the tubular guideway as an underlying support structure, although allowing entrance of some precipitation, has cost and other advantages. In accordance with the invention, however, an overlying tubular support structure may be used with the load being suspended therefrom.

The connectors which are secured to the pads are arranged for connection to any of a number of types of bodies including, for example, passenger carrying bodies for a public transportation system, freight-carrying bodies, bodies in the form of automobile carrying platforms and bodies which form small mobile homes or offices and which may be either rented or privately owned.

In accordance with further features of the invention, transfer means are provided which are preferably in the form of a transfer vehicle which is automatically controlled and which functions to move bodies between storage positions and a body loading/unloading position along a guideway at which the bodies may be automatically attached to or detached from a vehicle of the system. The transfer vehicle has a low profile, such that it can move over a central portion of a carrier vehicle and under a body carried by the carrier vehicle and between the aforementioned pads and connectors. Prong structures on a lift frame of the transfer vehicle are extended forwardly and rearwardly to engage the connectors and to release locking bars provided for locking the connectors to the pads during travel. The transfer vehicle then lifts the connectors and the body secured thereto and carries the body to a storage or unloading position. In the case of a body which is in the form of an automobile carrying platform, the transfer vehicle may carry the platform to a delivery position from which it can be driven away. The transfer vehicle is also usable in simply parking automobile carrying platforms in storage locations, if desired.

Each carrier vehicle is arranged to be supplied with control data which determine a stop to be made by each passenger in the case of a passenger carrying body or which determine a route through the system and to a destination point in the case of a freight carrying body.

Further important features relate to the support of the vehicle from wheels in a manner such as to safely retain the vehicle, to obtain a high degree of traction for acceleration and braking and to permit movement on steep slopes and around turns of short radius. The support also permits a vehicle to continue on a path on which it is travelling or to branch to a second path. In a public transportation system, for example, a vehicle may move from a main line guideway to a branch line guideway to discharge or pick up a passenger and to then move back from the branch line guideway to the main line guideway, permitting other vehicles to travel on the main line without substantial interruption To safely retain a vehicle on a guideway, wheels of the vehicle engage surfaces of a guideway to limit rolling movement of a vehicle about a longitudinal axis. Preferably, such wheels may engage both downwardly and upwardly facing surfaces of the guideway to limit upward as well as downward movement and while also limiting such rolling movement. An illustrated embodiment of a carrier vehicle has eight wheels. Two bogies are provided, each having two pairs of wheels, one wheel of each pair being a support wheel engaged with an upwardly facing guideway surface and the other wheel of each pair being a retaining wheel engaged with a downwardly facing guideway surface. Means are provided for controlling the engagement of retaining wheels with the downwardly facing guideway surfaces to obtain increased traction.

In the illustrated arrangement having eight wheels all are driven, each retaining wheel being geared to the associated support wheel. Thus high traction forces are obtained when required for acceleration and or climbing steep slopes as well as for braking on level or inclined surfaces.

Further specific features relate to insuring adequate tractive forces through the application of spring forces to maintain pressure between wheels and downwardly as well as upwardly facing surfaces, and to the control of such forces, either through setting the relative vertical spacing of such surfaces along the guideway or through a dynamic control of spring forces on the vehicle, using an electrically controlled motor or the equivalent.

In accordance with another important feature, vehicle and guideway constructions are provided in which both the velocity and path of movement of the vehicle are controlled in an autonomous manner from the vehicle but in a manner such as to permit monitoring of vehicle movements from a central location and to permit over-ride of the autonomous control in appropriate circumstances. The system avoids problems of proposed systems in which the movements of vehicles would be centrally controlled and susceptible to complete breakdowns in operation.

The autonomous control of the invention is achieved in a manner such as to obtain a very high degree of reliability. A guideway is provided with junction regions each arranged for entrance of a vehicle on entrance rails on which it is moving and exit on either a left-hand pair of exit rails or a right-hand pair of exit rails either of which may form a generally straight-line continuation of the entrance rails. Preferably, such junction regions are passive with no movable switching elements. Movement onto the selected pair of exit rails is controlled through the cooperation of steering control elements on the vehicle with guide elements of the guideway. In an illustrated embodiment, a vehicle carries left and right steering control wheels which are controllably movable up or down and which are grooved to receive upstanding guide flanges which extend along the sides of left and right support rails of a guideway. In the junction region, a guide flange of the left rail of the left pair of exit rails forms a continuation of the guide flange of the left entrance rail while a guide flange of the right rail of the right pair of exit rails forms a continuation of the guide flange of the right entrance rail. When approaching a junction region, control wheels on only one side of the vehicle are placed in downward positions for cooperation with the guide flange of either the left or right entrance rail and thereby the associated continuation flange of an exit rail to steer the vehicle onto the selected pair of exit rails. As a result, the vehicle is smoothly and reliably guided onto the selected pair of exit rails.

In accordance with another feature of the invention, the guideway is constructed in sections, the construction of each section being such as to facilitate operation in a manner such as to obviate any substantial abrupt change in direction of a vehicle travelling as it enters the section, moves along the section and leaves the section, thereby obtaining very smooth movement of passengers and freight, minimizing fatigue and extending the life of parts of the guideway and vehicle and improving reliability and safety. More specifically, a track member on each side of a section is supported through a first means of resilient form from an intermediate means which is supported through second means of more rigid form from the truss structure. The characteristics of both such first and second means are adjusted to obtain a value that is zero, or that is otherwise a constant, as to the rate of change of any acceleration in a vertical or horizontal direction transverse to the direction of movement of a vehicle.

The one variable that might interfere with such smooth movement is the movement of earth under any column which supports the ends of adjacent sections. To obviate this possibility adjustable support means are provided along the guideway and are arranged for ready access from a maintenance vehicle movable along either side of the guideway.

This invention contemplates many other objects, features and advantages which will become more fully apparent from the following detailed description taken in conjunction with the accompanying drawings.

DESCRIPTION OF PREFERRED EMBODIMENTS

Figure 1:
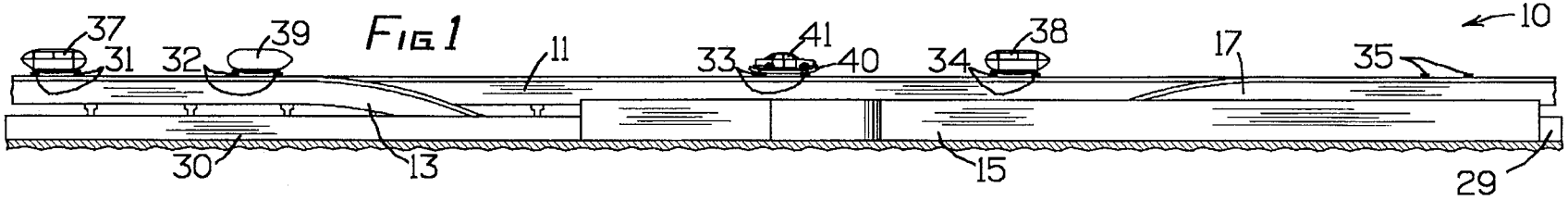
FIG. 1 is a side elevational view of a representative part of a transportation system of the invention.

Reference numeral 10 generally designates a transportation system constructed in accordance with the principles of this invention. The system 10 includes bodies which are adapted to carry various types of loads and which are carried by carrier vehicles for rapid automated travel between and within cities and towns. The system also provides for efficient loading of the bodies and transfer of bodies between carrier vehicles and storage and loading positions.

Figure 2:
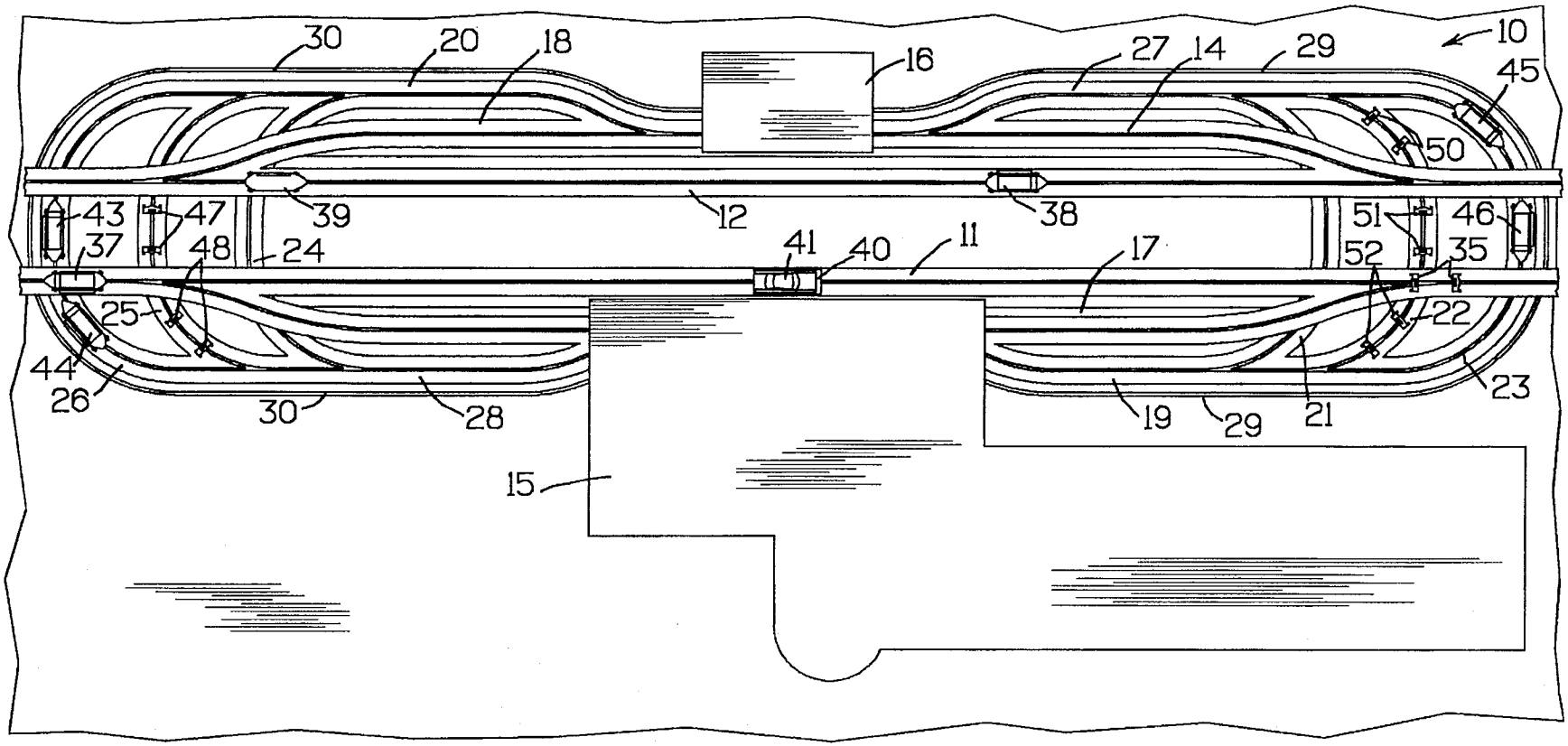
FIG. 2 is a top plan view of the part of the system shown in FIG. 1.

In the portion of the system 10 that is illustrated in FIGS. 1 and 2, bodies and support pads of carrier vehicles are shown on an elevated main line guideways 11 and 12 which support the carrier vehicles for movement at high speeds to the right and to the left. The vehicles may exit such elevated main line guideways 11 and 12 to move sidewardly and then downwardly along branch line guideways 13 and 14 to enter facilities 15 and 16 and they may thereafter exit the facilities 15 and 16 to move upwardly and then sidewardly on branch line guideways 17 and 18 to reenter the main line guideways 11 and 12. In the system as illustrated, the facility 15 is usable for loading, unloading and transfer of bodies and the facility 16 is usable for servicing of carrier vehicles.

Generally semicircular guideways are provided for temporary parking of body-carrying and empty vehicles and also for reversal of the direction of movement of vehicles to permit either of the facilities to be used in connection with vehicles traveling in either direction. In particular, the exit ends of facilities 15 and 16 are connected through semicircular guideways 21–23 and 24–26 to guideways 27 and 28 connected to the entrance ends of facilities 16 and 15. Guideways 22, 23, 25 and 26 may be used for parking of bodies and carrier vehicles, while guideways 21 and 24 are maintained clear for use in rapid reversal of the direction of movement. Preferably, the guideways 19–28 have upper surfaces at approximately ground level and a wall 29 extends around the guideways 19, 23 and 27 and a wall 30 extends around the guideways 20, 26 and 28.

The carrier vehicles may be programmed to be moved automatically along a selected path in the system and to a selected stop station. They include body mounting pad pairs which are movable in paths above the guideways 13, 14 and 17–28 and which are arranged to be securely but detachably locked to connectors on the frame of a load-carrying body. As will be described, each carrier vehicle includes a pair of bogies having wheels engaged with tracks within the guideway, each bogie supporting a post that projects upwardly and through guideways 19 and 20 and through a narrow slot in the guideway to a one of the body mounting pads.

FIG. 1 shows body mounting pad pairs 31–35 moving along the main line guideways in FIG. 1, with representative types of bodies 37–40 secured to pad pairs 31–34 and with pad pairs 35 being empty. Body 37, shown oriented for movement to the right along main line guideway 11 and body 38 shown oriented for movement to the left along main line guideway 12, are passenger-carrying bodies. Body 39, shown oriented for movement to the left along guideway 12 is a freight-carrying body with a size and shape similar to that of bodies 37 and 38. Body 40 is a specially constructed platform which carries an automobile 41 as shown.

FIG. 2 shows the pad pair 35, bodies 37–40 and automobile 41 and also shows bodies and pads hidden from view in FIG. 1 by the walls 29 and 30. Passenger-carrying bodies 43 and 44 are in parked positions on semicircular guideway 26 ready to be moved into the loading facility 15 to pick up a waiting passenger or passengers when requested. Another pair of passenger-carrying bodies 45 and 46 are in parked positions on semicircular guideway 23 ready to be moved into the facility 16 to pick up a waiting passenger or passengers within facility 16 when requested or to move through either of the guideways 24 or 26 and to the facility 15. Pad pairs 47 and 48 are in parked conditions on semicircular guideway 25, ready to be moved into the facility 15 to be loaded with a load such as a freight-carrying body or an automobile-carrying platform. Pad pairs 50–52 are in parked positions on semicircular guideway 22, ready to be moved through guideway 27, facility 16, guideway 20, one of the guideways 24 or 25 and the guideway 28 to the facility 15.

Figure 3:
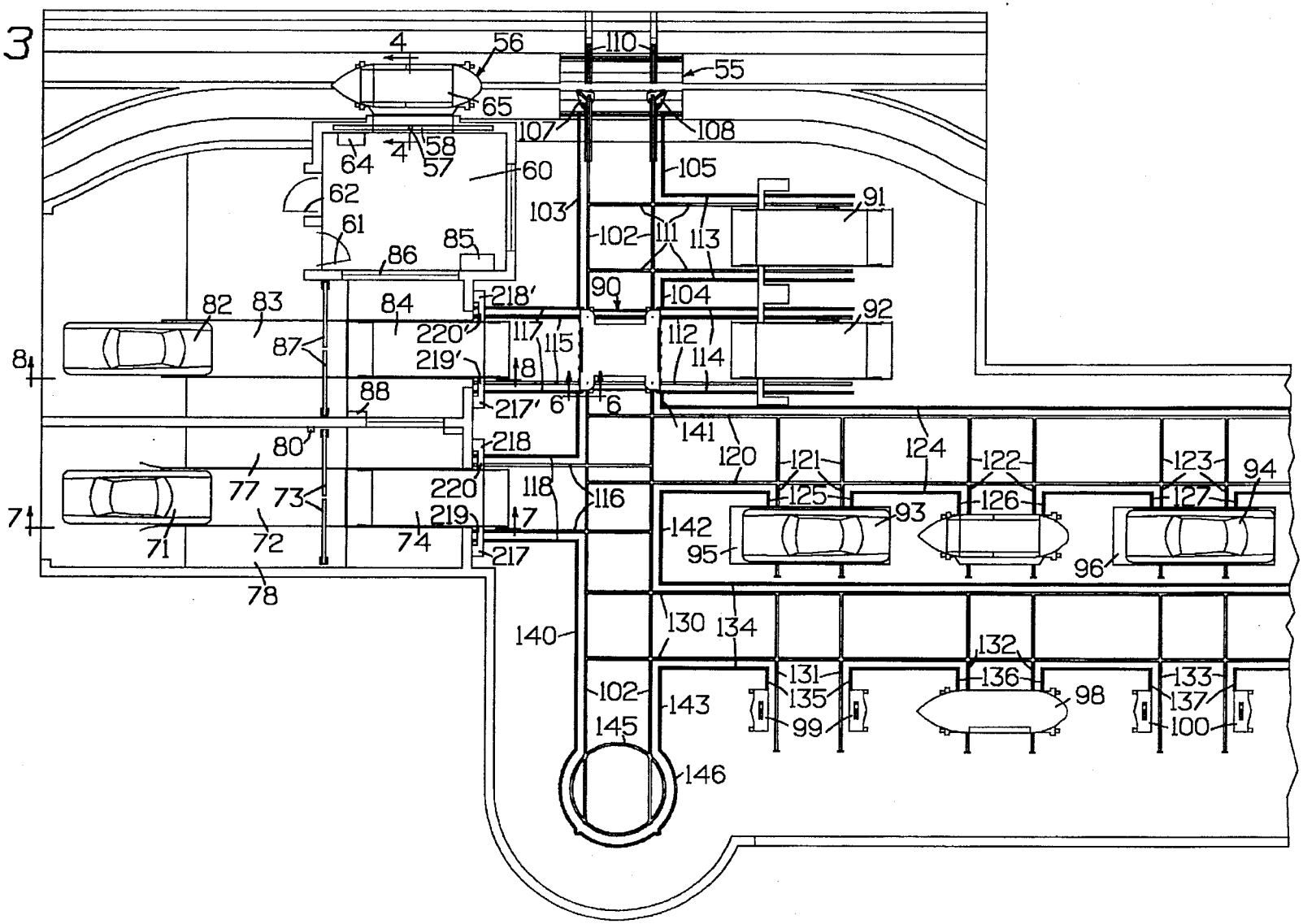
FIG. 3 is a top plan view, with a roof structure removed, of a portion of a facility which is part of the system shown in FIGS. 1 and 2.

FIG. 3 is a top plan view of a portion of the facility 15 which provides two loading and unloading positions along a guideway 54 which is connected between ends of guideways 17 and 19 and ends of guideways 13 and 28. Reference numeral 55 indicates one position at which a body may be transferred between a transfer vehicle and the pads of a carrier vehicle positioned thereat, as hereinafter described. A passenger-carrying body 56 is shown at a second position usable exclusively for pick-up and discharge of passengers and located opposite sliding doors 57 and 58 of a waiting room 60.

Passengers may enter the room 60 through a door 61 and exit through a door 62. Upon entry, a passenger may use a unit 64 to enter service request and identification data after deposit of coins or bills or entry of a credit card. The response of the system may depend upon the type of request. The system may be programmed to allow ride-sharing at a lower fare by willing passengers while also allowing exclusive use at a higher fare by a single passenger or group of passengers. In response to a request which assents to ride sharing, the system may wait for a body which will be moving in the desired direction on one of the main line guideways 11 or 12 and arriving within less than a certain time limit, to be diverted to branch line 13 or branch line 14 and brought to the position of body 56 as shown in FIG. 3. When no such body is available within a reasonable time or in response to an exclusive use request, an empty passenger-carrying body may be moved from a parked position, such as occupied by body 44 in FIG. 2, to the position of body 56 as shown in FIG. 3.

After a body such as body 56 is brought to a complete stop at the position as shown, sliding doors 57 and 58 are opened and a door 65 of the body 56 is also moved to an open position to permit one or more passengers to exit the body 56 and/or to permit one or more passengers to enter the body 56. As hereinafter described in connection with FIGS. 4 and 5, each passenger may use a key pad to identify a destination station, if different from a destination station previously identified by another passenger, and to signify that he or she is ready for travel. After all passengers have done so, both the door 65 of the body 56 and the sliding doors 57 and 58 are closed. Then the vehicle which carries the body 56 is moved along guideway 54 to enter guideway 17 and then enter main line guideway 11, if destination stations are to the right. If destination stations are to the left, the vehicle enters guideway 19, then semicircular guideway 21 and guideway 27 to move through the facility 16 and through guideway 18 to enter the main line guideway 12. As hereinafter described, automatic control means are provided for controlling acceleration of the vehicle and controlling movement of vehicles on the main line guideways to obtain entry of the vehicle on the main line at safe distances behind one vehicle and ahead of another, slowing down vehicles moving on the main line guideway as required.

The system as shown in FIG. 3 is operative in a body transfer mode to transfer a body in either direction between a storage position and the pads of a carrier vehicle at position 55. In addition, it is operative for either transport of automobiles on the main line guideways or as a parking facility, being operable in an automobile receiving mode for receiving automobiles on support bodies or platforms and transferring such platforms either to pads of a carrier vehicle at position 55 or to support pads at a storage position and being also operative in an automobile delivery mode to transfer an automobile support body to a delivery position from either the pads of a carrier vehicle at position 55 or support pads at a storage position.

An automobile 71 is shown at a receiving position at one end of a guide channel 72, awaiting the opening of gates 73 at the opposite end of the guide channel 72 to permit the automobile to be driven onto a platform 74 and permitting the driver to then receive audible and/or visual instructions. In response thereto, the driver then gets out of the automobile and uses a machine 76 to enter data which either signifies a desire to park or which identifies a desired destination on the guideway and a desire to either travel with the automobile or have the automobile transported without any occupant. For payment, a credit card may be used, or when the cost can then be determined, coins or bills may be entered for payment. A parking ticket may be issued, usable for securing delivery and in effecting payment upon delivery and securing release of the automobile.

If an election is made for one or more persons to travel with the automobile, and unless the user indicates possession of a previously issued communication device, the machine 76 may deliver a communication device usable within the automobile for wireless communication with equipment carried by the platform 74. During travel, an occupant of the automobile may use the communication device to change the desired destination during travel and to establish communication with a central control center, especially during any emergency which might arise.

If an election is made for transport of the automobile without an occupant or in the case of parking, instructions are given for all occupants to leave the automobile, exit on walkways 77 and 78 alongside the guide channel 72 and give a clear signal by pressing a button of a device 80. The gates 73 are then closed and the platform 74 is thereafter transferred to either the position 55 or to a storage location.

A delivered automobile 82 is shown at one end of a guide channel 83, after having been driven from a platform 84 shown in an empty condition at a delivery position at the opposite end of guide channel 83. When an automobile transported from another station arrives on a carrier vehicle at position 55, its supporting platform is moved to a storage location unless there is a pending request for immediate delivery. A machine 85 in waiting room 60 is usable to request delivery of a parked automobile, or of an automobile which has been transported and stored or of an automobile which is arriving at the position 55. A parking ticket may be used, any required cash payment may be made through coins or bills, or credit card and/or a key pad or the equivalent may be used to enter data identifying the user as being authorized to receive the automobile. Then the user may wait at a window 86 for delivery at the position of platform 84 and the opening of a pair of gates 87 to allow entry into the automobile and driving of the automobile to the position of automobile 82 as shown, the gates 87 being thereafter moved to the closed condition as shown.

When an occupied transported automobile arrives at position 55, its platform is normally delivered directly to the position of platform 84. If the occupant has a communication device which must be returned and/or if any payment or other operation is required, the occupant may be instructed to return the communication device or effect payment, using a machine 88 provided for that purpose, whereupon the gates 87 may be opened. When, however, everything is in order, the gates 87 may be immediately opened when the platform carrying an arriving automobile reaches the delivery position of platform 84.

A transfer vehicle 90 is provided for transfer of bodies between the pads of a carrier vehicle positioned at the body loading-unloading position 55 the receiving and delivery positions occupied by automobile platforms 74 and 84 and various storage positions. A number of storage positions are shown in FIG. 3, it being understood that many more storage positions or a fewer number may be provided as may be required for a particular facility. An ample number of body storage locations is generally desirable for efficient use of the transport capabilities of the system which may be restricted as required during daytime and evening hours to transport those passengers requiring service and freight requiring fast service, reserving other hours for transport of freight. If desired, a multi-story storage facility may be provided having, for example, a transport vehicle for each floor operative to transport bodies between support pads at storage locations and support pads on an elevator.

In FIG. 3, empty platforms 91 and 92 are shown in storage locations such that they can be readily quickly transferred to the receiving position of platform 74. Two parked automobiles 93 and 94 are shown on platforms 95 and 96 and a passenger body 97 and a freight body 98 are shown at additional storage locations. Two empty storage locations are shown, formed by two pairs of support pads 99 and 100 which are similar to those of a carrier vehicle and which include connectors for supply of electrical power to bodies supported thereon. The supply of electrical power may be highly desirable, for example, in connection with freight bodies having refrigeration equipment and in connection with bodies which are designed for use as mobile offices or small mobile homes.

In the operation of the transfer vehicle 90, it moves under a body, lifts the body from the support pads of a carrier vehicle or from support pads at a storage or loading position, then moves to a destination position and drops the body onto support pads thereat. Pairs of parallel tracks support four wheels of the vehicle, the tracks being arranged orthogonally and the wheels being pivotal about vertical steering axes to permit movement in two mutually transverse directions and also to permit rotation of the transfer about a central vertical axis to obtain a "turntable" operation. For supply of electrical power, electrical contact devices are provided on corner portions of the vehicle, each including a pair of contacts engageable with a pair of conductors of an electrical supply rail in parallel relation to the tracks.

To pick-up or deliver a body from or to pads of a carrier vehicle at the loading-unloading position 55, the transfer vehicle 90 may be moved over tracks 102 from a position as shown while contacts on one side thereof engage conductors of a supply rail 103 and contacts on the opposite side thereof engage conductors of either a rail 104 or a rail 105. As it approaches the position 55, the forward end thereof engages elements of structures 107 and 108 to pivot such structures about vertical axes and to then bridge a space through which pad support posts of carrier vehicles normally pass. The bridging structures 107 and 108 then provide support for forward pair of wheels as they move from ends of tracks 102 to tracks 110 which register with the tracks 102.

A pair of tracks 111 and a pair of tracks 112 are provided at right angles to the tracks 102 for support of the transfer vehicle 90 for movement to and from the positions of platforms 91 and 92, pairs of electrical rails 113 and 114 being provided alongside the tracks 111 and 112. A pair of tracks 115 and a pair of tracks 116 are provided at right angles to the tracks 102 for movement to and from the delivery and receiving positions of platforms 84 and 74, rails 117 and 118 being provided alongside the tracks 115 and 116. Another pair of tracks 120 is provided at right angles to tracks 102, extending to three pairs of tracks 121, 122 and 123 which are at right angles to tracks 120 and parallel to track 102 and which support the transfer vehicle during movement to the positions of platform 95, body 97 and platform 96. Rails 124 extend along tracks 120 and rails 125, 126 and 127 extend along tracks 121, 122 and 123. An additional pair of tracks 130 is provided at right angles to tracks 102, extending to three pairs of tracks 131, 132 and 133 which are at right angles to tracks 130 and parallel to track 102 and which support the transfer vehicle during movement to the positions defined by pads 99, body 98 and pads 100. Rails 134 extend along tracks 130 and rails 135, 136 and 137 extend along tracks 131, 132 and 133.

Additional rails 139, 140, 141, 142 and 143 are shown for supply of electrical power to the transfer vehicle 90 during movement along rails 102, rails 139 and 140 being in alignment with rail 103 and rails 141, 142 and 143 being in alignment with rails 104 and 105.

The system provides for a "turntable" rotation of an automobile platform or other body about a vertical axis, as is required with relative orientations of the receiving and delivery positions of platforms 74. Tracks 102 extend to a circular track 145 which is partially surrounded by a an arcuately extending rail 146 interconnecting the ends of tracks 140 and 143. At some time after an automobile arrives at the position 55 or after it is received at the receiving position of platform 74, its position may be reversed by moving its supporting platform on the transfer vehicle 90 to a position such that the four wheels of the transfer vehicle 90 may be turned to the proper steering angles for rotation about a vertical axis at the center of circular track 145 and arcuately extending rail 146. Then after rotation through 180 degrees, the four wheels may be returned to the initial steering angles for movement along rails 102 as required.

It is noted that the transfer vehicle 90 and the automobile support platforms have constructions which are symmetrical in nature so as not to require any rotation about a vertical axis other than when effecting a "turntable" operation. It is also noted that since the length of time required for a "turntable" operation may be substantial, it may be performed at a time when use of the transfer vehicle 90 is not required. It is noted, in this connection, that with proper control, a plural number of transfer vehicles may be simultaneously operated on one level. Thus, for example, in systems in which there are a large number of storage locations along tracks 120 and 130, separate transfer vehicles may be used to transfer bodies between positions along such tracks and the positions 55, 74 and 84, while a third transfer vehicle might operate in transferring bodies between positions 55, 74, 84, 91 and 92. It is also possible to provide more than one loading/unloading position similar to position 55 and, of course, the receiving and delivery positions 74 and 84 and related equipment may be duplicated.

Figure 5:
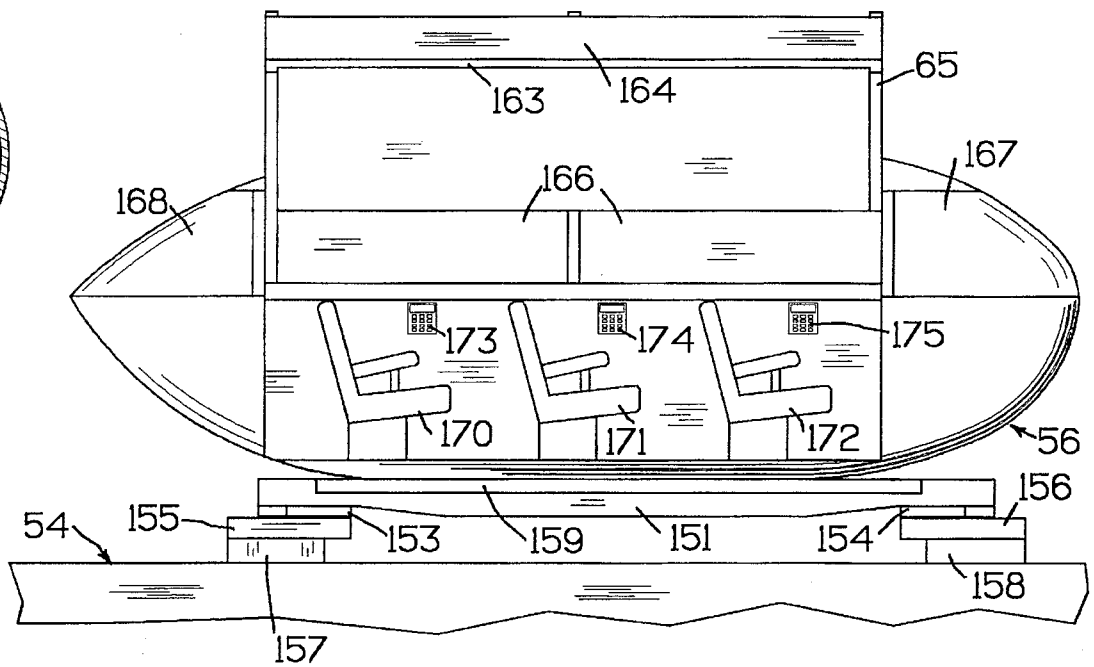
FIG. 5 is a side elevational view of the passenger body as shown in FIG. 4.
Figure 4:
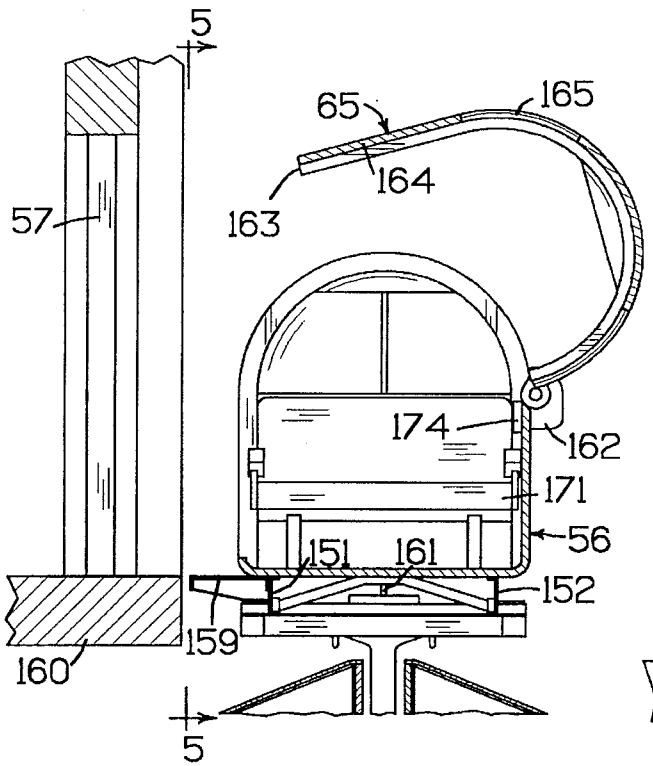
FIG. 4 is a sectional view taken generally along line 4—4 of FIG. 3 and illustrating a passenger body in a condition with a door in an open position.

FIG. 4 is a sectional view taken generally along line 4—4 of FIG. 3, but illustrating the passenger body 56 in a condition in which the door thereof 65 is open and FIG. 5 is a side elevational view of the body 56 in the open door position of FIG. 3. The illustrated body 56 is supported on two longitudinally extending frame members 151 and 152 in transversely spaced parallel relation and having ends secured to two connectors 153 and 154 which are releasably connected but securely locked to pads 155 and 156, in a manner as hereinafter described in detail. The pads 155 and 156 are integrally secured to posts 157 and 158 which project upwardly from bogies of a carrier vehicle and through a slot in the guideway 54. A floor plate 159 on the entrance side of the body extends to a point close to a floor portion of the waiting room structure, it being noted that the illustrated body has a width less than that of other bodies, such as automobile platforms, which may pass through the passenger boarding region. As will also be described, the connectors 153 and 154 provide electrical as well as mechanical connections to pads 155 and 156 to make a connection to a cable 161 for communications and for supply of electrical power to the body 56.

A hinge and door actuating structure 162 is provided which preferably includes a torsion spring and an electromechanical actuator and which journals the door 65 on the body 56 for pivotal movement through an angle of on the order of 70 degrees and about a horizontal axis which is at about a half-height elevation and on a side of the body which is opposite the entrance side. The lower edge 163 of a panel 164 of the door 65 is thereby brought to an elevation greater than the height of most entering passengers, panel 164 being in a vertical position in the closed position of the door. The door 65 includes two pairs of windows 165 and 166 extending on opposite sides thereof for substantially the full length thereof. The forward and rearward ends of the body are formed with windows 167 and 168 in upper portions thereof and are of rounded and tapered shapes as shown to provide an efficient low drag aerodynamic shape.

Opening of the door 65 provides ready access to three seats 170, 171 and 172 each of which provides ample room for two passengers. Selection devices 173, 174 and 175 are mounted alongside the seats, each including a display and a keypad, usable for selection of a destination station upon entry and at any time during travel and also usable for signalling readiness for the start of travel as well as for receiving communications from and making emergency calls to a central station.

As aforementioned, the system may be programmed to allow ride-sharing at a lower fare by willing passengers while also allowing exclusive use at a higher fare by a single passenger or group of passengers. When operative in the ride-sharing mode, the number of stops which are likely to be encountered by a boarding passenger will depend generally upon the number of intervening stations between the boarding station and the destination station. In a worst case scenario, there could be stops at all intervening stations since each intervening station could be selected either by a passenger present upon boarding or by a passenger replacing an exiting passenger. However, such a worst case scenario is not likely to occur and the number of stops encountered will, on the average, be substantially less that the number of intervening stations. In this respect, the system has a substantial advantage over systems in which there are stops at all stations whether necessary or not for picking up or discharging passengers. In other respects, it has additional advantages, particularly in that any station skipped can be skipped at a high speed and in that there is never any slow-down from stops unnecessarily made by others.

Figure 6:
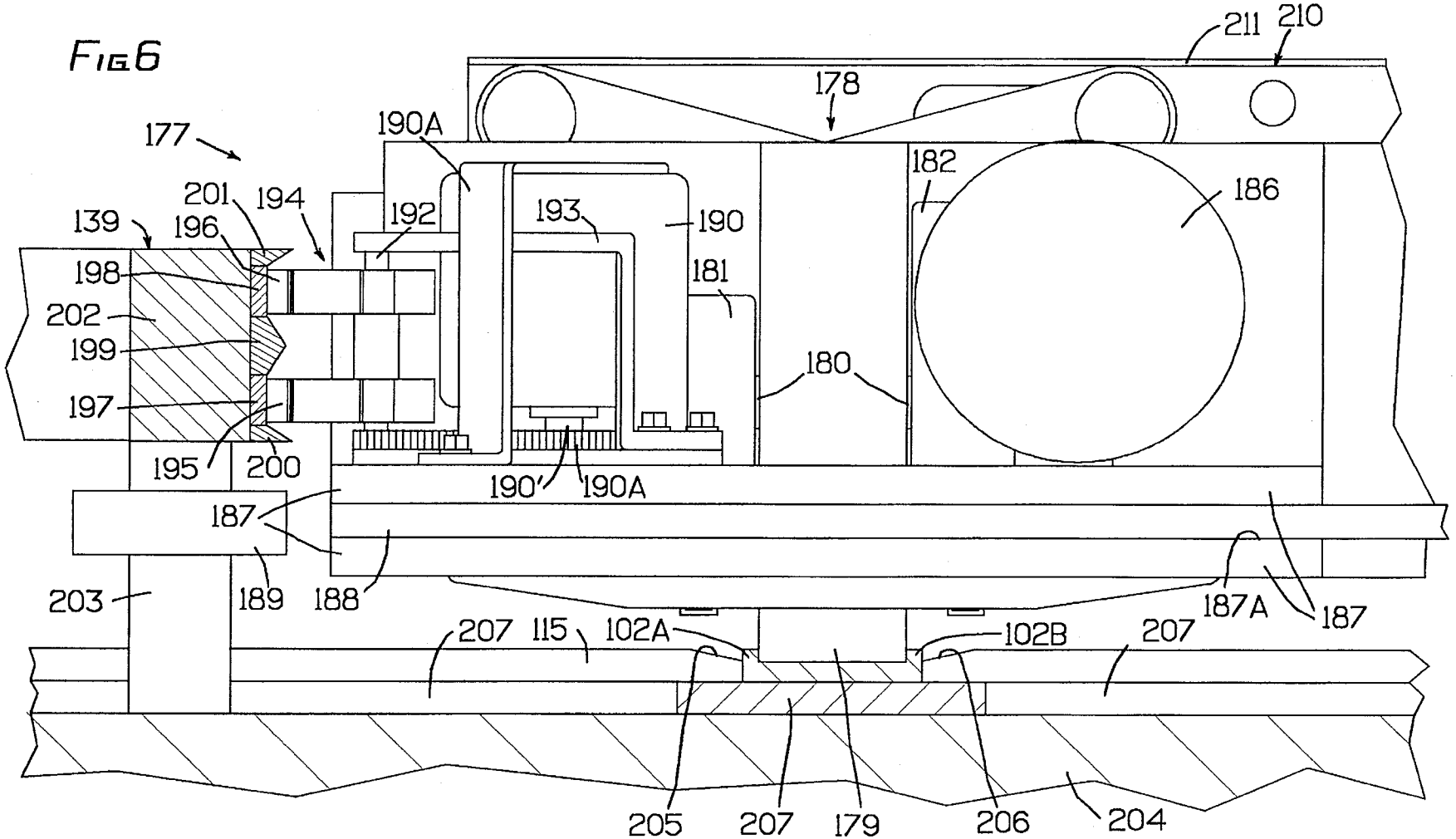
FIG. 6 is a cross-sectional view taken substantially along line 6—6 of FIG. 3 and providing an elevational view of certain wheel and contact assemblies.

FIG. 6 is a cross-sectional view taken substantially along line 6—6 of FIG. 3 and providing an elevational view of wheel and contact assemblies generally indicated by reference numeral 177 and provided in one of four corner portions of the transfer vehicle 90. A wheel assembly 178 includes a wheel 179 on a shaft 180, supports 181 and 182 for bearings which journal and which are supported by the shaft 180, a plate 184 secured to lower ends of supports 181 and 182 and an electric drive motor 186 for the wheel 179. The motor 186 is supported on the bearing support 182 and is operative to drive the shaft 180 through a worm gear unit as hereinafter described. A plate 187 is secured to frame structure of the vehicle and is supported on the plate 184 through ball bearings as hereinafter described, permitting rotation of wheel assembly 178 about a vertical steering axis.

As shown in FIG. 6, the plate 187 in one of its two outer surfaces has a horizontal groove 187A which receives and supports one end of an elongated electrical signal device 188. Device 188 is one of four vehicle carried signal devices which extend along the four sides of the transfer vehicle 90, an end portion of another of such devices being supported in a groove in the other outer surface of plate 187. Device 188 and the other three of such vehicle carried signal devices are inductively coupled to stationary signal devices including a signal device 189 which as shown in FIG. 6 is at a position under a junction between supply rails 117 and 139. As hereinafter described in connection with FIGS. 84 and 85, signals are transmitted from stationary devices such as device 189 and through devices such as device 188 to control circuitry of the transfer vehicle, for providing the transfer vehicle 90 with accurate data as to its location and for otherwise controlling movement of the transfer vehicle 90 from one position to another.

To control steering, a sector gear is secured to plate 184 of the wheel assembly 178 and is driven by a gear on a shaft 190' of an electric motor 190 which is supported by a bracket 190A on the upper surface of the plate 187. Such gears are not shown in FIG. 6 but a contact control sector gear 191 is shown which is also driven by the gear on shaft 190' and which is on a vertical shaft 192 journaled by a bracket 193 on the plate 187. The motor thus operates as both a steering motor and a contact control motor.

A contact assembly 194 is keyed to the shaft 192 and includes a pair of spring-loaded contacts 195 and 196 which are in sliding engagement with conductors 197 and 198 of the supply rail 139. As hereinafter described, the contact assembly 194 also includes additional contacts, not shown in FIG. 6, but arranged upon rotation of the sector gear 191 and contact support shaft 192 to engage conductors of rails such as the rail 117 which are at right angles to the rail 139.

The rail 139 further includes a member 199 between the conductors 197 and 198 and members 200 and 201 below and above the conductors 197 and 198. The members 199–201 are of insulating material and have beveled surfaces acting to guide the contacts into engagement with the conductors 197 and 198, it being noted that the contact assembly 194 is keyed to the shaft 192 but is movable vertically to accommodate variations in the vertical position of the vehicle 90 relative to the supply rails. A support member 202 of the rail 139 is of insulating material and supports the conductors 197 and 198 and the members 199–201.

All other rails, including the rail 117, a portion of which is shown in FIG. 6, have a construction like that of the rail 139 and the conductors thereof are all connected together, the upper and lower conductors being all connected to opposite terminals of a common electrical supply, such as a 120 volt 60 Hz supply. Support posts 203 which are suitably anchored to a floor 204 are provided in spaced relation along the lengths of the rails to support the rails, the support post 203 shown in FIG. 6 being also operative to support the signal device 188A.

As shown in FIG. 6, the track 102 has upwardly projecting side flange portions 102A and 102B which are engaged by the side edges of the wheel 178, other tracks including the track 115 having the same construction. At intersections, the side flanges are cut away to allow rotation of the wheel 178 and other wheels about vertical steering axes. Thus, the flanges of track 115 are cut back to points indicated by reference numerals 205 and 206. Track support members 207 are provided between the tracks and the floor 204, members 207 being of resilient cushing material which allows substantial deformation of the tracks, no springs being provided in the wheel supports of the illustrated vehicle 90. Suitable shim members are provided as necessary between track support members 207 and the floor 204 and between the rail support posts 203 and the floor 204 to place the wheel support surfaces of all tracks at substantially the same level and to position the conductors of the rails at the proper levels.

FIG. 6 shows a portion of a lift frame 210 of the transfer vehicle 90 which used to lift and lower bodies, also showing portions of items to be described hereinafter in detail, including link members and of one of four scissor jack mechanisms located in corner portions of the vehicle 90 and driven in synchronism from a common electric motor to lift and lower the frame structure in a rectilinear path. The lift frame 210 is covered by a cover plate 211 and carries prong structures not shown in FIG. 6 but movable horizontally to positions for picking up bodies.

Figure 7:
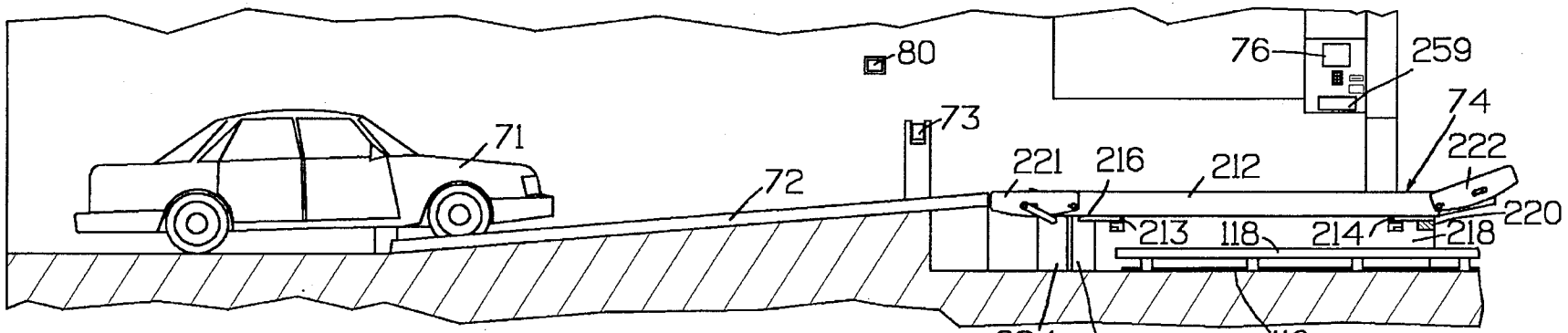
FIG. 7 is a sectional view taken substantially along line 7—7 of FIG. 3 and showing an automobile receiving section.

FIG. 7 is a sectional view taken substantially along line 7—7 of FIG. 3. When the gates 73 are opened, the automobile is driven up the guideway 72, which may be inclined as shown, and onto the platform 74. Guideway preferably includes flanges projecting upwardly from a main planar surface to guide movement of the front wheels of the automobile.

Platform 74 includes a main frame structure 212 which includes side flanges projecting upwardly from a main planar surface and which has opposite ends secured to two connectors 213 and 214. Connector 213 is supported on a stationary block 215 which includes a stop surface 216 engageable by connector 213 to limit movement of platform 74 to the left as viewed in FIG. 7, during movement into the receiving position as shown. For support of connector 214, two stationary support members 217 and 218 are spaced apart a distance sufficient for passage of the transfer vehicle therebetween and support the outer ends of bars 219 and 220 that extend inwardly at a level above the level of the upper extent of the transfer vehicle 90 when its lift frame 210 is in a lowered position. Note that in the plan view of FIG. 3, parts of members 217 and 218 and bars 219 and 220 are shown and that in the cross-sectional views of FIGS. 7 and 9, the bar 219 is shown in cross-section and the member 218 is shown in full lines. Also note that for support of the platform 84 and as is shown in the plan view of FIG. 3 and partly in FIG. 8, members 217' and 218' and bars 219' and 220' are provided which are like the members 217 and 218 and bars 219 and 200.

The platform 74 also includes two guards 221 and 222 pivotally secured to opposite ends of the main frame structure 212 and each having side flanges projecting upwardly from a main planar surface thereof. As hereinafter described in more detail in connection with FIG. 9, each of the guards 221 and 222 may be held in a lowered position by a mechanism 224 or released to be latched in an upwardly inclined position. In FIG. 7, the guard 221 is shown held in a lowered position by mechanism 224. In this position, its main planar surface is at the same level as the upper end of the main planar surface of the guideway 72 and that of the main planar surface of the main frame member 212 of platform 74 to support the wheels of the automobile 71 as it is driven onto the platform 74. Guard 222 is shown in its upward latched position in which it can be engaged by either the bumper of an automobile or its front wheels to tell the driver to stop forward movement. During travel, both guards are pivoted upwardly and they operate as aerodynamic fairings to reduce energy losses.

Figure 8:
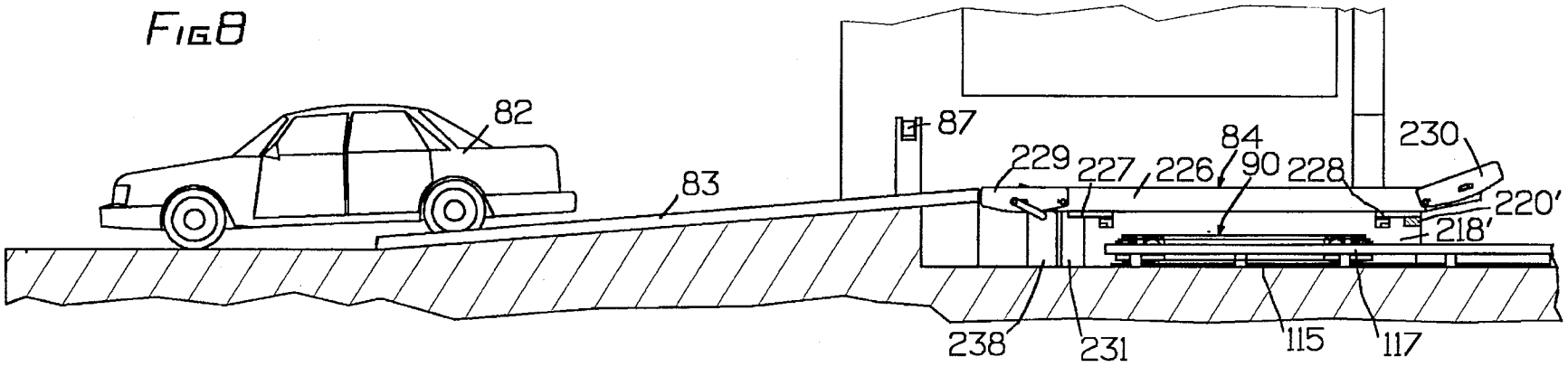
FIG. 8 is a sectional view taken substantially along line 8—8 of FIG. 3 and showing an automobile delivery section.

FIG. 8 is a cross-sectional view taken substantially along line 8—8 of FIG. 3 but showing the transfer vehicle 90 moved to a position under the platform 84. Platform 84 has a construction like that of the platform 74, and includes a main frame member 226, connectors 227 and 228 and guards 229 and 230, corresponding to member 212, connectors 213 and 214 and guards 221 and 222 of platform 74. The connector 227 is supported on a block 231 corresponding to block 215 and the connector 228 is supported on the ends of the aforementioned bars 219' and 220' which are supported by the stationary members 217' and 218'. Guard 229 is held in a lowered position by a mechanism 238 which corresponds to mechanism 224.

Figure 9:
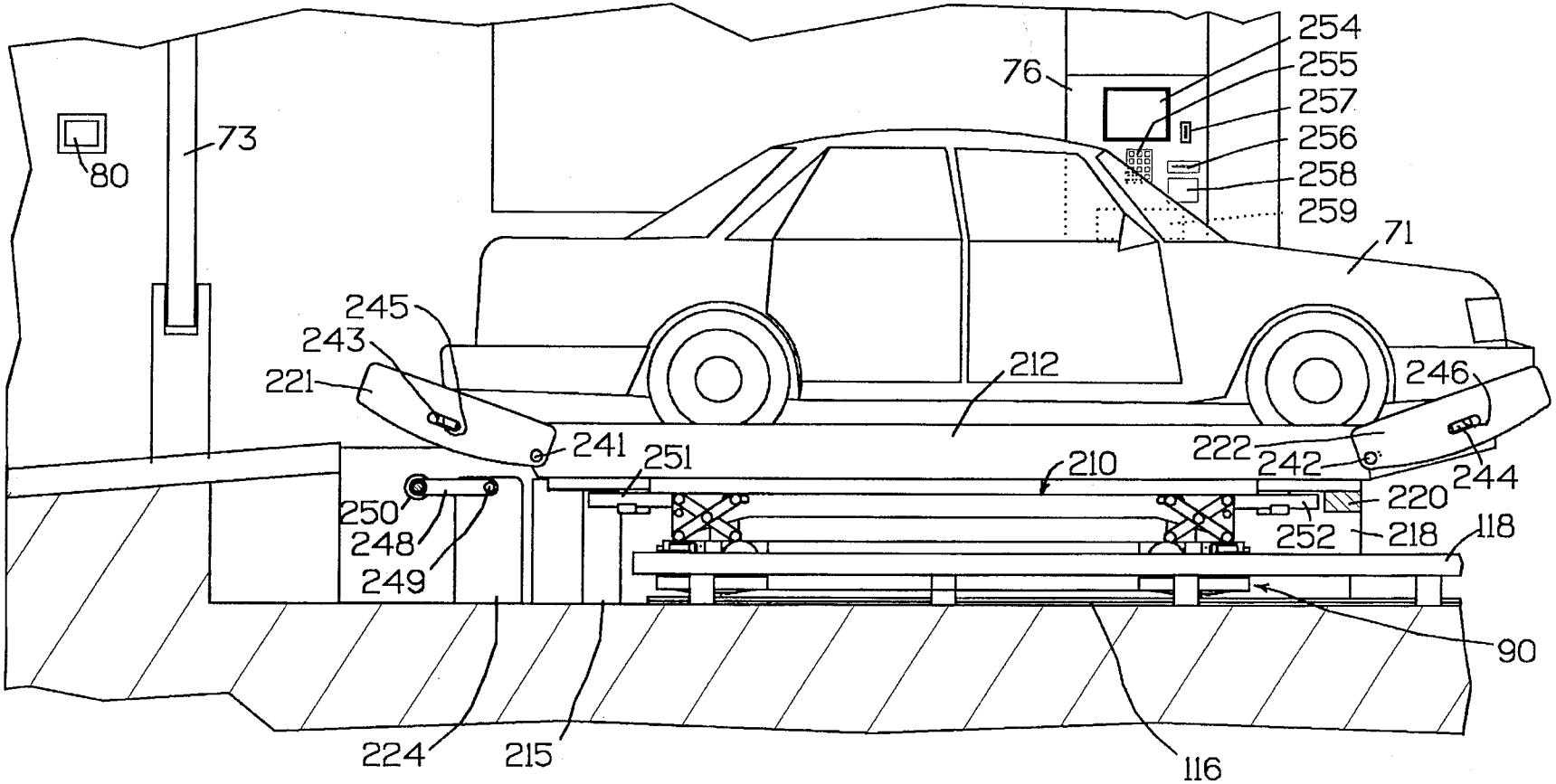
FIG. 9 is a view similar to the right-hand portion of FIG. 7 and on an enlarged scale, showing conditions after an automobile is driven onto a platform.

FIG. 9 is a view similar to the right-hand portion of FIG. 7 and on an enlarged scale, showing conditions after the automobile 71 is driven onto the platform 74. The guard 221 is shown in an upwardly inclined latched condition and the construction, support and operation of the guards 221 and 222 is shown more clearly. They are supported on the frame member 212 by pins 241 and 242 and are latched in upwardly inclined positions as shown when portions 243 and 244 of latch elements on spring members supported on the member 212 have been allowed to move outwardly under spring action and into slots 245 and 246 of the side flanges of the guards. The guard control mechanism 224 includes an arm 248 which has one end on a shaft 249 rotatable by the mechanism 224 and which at its opposite end carries a solenoid 250 operative to move a plunger in a direction parallel to the axis of shaft 249. To lower the guard 221, the arm is rotated in a clockwise direction from the position as shown until the plunger of solenoid 250 is aligned with the portion 243 of the latch element and with the slot 245. Then the solenoid 250 is operated to move the plunger thereof into the slot 245 while releasing the latch and the arm 248 is then rotated in a counter-clockwise direction to move the guard 221 to its lowered position.

FIG. 9 also shows the transfer vehicle 90 in a condition in which it has been placed after moving under the platform, after the lift frame 210 of the transfer vehicle 90 has been lifted by the scissor jack mechanisms of the vehicle to a position as shown and after prong structures 251 and 252 have been moved outwardly from the lift frame 210 of the transfer vehicle 90 and into openings in the connectors 213 and 214. The lift frame 210 of the vehicle 90 may then be moved further upwardly through a short distance by the scissor jack mechanisms of the vehicle to lift connectors 213 and 214 of the platform 74 to a position above the support block 215 and support bars 219 and 220. Then with the lift frame 210 in the final elevated position, the transfer vehicle may move the platform 74 to a storage position or, as hereinafter described in connection with FIGS. 16–18, to a position in which the connectors 213 and 214 are over pads of a carrier vehicle at the position 55.

FIG. 9 also provides a clearer showing of features of the machine 76. It includes a display 254, a key pad 255, a credit card receiving slot 256, a coin slot 257, a bill receiving device 258 and a slot 259 for delivery of a communication device when required.

Figure 10:
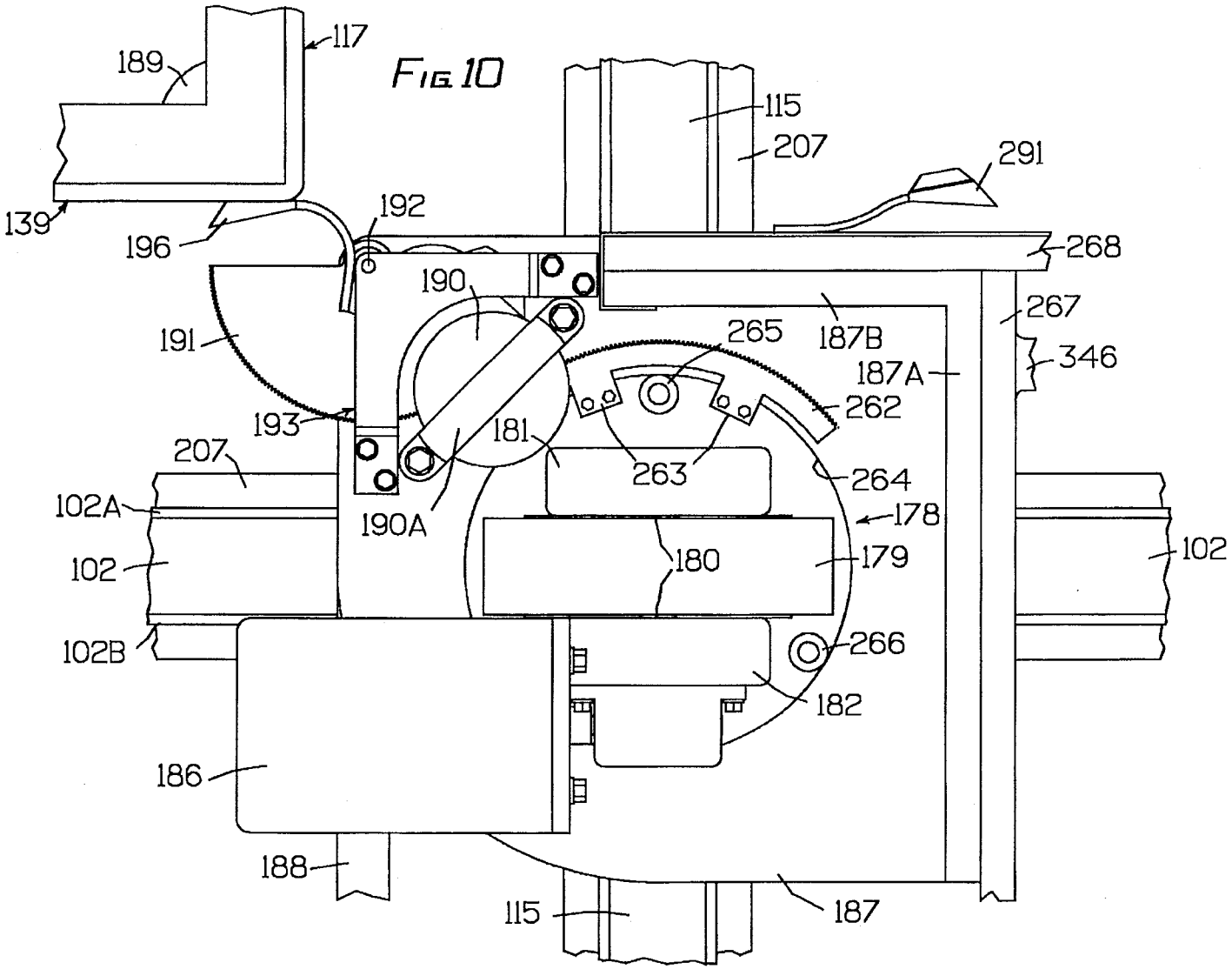
FIG. 10 is a top plan view of wheel and contact assemblies shown in FIG. 6 but with a cover plate removed.
Figure 11:
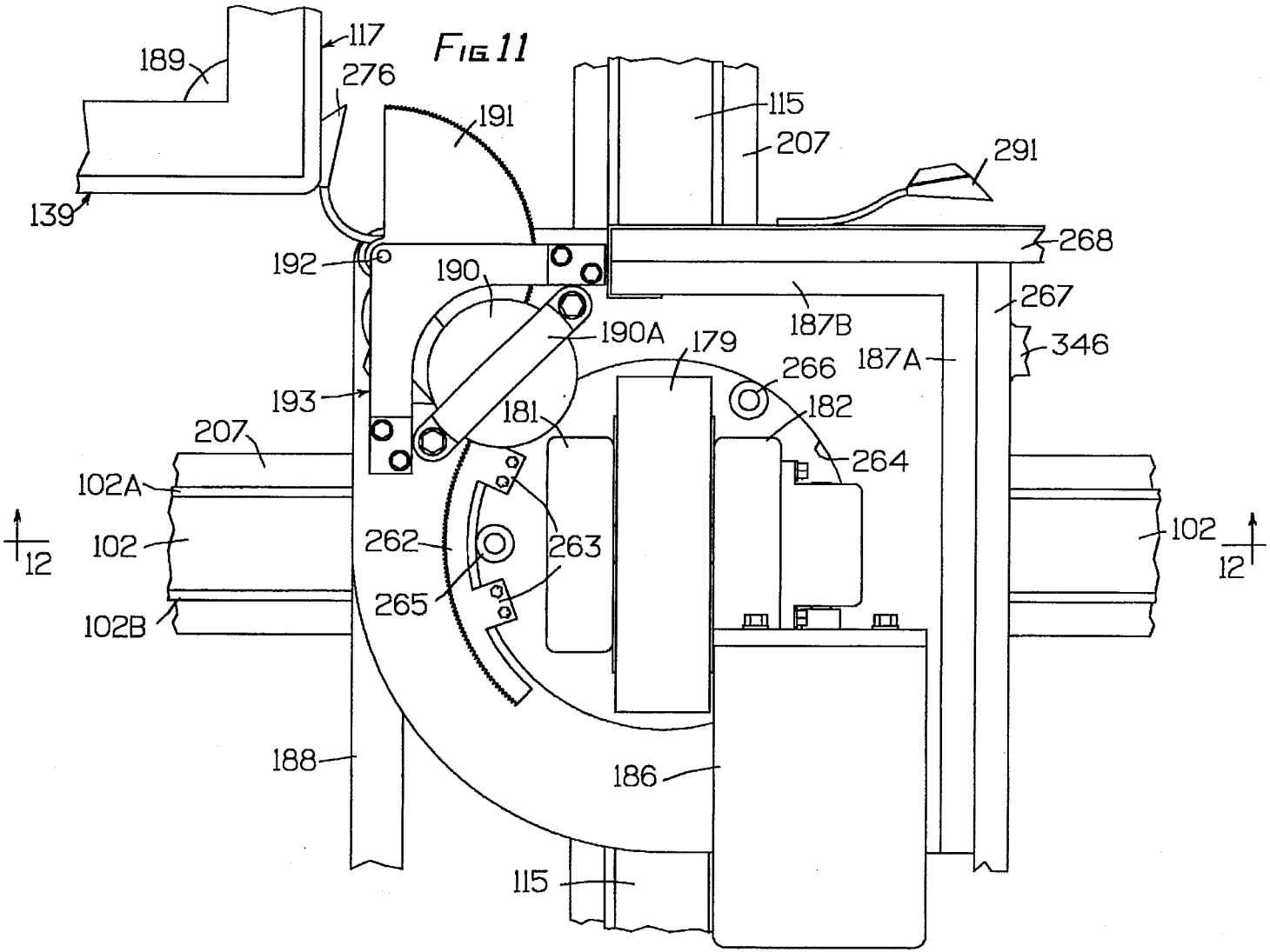
FIG. 11 is a view similar to FIG. 10 but showing conditions after a 90 degree rotation of the wheel assembly.
Figure 12:
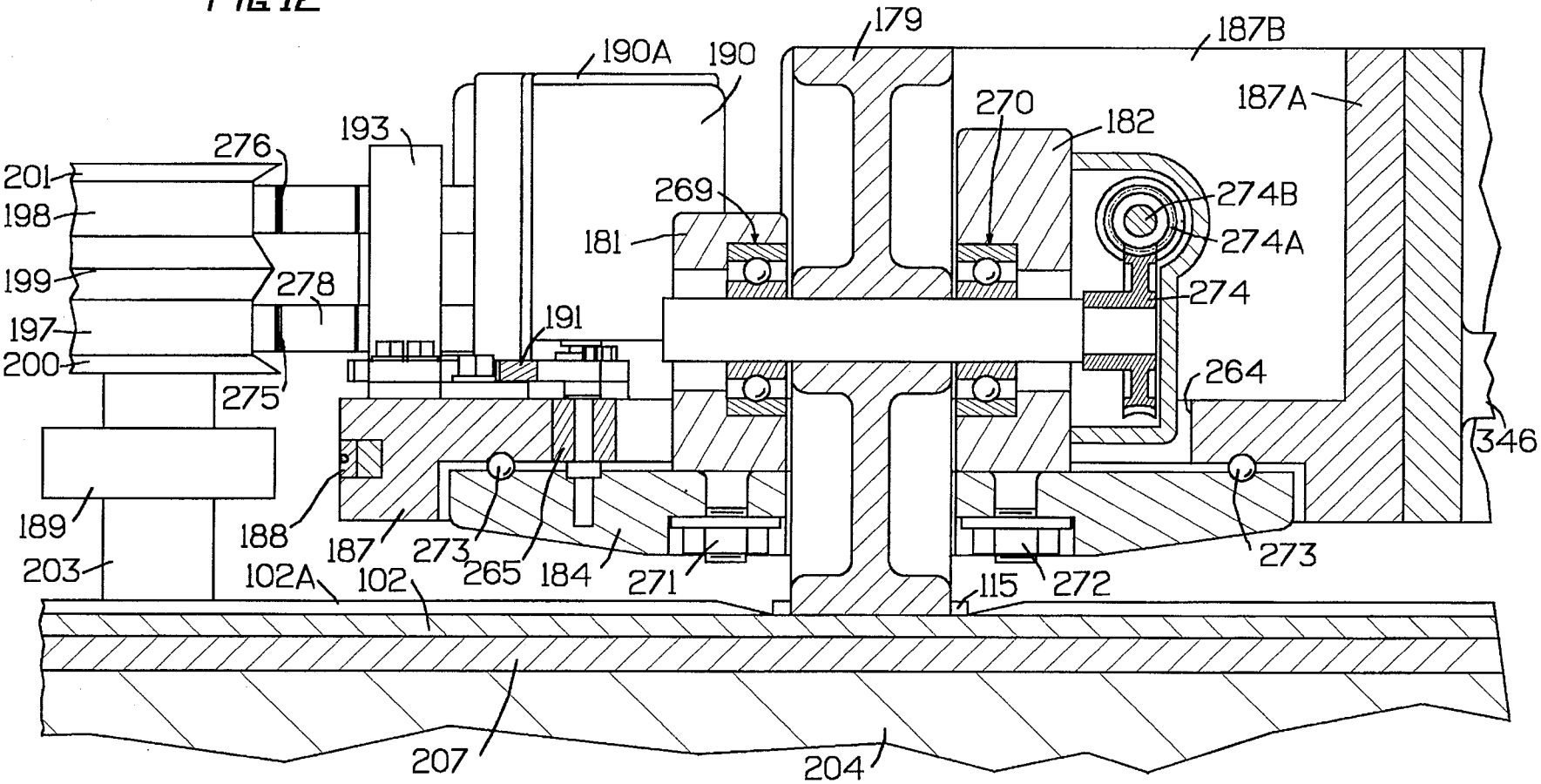
FIG. 12 is a sectional view taken substantially along line 12—12 of FIG. 11.
Figure 14:
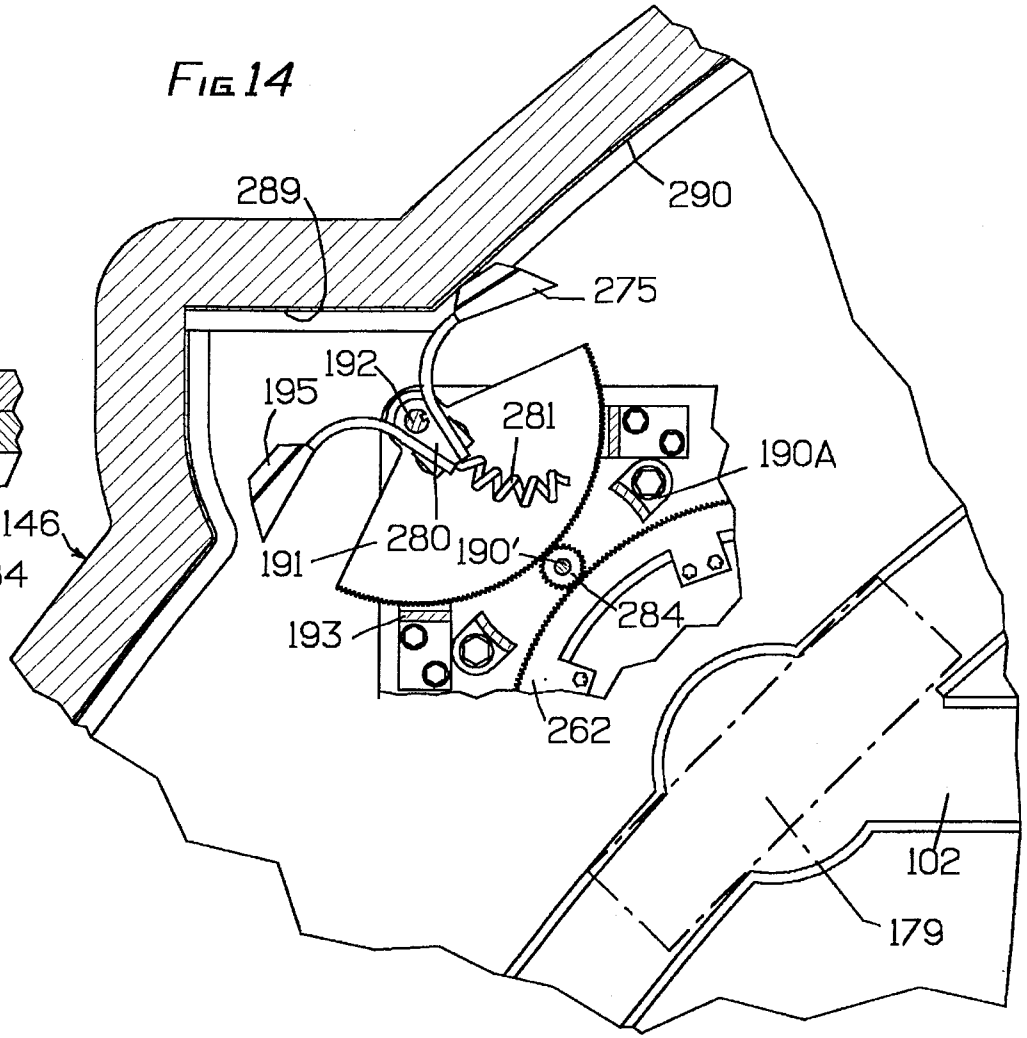
FIG. 14 is similar to FIG. 13 but shows portions of the assemblies in conditions for effecting a turntable operation.
Figure 13:
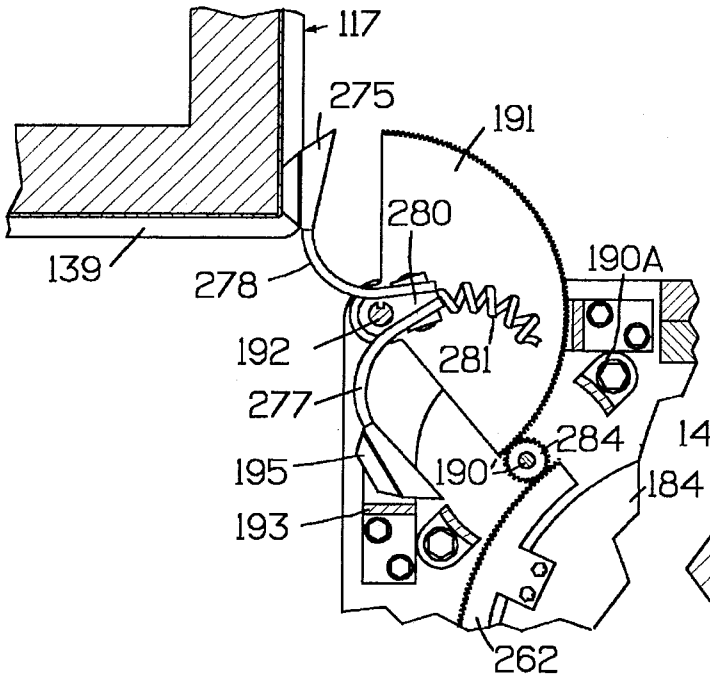
FIG. 13 shows details of portions of assemblies in a condition as shown in FIG. 11.

FIGS. 10–14 show additional details of the wheel and contact control assemblies which are shown in elevation in FIG. 6 and generally indicated by reference numeral 177. FIG. 10 is a top plan view of the assemblies in the positions shown in FIG. 6, but with cover plate 211 removed, and FIG. 11 is a view similar to FIG. 10 but showing conditions when the wheel assembly 178 has been rotated 90 degrees in a counter-clockwise direction. FIG. 12 is a sectional view taken substantially along line 12—12 of FIG. 11. FIG. 13 shows details of portions of the assemblies in a condition as shown in FIG. 11 and FIG. 14 is similar to FIG. 13 but shows portions of the assemblies in conditions for a "turntable" operation.

A sector gear 262 for steering control, mentioned in connection with FIG. 6 but not shown therein, has radially inwardly projecting portions 263 secured through spacers and bolts to the top of the plate 184 of the wheel assembly 178 and is driven by a gear on the shaft 192 of the steering and contact control motor 190. Three rollers at 120 degree spacings are also supported on plate 187 and are in rolling engagement with an internal cylindrical surface 264 of the stationary plate 187. Two of such rollers are shown in FIG. 10 as well as in FIG. 11 and are indicated by reference numerals 265 and 266, the third being hidden under the wheel drive motor 186.

The contact assembly mounting bracket 193 and mounting bracket 190A for the steering and contact control motor 190 are secured to the stationary plate 187 by bolts as shown. The plate 187 and associated parts of the wheel and contact assemblies may be provided as a modular unit to facilitate assembly and servicing and the plate 187 is formed with integral upstanding flange portions 187A and 187B as illustrated which are secured through bolts (not shown) to the ends of two frame members 267 and 268 of the transfer vehicle 90.

As shown in FIG. 12, ball bearing assemblies 269 and 270 journal the shaft 180 in the bearing supports 181 and 182 which have stud bolts welded or otherwise secured thereto and extending down through openings in the plate 184, nuts 271 and 272 being threaded on such bolts during assembly to thereafter support the plate 184 from the bearing supports 181 and 182. Preferably, there are three such stud bolts depending from each of the bearing supports 181 and 182.

As also shown in FIG. 12, balls 273 are engaged in grooves in the upper and lower surfaces of the members 184 and 187 to minimize friction and the force required to rotate the wheel assembly 178 about a vertical axis.

A worm gear 274 is secured on one end of the shaft 180 and meshes with and is driven by a worm 274A on shaft 274B which is coupled to the shaft of the wheel drive motor 186.

As previously described in connection with FIG. 6, the contact assembly 194 includes lower and upper contacts 195 and 196 engageable with lower and upper conductors 197 and 198 of the rail 139. For engagement with conductors of a rail such as rail 117 extending in a direction transverse to the rail 139, the contact assembly 194 further includes lower and upper contacts 275 and 276, both shown in FIG. 12. Each of the contacts 275 and 276 is supported on the end of a resilient leaf spring member, lower contacts 195 and 275 being shown in FIGS. 13 and 14 as being secured to ends of spring members 277 and 278 which are secured through a connector element 279 to a support member 280 of insulating material which is keyed to the shaft 192. The lower contacts 195 and 275 are electrically connected together through the connector element 279 which is of a conductive material and which is connected to one end of a flexible wire 281. The upper contacts 196 and 276 are similarly supported and similarly connected together and to one end of another flexible wire and, although not shown, it will be understood that the opposite ends of such flexible wires are connected through a conventional type of wiring to terminals which are also connected to contacts the other three corner assemblies and which supply power for all drive and control motors of the transfer vehicle 90.

FIG. 13 shows the drive of the sector gears 191 and 262 for the contact and wheel assemblies 194 and 178 through a common pinion gear 284 on the shaft 190' of the steering and contact control motor 190. The relative pitch radii of the sector gears 191 and 262 is such that the angular rotation of the contact assembly 194 is substantially greater than that of the wheel assembly 178, for the purpose of insuring good electrical contact with the rail conductors. In the illustrated construction, the contact assembly is rotated through 130 degrees when the wheel assembly is rotated through 90 degrees.

Figure 15:
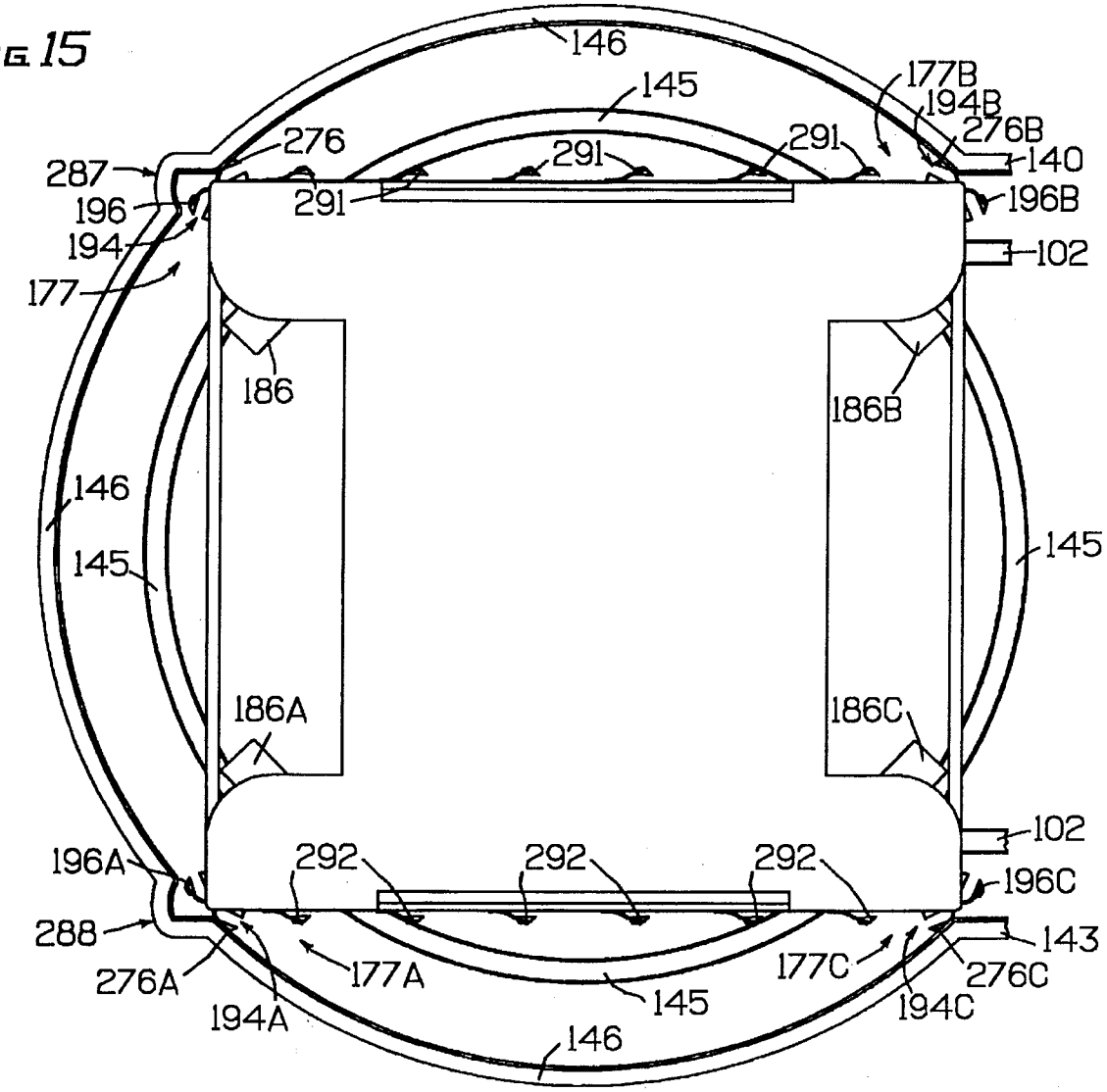
FIG. 15 is a top plan view showing a transfer vehicle in a position ready for the start of a turntable operation.

FIG. 14 is a view similar to FIG. 13, showing the position of the contact assembly 194 when the transfer vehicle 90 has reached a position for the "turntable" operation and is ready for the start of the operation. FIG. 15 is a top plan view showing the transfer vehicle 90 in this position and showing parts of the wheel and contact assemblies shown in FIGS. 10–14 and parts of three other wheel and contact assemblies which are generally indicated by reference numerals 177A, 177B and 177C. In FIG. 15, parts of the three other assemblies 177A, 177B and 177C which are similar to those of the assemblies 177 are designated by the same reference numbers with letters A, B and C affixed thereto. The wheel and contact assemblies 177C which are diagonally opposite the assemblies 177 have constructions substantially identical to those of the assemblies 177 while parts of the other two assemblies 177A and 177B have constructions with a mirror image relationship to the assemblies 177 of FIGS. 10–14.

To reach the position of FIGS. 14 and 15, the vehicle 90 is moved on the tracks 102 with contacts 196 and 196B in engagement with an upper conductor of rail 140 and with contacts 196A and 196C in engagement with an upper conductor of rail 143. In a final portion of such movement, the contacts 196 and 196A move past the ends of rails 140 and 143 and become engaged with upper conductors of rail portions 287 and 288 which form breaks in the rail 146 which otherwise has a circular configuration. Then the contacts of assembly 194 are rotated in a counter-clockwise direction to disengage contacts 195 and 196 from lower and upper conductors of rail portion 287 and to bring contacts 275 and 276 into engagement with lower and upper conductors of circular rail 146. Lower conductors 289 and 290 of the rail portion 287 and circular rail 146 are shown in FIG. 14. Similar rotations of the other three contact assemblies are effected, contact assemblies 194A and 194B being rotated in a clockwise direction and contact assembly 194C being rotated in a counter-clockwise direction. Such rotations are preferably effected sequentially rather than simultaneously, to insure continuous connection to the electrical supply source connected to the rail conductors.

When the contact assemblies are rotated, the corresponding wheel assemblies are rotated in the same directions to align the axes of all four wheels with a common vertical axis of rotation about which the vehicle is rotated when the wheels are then simultaneously driven by the energization of the respective drive motors. The position of the wheel 179 is diagrammatically indicated by broken lines in FIG. 14 and the positions of the motors 186, 186A, 186B and 186C are shown in FIG. 15.

It is noted that equal track spacings in the two orthogonal directions are not necessary so long as the wheel assemblies are rotated through the proper steering angles. The track spacings are nearly but not quite the same in the illustrated arrangement.

As is also shown in FIG. 15, a series of six contact sets 291 are provided in spaced relation along one side of the transfer vehicle 90 and a similar series of six contact sets 292 are provided in spaced relation along the opposite side of the transfer vehicle 90. Each such contact sets includes upper and lower contacts which are resiliently supported for engagement with upper and lower rail conductors. Similar additional contacts may be supported along the other two sides of the transfer vehicle 90. Such additional contacts are not necessary with the track configuration of the system as shown in FIG. 3, but are desirable for reducing average current through the corner contacts when moving along the rails 102, reducing resistance losses and increasing reliability. With other track configurations, at least one additional contact set may be required along one or more sides of the transfer vehicle 90, particularly when a track pair has aligned track pairs branching in both directions therefrom which are closer together than the distance between corner contacts. For example, in the track configuration of FIG. 3, when the transfer vehicle 90 moves along tracks 102 from a position in alignment with tracks 111 to a position in alignment with tracks 112, there is a range of positions in which neither of the corner contacts on the right hand side are in contact with the conductors of rail 104. If there were sets of tracks like tracks 111 aligned therewith but extending to the left and if there were no contacts in addition to the corner contacts, the supply of power would be disrupted.

Figure 16:
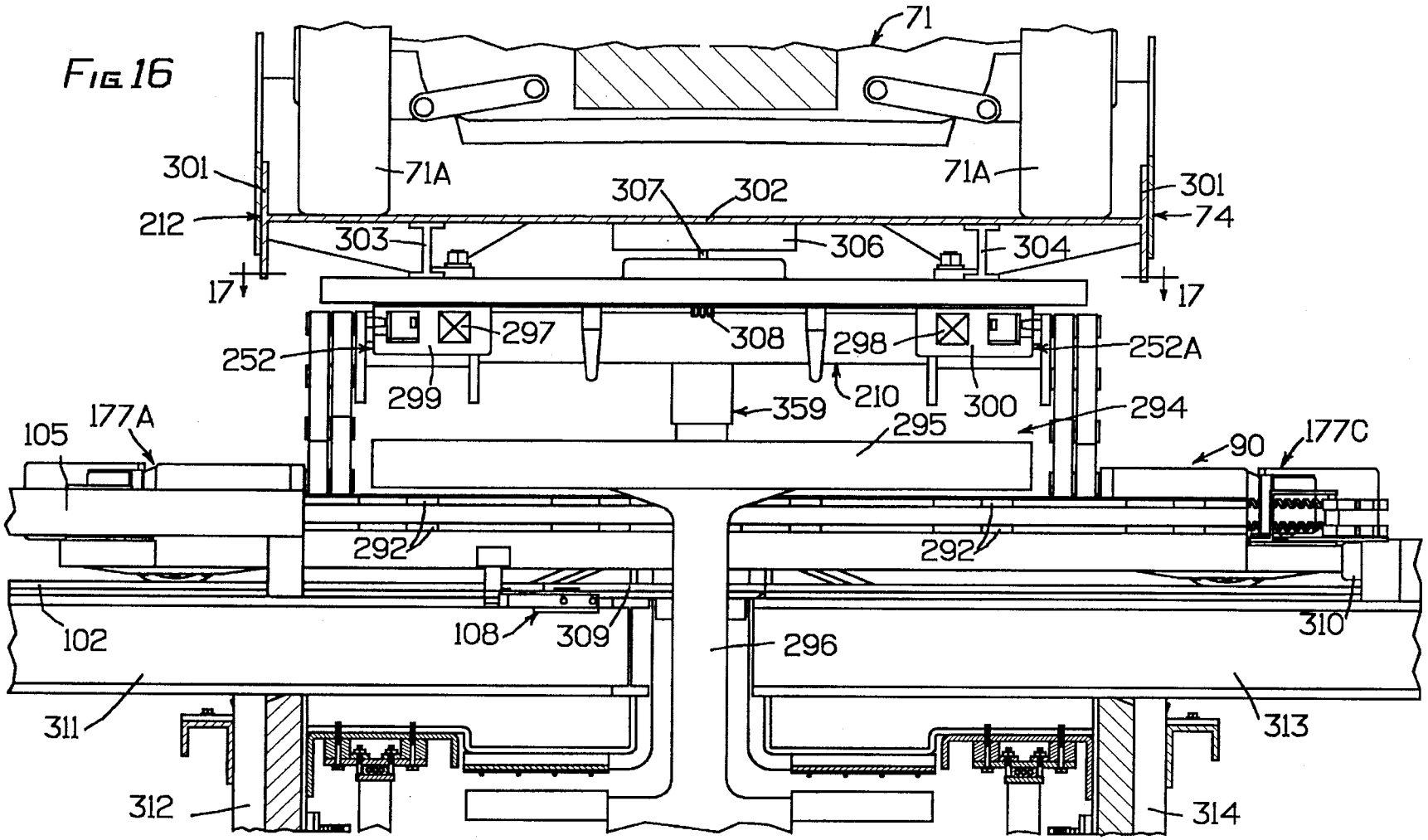
FIG. 16 is a cross-sectional view taken along one side of a transfer vehicle when positioned at a loading/unloading position of FIG. 3 and when a carrier vehicle has been moved to the loading/unloading position.

FIG. 16 is a cross-sectional view taken along the right side of the transfer vehicle 90 when positioned at the loading/unloading position 55 of FIG. 3 and when a carrier vehicle 294 has been moved to the loading/unloading position 55. The transfer vehicle 90 as shown in FIG. 16 is supporting a body in the form of the platform 74 which carries automobile 71 as shown in FIG. 9 and which has been assumed to have been moved by the transfer vehicle 90 to a position over the carrier vehicle 294.

The forward connector 214 of the platform 74 is shown supported in an elevated position by the lift frame 210 and above a forward pad 295 of the carrier vehicle 294, pad 295 being shown supported on the upper end of a post 296 which projects upwardly through a longitudinal slot in the guideway 54. The portions of the guideway structure shown in FIG. 16 are shown and described hereinafter.

The prong structure 252 also shown in FIG. 9 and a corresponding prong structure 252A on the opposite side of the transfer vehicle 90 are supported by the lift frame 210 and include prongs 297 and 298 which project forwardly through openings in depending portions 299 and 300 of the connector 214. The rearward prong structure 251 shown in FIG. 9 and a corresponding prong structure on the opposite side are supported and operate in a similar fashion.

As also shown in FIG. 16, the main frame 212 of the platform 74 has side guide flanges 301 and a planar surface 302 on which tires 71A of the automobile 71 are supported. Reinforcing longitudinally extending I- beams 303 and 304 are bolted or otherwise securely fastened to the forward connector 214 as well as the rearward connector 213 shown in FIG. 9. Electrical circuitry is supported within a housing 306 on the underside of the frame 212 and is connected through a cable 307 to an electrical plug of the connector 214 which includes contacts 308 projecting downwardly for engagement with contacts of the pad 295 in a manner as hereinafter described.

Portions of the forward bridging structure 108 are shown in FIG. 16, the bridging structures being shown in detail in FIGS. 39–43 as described hereinafter. As aforementioned in connection with FIG. 3, when the transfer vehicle 90 approaches the position 55, the forward end thereof engages elements of bridging structures 107 and 108 to pivot such structures about vertical axes and to then bridge a space through which pad support posts of carrier vehicles normally pass. The bridging structures 107 and 108 then provide support for forward pair of wheels as they move from ends of tracks 102 to tracks 110 which register with the tracks 102.

In the conditions shown in FIG. 16, a section of track 309 is supported by the bridging structure 108 to extend between a terminal end portion of one of the pair of tracks 102 and one end of the track 110, the opposite end of the track 110 being adjacent a resilient stop 310 which is engaged by an end surface of the transfer vehicle 90 to stop its movement when it is at the proper position. The track 102 shown in FIG. 16 is supported on a beam 311 which is supported in part by a post 312 and which has a terminal end spaced from a terminal end of a second beam 313 which is supported in part by a post 314 and which supports the track 110.

Figure 17:
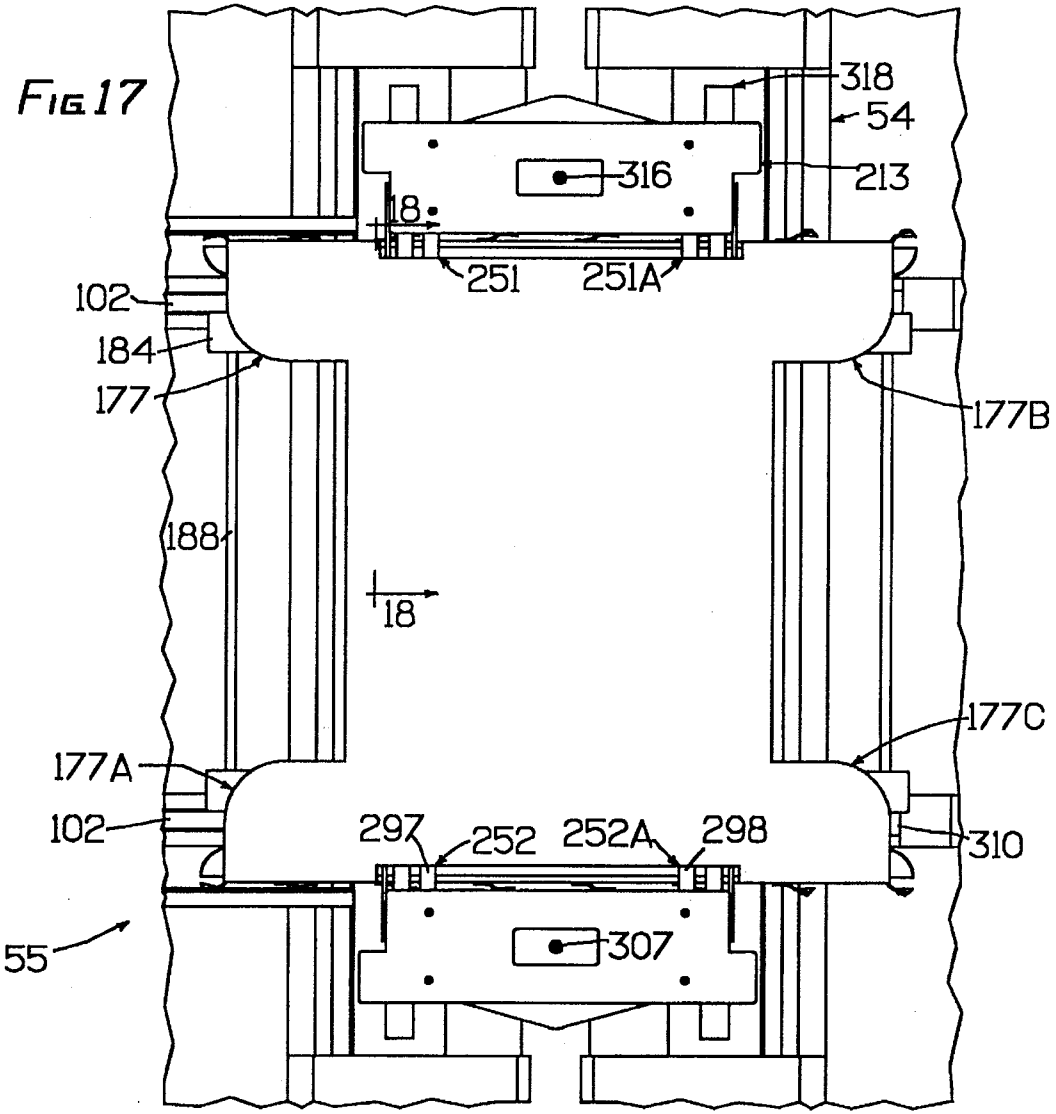
FIG. 17 is a cross-sectional view taken substantially along line 17—17 of FIG. 16 and looking downwardly to provide a top plan view of the transfer vehicle.

FIG. 17 is a cross-sectional view taken substantially along line 17—17 of FIG. 16, looking downwardly from position under the platform 74 and providing a plan view of the transfer vehicle 90, the rearward and forward connectors 213 and 214 to which the platform 74 is secured and associated structures, in the conditions depicted in FIG. 16. A cable 316 which corresponds to cable 307 is shown connected to the rearward connector 213. FIG. 17 also shows portions of a rearward pad 318 of the carrier vehicle 294 at the position 55, portions of the rearward prong structure 251 on one side of the transfer vehicle 90 and portions of another rearward prong structure 251A on the opposite side of the transfer vehicle 90.

Figure 18:
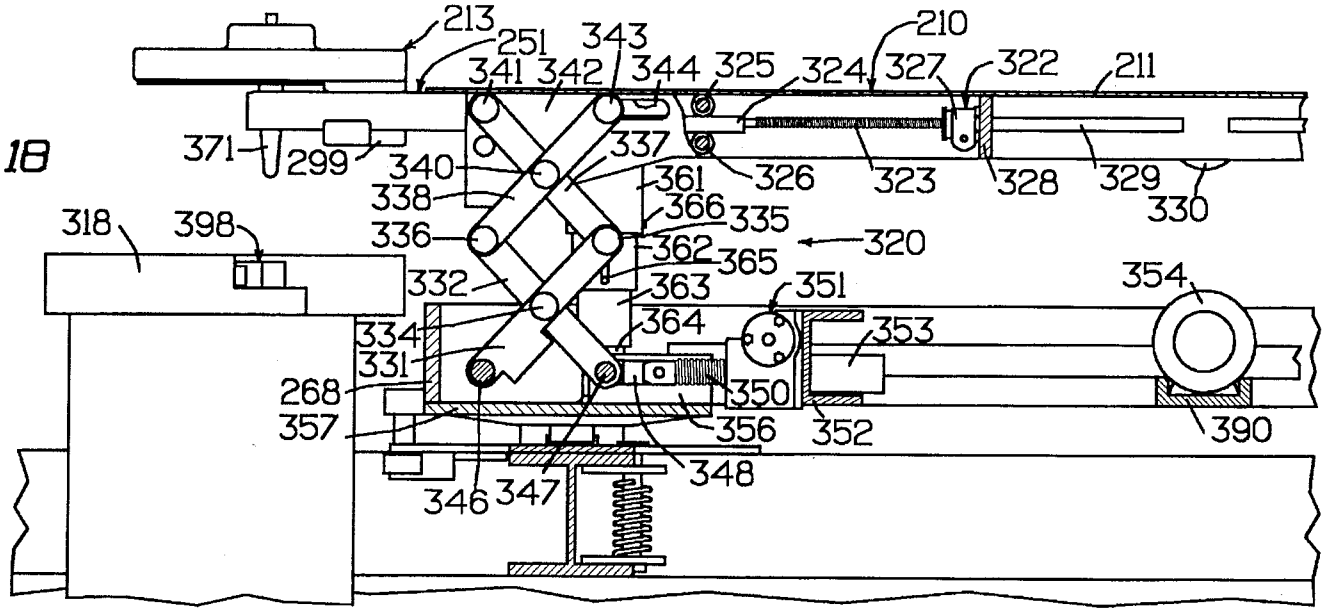
FIG. 18 is an elevational sectional view taken substantially along line 18—18 of FIG. 17 and showing a lift frame in an elevated position.

FIG. 18 is an elevational sectional view taken substantially along line 18—18 of FIG. 17. The lift frame 210 is shown held in an elevated position by the four scissor jack lifting mechanisms one of which is shown in FIG. 18 and generally designated by reference numeral 320.

A portion of the lift frame 210 is broken away to show an operating mechanism 322 for the prong structure 251 which is shown extended rearwardly into the connector 213. The mechanism 322 includes a lead screw 323 which is connected at its rearward end to a forward end portion 324 of the prong structure, portion 324 being positioned between upper and lower guide rollers 325 and 326 which are journaled by the lift frame. The forward end of the lead screw 323 extends into an operating device 327 which is supported on a member 328 of the lift frame 210 and which includes a forwardly extending housing 329 for receiving the lead screw 323 when retracted. As hereinafter described in connection with FIG. 20, a shaft of the device 327 and shafts of operating devices for each of three other lead screws are coupled to a common prong structure control motor 330 supported by the lift frame 210, a portion of the motor 330 being shown in FIG. 18.

The scissor jack mechanism 320 includes a lower pair of links 331 and 332 having midpoints connected through connector 334 and having upper ends connected through connectors 335 and 336 to lower ends of an upper pair of links 337 and 338 which have midpoints connected through a connector 340. The upper end of the link 337 is connected through a connector 341 to a member 342 of the lift frame and a connector 343 on the upper end of the link 338 has a shaft portion extended into a horizontally extending slot 344 in the member 342. A shaft 346 journals the lower end of the lower link 331 for movement about a fixed horizontal axis. Shaft 346 is secured to the main frame member 267 of the transfer vehicle 90, not shown in FIG. 18 but shown in FIGS. 10 and 11.

To operate the lift mechanism 320, the lower end of the link 332 is pivotal on a shaft 347 of a connector 348 on a rearward end of a lead screw 350 which is operated by a device 351 mounted on a bracket 352 secured to the main frame member 267 and having a forwardly extending housing portion 353 for receiving the lead screw 350 in a retracted position. As hereinafter described in connection with FIGS. 20 and 21, the device 351 and similar devices for each of the other three scissor jack mechanisms are coupled to a common jack mechanism drive motor 354.

One end of the shaft 347 extends into a horizontal slot 355 of a member 356 affixed to a main frame member 357 of the transfer vehicle 90. Slot 355 is not shown in FIG. 18 but appears in FIG. 19. The opposite end of shaft 347 extends into a similar horizontal slot in the main frame member 267, not shown.

To guide the lift frame 210 for vertical movement and limit horizontal displacements thereof, forward and rearward telescoping tube assemblies 359 and 360 are provided. The forward assembly 360 is shown in FIG. 16 and, as is shown in FIG. 18, the rearward assembly comprises an uppermost tube 361 secured to the lift frame 210, a lowermost tube 364 secured to the main frame member 357 and two intermediate tubes 362 and 363. A pin 365 on tube 363 extends into a vertical slot in tube 362 and a pin 366 on tube 362 extends into a vertical slot in tube 361 for lifting tubes 363 and 364 when the uppermost tube 361 is lifted.

Figure 19:
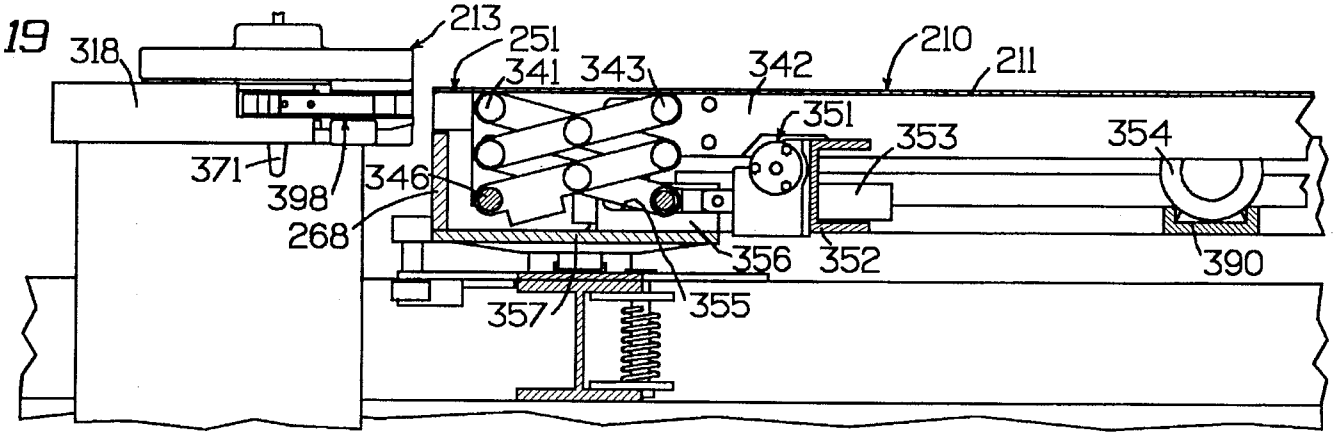
FIG. 19 is a view like FIG. 18 but showing the lift frame in a lowered position and a prong structure in a retracted position.

FIG. 19 is an elevational sectional view similar to FIG. 18 but illustrating the condition when the lift frame 210 is in a lowermost position and when the prong structure 251 is retracted. As described hereinafter in connection with FIGS. 22–35,when the prong structure 251 is retracted, portions of a locking mechanism of the pad 318 are drawn into a latched condition in an opening in the depending portion 299 of the connector 213, to securely lock the connector 213 to the pad 318. FIGS. 18 and 19 show one prong 371 of a pair of tapered guide prongs 371 and 372 which project downwardly from the connector 213 and which extend into openings in the pad 318 during downward movement of the lift frame 210 to insure accurate location of the connector 213 on the pad 318. As hereinafter described in connection with FIGS. bbb, the prong 371 also operates to lift a protective cover for an electrical socket of the pad 318 to permit insertion of contacts of a plug of the connector 213 into the socket of the pad 318.

Figure 20:
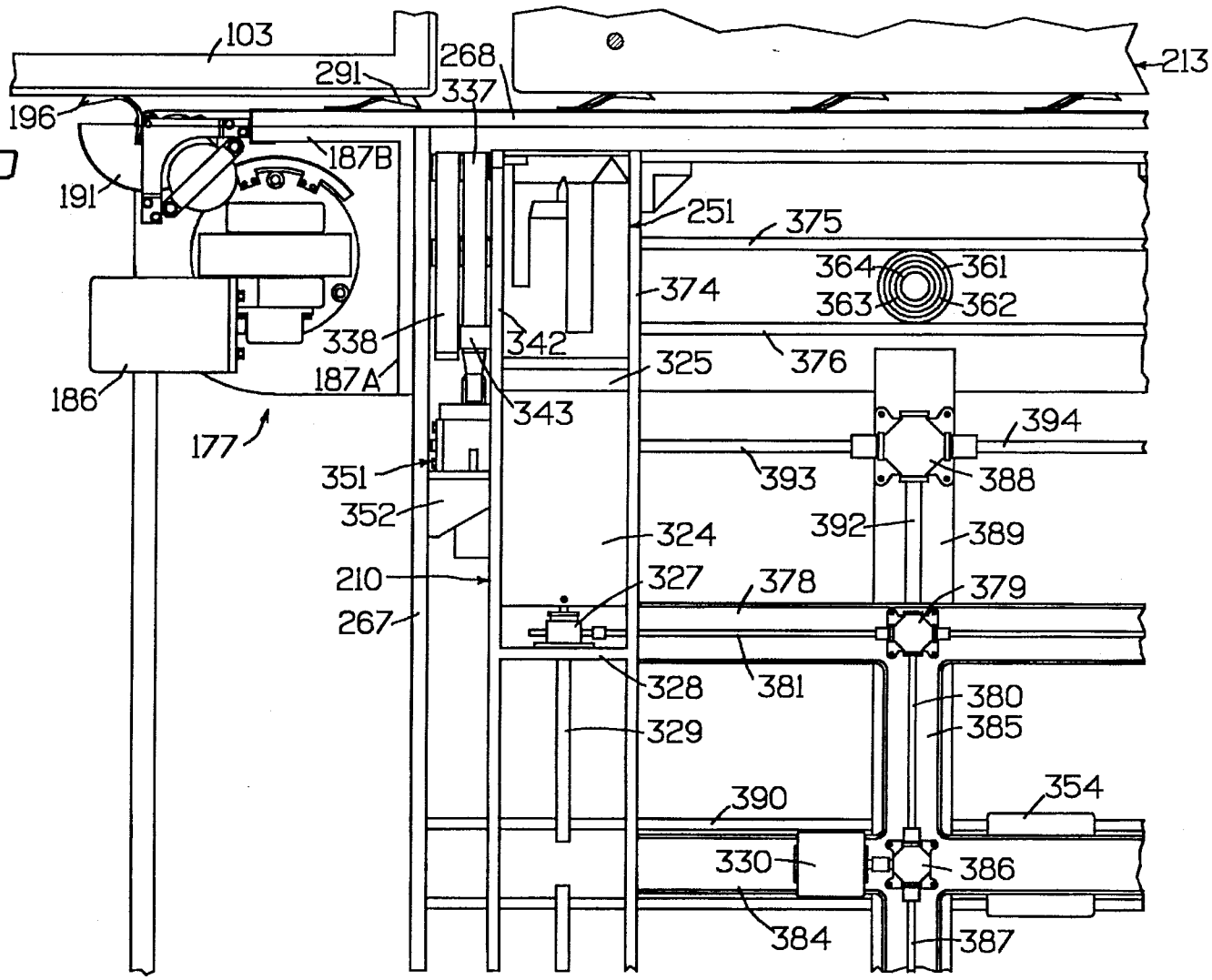
FIG. 20 is a plan view of portions of the transfer vehicle and a connector and a pad as shown in FIG. 17 but with a cover plate of the transfer vehicle removed.
Figure 21:
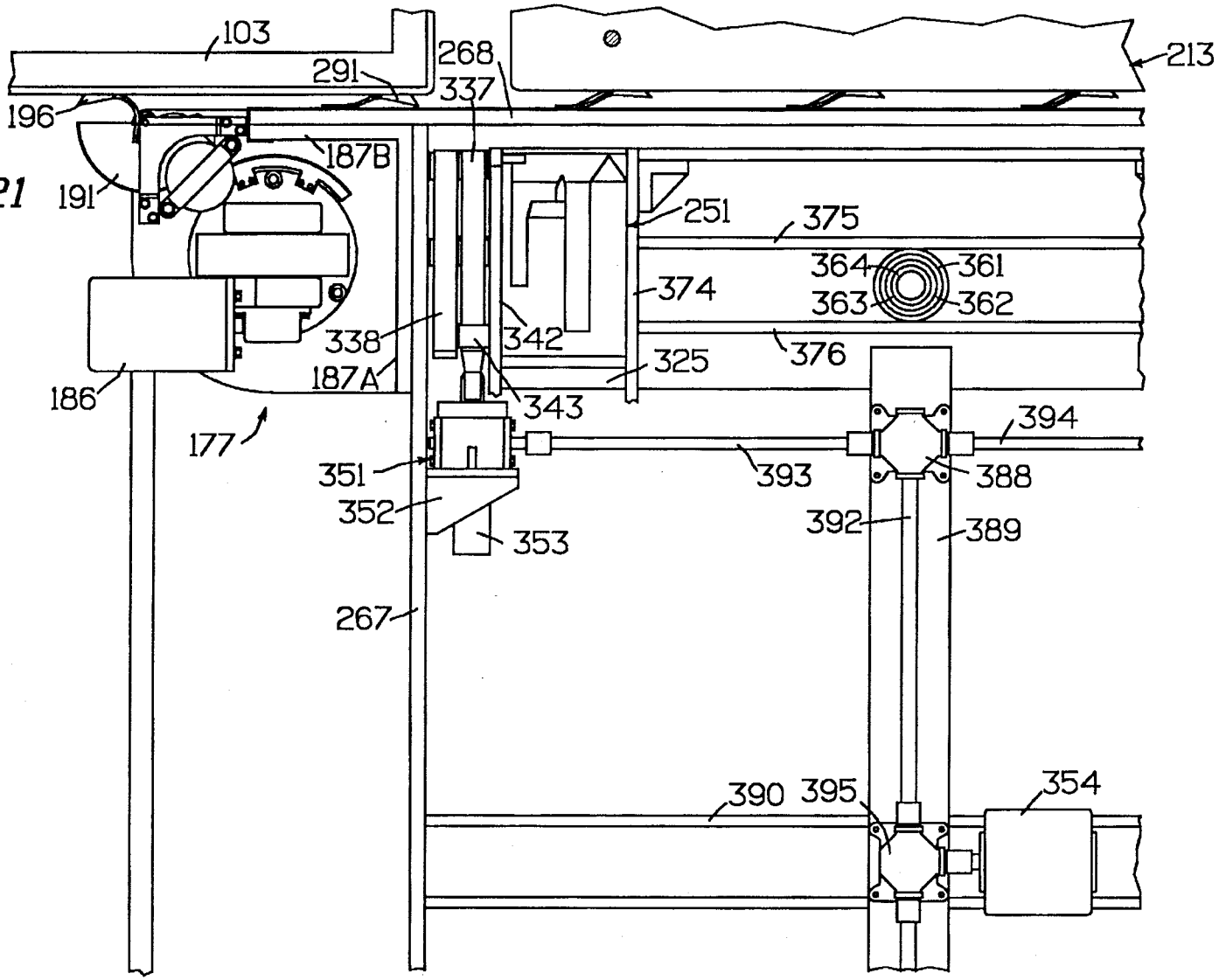
FIG. 21 is a plan view like FIG. 20 but with parts of a lift frame broken away to shown details of a jack drive arrangement.

FIG. 20 is a plan view of portions of the transfer vehicle 90, connector 213, pad 318 and associated structures shown in FIG. 17 but with the cover plate 211 removed, showing features of construction of the lift frame 210 and features of the drive of the four prong structures from the common drive motor 330 on the lift frame 210. FIG. 21 is a view similar to FIG. 20 but with portions of the lift frame 210 and associated structure removed to provide a clearer showing of features of the drive of the four scissor jack mechanisms from the common drive motor 354.

The lift frame 210 includes a frame member 374 which is parallel to and cooperates with the frame member 342 to guide the prong structure 251 and the forwardly extending portion 324 thereof for rectilinear movement. Roller 325 and roller 326 (shown in FIG. 18) are journaled between members 342 and 374 and the support member of device 328 extends between members 342 and 374. The uppermost tube 361 of the telescoping guide assembly is secured between central portions of a pair of members 375 and 376 which extend in parallel relation between member 374 and a corresponding member on the opposite side of the lift frame 210.

Another member 378 extends between the member 374 and a corresponding member on the opposite side of the lift frame 210 for support of a unit 379 which includes bevel gears coupling a shaft 380 to shafts 381 and 382. Shaft 381 is coupled to the drive device 327 for the prong structure 251, while shaft 382 is coupled to a prong support drive device on the opposite side of the lift frame 210. The prong drive motor 330 is mounted on a member 384 which extends between member 378 and a corresponding member on the opposite side of the lift frame 210, in a region mid-way between forward and rearward ends thereof. A frame member 385 may preferably be provided between central portions of the members 378 and 384.

The shaft of the motor 330 is coupled to a unit 386 which includes bevel gears and which drives the shaft 380 and a shaft 387 which is coupled to a unit corresponding to unit 379 for drive of prong structures 252 and 252A on the forward end of the lift frame 210 in unison with the drive of the prong structures 251 and 251A on the rearward end of the lift frame 210.

The drive of the scissor jack mechanisms from the motor 354 is best shown in FIG. 21. A bevel gear device 388 is mounted on a member 389 which extends between the member 357 and a corresponding member on the forward end of the main frame of the vehicle 90, a central portion of the member 389 being secured to a member 390 which supports motor 354 and which extends between a central portion of frame member 267 and a central portion of a corresponding member on the opposite side of the main frame. Device 388 is driven by a shaft 392 and is coupled through a shaft 393 to the lead screw drive device 351 and through a shaft 394 to a corresponding lead screw drive device on the opposite side of the main frame of the transfer vehicle 90.

A bevel gear device 395 is mounted on a central portion of the member 389 and is coupled to the shaft of the motor 354. Device 395 drives the shaft 392 to thereby drive both of the rearward scissor jack mechanism and also drives a shaft 396 which corresponds to the shaft 392 and which drives both the forward scissor jack mechanisms, thereby driving all four mechanisms in unison to lift and lower the lift frame 210 in a rectilinear path of movement.

Figures 22, 23, 24, 25:
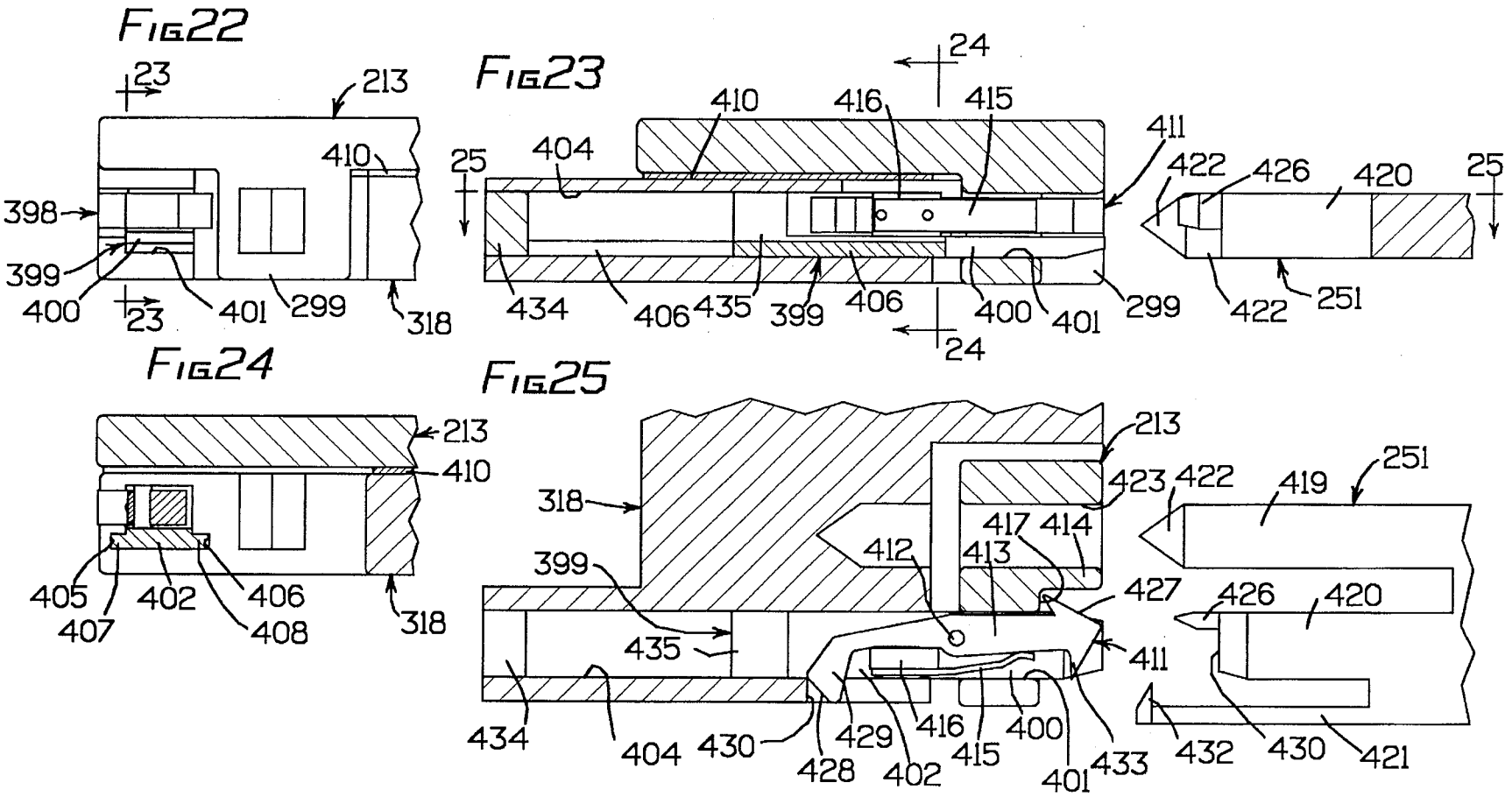
FIG. 22 is a front elevational view of portions of a connector, a support pad of a carrier vehicle and a locking mechanism connecting the connector and pad.
FIG. 23 is a cross-sectional view taken substantially along line 23—23 of FIG. 22, also showing portions of a prong structure.
FIG. 24 cross-sectional view taken substantially along line 24—24 of FIG. 23.
FIG. 25 cross-sectional view taken substantially along line 25—25 of FIG. 23.

FIGS. 22–33 illustrate the construction of a locking mechanism 398 which interconnects the connector 213 and pad 318 and the operation of the prong structure 251 in lifting and lowering the connector 213 and in engaging and releasing the locking mechanism 398. FIG. 22 is a front elevational view showing a portion of the connector 213 and portions of the pad 318 and locking mechanism 398; FIG. 23 is an elevational sectional view taken along line 23—23 of FIG. 22 and illustrating a portion of the structure shown in FIG. 22 and also a portion of the prong structure 251; FIG. 24 is an elevational sectional view taken along line 24—24 of FIG. 23; FIG. 25 is a sectional view looking downwardly along a line 25 of FIG. 23; and FIGS. 26–33 are views similar to FIG. 25 but illustrating the prong structure 251 in various positions relative to the connector 213, pad 318 and locking mechanism 398 to show the mode of operation.

The locking mechanism 398 includes a lock bar 399 supported by the pad 318 and arranged for slidable movement between a rearward released condition and a forward locking position. Lock bar 399 is shown in FIGS. 22–25 in its forward locking position in which a forward portion 400 thereof is in a lower portion of an opening 401 in the depending portion 299 of the connector 213, the lower surface of the portion 400 being engaged by the lower upwardly facing surface of the opening 401 to limit upward movement of the connector 213 relative to the pad 318. A rearward portion 402 of the lock bar 399 is movable in an opening 404 of the pad 318 which is formed with a pair of grooves 405 and 406 receiving integral longitudinally extending ribs 407 and 408 of the bar 399 as shown in FIG. 24.

A member 410 of a sheet material is preferably secured to a lower surface of the connector 213 to engage the upper surface of the pad 318 and to be compressed to a certain degree when the lock bar 399 is in its locking position. The lock bar 399 is then frictionally retained in its locked position through frictional engagement between the lower surface of its forward portion 400 and the lower surface of the opening and also through frictional engagement of the ribs 407 and 408 in the grooves 405 and 406. However, to insure retention of lock bar 399 in its locked position, a latch member 411 is pivotally secured on a pin 412 which projects upwardly from the lock bar 399. In the forward locking position of the lock bar 399, a forward portion 413 of the latch member 411 extends through an upper portion of the opening 401 in the depending portion 299 of the connector 213 and is formed at its forward end with a tooth 414 which projects sidewardly in one direction therefrom. A leaf spring 415 is supported at its rearward end on an upstanding portion 416 of the lock bar 399 and has a forward end engaged with the latch member 411 in a counter-clockwise direction as viewed in FIG. 25 and to the position shown in FIG. 25 in which the tooth 414 is in front of a surface 417 of the portion 299 of the connector 213 adjacent one side of the opening 401.

The prong structure 251 is formed with three rearwardly projecting portions 419, 420 and 421. Portion 419 supports the connector 213 during lifting and lowering thereof and also performs a centering function. Portion 420 operates to move the latch member 413 to a released position and to move the lock bar 399 to a rearward release position to permit the connector 213 to be lifted above the pad 318. Portion 421 performs a lock engaging function in moving the lock bar 399 forwardly to its locking position after the pad 213 is lowered by the prong structure 251 to a position on the pad 318.

Portion 419 as shown has a square cross-sectional configuration and is formed with a pointed rearward end 422. When the portion 419 is moved rearwardly, a centering action may be obtained as necessary through engagement of the surfaces of the pointed rearward end 422 with surfaces about a square opening 423 in the depending portion 299 of the connector 213. The portion 419 then extends through the opening 423 and into an opening 424 in the pad 318 which is open at its upper end, the portion 419 being then positioned to support the connector and move upwardly to lift it from the pad 318.

The latch and lock release portion 420 carries a rearwardly projecting prong 426 which is engageable with a surface 427 of the latch member 413 to pivot the latch member in a clockwise direction as viewed in FIG. 25 and to a release position in which the tooth 414 is clear of the surface 417. Such clockwise movement of the latch member 413 to the release position is facilitated and insured by engagement of an inclined surface 428 of a rearward end portion 429 of the latch member with a surface 430 of the pad 318. During rearward movement of the prong structure 251 after the latch member 413 is moved to its released position, the forward end of the lock bar 399 is engaged by a surface 430 of the latch and lock release portion 420 of prong structure 251, after which the portion 420 moves into the opening 401 in the depending portion 299 of the connector 213. The lock bar 399 is then moved to its rearward released position, it being noted that the rearward end portion 429 of the latch member is then within the opening.

When the prong structure 251 is in a rearward position in supporting relation to the connector 213 and when it is moved downwardly to drop the connector 213 onto the pad 318, an inwardly extending finger 432 of the lock engaging portion 421 of the prong structure 215 is located behind a lock bar unlocking tooth 433 which extends from the forward end of the latch member 411 in a sidewise direction opposite the direction in which the lock bar locking tooth 414 extends. When the prong structure 251 is then moved forwardly, finger 432 engages the tooth 433 to draw the lock bar 399 forwardly toward the locking position shown in FIG. 25, in which the rearward end portion 429 is in front of the surface 430 and in which the latch member 411 is rotated by the spring 415 to the position shown in FIG. 25.

Figures 26, 27, 28, 29, 30, 31, 32, 33:
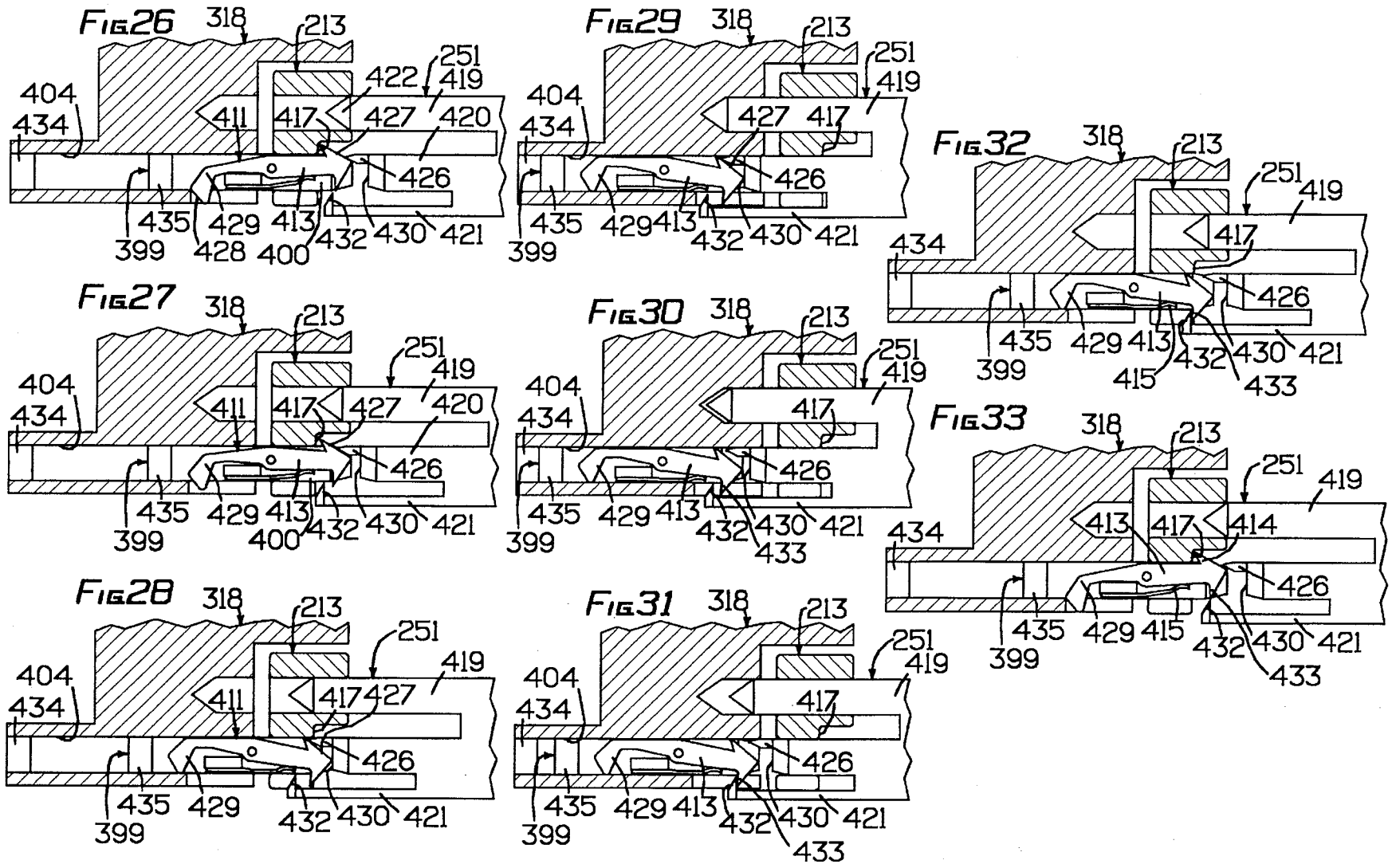
FIGS. 26–33 are cross-sectional views similar to FIG. 25 but showing a sequence of movements of parts of the locking mechanism and of the prong structure.

FIGS. 26–29 shown the sequence of operation during rearward movement of the prong structure 251 to release the lock bar 399 and to place it in a position to lift the connector 213 from the pad 318. FIG. 26 shows the initial engagement of prong 426 with surface 427 of latch member 411, just after the pointed rearward end 422 of portion 419 has performed any necessary centering function. FIG. 27 shows conditions during rotation of the latch member 411. FIG. 28 shows the condition in which the forward end of the lock bar 399 is engaged by the rearward surface 430 of the portion 420, the latch member 411 having been previously moved to a position in which the rearward end portion 429 thereof is within the opening 404 in the pad 318. FIG. 29 shows the condition in which the prong structure 251 is moved to the limit of its rearward travel.

In the position shown in FIG. 29, the prong structure 251 may be lifted to lift the connector 213 from the pad 318, it being noted that the pad 318 has open spaces above the ends of portions 419 and 420 and above finger 432 of portion 421 of the prong structure 251.

FIGS. 30–33 show the sequence of operation in installing connector 213 on the pad 318 and operating the lock bar 399 to its locked position. When the prong structure is carrying the connector 213 and moved downwardly to drop the connector 213 onto the pad 318, the prong structure may in the position shown in FIG. 29 or it may be displaced a small distance forwardly to the position shown in FIG. 30, FIG. 30 being provided to show that highly accurate location of the prong structure relative to the connector 213 is not necessary. The finger 432 is then behind the tooth 433 of the latch member 411 and as the prong structure 251 is moved forwardly through positions as shown in FIGS. 31 and 32, the lock bar 399 is drawn forwardly, rotation of the latch member 411 being prevented by the location of its rearward end portion 429 within the opening 404 of the pad 318. However, when the prong structure 251 has reached a position as shown in FIG. 33, rearward end portion 429 of latch member 411 is clear of the surface 430 and the latch member is rotated by the spring 415 to its lock position as shown. The tooth 433 is then clear of the finger 432 and the prong structure 251 can be moved to a position as shown in FIG. 25 to leave the connector 213 locked to the pad 318.

To insure that lock bar 399 will be maintained in the rearward released position of FIGS. 29 and 30 and ready for loading of a connector on the pad 318, a stop element 434 affixed in the rearward end of the opening 404 in pad 318 may preferably be in the form of a permanent magnet operative to attract and hold a element 435 of magnetic material which is integral with the lock bar 399 or otherwise secured thereto.

Figure 34:
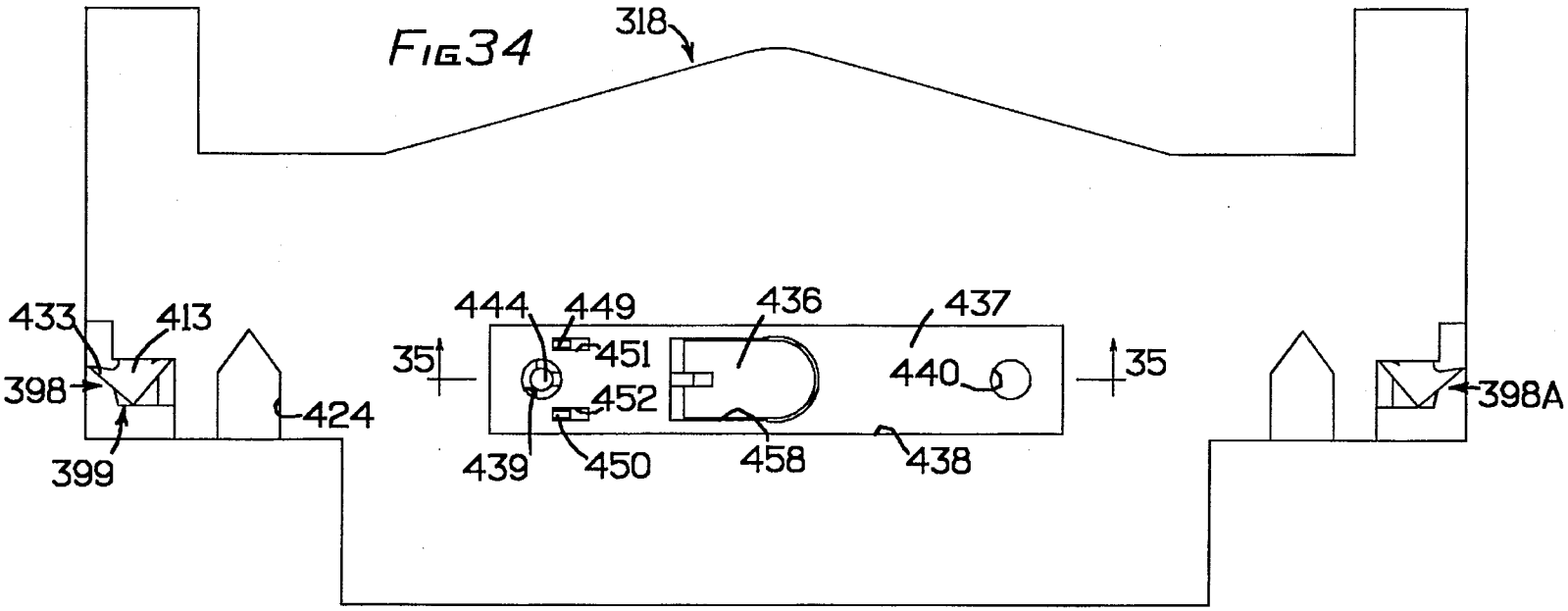
FIG. 34 is a top plan view of a rearward pad of carrier vehicle, showing a cover plate over an electrical receptacle of the pad.

FIG. 34 is a top plan view of the rearward pad 318 and shows that the pad is open above the opening 424 and above end portions of the latch mechanism 398, i.e. above those regions in which portions of the prong structure 215 extend during installation or removal of a connector such as the connector 213. The forward end 413 of the latch member 411 and the tooth 433 thereon are shown with a clear space behind tooth into which the finger 432 of the portion 421 of the prong structure may be dropped. The pad 318 and a locking mechanism 398A provided on the opposite right hand side as shown have constructions which mirror those of the left hand side of the pad 318 and the locking mechanism 398.

Figure 35:
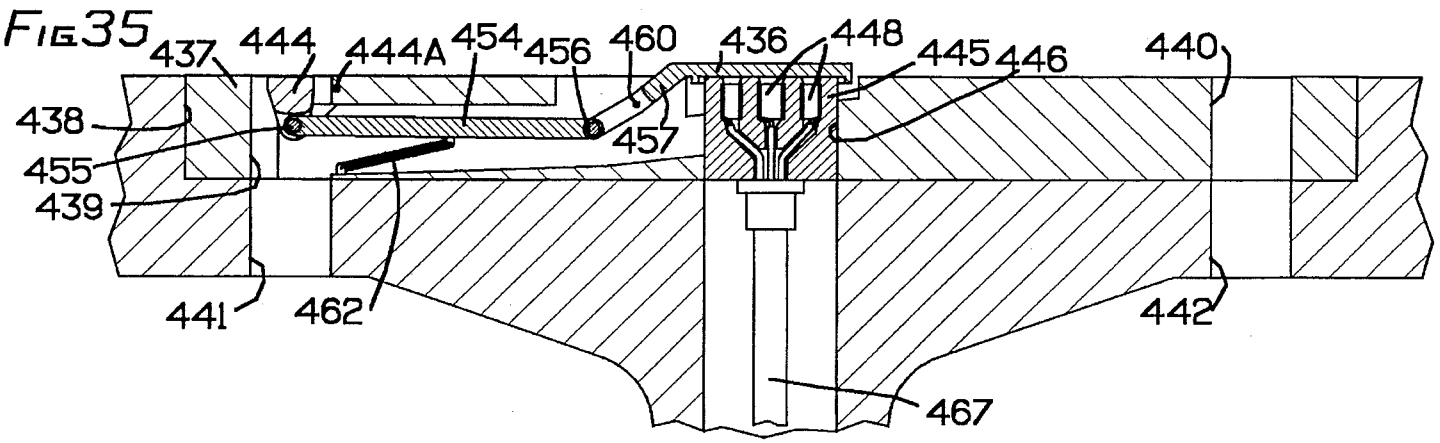
FIG. 35 is a cross-sectional view taken substantially along line 35—35 of FIG. 34.

FIG. 34 also provides a top plan view of structure by which a connector such as connector 213 is guided onto the pad 318 and by through which electrical connections are made. FIG. 35 is a sectional view of such structure on an enlarged scale, being taken along line 35—35 of FIG. 34.

A cover plate 436 is mounted in a mounting plate 437 which is installed in a recess 438 of the pad 318 and which has openings 439 and 440 for receiving guide prongs such as the tapered guide prongs 371 and 372 which extend downwardly from the connector 213, the pad 318 having openings 441 and 442 below the openings 439 and 440. As the connector 213 is lowered down toward the pad 318, the prong 371 engages a cover plate operator 444 in the opening 439. Cover plate operator 444 is linked to the cover plate 436 to swing it about a horizontal axis and to a position it to the side of an electrical connector receptacle 445 which is mounted in an opening 446 at a central location in the mounting plate 437. As the connector 213 then moves further downwardly to rest on the pad 318, male contacts of an electrical connector plug carried by connector 213 are inserted into female contacts 448 of the plug 445.

The cover plate operator 444 is supported for pivotal movement about a horizontal axis, indicated by a point 444A in FIG. 35, by a pair of pins, not shown, which are secured to the mounting plate and which extend through a pair of integral arm portions 449 and 450 of the operator. The arm portions 449 and 450 extend into slots 451 and 452 of the plate 437 as shown in FIG. 34. A link 454 is pivotally connected to the operator 444 by a pin 455 and is pivotally connected by a pin 456 to an extension portion 457 of the cover plate 436. Portion 457 is pivotally supported within an opening 458 in the mounting plate 437 by a pair of pins, which are not visible in the drawing but which support the cover plate 437 and the portion 457 thereof for pivotal movement about an axis indicated by point 460 in FIG. 35. A tension spring 462 operates between an intermediate point of the link 454 and the mounting plate 436 to position the operator 444 within opening 439 and to position cover plate 436 in a closed position as shown in FIG. 35.

Figure 37:
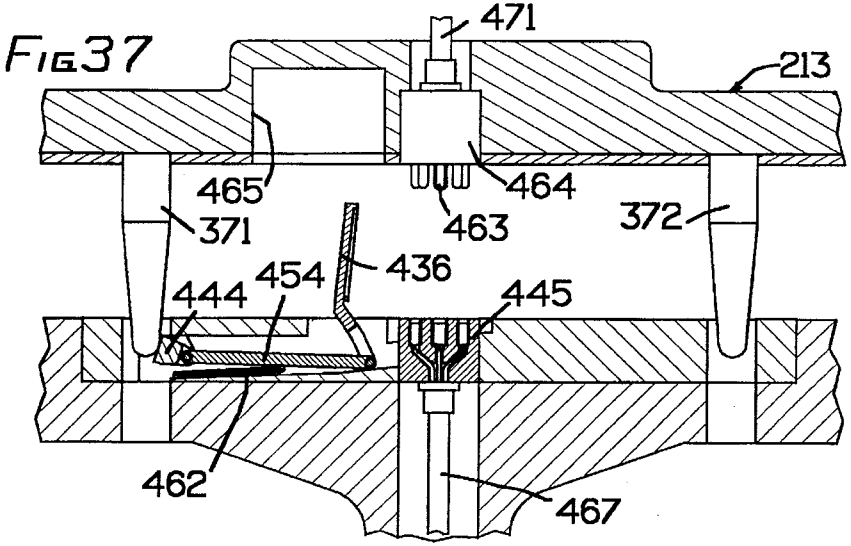
FIGS. 36–38 are view similar to FIG. 35 but additionally provide cross-sectional views of portions of a connector in certain positions to illustrate the operation of the cover plate to an open position and the engagement of an electrical plug of the connector with the receptacle of the pad.
Figure 38:
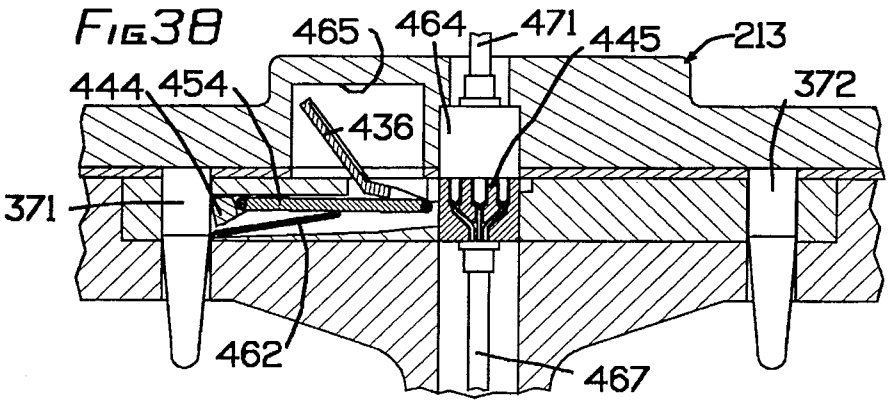
Figure 36:
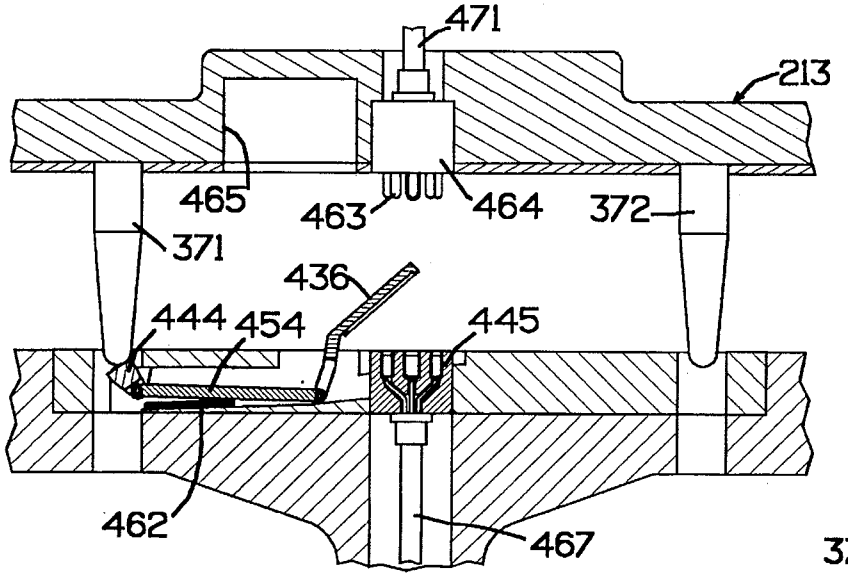

FIGS. 36–38 are similar to FIG. 35 but additionally provide a cross-sectional view of the connector 213 and show the connector 213 in certain positions to illustrate the operation. FIG. 36 shows the condition when the connector 213 has been moved downwardly to a position in which the lower end of tapered guide prong 371 has engaged the operator 444 to rotate it in a counter-clockwise direction and to also rotate the cover plate in a counter-clockwise direction. FIG. 37 shows the condition in which the connector 213 has been moved further downwardly and FIG. 38 shows the condition when the connector 213 has been moved further downwardly to rest on the pad 318.

In the condition shown in FIG. 38, male contacts 463 of a plug 464 carried by the connector 213 are engaged in the female contacts 448 of the receptacle 445 and the cover plate is positioned within a downwardly open recess 465 in the connector 213. Prior to reaching the final condition of FIG. 38, cylindrical portions of the prongs 371 and 372 are engaged in the openings 439 and 440 to accurately center the plug 464 relative to the receptacle 445 as the male contacts 463 enter the female contacts 448.

A cable 467 extends downwardly from the receptacle 445 and within a central passage in a post 470 which supports the pad 318 from a carrier vehicle. Cable 467 connects the receptacle 467 to circuitry of the carrier vehicle while plug 464 is connectable through a cable 471 to circuitry of a body mounted on the connector 213. Through the interconnection thus provided, a direct conductive link is provided for supply of electrical power from the carrier vehicle to any body secured thereto, for lighting or any other purpose as may be desired, and a direct conductive link is provided for communications and control in either direction between the carrier vehicle and the body. At the same time, the electrical connector of the pad is protected from the elements by the cover plate 436, when a carrier vehicle is moved through the system without carrying a body thereon.

Another construction to achieve the same objectives involves the use of inductively coupled transformer windings or other wireless forms of links for either power or communications or both. In such a construction, first and second core portions of a transformer are respectively carried by a pad and a connector to be brought into engagement or close proximity and provide a complete core with minimal air gaps when the connector is mounted on the pad, a primary winding being mounted on the first core portion and a secondary winding being mounted on the second core portion.

Another alternative construction is one in which prongs similar to prongs 371 and 372 are used for supply of electrical power, being electrically insulated from each other with at least one being insulated from the frame structure of the connector 213. In this construction, a contact in the pad is actuated from a position in which it is protected from the elements to a position in engagement with a prong, using either a solenoid or other electrical actuator or an actuator in the form of a mechanical linkage which may be actuated by the prong.

FIGS. 39–43 show the construction and operation of the bridging structure 108, the construction and operation of which is mirrored by the bridging structure 107. As aforementioned, the bridging structures are pivoted about vertical axis when elements thereof are engaged by a transfer vehicle 90 approaching the position 55 and then bridge a space through which pad support posts of carrier vehicles normally pass and to provide support for a forward pair of wheels as they move from ends of tracks 102 to tracks 110 which register with the tracks 102.

Figure 42:
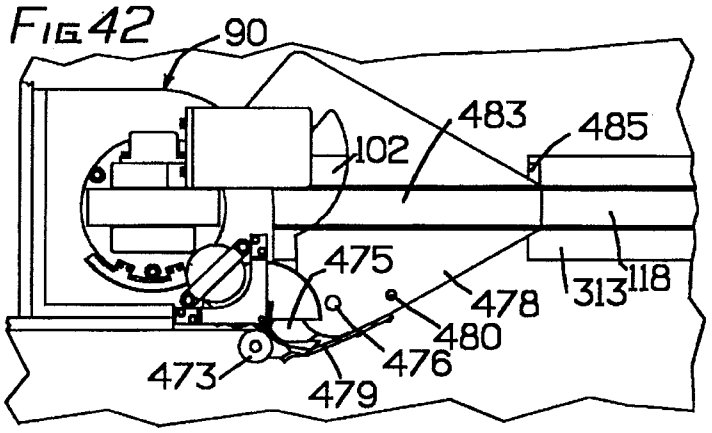
FIG. 42 is a top plan view similar to FIG. 39 but showing the transfer vehicle moved to a position to actuate the bridging structure into an operative position over the guideway slot.
Figure 43:
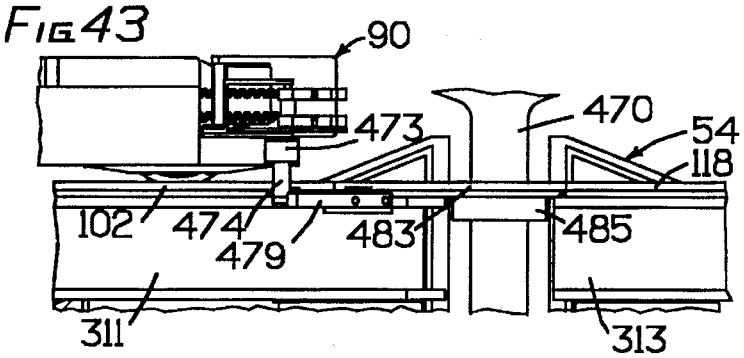
FIG. 43 is a side elevational view of the structure as shown in FIG. 42.
Figure 39:
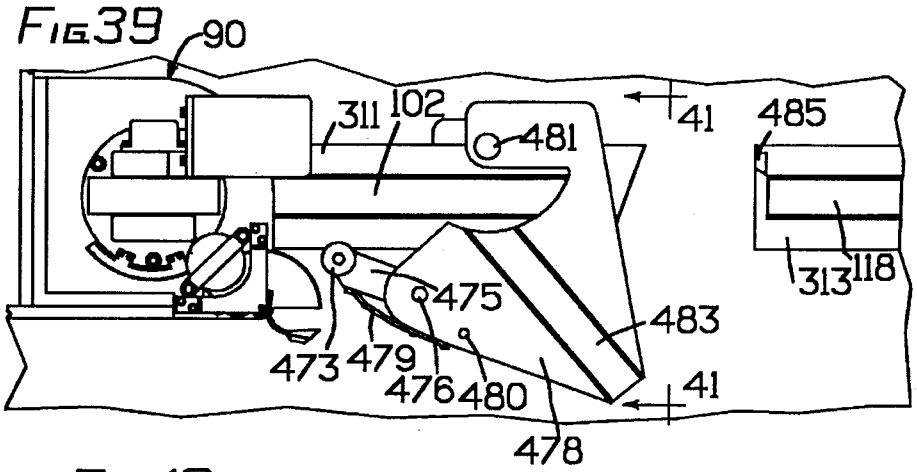
FIG. 39 is a top plan view of a bridging structure and portions of a transfer vehicle approaching the bridging structure for movement over a guideway slot.
Figure 40:
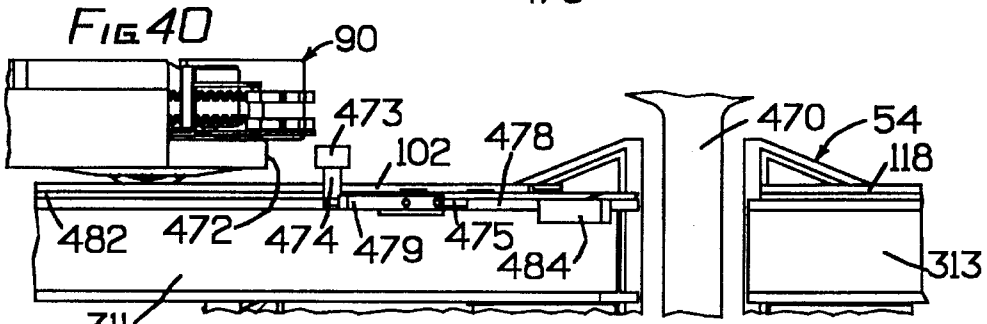
FIG. 40 is a side elevational view of the structure of FIG. 39.

FIGS. 39 and 40 show a condition in which the carrier vehicle 90 is moving into the loading-unloading position 55 from the left and in which an end surface 472 of the vehicle is approaching a roller 473 disposed in the path of surface 472 and journaled on the upper end of a post 474. Post 474 is secured at its lower end to one end of an arm 475 which is journaled on the lower end of a pin 476 projecting downwardly from a plate 478. A leaf spring 479 is mounted on the plate 478 and engages the arm 475 to urge the arm 475 in a clockwise direction as viewed in FIG. 39. Movement of the arm 475 in a clockwise direction is limited by engagement of a pin 480 by an end of arm 475 that is opposite that which carries the post 474 and roller 473. The plate 478 is pivotally supported on a vertical shaft portion of a member 481 carried by the I-beam 311, the track 102 being supported on I-beam 311 through a spacer plate 482 which has a thickness approximately equal to that of plate 478. Plate 478 carries a track section 483 on its upper side and a rigidifying and strengthening member 484 is welded or otherwise secured on the underside of plate 478, below the track section 483. The track section 483 has one end positioned at the left end of track 102 to form a continuation of track 102 when the plate 478 is pivoted in a counter-clockwise direction to a position as shown in FIG. 42. An end portion of plate 478 then engages a stop 485 on the I-beam 313 and an opposite end of track section 483 is then positioned at the left end of track 118.

Figure 41:
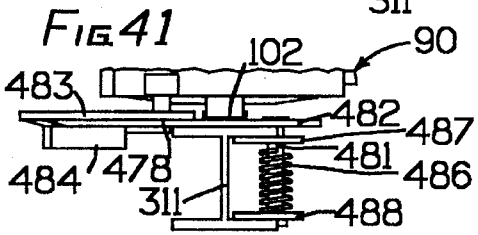
FIG. 41 is a cross-sectional view taken substantially along line 41—41 of FIG. 39.

The plate 478 is urged to rotate in a clockwise direction by a torsion spring 486, shown in the elevational sectional view of FIG. 41. Spring 486 is disposed between plates 487 and 488 which are secured on lower and upper surfaces of upper and lower flanges of I-beam 311, the upper end of spring 486 being connected to the shaft portion of member 481 and the lower end thereof being connected to the plate 488 on a lower flange of the I-beam 311.

Normally, in the absence of the transfer vehicle 90 at the loading-unloading position 55, the track section support plate 478 is held by action of the spring 486 in the position as shown in FIG. 39 in which clockwise movement is limited by engagement of the arm 475 with an edge portion of an upper flange of the I-beam 311. When the transfer vehicle 90 is moved to the right, the end surface 472 thereof engages the roller 473 and rotates the plate 478 in a counter-clockwise direction to the position shown in FIG. 42, in which the spring 479 holds the roller 473 in engagement with a side surface of the transfer vehicle and in which the plate 478 engages the stop 484. The track section 483 then bridges the gap between the right end of track 102 and the left end of track 110 for support of the forward wheel of the transfer vehicle as it is moved further to the right.

When the transfer vehicle 90 is moved back to the left, after transfer of a body to or from a carrier vehicle at the position 55 and after the end surface 472 is to the left of roller 473, the torsion spring 486 rotates the plate 478 back to the position shown in FIG. 39 in which the space between I-beams 311 and 313 is clear for passage of pad-supporting posts of carrier vehicles.

Figure 44:
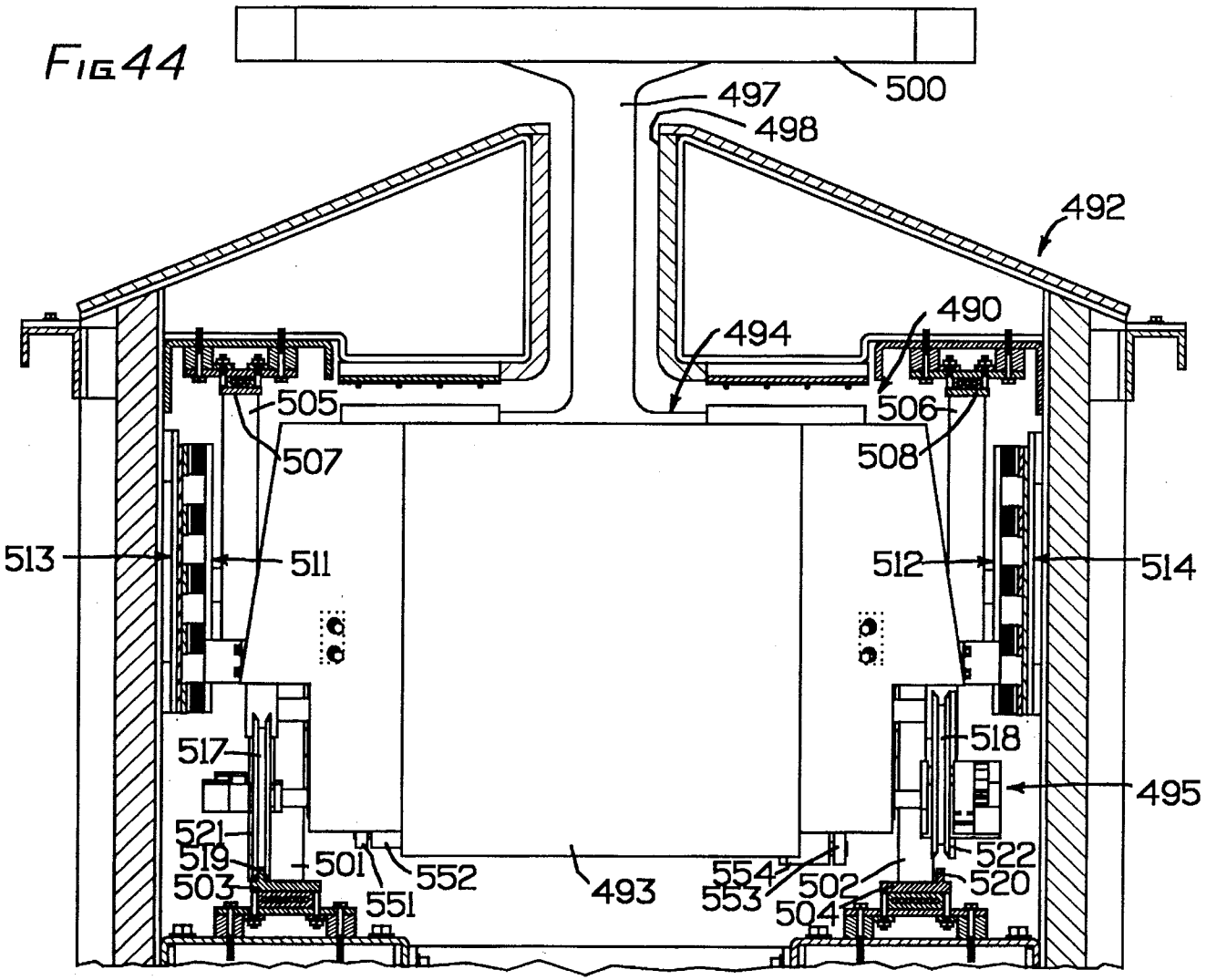
FIG. 44 is a front elevational view of a carrier vehicle and is also an elevational sectional view of a guideway looking rearwardly in a direction opposite a direction of travel.
Figure 45:
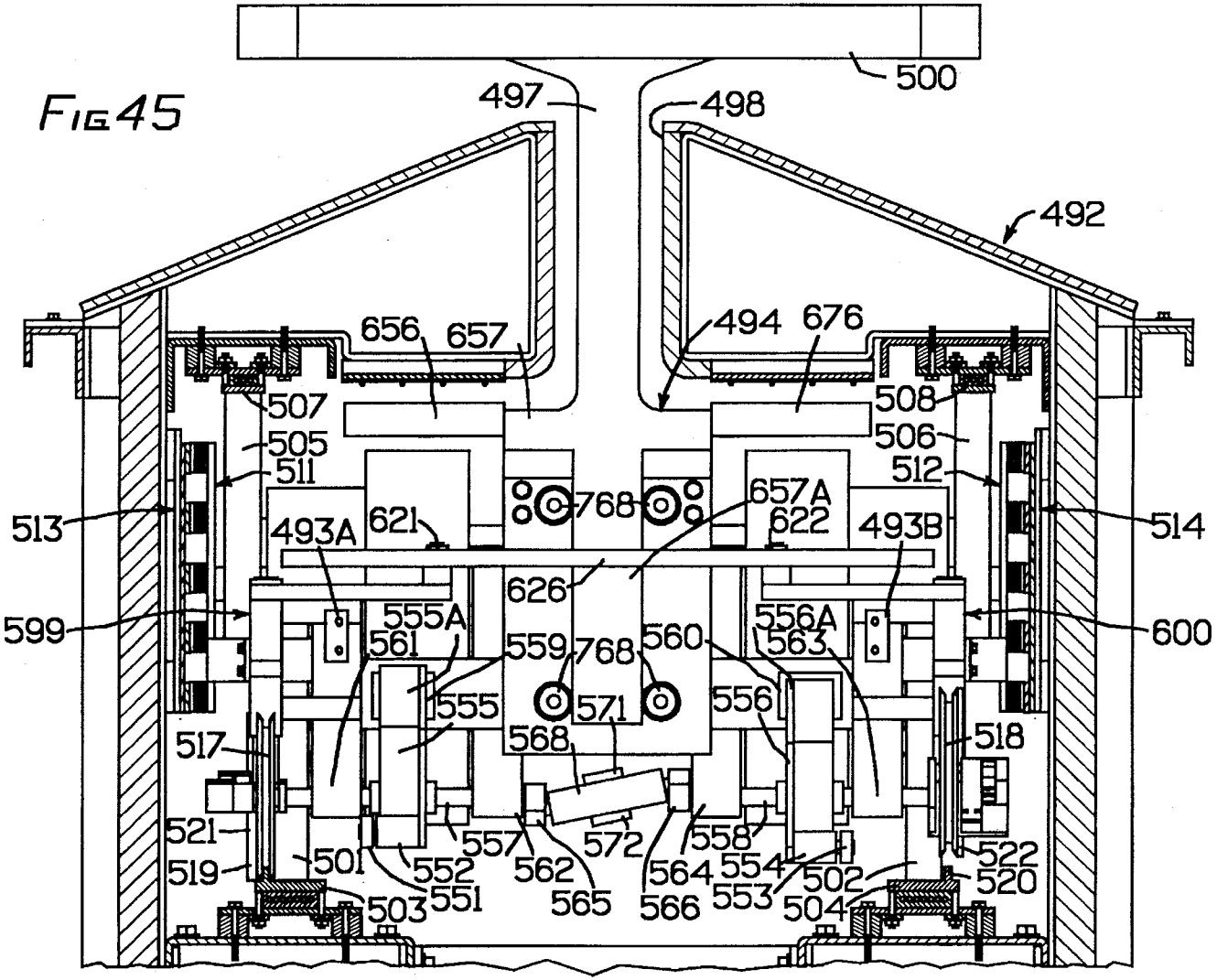
FIG. 45 is a view like FIG. 44 but showing the carrier vehicle structure after removal of an aerodynamic fairing thereof.
Figures 46, 47:
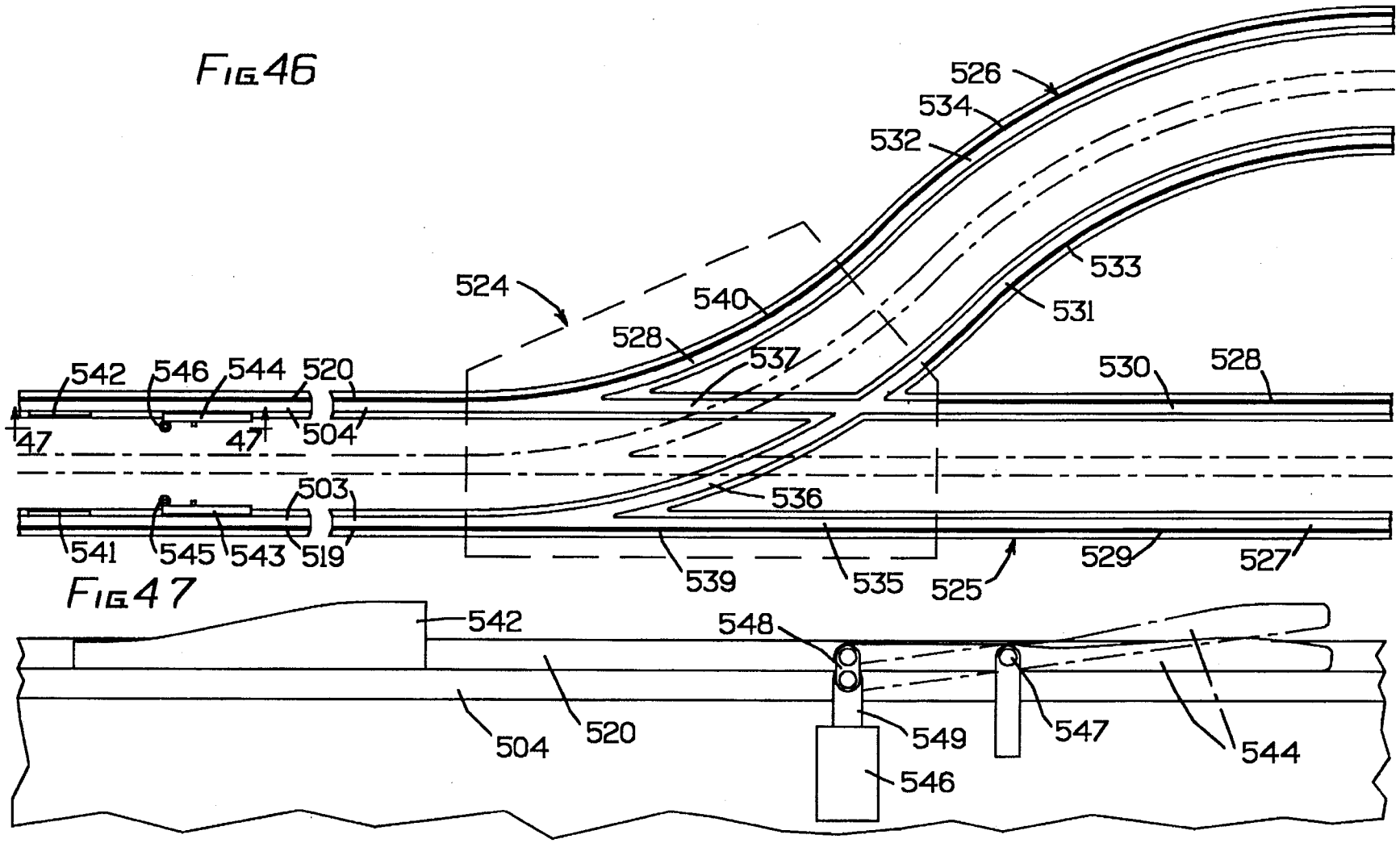
FIG. 46 shows a representative arrangement of lower guideway tracks in a transition region which allows a carrier vehicle to move selectively from one guideway to either of two other guideways.
FIG. 47 is a cross-sectional view on an enlarged scale, taken substantially along line of FIG. 46.
Figure 48:
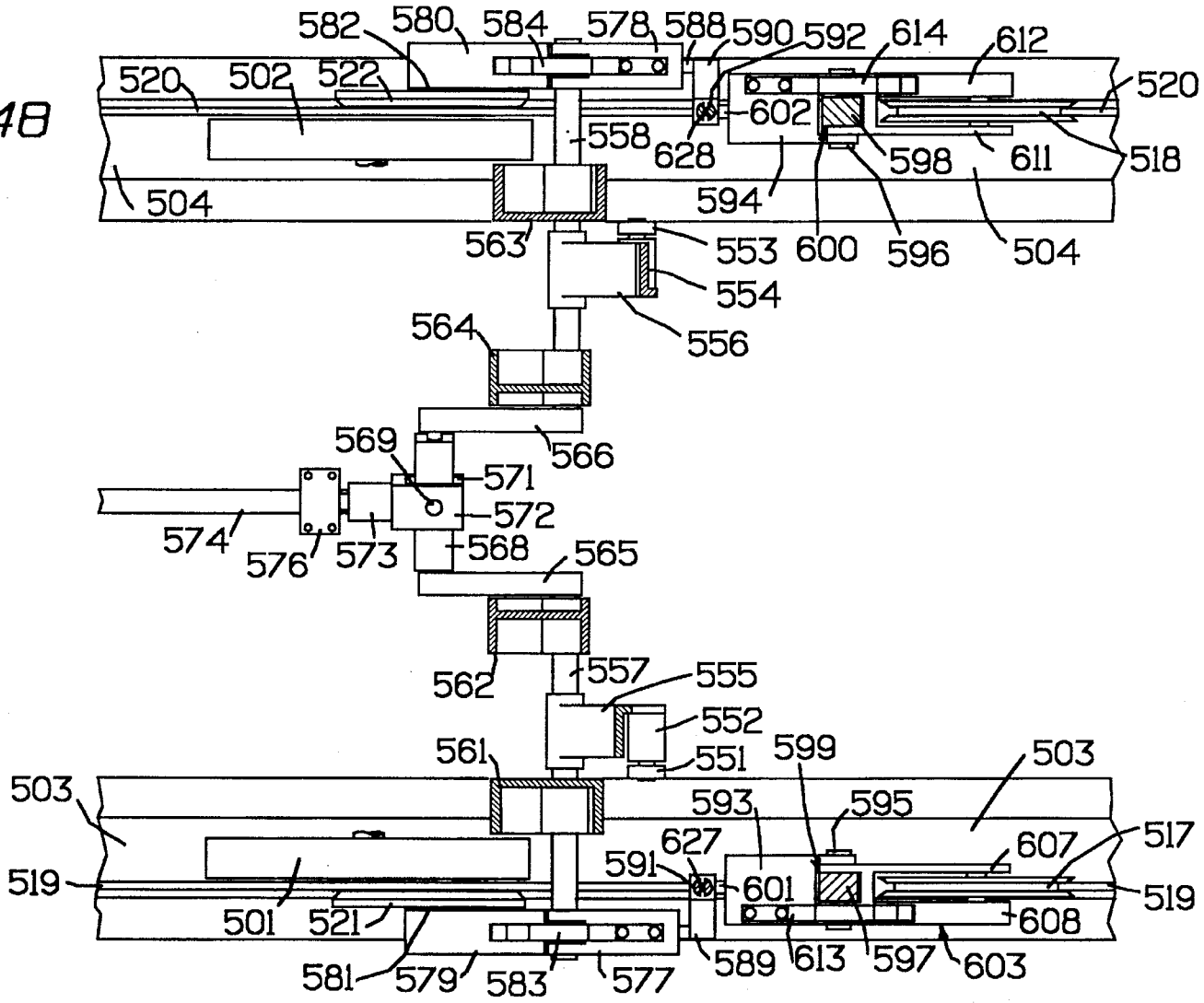
FIG. 48 is a sectional view taken along line 48—48 of FIG. 45 and showing a linkage which interconnects certain cam rollers and guide wheels of a carrier vehicle.
Figure 49:
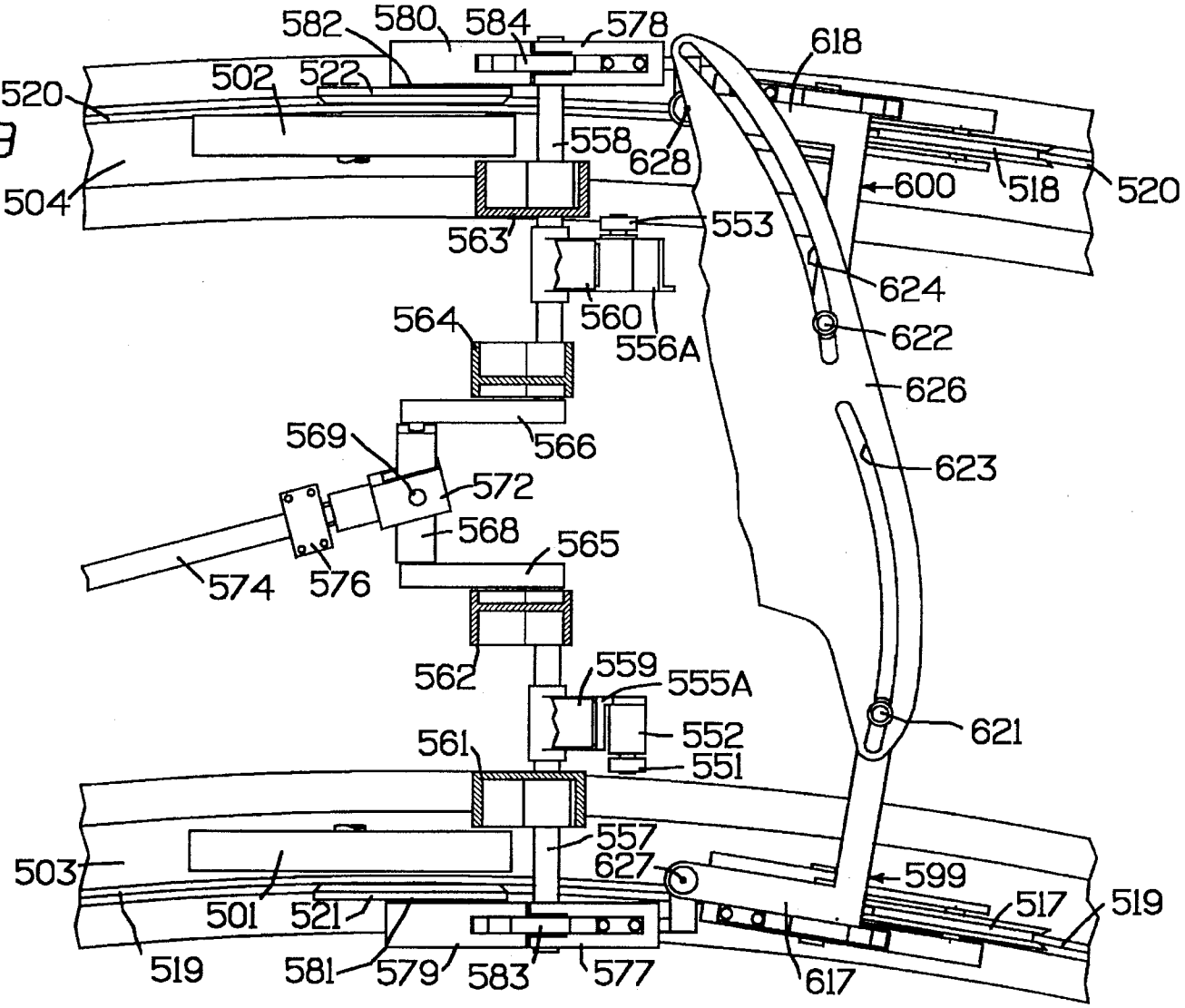
FIG. 49 is a view similar to FIG. 48 but showing how the carrier vehicle is guided in a turn.

FIGS. 44–50 show features of construction of a carrier vehicle 490 and a guideway 492 in which the carrier vehicle 490 moves, particularly with regard control of movement along the guideway 492 and selective movement from the guideway 492 to other guideways. FIG. 44 is a front elevational view of the carrier vehicle 490 and is also an elevational sectional view of the guideway 492 looking rearwardly in a direction opposite a direction of travel; FIG. 45 is a view similar to FIG. 44 but showing the carrier vehicle 490 after removal of an aerodynamic fairing 493 from the ends of two posts 493A and 493B, fairing 493 being operative to direct air downwardly and inwardly into a region below the path of movement of the vehicle 490 within the guideway 492; FIG. 46 shows a representative arrangement of lower tracks in a transition region to allow the carrier vehicle 490 to move selectively from the guideway 492 to either of two other guideways; FIG. 47 is a sectional view taken along line 47—47 of FIG. 46 and showing the form and control of cam members in the guideway 492; FIG. 48 is a sectional view taken along line 48—48 of FIG. 45 and showing a linkage which interconnects cam rollers to each other and to guide wheels; and FIG. 49 is a view similar to FIG. 48 but showing how the carrier vehicle 490 is guided in a turn.

The carrier vehicle 490 includes a main frame 494 supported by front and rear bogies 495 and 496 having mirror image constructions and journaled by the main frame 494 for pivotal movement about front and rear vertical turn axes. The front bogie 495 is shown in FIGS. 44 and 45 and is disposed with its turn axis below a post 497 which extends upwardly from the front portion of the main frame 494 and through a relatively narrow slot 498 in the guideway 492 to an upper end which supports a front pad 500 of the carrier vehicle 490. The guideway 492 may be a main line guideway such as one of the guideways 11 or 12 shown in FIG. 1, or may be a branch guideway, all guideways having the same or similar constructions.

A pair of lower support wheels 501 and 502 of the bogie 495 are supported on pair of lower tracks 503 and 504 of the guideway 492 and a pair of upper support wheels 505 and 506 are engaged with downwardly facing surfaces of a pair of upper tracks 507 and 508. In the construction of a drive transmission assembly for each bogie of the carrier vehicle 490 as hereinafter described, differential gearing assemblies are provided to allow wheels on opposite sides of the carrier vehicle 490 to rotate at different speeds while the vehicle is turning. All four wheels 501, 502, 505 and 506 are driven from a common electric drive motor in the front bogie 495 and corresponding wheels in the rear bogie 496 are similarly driven from a common electric drive motor.

For supply of electrical power to the front bogie 495 of the carrier vehicle 490, a pair of contact shoe assemblies 511 and 512 are supported by the bogie 495 on opposite sides thereof which resiliently contact shoes for sliding engagement with conductors of conductor assemblies 513 and 514 which are supported on the inside of side walls of the guideway 492 and which extend along the length of the guideway 492. In the illustrated arrangement, each of the contact shoe assemblies 511 and 512 carries five contact shoes in vertically spaced relation engageable with corresponding conductors of the conductor assemblies 513 and 514.

Two of the five conductors of each of the contact shoe assemblies 511 and 512 may be connected to one terminal of a DC power source, another two may be connected to the opposite terminal of the DC power source and the remaining one of the five conductors may be used for communication or control purposes. For a three wire single phase AC source having a neutral terminal and two main terminals, two of the five conductors of each assembly may be connected one main terminal, another two conductors of each assembly may be connected to the other main terminal and the remaining one of the five conductors may be connected to the neutral terminal. For a three phase Y-connected source, three main terminals and a neutral terminal may be connected to four of the five conductors and the remaining conductor may be used for communication or control purposes.

In direction control operations as hereinafter described when, for example, a vehicle may either continue on a main guideway or move to a branch guideway, the contact shoes of both contact assemblies cannot simultaneously engage conductors of two conductor assemblies. However, contacts of both contact assemblies are normally engaged with conductors of the corresponding conductor assemblies so as to normally provide two paths for current flow from the source to the carrier vehicle 490 through the contact shoe assemblies of the front bogie. The rear bogie 496 also carries two contact assemblies, thereby providing two paths for current flow to the carrier vehicle 490 during switching operations and four paths during normal operation.

To guide the carrier vehicle 490 along the tracks 503 and 504 during movement along the guideway 492 and for selectively guiding the carrier vehicle from the guideway 492 to a guideway branching therefrom, direction control means are carried by and controlled from the vehicle 490 to be selectively operable between two conditions and for cooperation with guide means along guideways, including guide means in Y junctions in which a vehicle entering from one guideway is guided through either of two exits to enter either of two other guideways. The arrangement is passive in the sense that no switches need be operated along the guideway, the direction being controlled from the vehicle. However, it is possible to send signals to the vehicle to control the direction of travel and it is also possible to operate certain cams along the guideway to effect a mechanical control in a manner as hereinafter described.

In the construction as illustrated, the direction control means includes a pair of grooved turn control wheels 517 and 518 which are connected to the bogie 495 to control turning thereof about its vertical turn axis. Guide means are provided along the guideway including guide ribs 519 and 520 which are engageable by the grooved turn control wheels 517 and 518 in lowered positions thereof. The ribs 519 and 520 extend along and project upwardly from the lower tracks 503 and 504 on the outside of the surfaces of the tracks 503 and 504 which are engaged by the wheels 501 and 502. The direction control means also includes two solid transverse position control wheels 521 and 522, each being connected to the bogie 495 for movement between an upper inactive position and a lower active position in which it is on the outside of the a corresponding rib 519 or 520 and in which it is in approximate transverse alignment with the wheels 501 and 502.

The grooved and solid turn and transverse position control wheels 517 and 521 on the right side of the carrier vehicle 490, i.e. the right-hand side of the carrier vehicle 490 to an observer on the carrier vehicle 490 who is looking forwardly in the direction of travel, are shown in lowered positions in FIGS. 44–46 while the grooved and solid wheels 518 and 522 on the left side of the carrier vehicle 490 are shown in elevated positions. The carrier vehicle 490 is then guided by the surfaces of the grooved turn control wheel 517 which are on the inside and outside of the rib 519 of the right track 503, by surfaces of the lower main wheel 501 and solid transverse position control wheel 521 which are on the inside and outside of the rib 519 and also by the surface of the outside of lower main wheel 502 which is on the inside of the rib 520 of the left track 504.

FIG. 46 shows a representative arrangement of lower tracks in a Y junction 524 which is indicated by broken lines and which allows the carrier vehicle 490 to move selectively from the guideway 492 and through an entrance of the Y junction 524 to either one exit and to a guideway 525 or through a second exit and to a guideway 526. Guideways 525 and 526 will be referred to as right and left guideways since they appear on the right and left to an observer looking forwardly from the carrier vehicle 490 in the direction of travel. Right guideway 525 has right and left tracks 527 and 528 and associated guide ribs 529 and 530 and left guideway 526 has right and left tracks 531 and 532 and guide ribs 533 and 534. In the Y junction 524, track surfaces are provided which include surfaces 535 and 536 extending from the surface of the right track 503 to those of the right tracks 527 and 531 of the right and left guideways 525 and 526 and surfaces 537 and 538 extending from the surface of the left track 504 to those of the left tracks 528 and 534 of the right and left guideways 525 and 526. A single right guide rib 539 is provided which extends from the right rib 519 of guideway 492 to right rib 529 of the right guideway 525 and a single left rib 540 is provided which extends from the left rib 520 of guideway 492 to the left rib 534 of the left guideway 526.

The junction 524 thus provides one continuous guide rib for directing a carrier vehicle to each exit and it provides continuous support surfaces for the lower wheels of a carrier vehicle. The upper tracks are not shown in FIG. 46, but broken lines are provided to indicate the positions of slots in the guideway which are required for movement of the support posts of a carrier vehicle in passing through the junction, thereby requiring that there be a gap in each upper tracks crossing a slot which is at least as wide as the slot at the crossing point. As hereinafter described, the upper wheels of the carrier vehicle are urged upwardly into engagement with the upper tracks, but with a limit on such upward movement. To obtain a smooth movement through Y junctions, the surface of each upper track that must have a gap therein is gradually inclined upwardly in approaching the gap and is gradually inclined downwardly following the gap, thereby allowing the corresponding upper wheel to gradually move upwardly to the limit of its travel in approaching the gap and to gradually move downwardly following the gap.

To cause the carrier vehicle 490 to move from the guideway 492 to the right guideway 525, the grooved and solid guide wheels 517 and 521 on the right side of the carrier vehicle 490 are kept in a lowered position such as shown in FIGS. 44–46 to cooperate with the single right rib 539 of the Y junction 524 and then with the right rib 529 of the guideway 525 in guiding the carrier vehicle 490 to and along the right guideway 525. To cause the carrier vehicle 490 to move from the guideway 492 to the left guideway 526, the grooved and solid guide wheels 518 and 522 on the right of carrier vehicle 490 are lowered position from a raised position such as shown in FIGS. 44–46 to cooperate with the single left rib 540 of the Y junction 524 and then with the left rib 534 of the guideway 526 in guiding the carrier vehicle 490 to and along the left guideway 526. As hereinafter described, a linkage connects the guide wheels in a manner such as provide two conditions of stability with the guide wheels on one side being in an inactive elevated position while those on the opposite side are in a lowered active position, thereby insuring that the vehicle will move in only one of two possible paths in moving through a Y junction.

In the representative arrangement shown in FIG. 46, the tracks 535 and 537 of the Y junction 524 are aligned along straight lines with the tracks 503 and 504 of the guideway 492 while the tracks 536 and 538 of the Y junction 524 curve off to the left from the tracks of the tracks of the guideway. The reverse could be the case, i.e. the Y junction tracks which extend to the right guideway could curve off to the right while the Y junction tracks which extend to the left guideway could be straight. Also both Y junction tracks and associated guide ribs could be curved, one to the right and one to the left.

FIG. 46 shows the radii of curvature of the curved tracks as being quite small, on the order of 20 feet, which might be the case within an interchange such as shown in FIGS. 1 and 2. However, very large radii of curvature are used when, for example, the carrier vehicle 490 is travelling at high speeds and is to either continue travel in a main line guideway or exit to a branch guideway.

In any case in which the guideway is curved there is a super-elevation of the outer track designed to obtain at normal expected speeds a resultant of gravitational and centrifugal forces which is perpendicular to the track surfaces and to thereby impose minimal side forces on the surfaces of the guide wheels, ribs and support wheels which cooperate to control the direction of travel.

FIG. 46 shows cam members usable in control of raising and lowering of the grooved and solid turn and transverse position control wheels on the right and left sides of the carrier vehicle 490. Right and left stationary cam members 541 and 542 and right and left movable cam members 543 and 544 are provided, the latter being controlled by solenoids 545 and 546. The sectional view of FIG. 47 shows the left cam members 542 and 544 in elevation and also shows the pivotal support of cam member 544 on a pin 547 and a link 548 connecting an armature 549 of solenoid 546 to the cam member 544. Solenoid 546 when energized pulls one end of the cam member 544 downwardly to move an opposite operative end thereof upwardly to an active position which is indicated in broken lines and in which its upper surface is in a position similar to that of the upper surface of the stationary cam member 542. The construction and operation are the same with respect to the cam members 541 and 543 and solenoid 545 on the right side of the guideway 492, an operative end of the cam member 543 being moved upwardly to an active position when the solenoid 545 is energized.

FIG. 45 shows cam follower rollers which can coact with the cam members 542–544 and which are linked to the guide wheels 517, 518, 521 and 522 for control thereof. A right cam follower roller 551 is journaled on an armature of a solenoid 552 and a left cam follower roller 553 is journaled on the armature of a solenoid 554. When the solenoid 552 is energized, the roller 551 is moved outwardly to a position such that it will engage the cam member 541 as the carrier vehicle 490 is moved along the portion of guideway 492 shown in FIG. 46. Similarly, when the solenoid 554 is energized, the roller 553 is moved outwardly to a position such that it will engage the cam member 542 as the carrier vehicle 490 is moved along the portion of the guideway 492 shown in FIG. 46. In FIGS. 44 and 45, the positions of the cam members 541 and 542 are shown in broken lines.

The cam follower rollers 551 and 553 are connected to the guide wheels and to each other through a linkage which is such as to selectively obtain first and second stable conditions. In the first stable condition shown in FIGS. 44 and 45, the right direction control wheels 517 and 521 are lowered and the left direction control wheels 518 and 522 are raised when the right roller 551 is raised and the left roller 552 is lowered. Under the first stable condition, when the carrier vehicle 490 is moved along the portion of the guideway 492 shown in FIG. 46, the right direction control wheels 517 and 521 will cooperate with the rib 539 of the Y junction 524 to guide the carrier vehicle 490 to the right guideway 515.

If, under the first stable condition and before the carrier vehicle 490 is moved along the portion of guideway 492 shown in FIG. 46, the solenoid 554 is energized to move the left roller 553 outwardly, subsequent movement of the carrier vehicle 490 along the portion of guideway shown in FIG. 46, will cause the second stable condition to be reached prior to reaching the Y junction 524, the left roller 553 being raised by engagement with the cam member 542, the right roller 551 being lowered, the right direction control wheels 517 and 521 being raised and the left guide wheels 518 and 522 being lowered. In the second stable condition, the left direction control wheels 518 and 522 cooperate with the rib 540 in the Y junction 524 to guide the carrier vehicle 490 to the left guideway 524.

The movable cam members 543 and 544 are controllable through selective energization of the solenoids 545 and 546 to independently control switching operations. Cam members 543 and 544, when the operative ends thereof are moved upwardly, are wide enough to be in the path of cam rollers 551 and 553 regardless of the condition of energization of the solenoids 552 or 554 and whether either of the cam rollers 551 and 553 is in an inward or outward position. If solenoid 545 is energized prior to movement of the carrier vehicle 490 onto the portion of guideway 492 shown in FIG. 46, the operative end of cam member 543 is moved upwardly to be in the path of cam roller 551 as the carrier vehicle 490 moves forwardly and to move the cam roller 551 upwardly if cam roller 551 is not already in an upward position, whereby the carrier vehicle 490 will move to the right guideway 525. In a similar fashion, energization of the solenoid 546 will cause the carrier vehicle 490 to move to the left guideway 526.

Accordingly, two independent control means are provided for selective switching from the guideway 492 on which the carrier vehicle 490 is moving to either one of the two other guideways 525 and 526, the first means including the solenoids 552 and 554 carried by the carrier vehicle 490, and the second control means including the solenoids 543 and 544 which are associated with the guideway 492.

FIG. 48, which is a sectional view looking downwardly from along line 48—48 of FIG. 45, provides a plan view of the aforementioned linkage which interconnects the cam rollers 551 and 553 to the guide wheels and to each other. The solenoids 552 and 554, armatures of which journal the rollers 551 and 553, are secured to lower portions of a pair of brackets 555 and 556 which are secured to a pair of horizontal shafts 557 and 558. Upper portions 555A and 556A of the brackets 555 and 556, shown in FIG. 45, are arranged for magnetic coaction with permanent magnets 559 and 560 which are supported by the bogie 495. When the linkage is in the condition shown, the permanent magnet 559 is engaged by the upper portion 555A of bracket 555 and exerts a holding force of substantial magnitude sufficient to obtain a high degree of stability in maintaining the linkage in the condition as shown. However, when sufficient torque is applied through the linkage to the shaft 557, the linkage can be operated to a second condition opposite that shown, whereupon the permanent magnet 560 is engaged by the upper portion 556A of bracket 556 to hold the linkage in the second condition.

Shaft 557 is journaled in bearings carried by depending portions 561 and 562 of members of a frame structure of the front bogie 495 and shaft 558 is similarly journaled in bearings carried by depending portions 563 and 564 of a left portion of a frame structure of the front bogie 495.

The shafts 557 and 558 control raising an lowering of the guide wheels on the opposite sides of the carrier vehicle 490 and it is desirable that the guide wheels on either one side or the other be in a lowered active condition while those on the opposite side are in an upper inactive condition. For this reason an arrangement is provided for linking shafts 557 and 558 to rotate in opposite directions and for also linking such shafts to corresponding shafts of the rear bogie while permitting turning movements of bogies about vertical turn axes.

In particular, arms 565 and 566 are secured to inner ends of the shafts 557 and 558 and extend rearwardly to terminal ends which are interconnected through ball joints to ends of a member 568 which is pivotal about a central longitudinally extending horizontal axis. The details of the ball joints are not shown, but they include ball members which are engaged in sockets in the arms 565 and 566 and which so supported by the member 568 as to allow limited movement in a radial direction relative to the horizontal axis. The vertical turn axis of the front bogie is indicated by reference numeral 569 and extends through a central portion of the member 568 which is pivotally secured by a pin 570 between portions 571 and 572 of a member 573 which is keyed to the forward end of a shaft 574, a member corresponding to member 573 being keyed to a rearward end of the shaft 574 for control of guide wheels of the rear bogie in unison with those of the front bogie. Bearings which include a bearing 576 are secured to the main frame 494 of the carrier vehicle 490 to journal the shaft for rotation about the aforementioned central longitudinally extending horizontal axis.

Figure 50:
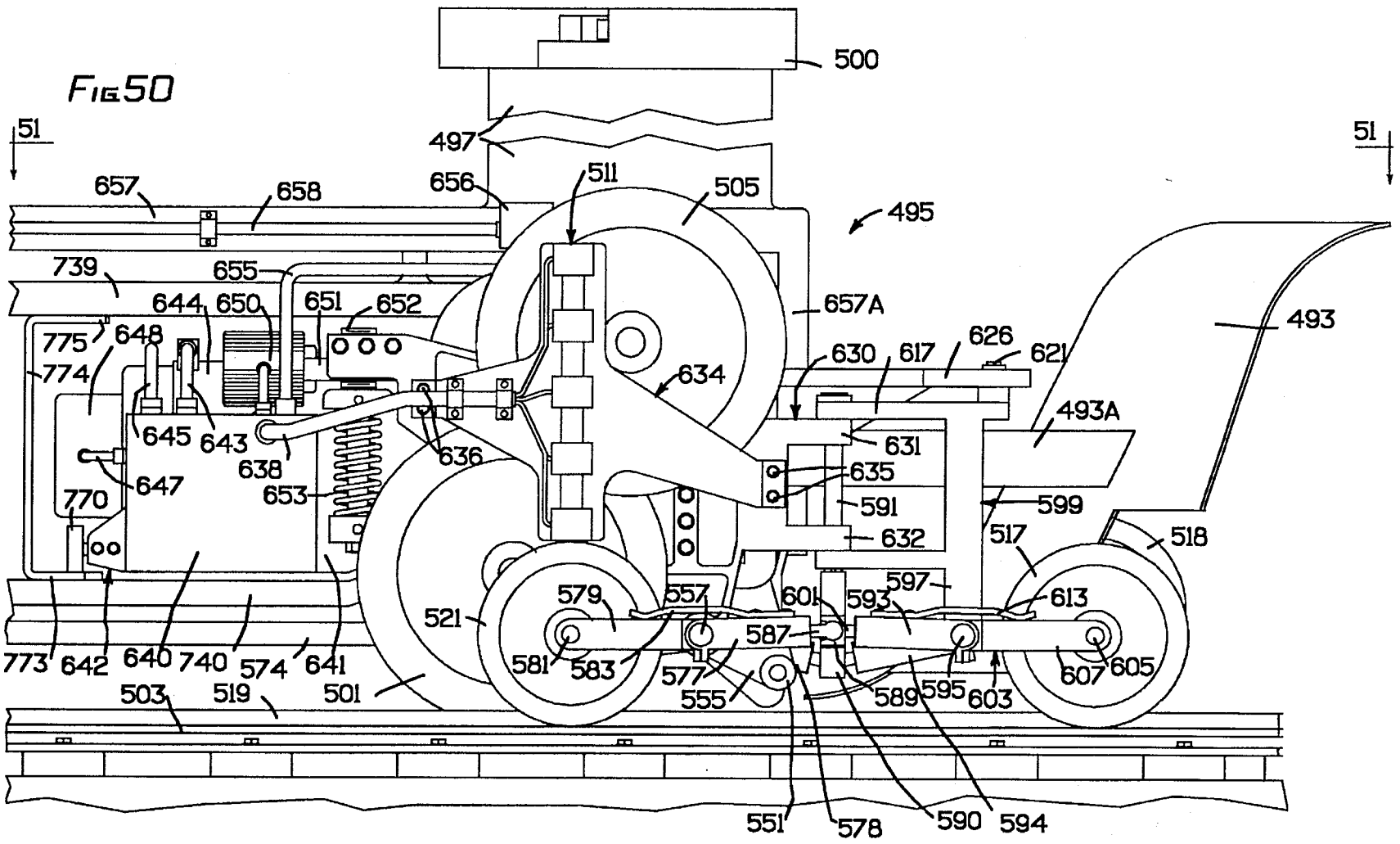
FIG. 50 is a side elevational view of the carrier vehicle of FIGS. 44 and 45, but showing only lower track portions of a guideway.

The operation of the shafts 557 and 558 in controlling raising and lowering of the guide wheels will be clarified by considering FIGS. 48 and 49 in conjunction with FIG. 50 which is a side elevational view of the carrier vehicle, showing only lower track portions of the guideway 492. One pair of arms 577 and 578 are secured to outer ends of the shafts 557 and 558. Another pair of arms 579 and 580 are supported on the outer ends of shafts 557 and 558 for limited pivotal movement relative thereto and journal support shafts 581 and 582 of the solid guide wheels 521 and 522. Leaf springs 583 and 584 are secured to the arms 577 and 578 and are engaged with the arms 579 and 580 to urge the arms in counter-clockwise directions as viewed in FIG. 50. Spring 583 resiliently urges the periphery of the solid guide wheel 521 into engagement with a portion 585 of the track 501 on the outside of the rib 519 when the arm 577 is rotated to a position as shown in FIG. 50. Spring 584 performs a similar function with respect to the solid guide wheel 522.

An arrangement is provided for control of raising and lowering of the grooved turn control wheels 517 and 518 from the arms 577 and 578 while permitting turning movements of the guide wheels about vertical turn axes. In particular, the arms 577 and 578 are connected through a pair of connect members 587 and 588 to a pair of vertically movable members 589 and 590. Members 589 and 590 are keyed to vertical shafts 591 and 592 to prevent rotation about the vertical axes of shafts 591 and 592 while allowing vertical rectilinear movement of members 589 and 590. To allow control of the vertical movement of members 589 and 590 from the pivotal arms 577 and 578, the connect members 587 and 588 are supported from the arms 577 and 578 for slidable movement in an radial direction relative to the axes of shafts 557 and 558.

The vertically movable members 589 and 590 are connected to ends of a pair of arms 593 and 594 which are supported through shafts 595 and 596 from the lower ends of a pair of members 597 and 598. Members 597 and 598 are parts of a pair of turn control structures 599 and 600 which are supported from the front bogie 495 for pivotal movement about vertical axes aligned with the axes of shafts 591 and 592. As will be described, such turn control structures 559 and 600 are interconnected to the main frame of the carrier vehicle 490 through a cam arrangement which is such as to obtain a proper angular position of the bogie 495 about its vertical turn axis and proper angular positions of the grooved guide wheels relative to the guide ribs regardless of whichever of the grooved turn control wheels 517 or 518 is in a lowered position to engage the corresponding guide rib 519 or 520.

To connect members 589 and 590 to the arms 593 and 594, members 601 and 602 are slidably supported from the arms 593 and 594 for limited radial movement relative to the axes of shafts 595 and 596 and have ball portions disposed in sockets of the vertically movable members 589 and 590.

The grooved turn control wheels 517 and 518 are supported by another pair of arms 603 and 604 which are supported on the shafts 595 and 596 and which are connected through a leaf spring arrangement to the arms 593 and 594. The guide wheel 517 is journaled by a shaft 605 between portions 607 and 608 of arm 603 and the guide wheel 518 is similarly journaled by a shaft 609 between portions 611 and 612 of arm 604. Leaf springs 613 and 614 are secured to the arms 593 and 594 and engage the arms 603 and 604. Spring 613 resiliently urges the periphery of the grooved guide wheel 518 into engagement with the rib 519 when the arm 593 is rotated to a position as shown in FIG. 46. Spring 614 performs a similar function with respect to the grooved guide wheel 518.

FIG. 49 is a view that is similar to FIG. 48 but shows portions of the turn control structures 599 and 600 and the positions of the guide wheels under conditions in which the carrier vehicle 490 is turning with a relatively short turn radius. It also shows the upper portions 555A and 556A of the brackets 555 and 556 and the latching magnets 559 and 560.

The turn control structures 599 and 600 are pivotal about the vertical axes of the shafts 591 and 592 and include the downwardly projecting portions 597 and 598 shown in cross-section in FIG. 49 and upper arm portions 617 and 618. Portions 619 and 620 project inwardly from the ends of the upper arm portions 617 and 618 and carry cam follower elements 621 and 622 engaged in cam slots 623 and 624 of a cam plate 626 secured to and extending forwardly from the main frame of the carrier vehicle 490. In the illustrated construction, the locations of the vertical axes of turn of the turn control structures 599 and 600 relative to the axes of the grooved and solid wheels in the straight ahead condition and the configuration of the cam slots 623 and 624 are such that the axes of all of the four guide wheels 517, 518, 521 and 522 always intersect at a common vertical turn axis of the carrier vehicle 490, regardless of the angle of turn of the front bogie 495 relative to the main frame of the carrier vehicle 490.

The configuration of the cam slots as shown was determined from assumed coordinates of the cam follower elements relative to the grooved guide wheels 517 and 518 and relationships in a straight ahead condition in which the axes of turn of the structures 599 and 600, indicated by reference numerals 627 and 628 in FIG. 49 are in a line which is midway between the axes of the grooved guide wheels 517 and 518 and the axes of the position control wheels 521 and 522, the latter axis being intersected by the turn axis of the bogie 495 which is indicated by reference numeral 569. The result is that all four wheels 517, 518, 521 and 522 are always in substantially correct tracking relationship to the tracks 501 and 502 and the guide ribs 519 and 520 it being assumed that the tracks and guide ribs have the proper spacings and that any curved portions have common centers of curvature.

The conditions shown in FIG. 49 are such that the angle of turn of the front bogie 495 relative to the main frame of the carrier vehicle 490 is 15 degrees and are such that the diameter of the wheels is 20 inches with the distance between the turn axes of the front and rear bogies being 120 inches, all other dimensions being proportional to what is shown in the drawings. Under such conditions, the turn radius of the carrier vehicle 490, measured from its center, is slightly less than 20 feet, the angle of turn of the control structure 599 from the straight ahead condition is approximately 9.25 degrees and the corresponding angle of turn of the control structure 600 is approximately 7.5 degrees. The angle of turn of the right structure 599 in the illustrated case of a turn to the right is greater than that of the structure 600 since structure 599 is closer to the turn axis of the carrier vehicle 490.

It is noted that for reasons to be discussed hereinafter, the axis of the lower support wheels 501 and 502 is displaced rearwardly from the axis of upper support wheels 505 and 506 of the front bogie 495. In the illustrated arrangement, such axes are displaced rearwardly and forwardly from the axis of the solid guide wheels 521 and 522. As a result, the arrangement does not produce precise tracking of either the lower support wheels 501 and 502 or the upper support wheels 505 and 506. However, the displacements are quite small in relation to the turn radius and produce no substantial adverse effects, even in a minimum radius of turn condition.

It is also noted that the primary function of the grooved turn control wheels is to steer the bogie by applying sufficient torque to rotate the bogie to a position in which the axes of the support wheels and the solid transverse position control wheels are transverse to the direction of travel. When resisting of centrifugal or wind or other transverse forces is necessary, they are resisted primarily by interaction of lower support wheels and guide ribs or, during travel through a Y junction, by interaction of solid guide wheels and guide ribs.

FIG. 50 shows additional features of construction of the front bogie 495 and associated portions of the main frame of the carrier vehicle 490. It shows in side elevation portions of a frame member 630 which is part of a frame structure of the front bogie 495 and which includes the depending portion 561 shown in FIGS. 48 and 49. Frame member 630 also includes forwardly projecting portions 631 and 632 that support the shaft 591 which journals the structure 599 and on which the member 589 is vertically movable. A support bracket 634 for the contact shoe assembly 511 has a forward end portion secured by screws 635 to a forward end portion of the member 630 and by screws 636 to a rearward end portion of the member 630. One end of a flexible cable 638 supported from the frame member 630 has conductors which connect the five illustrated contact shoes of the assembly to terminals in a control unit 640.

The control unit 640 is supported on the outside of a vertical wall portion 641 of another frame member 642 of the front bogie 495 and circuitry therewithin is connected through a cable 643 to an electric drive motor 644 of the front bogie 495, through a cable 645 to a unit on the left side of the bogie 495, through a cable 647 to a brake 648 for the drive motor 644 and through a cable 649 to a traction control motor 650. As hereinafter described, the traction control motor 650 operates through a drive unit 651 to drive a lead screw 652 and to control the force which is exerted by a compression spring 653 to control forces exerted between the lower and upper support wheels 501 and 505 and the lower and upper tracks 503 and 507.

The control unit 640 is also connected through another flexible cable 655 to terminals in a junction box 656 mounted on the side of a top frame member 657 of the carrier vehicle 490. Junction box 656 includes terminals connected through a cable within the post 497 to a receptacle of the pad 500 for connection to circuitry of a body carried by the carrier vehicle 490. Terminals of the box 656 are also connected to terminals of a corresponding junction box for the rear bogie 496 through a cable 658 which extends along the side of the top frame member 657 of the carrier vehicle 490.

The junction box 656 also supports devices which are inductively coupled to transmission lines arranged along the guideway 492, the transmission lines being connected to a series of monitoring and control units disposed along the guideway, for transmission of identification and speed data and to receive speed and other instructions. As described hereinafter in connection with FIGS. 68–75B, such monitoring and control units communicate directly with one another or through section control, region control, and central control units for recording of data regarding activity along the guideway and for receiving instructions.

Figure 51:
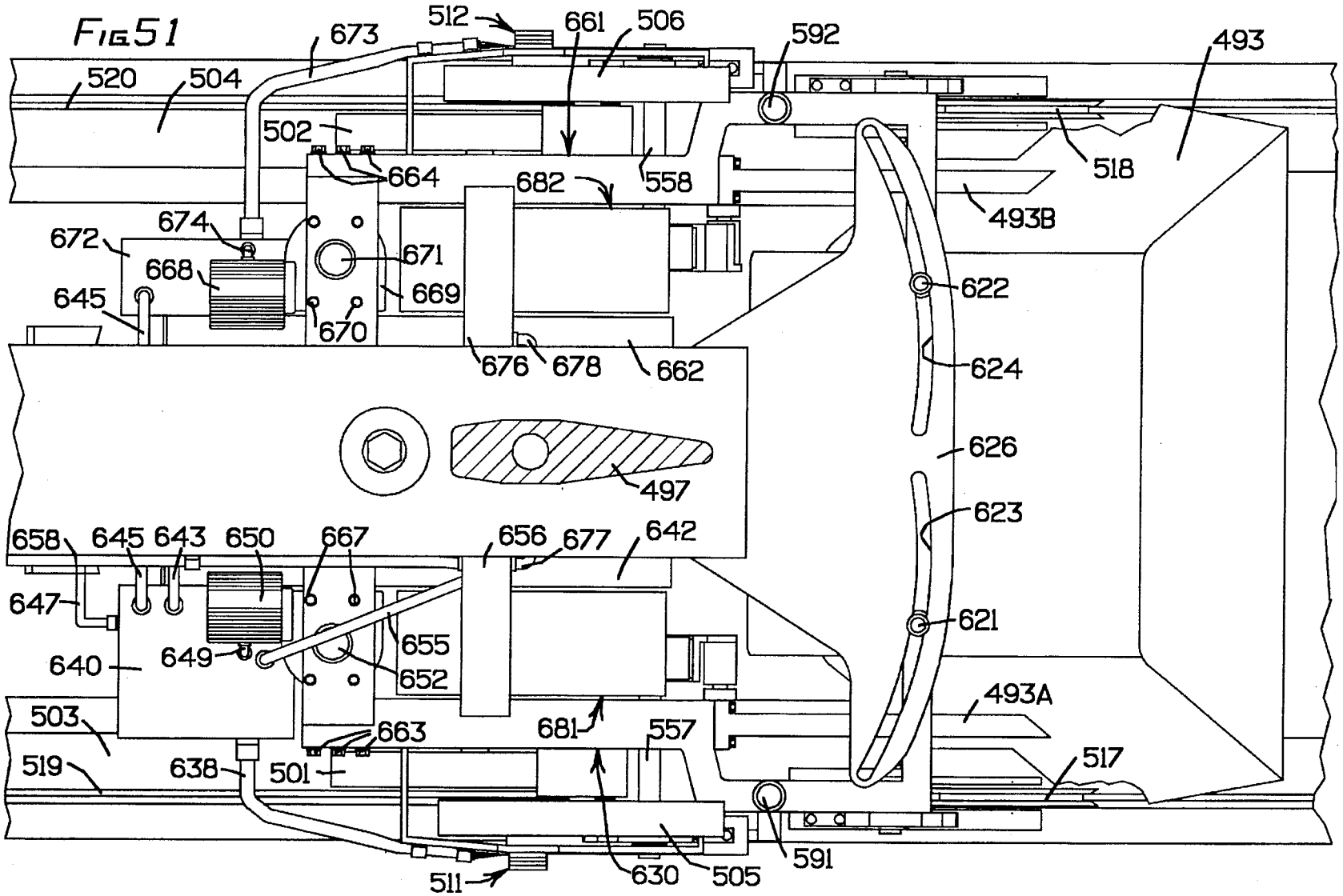
FIG. 51 is a top plan view of the carrier vehicle as shown in FIG. 50.

FIG. 51 is a sectional view taken along line 51—51 of FIG. 50 and providing a top plan view of a front portion of the carrier vehicle 490. The frame structure of the bogie 495 includes the aforementioned frame members 630 and 642, which are on the right side of the bogie 495 when looking forwardly in the direction of travel, and members 661 and 662 on the opposite left side of the bogie which respectively correspond to members 630 and 642. Members 630 and 661 are secured by screws 663 and 664 to opposite ends of a horizontal bar 666 of the frame structure of the bogie 495 and frame members 642 and 630 are secured to the underside of bar 666 by bolts not shown in FIG. 51. The drive unit 651 and control motor 650 of the traction control assembly on the right side are secured under the bar 666 by bolts 667 and a traction control arrangement is provided on the left side including a motor 668 and drive unit 669 secured under the bar 666 by bolts 670. Openings are provided in the bar 666 for the lead screw 652 and for a lead screw 671 of the left hand traction control arrangement.

The cable 645 connects the control unit 640 to an auxiliary control unit 672 which is secured to the outside of a vertical wall of the frame member 662 and which is connected through a cable 673 to the contact shoe assembly 512 and through a cable 674 to the traction control motor 668. A junction box 676 corresponding to the junction box 656 and including inductive coupling devices like those of junction box 656 is preferably provided on the left side of the top frame member 657 of the carrier vehicle 490. Connections are made from the junction box 656 through conductors extending through a conduit elbow 677, through a passage through the frame member 657 and through a second conduit elbow 678 to the junction box 676.

As described in detail hereinafter, the front bogie is supported from the support wheels 501, 502, 505 and 506 through a right gear unit 681 which is supported through bearings therein on shafts secured to the lower and upper right hand support wheels 501 and 505 and through a left gear unit 682 which is supported through bearing therein on shafts secured to the lower and upper right hand support wheels 502 and 506. The left gear unit 681 is disposed between and supports frame members 630 and 642 through bearings which permit limited pivotal movement about a horizontal support axis and the left gear unit 682 is similarly disposed between and supports the frame members 661 and 662 for limited pivotal movement about the same support axis. The compression springs of the traction control assemblies exert torques on the two gear units 681 and 682 to apply forces urging the upper support wheels 505 and 506 upwardly into engagement with the upper tracks 507 and 508 of the guideway 492 while applying forces aiding gravitational forces in urging the lower support wheels 501 and 502 downwardly into engagement with the lower tracks 503 and 504.

Figure 52:
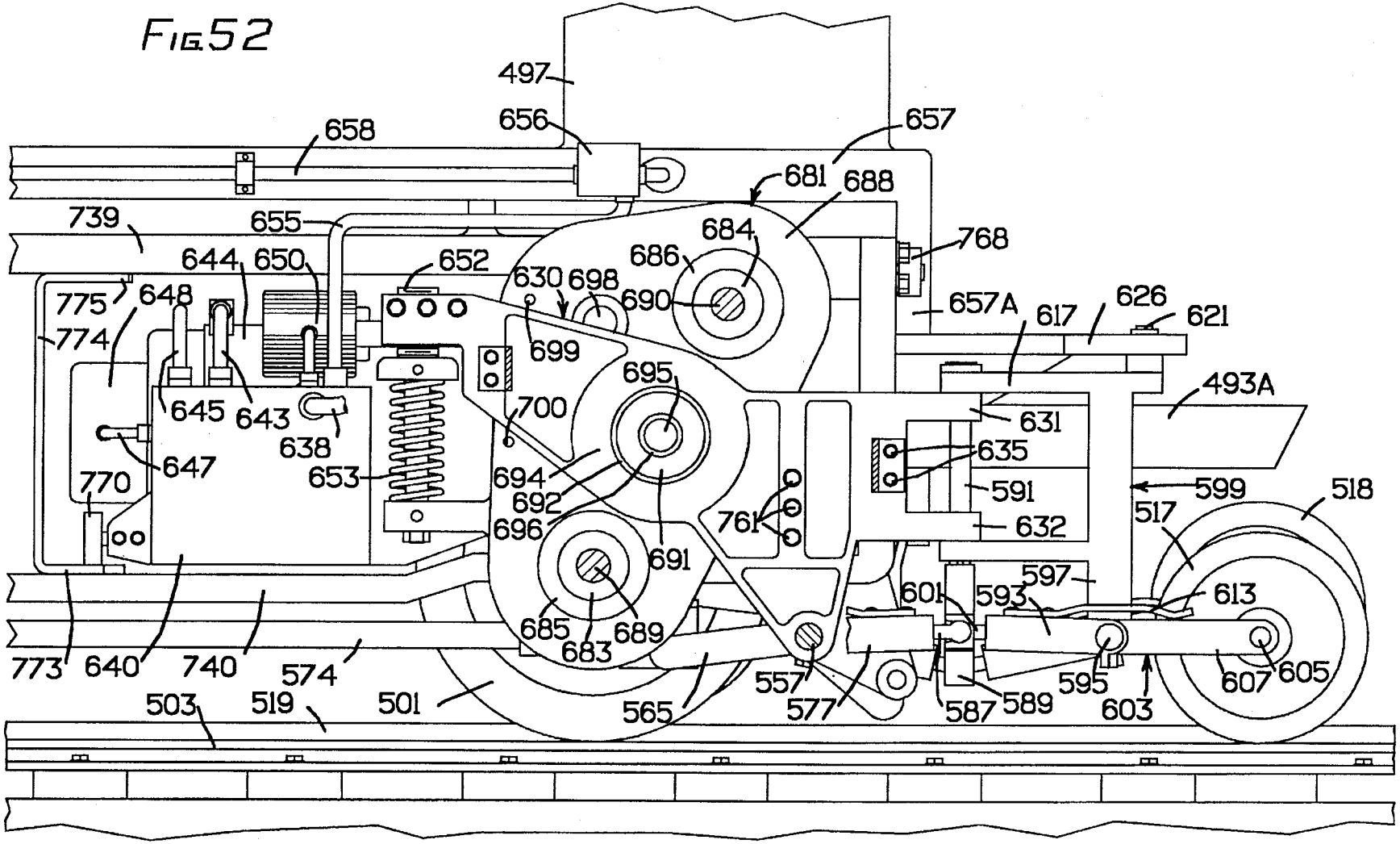
FIG. 52 is a side elevational view similar to FIG. 50 but showing the structure with support wheels on one side removed and with portions of a guide wheel assembly on one side removed.

FIG. 52 shows the construction as shown in FIG. 50 after removal of the lower and upper support wheels 501 and 505 and after removal of the contact shoe assembly 511 and portions of its support bracket 634. The gear unit 681 includes bearings 683 and 684 which are mounted in outwardly projecting portions 685 and 686 of an outer housing member 688 of the gear unit 681 and which journal shafts 689 and 690 for the lower and upper support wheels 501 and 505. Another outwardly projecting portion 691 of the outer housing member 688 is journaled by a sleeve bearing 692 in an opening of a central portion 694 of the frame member 630 of the front bogie 495. The unit 681 is thereby journaled for pivotal movement about a horizontal axis which is midway between the axes of the lower and upper wheel shafts 689 and 690.

A drive shaft 695 is rotatable on the pivot axis of the unit 681 and has an outer end journaled within the portion 691 by a sleeve bearing 696. As hereinafter described, gears within the unit 681 drive the shafts 689 and 690 from the drive shaft drive shaft 695 to rotate at the same angular velocity but in opposite angular directions so that the lower end of the lower drive wheel 501 and the upper end of the upper wheel 505 move in the same direction.

As is shown in FIG. 52, the pivot axis of the unit 681 is midway between the axes of wheel shafts 689 and 690 and is spaced forwardly from the axis of the lower wheel shaft 689 and rearwardly from the axis of the upper shaft 690. When from the weight of the carrier vehicle 490, a downward force is applied at the pivot axis, a torque is applied to the unit 681 tending to rotate the unit 681 in a clockwise direction as viewed in FIG. 52. This torque is opposed by the compression spring 653 which acts downwardly on a portion 698 of the housing of unit 681 to apply a torque acting in a counter-clockwise direction on unit 681 and tending to lift the pivot axis and force the upper wheel 505 into pressure engagement with the upper track 507.

Rotation of the wheel unit 681 in counter-clockwise and clockwise directions is limited by engagement of pins 699 and 700 with upper and lower surfaces of the frame member 630 but the force applied by the spring 653 in normal operation should be such as to maintain substantial pressure engagement between both the lower and upper wheels and the lower and upper tracks. The traction control motors 650 and 668 of the front bogie 495 and corresponding control motors of the rear bogie 496 are controllable as a function of loading of the carrier vehicle 490, to apply a minimal spring force when no body is carried by the carrier vehicle 490 and to apply an additional force proportional to the weight of any body carried by the carrier vehicle 490. The traction control motors 650 and 668 are also controllable as a function of required traction for accelerating and braking and when going up or down steep inclines. In addition, the traction control motors 650 and 688 may be controlled to apply greater forces on one side than on the other, as when going around turns at speeds that are not compensated by any superelevation of the outer track or when strong side wind forces are encountered.

It is noted that primary purpose of the spring 653 is to obtain proper traction and insure safety in movement of the carrier vehicle 490 through guideways, rather than for the usual purpose of springs in rail car and automobile suspensions which is to compensate for unavoidable track and road irregularities. Moreover, it is an objective of the design and construction of guideways of the invention to minimize abrupt changes in levels and slopes and avoid the need for suspension designs comparable to those of the prior art. However, the spring 653 operates to a limited extent in compensating for irregularities in the levels of the upper and lower tracks. For example, an increase in the level of the lower track not accompanied by a corresponding decrease in the level of the upper track will increase the level of the pivot axis by half the increase in level of the lower track.

Figures 53, 54:
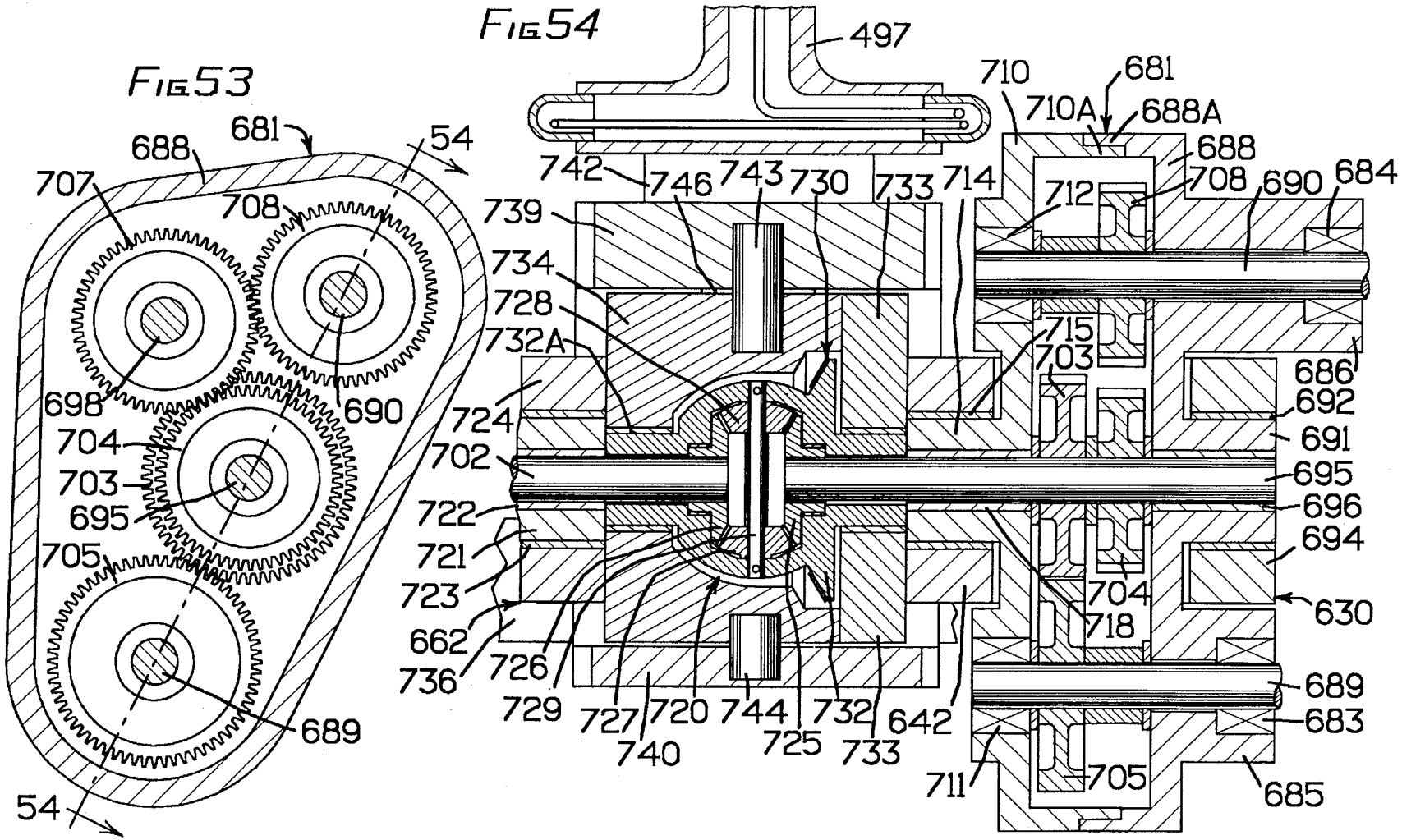
FIG. 53 is an elevational sectional view looking inwardly from inside an outer wall of a housing of a right gear unit of the carrier vehicle.
FIG. 54 is a cross-sectional view, the right hand part being taken substantially along an inclined plane line 54—54 of FIG. 53 and the left hand part being taken along a vertical plane and showing parts of a differential gearing assembly used in driving drive shafts of both right and left gear units.

FIG. 53 is an elevational sectional view looking inwardly from inside an outer wall of the housing of the right gear unit. FIG. 54 is a sectional view, the right hand part being taken along an inclined plane of FIG. 53 along line 54—54, and the left hand part being taken along a vertical plane and showing parts of a differential gearing assembly used in driving the drive shaft 695 of the right gear unit 681 and a drive shaft 702 of the left gear unit 682. Drive shaft 695 carries gears 703 and 704, gear 703 being meshed with a gear 705 on the shaft 689 for the lower wheel 501 and gear 704 being meshed with a reversing gear 707 on the shaft 698 meshed with a gear 708 on the shaft 690 for the upper wheel 505. The shaft 689 for the lower support wheel 501 is thereby rotated in a direction opposite that of the drive shaft 695 while the shaft 690 for the upper support wheel 505 is rotated in the same direction as the drive shaft 695 and upper end of the upper wheel 505 moves in the same direction as the lower end of the lower wheel 501.

An inner housing member 710 has a flange portion 710A which fits within an inwardly extending peripheral flange portion 688A of the outer housing member 688. Inner housing member 710 supports bearings 711 and 712 for the inner ends of the lower and upper wheel support shafts 689 and 690. An inwardly projecting portion 714 of the inner housing member 710 is journaled by a sleeve bearing 715 in an opening in the frame member 642 of the front bogie 495. A sleeve bearing 718 for an intermediate portion of the drive shaft 695 is supported within the portion 714 of the inner housing member 710. The bearings 683, 711 and 684, 712 for the lower and upper support wheel shafts 689 and 690 may preferably be roller bearings and spacer members as shown are provided within the housing of the unit 681, on the drive shaft 695 and on the lower and upper support wheel shafts 689 and 690.

A differential gear assembly generally indicated by reference numeral 720 is provided for driving the drive shafts 695 and 702 of the right and left gear units 681 and 682. The left gear unit 682 has a construction which mirrors that of the right gear unit and only a portion 721 of an inner housing member of the left gear unit 682 is shown in FIG. 54. Portion 721 supports a sleeve bearing 722 for the shaft 702 and is journaled by a sleeve bearing 723 within a central portion 724 of the inner frame member 662 on the left side of the bogie 695.

The differential gear assembly 720 includes a pair of side gears 725 and 726 secured to the inner ends of the shafts 695 and 702 and in mesh with a pair of pinions 727 and 728 on a shaft 729 carried by a differential case member 730. A drive gear 732 drives the case member 730 and may be an integral part thereof as shown. Drive gear is in mesh with a pinion, not shown in FIG. 54, which is driven from the shaft of the drive motor 644.

Drive gear 732 and the case member 730 integral therewith have portions journaled by bearings in members 733 and 734, including bearing 732A in member 734. Members 733 and 734 are secured together to form a housing for the differential gear assembly 720 and which are secured to the frame members 642 and 662 and also to a horizontal bar 736 which forms an additional part of the frame of the bogie 495 and which is secured to the frame member 642 and 662 as well as the frame members 630 and 661.

As previously discussed, the support post 497 for the front pad 500 projects upwardly from a top frame member 657 of the main frame 494 of the carrier vehicle 490. The main frame 494 further includes a base frame and a resilient support between the member 657 and the base frame, the base frame being directly supported from the front and rear bogies 495 and 496 through connections permitting turning movements of the bogies about vertical turn axes. The base frame includes a longitudinally extending upper member 739 in underlying relation to the top frame member 657, a longitudinally extending lower member 740 in spaced relation below the upper member 739 and a vertical forward member 741 connecting the forward ends of the upper and lower members 739 and 740. In the illustrated construction, the resilient support of the top frame member 657 includes a member 742 in the form of a block of elastomeric material.

The housing which is formed by the members 733 and 734 and which encloses the differential gear assembly 720 is disposed between the upper and lower members 739 and 740. To permit turning of the front bogie about a vertical turn axis, a top pin 743 has an upper end portion extending into a hole in the lower surface of the upper member 739 and a lower end extending into a hole in the upper surface of the gear housing member 734 while a bottom pin has an upper end portion extending into a hole in the lower surface of the gear housing member 734 and a lower end extending into a hole in the upper surface of the bottom member 740. A thrust washer 746 is disposed on the top pin 743 between the lower surface of member 739 and the upper surface of member 734.

Figure 55:
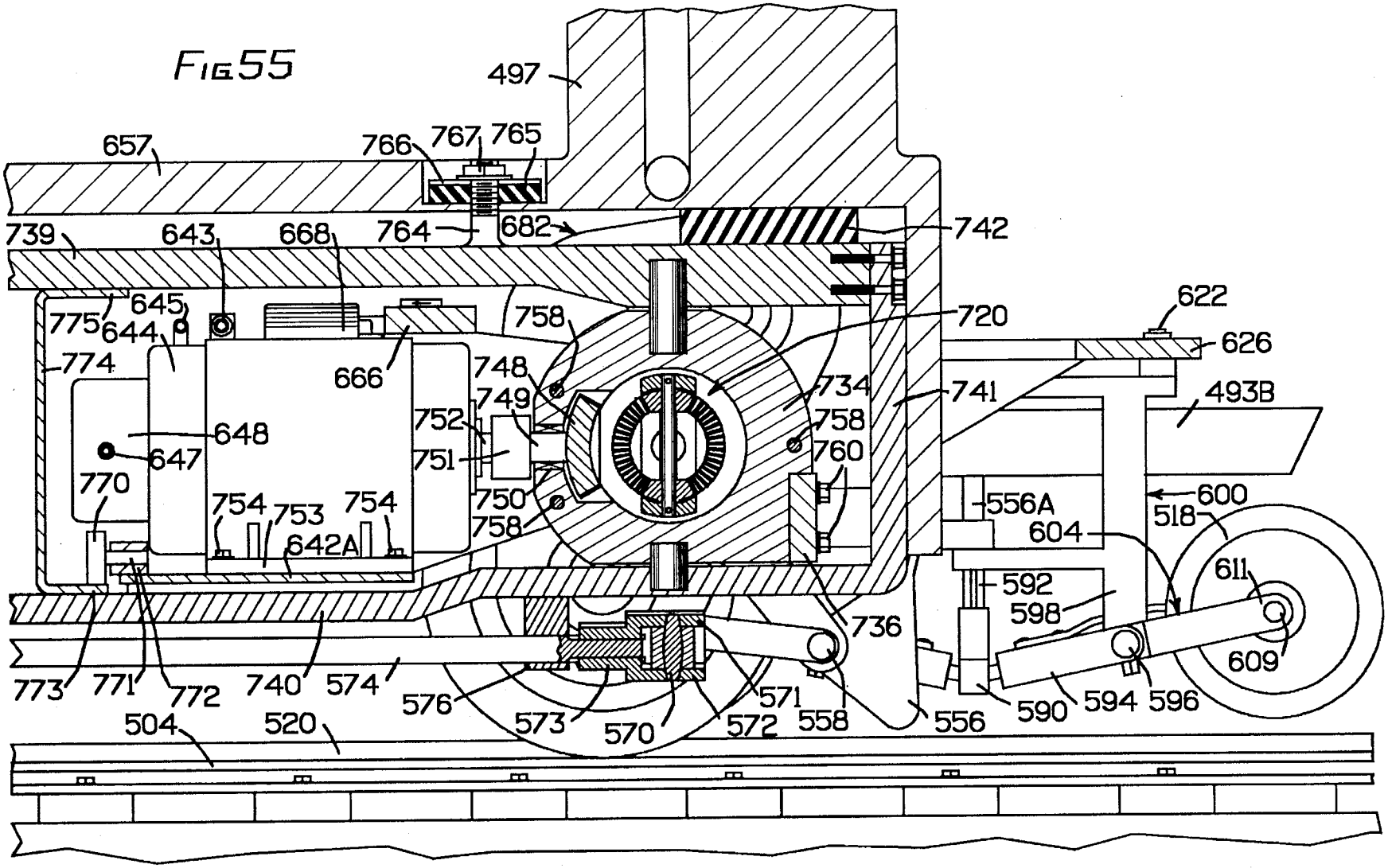
FIG. 55 is an elevational cross-sectional view of the carrier vehicle taken along a central plane.
Figure 56:
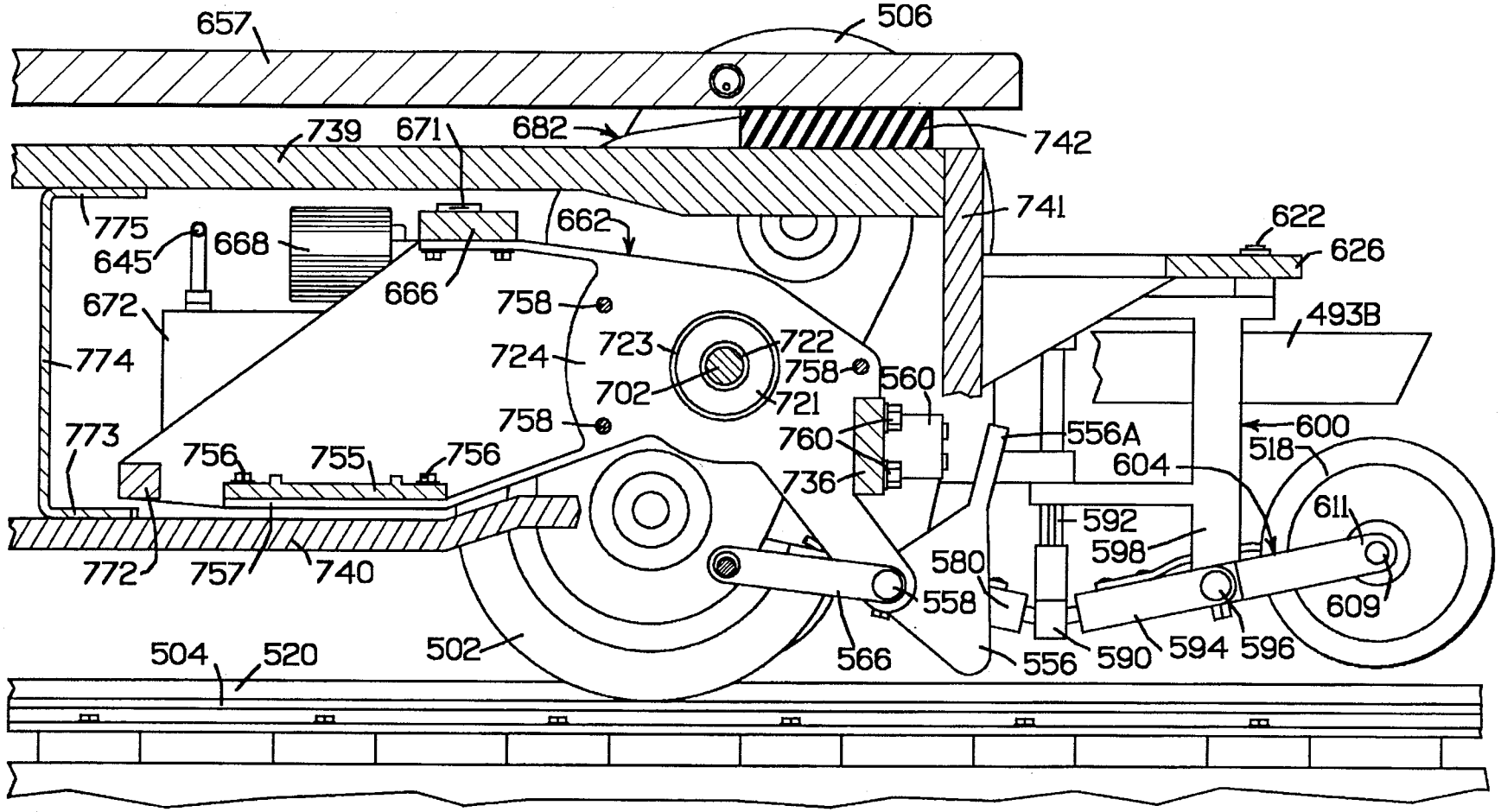
FIG. 56 is an elevational cross-sectional view similar to FIG. 55 but taken along a plane closer to a left side of the vehicle.

FIGS. 55 and 56 show additional features of construction of the front bogie 495. FIG. 55 is an elevational sectional view looking to the left from a central longitudinally extending vertical plane of a front portion of the carrier vehicle 490, the view being taken with the aerodynamic fairing 493 removed. FIG. 56 is a view similar to FIG. 55 but looking to the left from a plane which is generally along the left side of differential gear housing member 734. The motor 644 is shown in full lines in FIG. 55 and only portion of a mounting flange of the motor 644 is shown in cross-section in the showing of FIG. 56.

In FIG. 55, a pinion 748 is shown within the differential gear housing member 734 and on a shaft 749 which is journaled in an opening of the member 734 by a bearing 750 and which is coupled through a coupling 751 to the shaft 752 of the motor 644. A flange 753 on the right side of a housing of the motor 644 is secured as by bolts 754 to an inwardly extending flange 642A of the frame member 642 and a flange 755 (FIG. 56). on the left side of the motor housing is secured by bolts 756 to an inwardly extending flange 757 of the frame member 662.

The members 733 and 734 which form the differential gear housing are secured in place between the frame members 642 and 662 by through three bolts 758, shank portions of which are shown in FIGS. 55 and 56. Three pairs of bolts 760 are provided to secure portions of the horizontal frame bar 736 to the frame members 642 and 662 and the differential gear housing member 734, one pair being shown in FIG. 55, and another pair being shown in FIG. 56. As is shown in FIG. 52, three bolts 761 secure the frame member 630 to the right end of the horizontal frame bar 736 and similar bolts, not shown, secure the member 661 to the opposite left end of the horizontal frame bar 736.

As is shown in FIG. 55, the forward member 741 of the base frame is formed integrally with the lower member 740 and its upper end is secured by bolts to the forward end of the upper member 739. FIG. 55 also shows the resilient block member 742 in cross-section and a connection between the top member 657 of the frame 494 and the upper member 739 of the base frame to resiliently limit upward movement of the top frame member. The connection includes a stud bolt 764 secured to the upper frame member 739 and extending upwardly through an opening in the member 657 and through resilient and solid washers 765 and 766, a nut 767 being threaded on the upper end of the bolt 764.

To resiliently limit canting movement of the top frame member 657 relative to the base frame, member 657 has an integral portion 657A which extends downwardly from the forward end thereof along the forward surface of the forward member 741. As shown in the front elevational view of FIG. 45, the portion 657A extends between an upper and lower pairs of rollers 768. Rollers 768 are journaled on the member 741 for rotation about horizontal axes perpendicular to the vertical face of the member 741 and each roller has a solid tire of a resilient elastomeric material, the rollers thereby providing a resilient limit on canting movement while allowing vertical movement to be limited by the resilient block 742 and the connection which includes stud bolt 764.

A roller 770, shown in FIG. 55, is preferably provided for using the base frame of the carrier vehicle 490 to bear the weight of the relatively heavy motor 644. Roller 770 is journaled on a shaft 771 which is carried at the center of a horizontal bar 772 having opposite ends secured to walls of the frame members 646 and 662. During rotation of the front bogie about its turn axis, the roller 770 rides on a lower flange 773 of a vertical strut member 774, lower flange 773 being secured to the lower frame member 740 and an upper flange 775 of strut member 774 being secured to the upper frame member 739.

Figure 57:
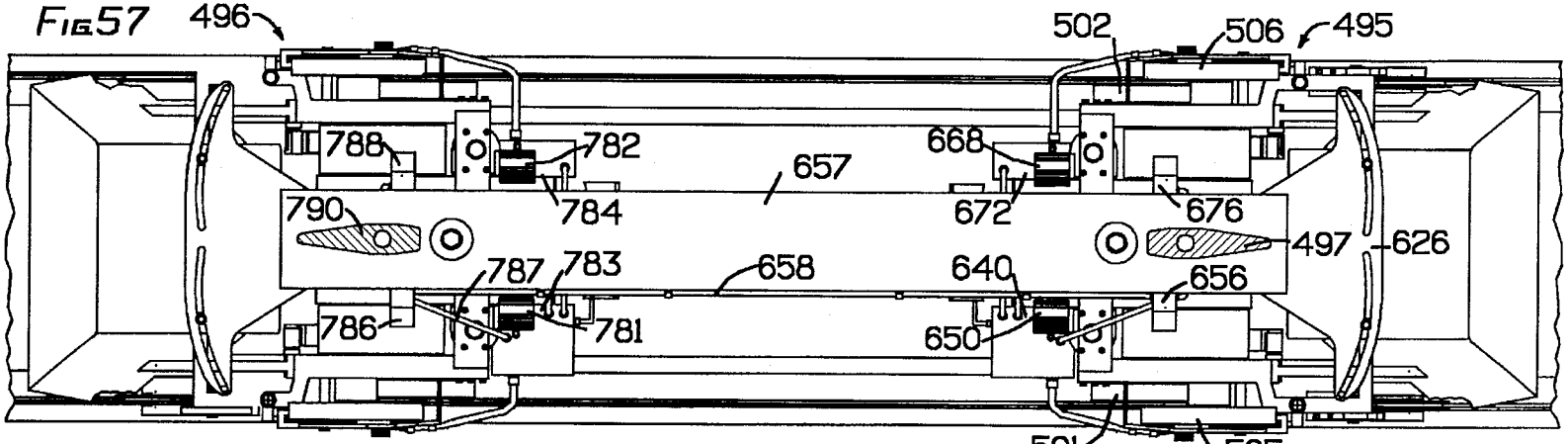
FIG. 57 is a view with side structures of a guideway removed and looking downwardly from a level below pads of a carrier vehicle to otherwise provide a substantially complete top plan view thereof.
Figure 58:
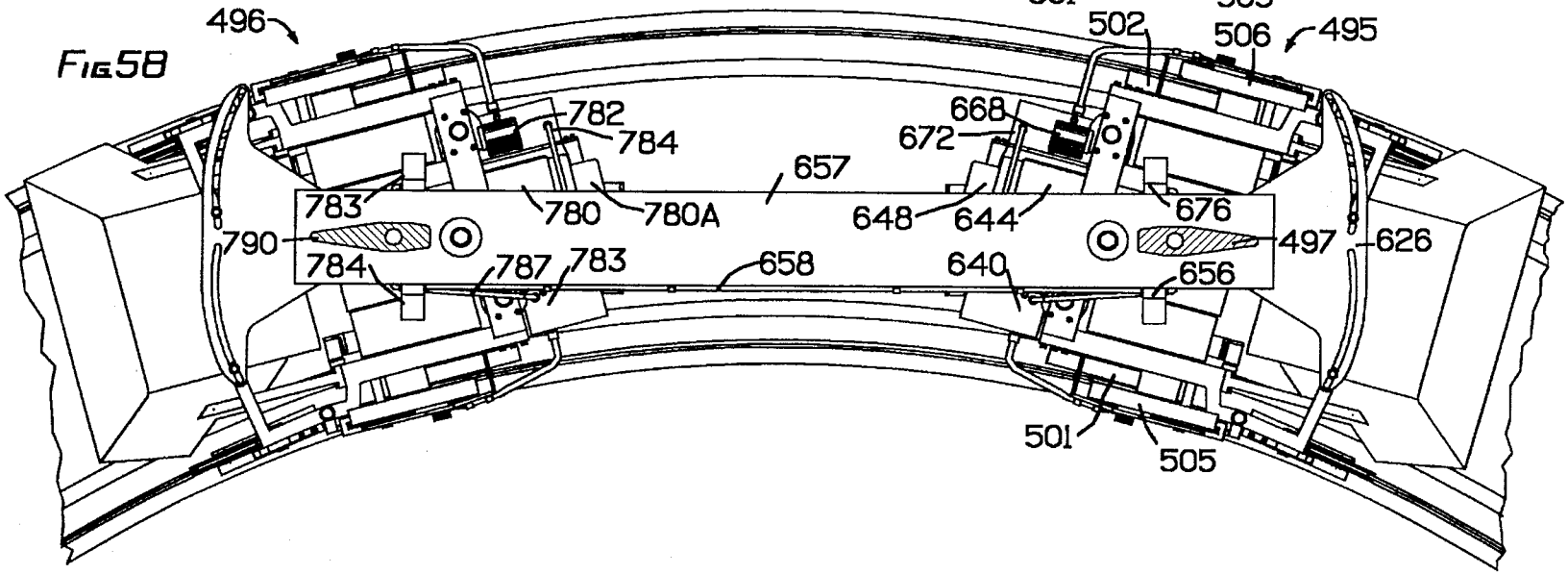
FIG. 58 is a view like FIG. 57 but showing the vehicle in a condition for moving around a turn of short radius.

FIGS. 57 and 58 are views with side structures of the guideway removed and looking downwardly at the carrier vehicle 490 from a level below the pads thereof, otherwise providing complete top plan views of the carrier vehicle 490. In FIG. 57 the carrier vehicle 490 is shown in a condition for travel straight ahead and in FIG. 58 the carrier vehicle 490 is shown in a condition for travel around a turn having a radius of, approximately 20 feet. As shown, the rear bogie 496 has a construction which mirrors that of the front bogie 495 so that the grooved guide wheels of the rear bogie trail the support and solid guide wheels. The rear bogie 496 includes a drive motor 780 and an associated brake 780A which correspond to the drive motor 644 and brake 648 of the front bogie 495. Motor 780 is coupled through gearing assemblies like those of the front bogie 495 to lower and upper wheels which correspond to the wheels 501, 502, 505 and 506. The rear bogie also includes traction control motors 781 and 782 corresponding to traction control motors 650 and 668, also control units 783 and 784 which correspond to control units 640 and 668 of the front bogie 695.

In normal operation, drive and braking torques may be applied to all eight wheels of the carrier vehicle 490. A mechanical or electrical failure in the drive and braking operation in only one of the two bogies will not prevent safe operation of the carrier vehicle 490.

The cable 658 connects the junction box 656 to a rear junction box 786 which is connected through a cable 787 to the control unit 783 and which is also connected to a junction box 788 on the opposite side of the carrier vehicle 490. It is not essential but for redundant and more reliable operation, junction boxes 786 and 788 may desirably include transceivers duplicating those of junction boxes 656 and 676.

A post 790 corresponding to the front post 497 is shown in cross-section at the rear end of the top member 657 of the carrier vehicle 490 in a position to underlie a rear pad corresponding to the front pad 500. The illustrated posts 497 and 790 are elongated for the purpose of obtaining increased strength against bending from transverse forces applied to a body being carried while minimizing the required width of the slot in the guideway, it being desirable that the guideway slot be as narrow as possible to minimize downward flow of precipitation, dust and other extraneous matter therethrough. The illustrated posts are tapered toward the front and rear ends thereof, for the purpose of obtaining sufficient clearance while minimizing the required width of the slot in the turn portion of the guideway shown in FIG. 58. The slot in the guideway may preferably be narrower in the straight line portion of the guideway 492 and wider in bending portions thereof.

FIGS. 59–63 show the construction of a guideway of the invention. As discussed hereinabove, the guideway is constructed in sections, the construction of each section being such as to facilitate operation in a manner such as to obviate any substantial abrupt change in direction of a vehicle travelling as it enters the section, moves along the section and leaves the section, thereby obtaining very smooth movement of passengers and freight, minimizing fatigue and extending the life of parts of the guideway and vehicle and improving reliability and safety. The one variable that might interfere with such smooth movement is the movement of earth under any column which supports the ends of adjacent sections. To obviate this possibility adjustable support means are provided along the guideway and are arranged for ready access from a maintenance vehicle movable along either side of the guideway.

Figure 59:
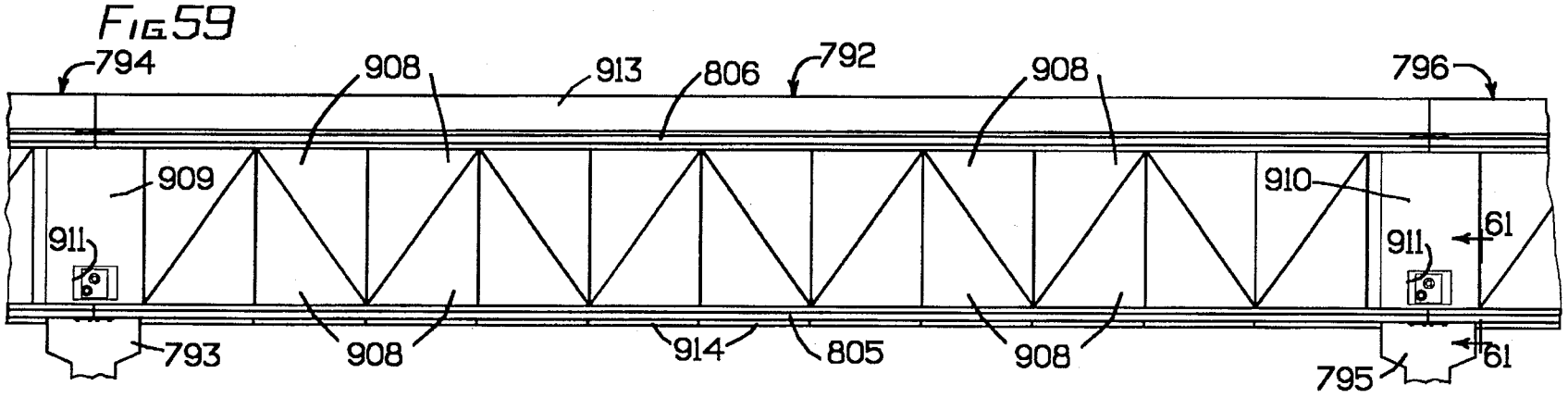
FIG. 59 is a side elevational view of a portion of a guideway supported on two support columns.
Figure 60:
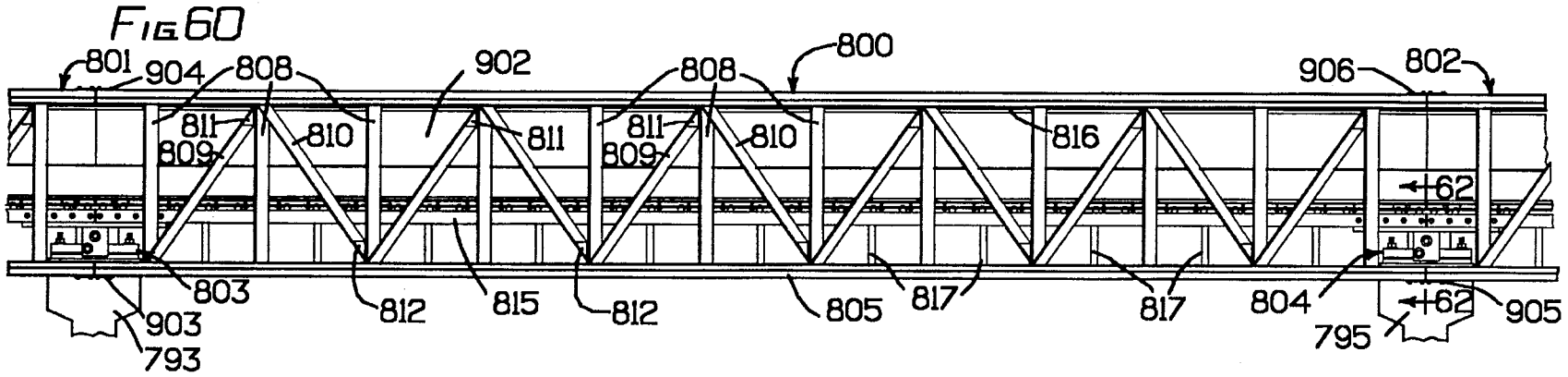
FIG. 60 is a side elevational view similar to FIG. 59 but showing the appearance of the guideway prior to installation of top, side and bottom panels to illustrate the construction of a truss structure.
Figure 61:
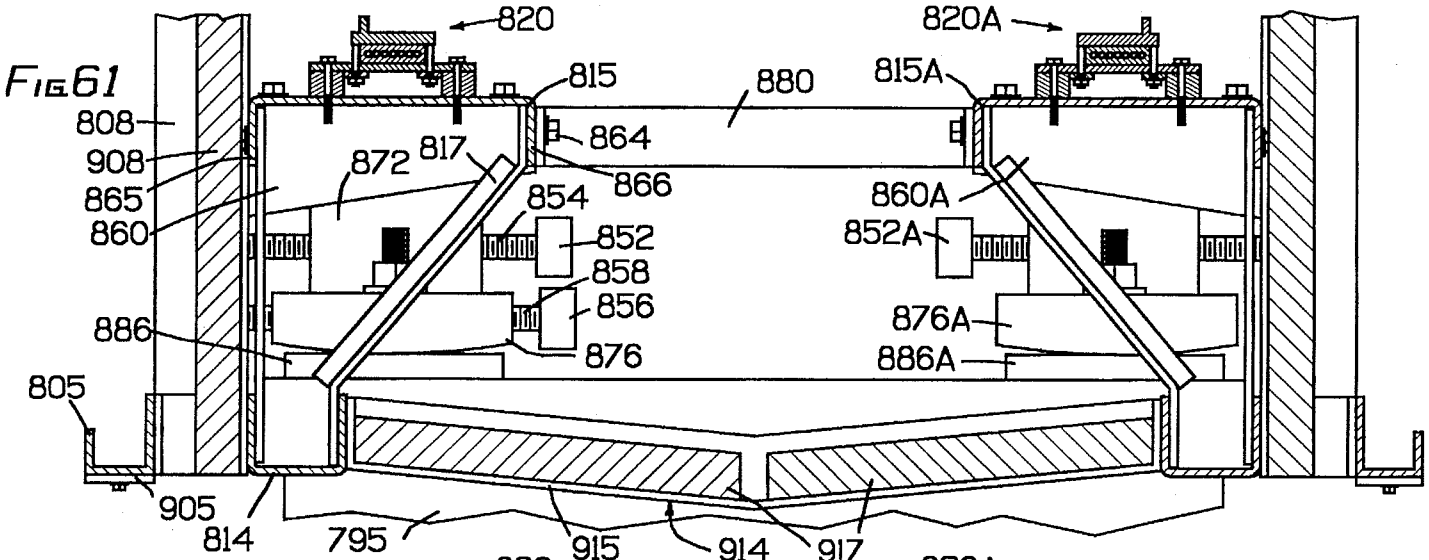
FIG. 61 is a cross-sectional view taken substantially along line 61—61 of FIG. 59.
Figure 62:
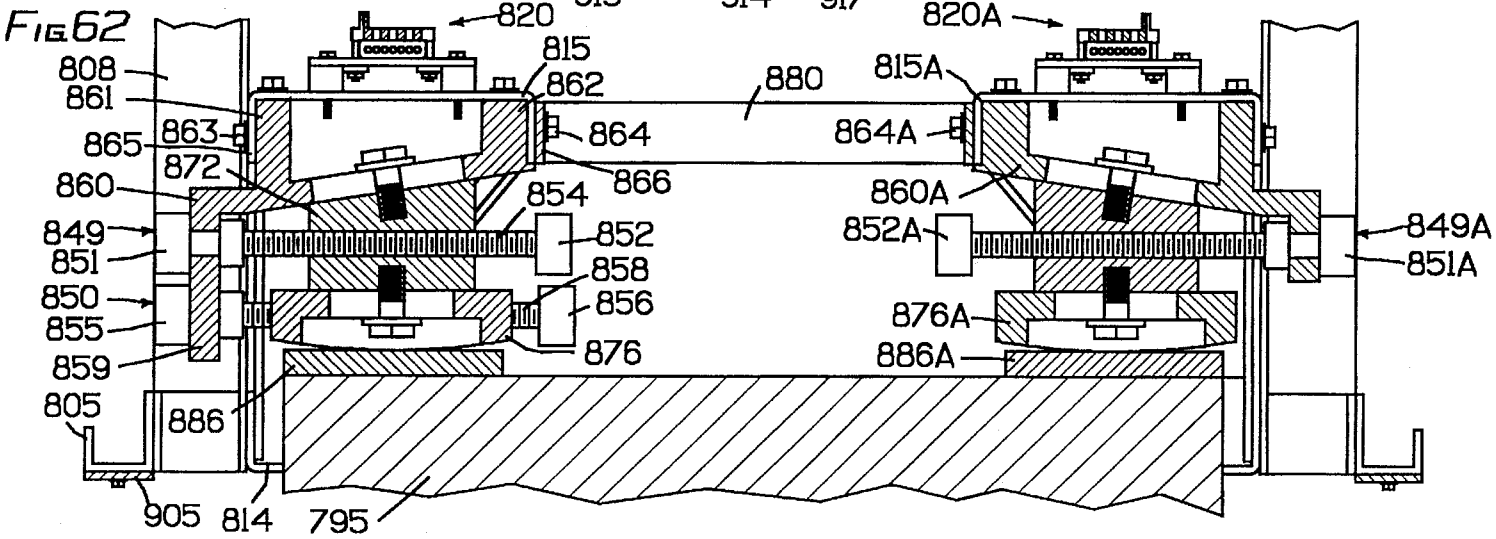
FIG. 62 is a cross-sectional view taken substantially along line 62—62 of FIG. 60.
Figure 63:
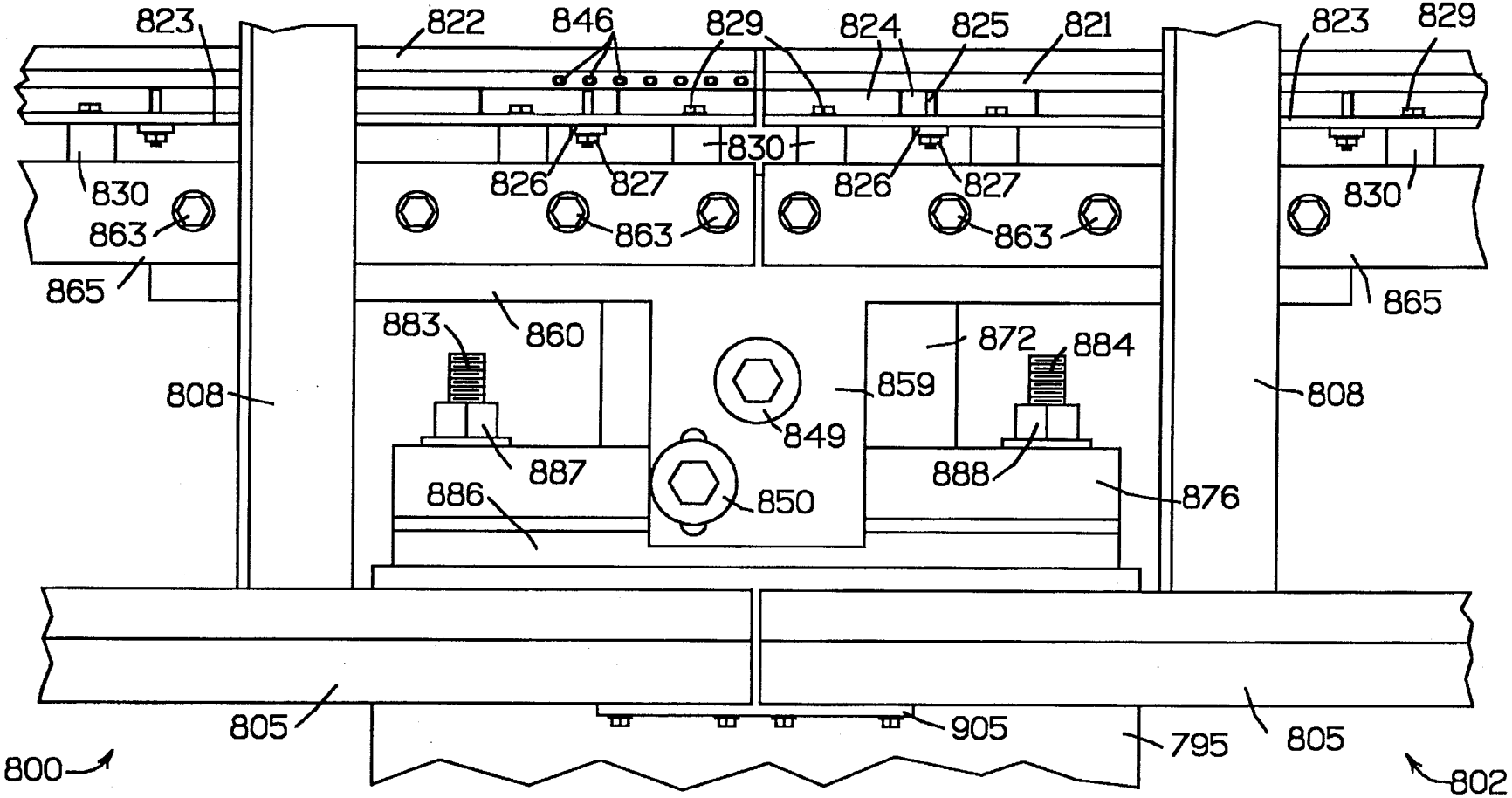
FIG. 63 is a side elevational view corresponding to a portion of FIG. 60 but on an enlarged scale to show features of construction of a connection and adjustable support assembly.
Figure 65:
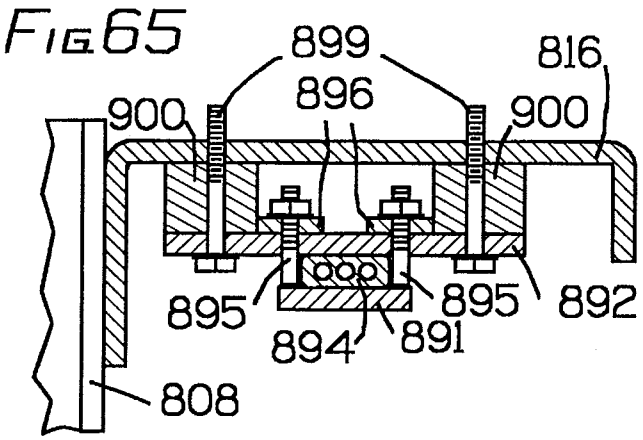
FIG. 65 is a sectional view showing an upper track structure.
Figure 64:
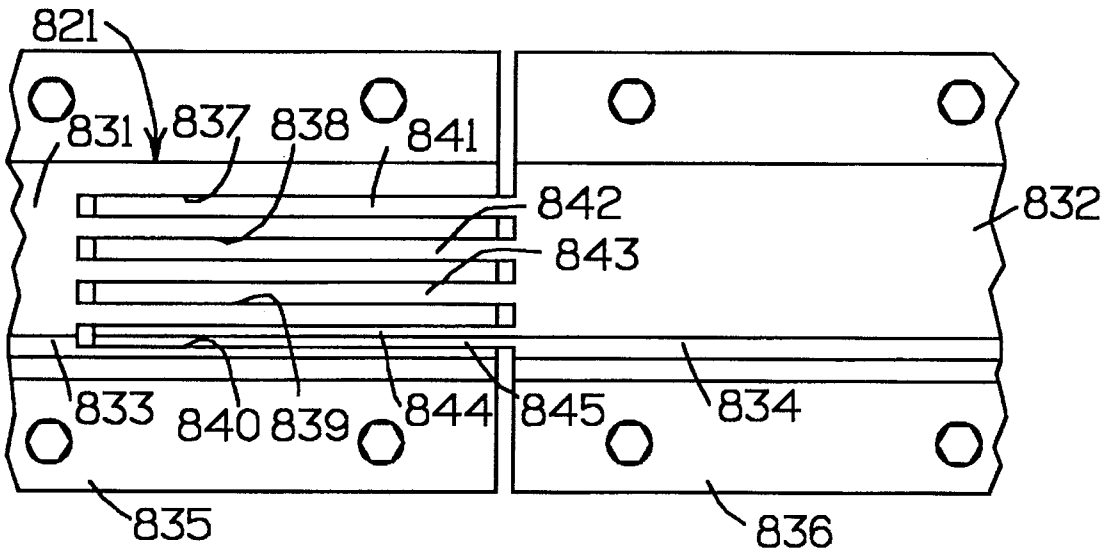
FIG. 64 is a top plan view of a portion of the structure shown in FIG. 63.

FIG. 59 is a side elevational view of a portion of a guideway supported on two support columns, and FIG. 60 is a side elevational view similar to FIG. 59 but showing the appearance of the guideway prior to installation of top, side and bottom panels to illustrate the construction of a truss structure. FIG. 61 is a sectional view taken along line 61—61 of FIG. 59 and FIG. 62 is a sectional view taken along in 62—62 of FIG. 60. FIG. 63 is a side elevational view corresponding to a portion of FIG. 60 but on an enlarged scale to show features of construction of the connection and adjustable support assembly 804, and FIG. 64 is a top plan view of a portion of the structure shown in FIG. 63. FIG. 65 is a sectional view showing an upper track structure.

In FIG. 59, one end of a section 792 of the guideway 492 is shown supported on an upper end portion of a column 793 which also supports an end portion of an adjacent section 794, the other end of section 792 being shown supported on an upper end of a second column 795 which also supports an end portion of another section 796 adjacent thereto. The section 792 is constructed by first constructing a pair of truss structures of modular form, FIG. 60 showing in side elevation a truss structure 800 for one side of the section 792 and portions of truss structures 801 and 802 of similar modular form for one side of the section 794 and one side of the section 796. The truss structures for the opposite side mirror those of the structures 800–802. In the sectional views of FIGS. 61 and 62, corresponding parts are indicated by the same reference numbers with "A" appended thereto.

An assembly 803 connects the adjacent ends of truss structures 800 and 801 and provides a support from the column 793 which can be readily adjusted to accommodate changes in the level or transverse position of the upper end of the column 793. At the opposite end of structure 800, an assembly 804 performs similar connection and adjustable support functions with respect to the adjacent ends of truss structures 800 and 802 and the column 795.

The truss structure 800 includes a lower longitudinally extending frame member 805 having an upwardly open generally channel shaped cross-sectional configuration, an upper longitudinally extending frame member 806 having a downwardly open generally channel shaped cross-sectional configuration, a series of vertical post members 808 extending between inner sides of the lower and upper members 805 and 806, and first and second series of angle members 809 and 810. Each of the post members 808 and each of the members 807–810 has an L-shaped cross-sectional configuration. Flanges at the lower ends of the first series of angle members 809 are welded or otherwise secured against flanges of the lower ends of alternate ones of the post members 808 and flanges at the upper ends thereof are secured through brackets 811 to the upper ends of the remaining ones of the post members 808. Similarly, flanges at the upper ends of the second series of angle members 810 are welded or otherwise secured against flanges of the upper ends of the said alternate ones of the post members 808 and flanges at the lower ends of the angle members 810 are secured through brackets 812 to the lower ends of remaining ones of the post members 808.

Figure 62A:
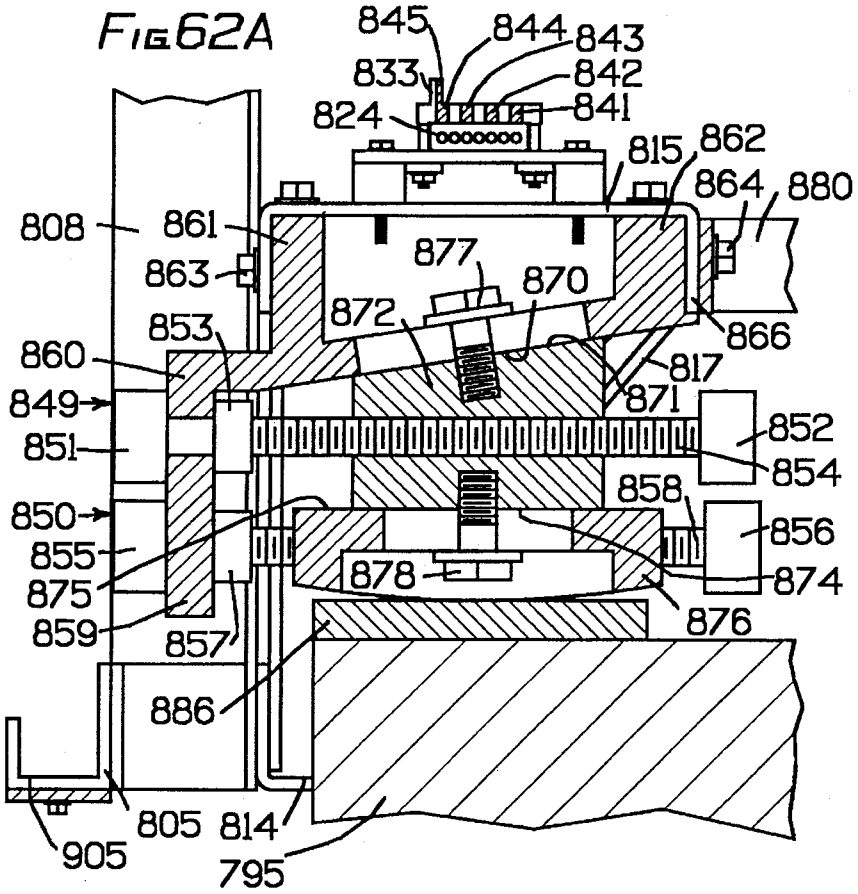
FIGS. 61A and 62A respectively correspond to portions of FIGS. 61 and 62 on an enlarged scale.
Figure 61A:
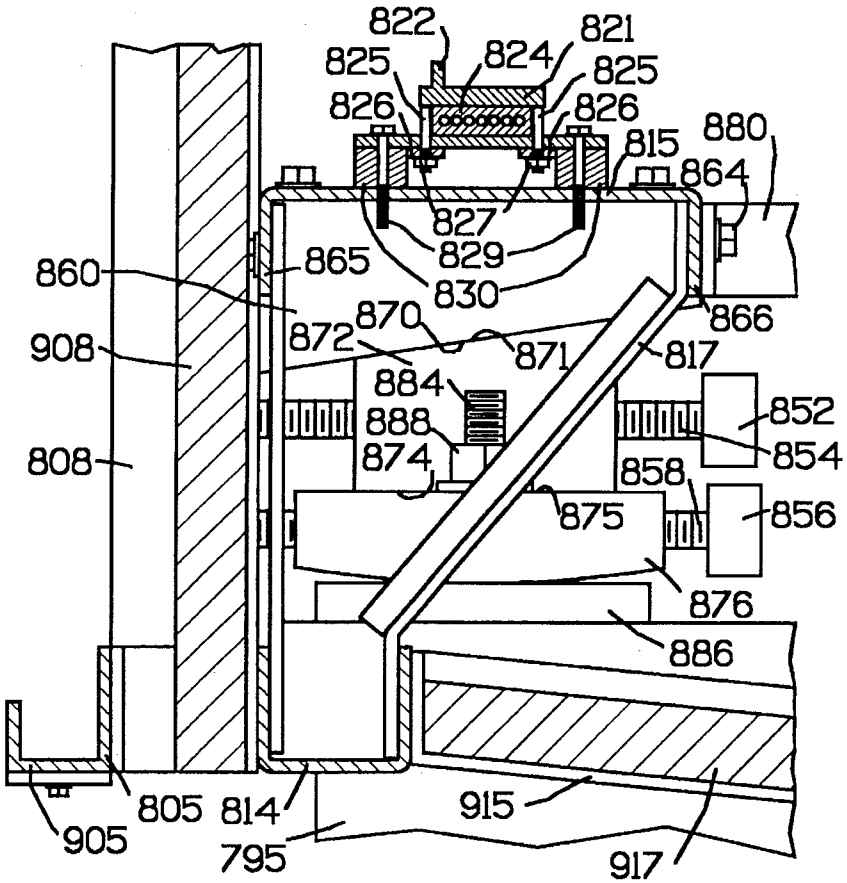

The truss structures have identical constructions and, in the cross-sectional views of FIGS. 61 and 62, certain parts of the structures are identified by the same reference numerals. Each truss structure includes a lower channel shaped member 814, that of structure 802 being shown in cross-section in FIGS. 61 and 61A and that of structure 800 being shown in full lines in FIGS. 62 and 62A. Each member 814 is welded or otherwise secured at spaced points to inside surfaces at the lower ends of the vertical post members 808. In addition, lower and upper longitudinally extending track supporting members 815 and 816 are provided, each having a downwardly open channel shaped cross-sectional configuration. Spaced portions of an outer flange of the upper track supporting member 816 are welded or otherwise secured against inside surfaces at the upper ends of the vertical post members 808. Spaced portions of an outer flange of the lower track supporting member 815 are welded or otherwise secured to the vertical post members 808 and the angular brace members 808–810 at a level which is substantially above the level of the members 805 and 814. A series of angular struts 817 are provided each extending angularly upwardly and inwardly from each member 814 to points on the outside of an inner flange of the lower track supporting member 815. Certain of such struts 817 are located midway between the vertical post members 808 as shown in FIG. 60. Additional struts may be located behind the vertical post members 808 so as not to be seen in FIG. 60.

A lower track structure 820 includes a track member 821 which forms a section of the track 503 and which has a longitudinally extending rib 822 forming a section of the guide rib 519. The track member is supported through a first means of resilient form from an intermediate means which is supported through second means of more rigid form from the truss structure and, in accordance with the invention, the characteristics of both such first and second means may be adjusted to obtain optimum performance, the objective being to obtain a value that is zero, or that is otherwise a constant, as to the rate of change of any acceleration in a vertical or horizontal direction transverse to the direction of movement of a vehicle.

A plate 823 which functions as an intermediate support means is provided in underlying relation to the track member 821 which is supported therefrom through a first means formed by series of resilient blocks 824. A series of stud bolts 825 are secured along opposite sides of track member 821 and extend downwardly through openings in the plate 823 and through resilient washers 826 with nuts 827 being threaded on the lower ends of bolts 825 to limit transverse and upward movements of the track member 821 relative to the plate 823.

To form a second means between the intermediate means formed by the plate 823 and the frame structure, the plate is connected to the lower track supporting member 815 of the frame structure through a series of bolts 829 which extend downwardly through openings along opposite sides of the plate 823 and thence through spacer members 830 to lower ends which are threaded into openings in the track supporting member 815. The openings in member 815 for bolts 829 extend along straight lines for a section of straight track but extend along curved lines for a section of curved track. The spacer members 830 are not normally of uniform thickness but have thicknesses which vary along the length of the section and which may be different on opposite sides of the section. They may vary to obtain a desired profile of change in elevation along the length of the section and desired difference in elevation from one side to the other. The thickness of the spacer members 830 is also normally varied along the length of the section to compensate for changes in the level of the support member 815, including changes resulting from static stresses of members of the truss structure 800 caused by gravitational forces on the truss structure.

In any case, a path is defined by the member 823 which in a static condition, i.e. in the absence Of a vehicle on the guideway section, should be either a straight line path or a curved path which is such as to obtain a value which is zero or which is otherwise a constant as to any acceleration of a vehicle moving along the section that is attributable to a deviation the curved path from a straight line path.

In the presence of a vehicle on the guideway, the aforementioned path defined by the member 823 is displaced from a straight line path or from a desired curved line path as a result of the weight of the vehicle, and by varying the spacing or resiliency or otherwise changing the characteristics of the blocks along the length of the section, it is possible to compensate for such displacement from the path obtained under static conditions. Thus the resilient blocks 824 do not normally provide a support of uniform flexibility but provide a flexibility which is varied along the length of the section to provide dynamic compensation for deflections which result from positioning and movement of the carrier vehicle 490 along the section. The flexibility of the support provided by the blocks 824 is determined by factors including the spacing and effective modulus of elasticity of the blocks 824 and is generally at a maximum in end regions close to the support columns 793 and 795.

Maximum deflection of the tracks structure relative to the support member is thereby obtained in regions where the deflection of the truss structure under the load of the carrier vehicle 490 is at a minimum. In regions between the end regions there may be a substantial deflection of the truss structure under load. In such regions, the flexibility of the support provided by the blocks 824 is decreased to decrease deflection of the tracks relative to the support member in proportion to the deflection of the truss structure under the load of the carrier vehicle 490 and to thereby guide the carrier vehicle 490 in movement along a desired path. Such downward deflection of the truss structure under the load of the carrier vehicle 490 is not instantaneous and is delayed by the inertia of the truss structure so that the point of maximum downward deflection of the truss structure 800 is not at the midpoint of the section but is offset therefrom in the direction of travel of the carrier vehicle 490. To take this phenomena into account, the point of minimum flexibility provided by the blocks 824 is offset in the direction of travel from the midpoint of the section as a function of the expected speed of travel and the weight, distribution of weight and effective section modulus in the truss structure.

FIG. 64 shows a junction of end portions of adjacent track members which includes tines extending longitudinally from an end of one track member and fitted into slots in the other track member, a series of transverse locking pins being provided to lock together the tines of the one track member and the portions of the other member between the slots therein. This arrangement provides substantially continuous support for vehicles passing over the junction, but the locking pins extend through slots in one of the members to permit a certain amount of relative movement which may be encountered during assembly or due to thermal expansions and contractions.

FIG. 64 shows one end portion 831 of the track member 821 and an adjacent end portion 832 of a track member which is identical to the track member 821. A guide rib 833 is provided on the track member end portion 831 which forms a continuation of the aforementioned guide rib 822 and a similar guide rib 834 is provided on the track member end portion 832. The illustrated track member end portions 831 and 832 are supported on and secured to an end portion 835 of plate 823 and an end portion 836 of an adjacent plate identical to plate 823, using the bolts 829. The illustrated end portion 831 is formed with slots 837, 838, 839 and 840 extend longitudinally from the terminal end of the end portion 831 and which receive tines 841, 842, 843 and 844 projecting from the end of the end portion 832. Tine 844 includes a guide rib portion 845 which forms a continuation of the guide rib portion 834 of the track member end portion 832. After assembly of track members to place the tines 841 in the slots 837–840, a series of pins 846 (FIG. 63) are driven through a series of longitudinally spaced and transversely aligned holes in the tines 841–844 to extend through a series of longitudinally spaced and longitudinally extending slots in parts of the slotted end portion 831 that have the slots 837–840 therebetween. With this arrangement, a substantially continuous support surface is provided for wheels of the carrier vehicle 490 while also providing an expansion joint which permits relative longitudinal movement of the track members which have the end portions illustrated in FIGS. 63 and 64. A nearly continuous guide rib structure is also provided, the maximum distance between the terminal end of the guide rib portion 845 and the end of the rib 833 being quite small in relation to the size of the guide wheels.

The connection and adjustable support assembly 804 is illustrated in the sectional views of FIGS. 61 and 62 and in the side elevational view of FIG. 63. It includes a vertical adjustment member 849 usable for adjusting the position of adjacent end portions of the truss structures 800 and 802 relative to the top of the column 794 in a vertical direction and a transverse adjustment member 850 usable for adjusting the position of the adjacent end portions of the truss structures 800 and 802 in a transverse horizontal direction relative to the top of the column 794.

The vertical adjustment member 849 has head portions 851 and 852 at opposite outer and inner ends thereof, a collar portion 853 spaced inwardly from the outer head portion 851 and a threaded portion 854 between the collar portion 853 and the inner head portion 852. Similarly, the transverse adjustment member 850 has head portions 855 and 856 at opposite outer and inner ends thereof, a collar portion 857 spaced inwardly from the outer head portion 855 and a threaded portion 858 between the collar portion 857 and the inner head portion 856. The head portions 851, 852, 855 and 856 all have hexagonal sockets for receiving hexagonal ends of adjustment tools, an elongated tool being usable from an opposite side of the guideway to engage the sockets of the inner heads 852 and 856.

Shank portions of adjustment members 849 and 850 between the head portions 851 and 855 and collar portions 853 and 857 extend through openings in a downwardly extending portion 859 of a support member 860. The opening through which the shank portion of member 850 extends is elongated in a vertical direction to allow relative vertical movement of member 860 and lead screw member 850.

The support member 860 includes upwardly extending portions 861 and 862 secured by two series of bolts 863 and 864 to the inside and outside of outer and inner downwardly extending flange portions 865 and 866 of the lower track support member 815 of adjacent truss structures.

For vertical adjustment, the support member 860 has a lower inclined surface 870 which is slidably engaged with an upper inclined surface 871 of a wedge member 872 through which the threaded portion 854 of vertical adjustment member 849 extends, rotation of member 849 being effective to move the wedge member 872 horizontally to thereby adjust the vertical position of the support member 862. For horizontal adjustment, the wedge member 872 has a lower horizontal surface 874 slidably engaged with an upper horizontal surface 875 of a member 876 which is supported from the column 876 and through which the threaded portion 858 of transverse adjustment member 850 extends, rotation of member 850 being thereby effective to adjust the horizontal position of member 862. Bolts 877 and 878 have shank portions extending through slots in the support member 860 and in the member 876 and have end portions threaded into openings in the upper and lower surfaces of the wedge member 872 to allow relative sliding engagement of surfaces 870 and 871 and relative sliding engagement of surfaces 874 and 875 while preventing relative movements in directions perpendicular to such surfaces.

A connection and adjustable support assembly 804A is provided at the opposite side of the guideway which has a construction mirroring that of the assembly 804 differing in that no transverse adjustment member is provided which corresponds to the member 850. A connection member 880 has one end connected by one of the bolts 864 to the support member 860 and opposite end secured by a corresponding bolt 864A to a corresponding support member 860A of the assembly 804A so that when lead screw 850 is rotated, the positions of both the support members 860 and 860A are adjusted horizontally at the same time. The vertical position of the support member 860A is adjustable independently of the that of the support member 860 through rotation of a vertical adjustment member 849A which has an inner head portion 852A with a socket engageable by the end of an elongated tool inserted from the left side of the guideway. To make adjustments from the right side of the guideway, the end of a tool is engageable in a socket of an outer head portion 851A of member 849A and is engageable with sockets in the inner head portions 852 and 856 of the lead screw members 849 and 850.

The member 876 of the assembly 804 is secured to the column 795 by means of a pair of stud bolts 883 and 884 extending upwardly from the column and through openings in a spacer plate 886, nuts 887 and 888 being threaded on the bolts 883 and 884. A corresponding member 876A of the assembly 804A is similarly secured to the column 794 through a similar pair of stud bolts extended through a corresponding spacer plate 886A. Openings for such stud bolts which are provided in the member 876 and the corresponding member 876A of the assembly 804A are relatively large and, as shown in FIGS. 61 and 62, the lower surfaces of the members 876 and 876A which are engaged with the spacer plates 886 and 886A have cylindrically convex contours to allow for limited rocking movements about horizontal longitudinally extending axes as may be required when there are different vertical levels of the support members 860 or 860A. Spacer plates 886 and 886A may have different thicknesses, particularly for guiding a vehicle in turns where a large superelevation of one track is required relative to the other. Either or both of the spacer plates may also be removed and replaced by plates of different thicknesses in cases where a necessary vertical adjustment cannot be accomplished by rotation of either of the lead screws 849 or 849A. A suitable grease is applied to the surfaces of the wedge members during construction and at periodic maintenance times to prevent rust from forming and locking up the adjustable assemblies.

FIG. 65 shows an upper track structure 890 which includes a track member 891 forming a section of the track 505. Member 891 is supported from an overlying plate 892 through a series of resilient blocks 894 and has a series of stud bolts 895 secured along opposite sides thereof and extending upwardly through openings in the plate 892 and through resilient washers 896 with nuts 897 being threaded on the upper ends of bolts 895 to limit transverse and downward movements of the track member 891 relative to the plate 892.

The plate 889 is connected to the upper track supporting member 816 through a series of bolts 899 which extend upwardly through openings along opposite sides of the plate 889 and thence through spacer members 900 to lower ends which are threaded into openings in the upper track supporting member 816. The track member 891 has a construction similar to that for the lower track structure as illustrated in FIG. 64, being provided slots in one end portion and tines projecting from an opposite end portion, for mating with tines and slots of track members of adjacent sections.

It is also noted that conductor assemblies 513 and 514 are provided by providing a conductor assembly 902 of modular form which is mounted on the inside of the post and angle members 808–810 of truss structure 800 as shown in FIG. 60 and a similar assembly is mounted on the opposite side, each of such modular conductor assemblies having conductors with opposite end portions which mate with conductors of adjacent sections to provide substantially continuous surface for engagement by contact shoes while allowing for expansion and for facilitating assembly.

In constructing a guideway, surveys are performed to determine a desired path of travel of a vehicle, the required positions of connections of sections of the guideway to one another and the exact contours of the track structures in each section. The truss structure modules for each section are then constructed after taking such contours and speed and other variables into account and making a determination of the locations of mounting holes and required thicknesses and characteristics of spacer and resilient block elements. Instructions are also issued for erection of supporting columns to place the tops thereof at the proper positions and elevations.

Next, the modules are installed on the columns after first installing connection and adjustable support assemblies such as the assemblies 804 and 804A, bolts such as bolts 865 and 866 being installed to secure lower track support members such as members 815 and 815' to support members such as member 860. Lower track sections are then interconnected through installation of pins such as pins 846 and upper track sections and conductors of conductor modules of are interconnected in a similar fashion. As shown in FIGS. 59 and 60, a pair of lower and upper connecting plates 903 and 904 are installed to connect end portions of the lower and upper members 805 and 806 at one end of the truss structure 800 to adjacent lower and upper members of the adjacent truss structure 801 and another pair of lower and upper connecting plates 905 and 906 are installed at the opposite end of the truss structure 800 to connect end portions of the lower and upper members 805 and 806 to adjacent lower and upper members of the truss structure 802. Next, any necessary fine adjustments of the connection and adjustable support assemblies are performed to accurately position the track structures.

In a final assembly operation, triangularly shaped side panels 908 are installed in the triangularly shaped regions between the vertical post members 808 and the angle members 809 and 810 and rectangular panels 909 and 910 are installed in the region of the connect and adjustable positioning assemblies 803 and 804, such rectangular panels 909 and 910 having openings 911 and 912 which provide access to sockets in the ends of lead screw members such as members 849 and 850 and 849A. Also, a series of top sections 913 and a series of bottom sections 914 are installed on the truss structures. As is shown in FIG. 61, each bottom section 914 includes a member 915 having opposite ends secured to the members 814 and 814A. Each bottom section 914 also includes members 917 each of which is primarily of a material which is highly absorptive with respect acoustic energy, but which includes a metallic layer or screen on its underside to provide electromagnetic shielding.

In constructing the side panels 908–910 and the top section 913, as well as in constructing the bottom section 914, materials are used which absorb acoustic energy developed in the interior of the guideway during movement of the carrier vehicle 490 therethrough and which minimize entry of precipitation and extraneous materials. The outside surfaces of the panels 908–910 and top section 913 are preferably in the form of layer of a metallic material, or layers of fine mesh screens of metallic material are otherwise included, for the purpose of providing electromagnetic shielding to minimize detection from the outside of signals generated within the guideway and to minimize transmission into the guideway of externally generated signals which might adversely affect the control of movement of the carrier vehicle 490.

Before the final assembly operation is performed, a carrier vehicle 490 is preferably moved through the guideway to test for possible inaccuracies in the support of the track structures which might be corrected by adjustments such as adjustments of the size of spacer members or other elements along the guideway. After producing satisfactory results in tests and any necessary retest, the final assembly operation is then performed.

Once installed, the guideway is tested periodically to determine any deviation from a path for smooth travel and the source of any such deviation. If the problem is with a particular truss structure, steps may be taken for correction, either by adjustment of the thickness of the spacer members 830 or by adjustment of the spacing of resilient members 824 along the length of the section. Once proper adjustments along every section are accomplished, they are not likely to recur and the most likely cause of any problem will be due to uneven settling of the supporting columns, whereupon the required compensation can be effected through the adjustment members 849, 850, 849A and 850A.

Figure 66:
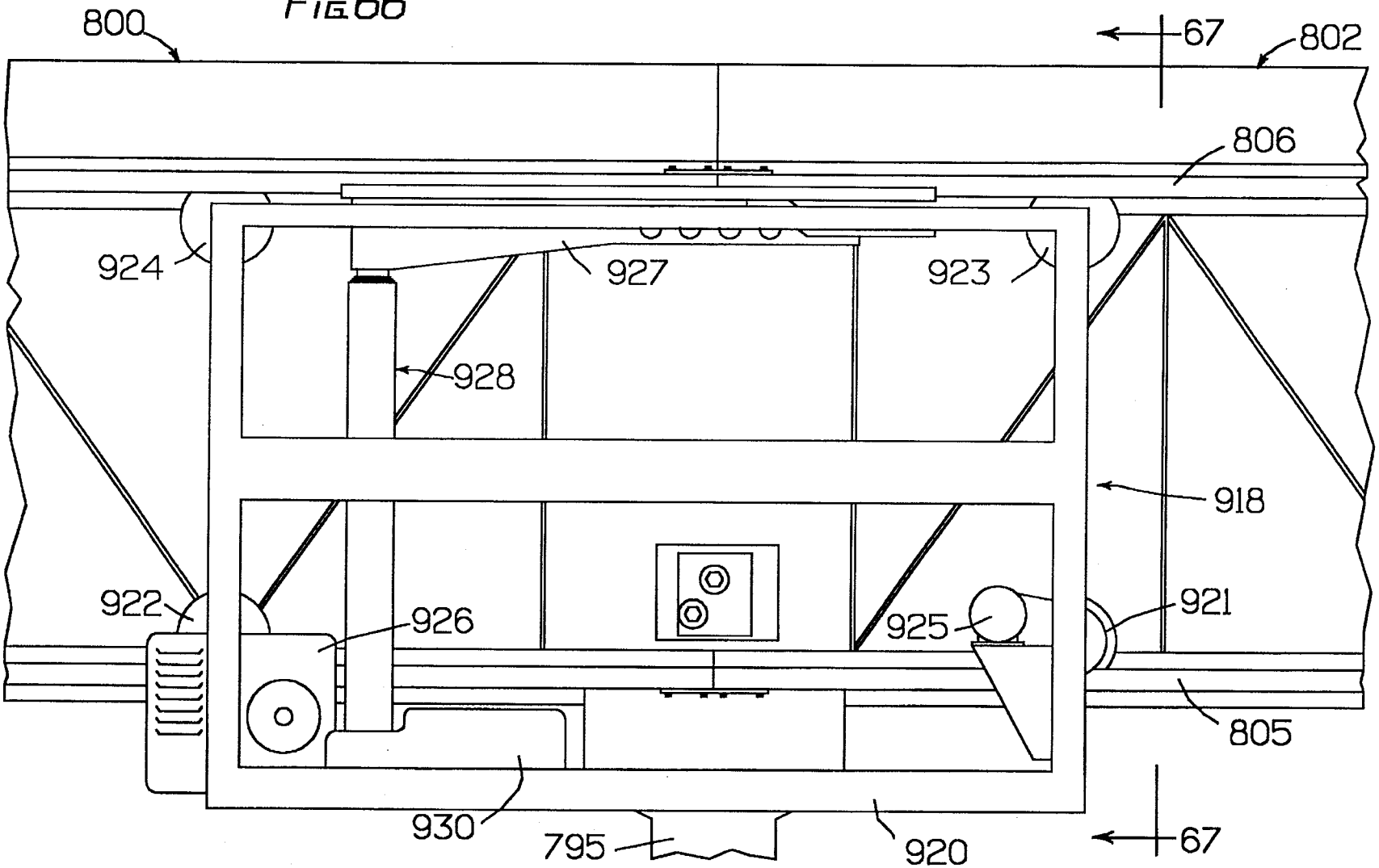
FIG. 66 is a side elevational view showing a servicing vehicle on one side of a guideway.
Figure 67:
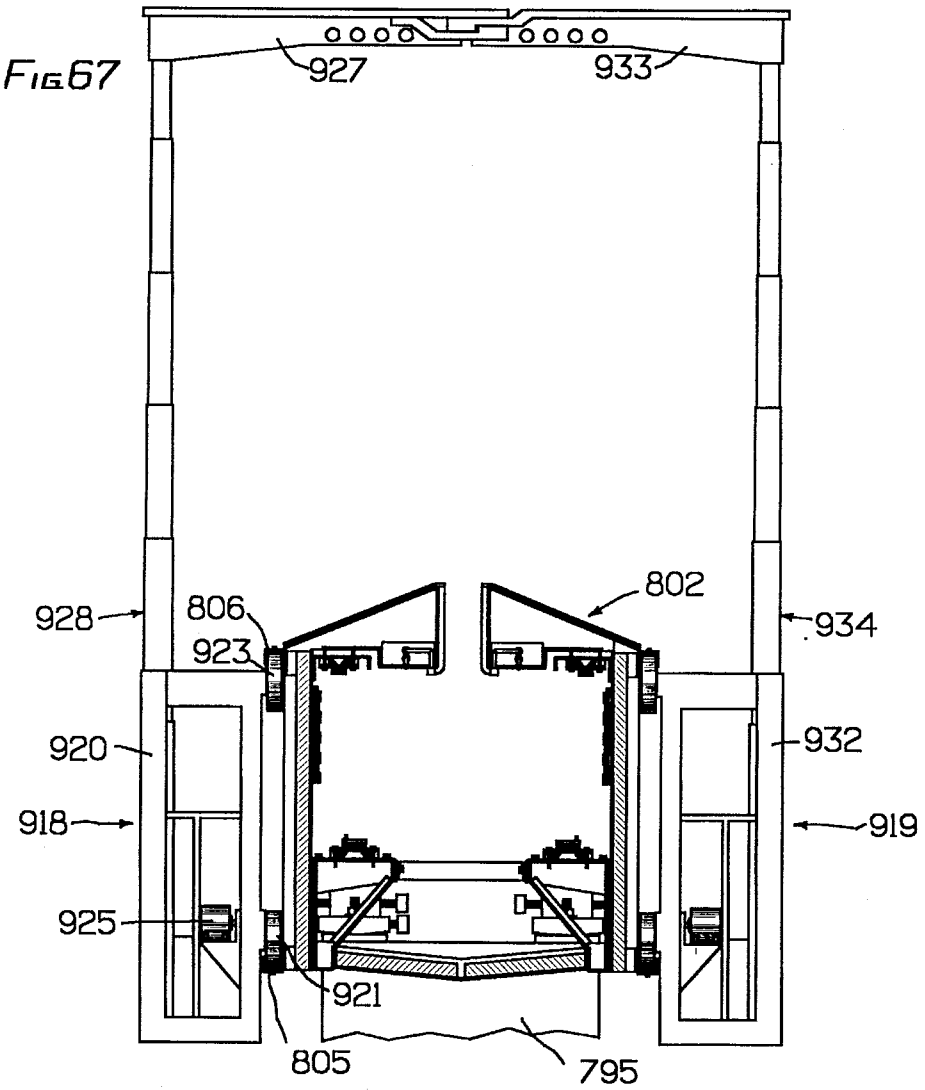
FIG. 67 is a sectional view taken along line 67—67 of FIG. 66 and showing an optional second servicing vehicle positioned on an opposite side of the guideway, having a reduced scale to show upwardly extended conditions of lifting devices of both servicing vehicles.

FIG. 66 is a side elevational view showing a servicing vehicle 918 on one side of the guideway 492, along the junction between guideway sections 792 and 794 shown in FIG. 59, and FIG. 67 is a sectional view taken along line 67—67 of FIG. 66 and showing an optional second servicing vehicle 919 positioned on the opposite side of the guideway. FIG. 67 has a reduced scale to show upwardly extended conditions of lifting devices of both servicing vehicles.

The servicing vehicle 918 includes a frame structure 920 supported from the guideway by two lower wheels 921 and 922 the lower ends of which are engaged in the lower upwardly open channel-shaped frame member 805 and by two upper wheels 923 and 924 the upper ends of which are engaged in the upper downwardly open channel-shaped frame member 806. For positioning the vehicle 918 at any desired position along a guideway, the wheel 921 is driven from an electric motor 925 which is supplied with power from a gasoline-fueled generator unit 926. For handling of heavier objects, a lift device is provided by a boom 927 which is supported at the upper end of a hydraulic lift 928 and which is adjustably rotatable about a vertical axis. Lift 928 is formed by a series of telescoping cylinders as shown and is supplied with fluid by a control unit 930 which is also supplied with power from the unit 926.

For many servicing operations, only one servicing vehicle is required, as for example, when it is desired to adjust supports such as the supports shown in FIGS. 61 and 62 on opposite sides of a guideway, sockets in head portions of the lead screw members on either side of the guideway being accessible from the other side. However, as shown in FIG. 67, the servicing vehicle 919 is optionally positionable on the opposite side of the guideway and includes a frame structure 932, a boom 933 and a lift 934 and has a construction which mirrors that of the vehicle 918 except that to obtain greater strength for handling of heavier objects, the end of the boom 933 is configured to interlock with the end of the boom 927 when the booms are rotated to positions as shown and with the lifts 928 and 934 positioned opposite each other. Suitable hoist devices may be connected to the booms 927 and 933 for lifting and handling bodies or portions of the guideway or a carrier vehicle, as may be required to perform servicing operations.

Figure 68:
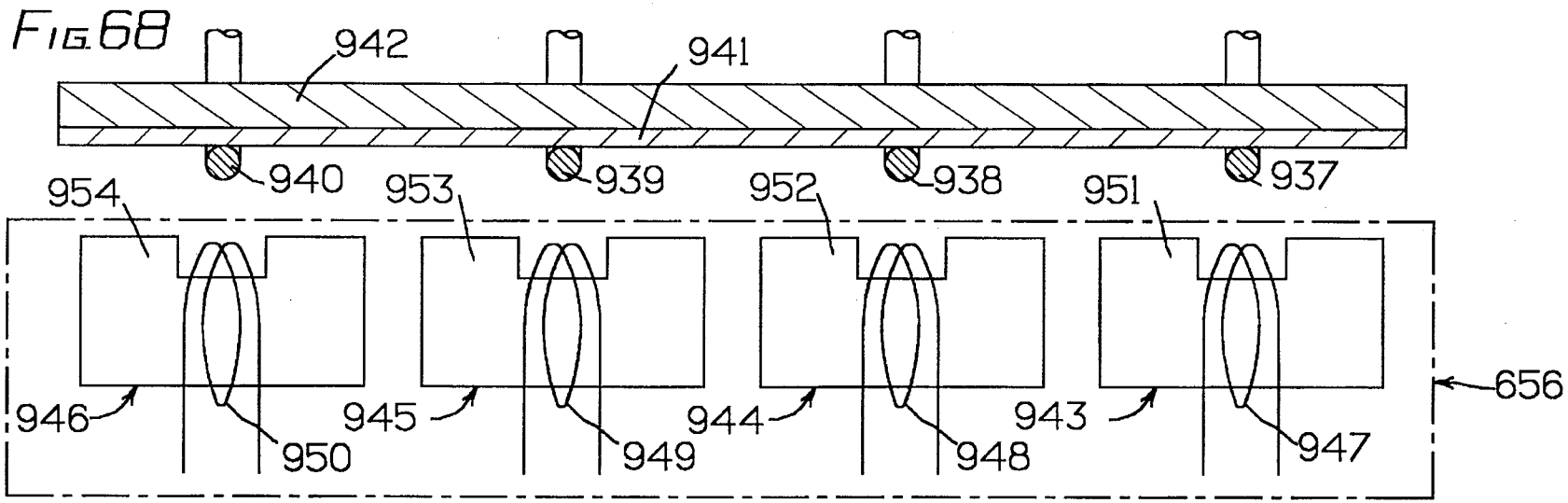
FIG. 68 diagrammatically illustrates the construction of inductive coupling devices of the guideway and of the carrier vehicle, operative in wireless transmission of data between the carrier vehicle and monitoring and control units along the guideway.

FIG. 68 diagrammatically illustrates the construction of inductive coupling devices of the guideway 492 and of the carrier vehicle 490, operative in wireless transmission of data between the carrier vehicle 490 and monitoring and control units along the guideway 492. Four conductors 937, 938, 939 and 940 are supported from the top structure of the guideway 492 to extend longitudinally therealong, on the underside of a layer 941 of insulating dielectric material which is secured on the underside of a conductive plate 942, the conductors 937–940 cooperating with layer 941 and the conductive plate 942 to provide four transmission lines, each having a characteristic impedance determined by the diameter of the conductor and the thickness and dielectric constant of the layer 941.

The junction box 656 of the carrier vehicle 490 is indicated diagrammatically by broken lines and it supports four inductive coupling devices 943–946 that are formed by coils 947–950 on cores 951–954 of a low loss and high permeability magnetic material each having ends in spaced facing relation to the plate 942 and on opposite sides of a vertical plane through an associated one of the conductors 937–940. The coils 947–950 are thereby inductively coupled to portions of the conductors 937–940 so that through transformer action, signals that are applied to either the coils or the conductors will develop corresponding signals in the other.

Figure 69:
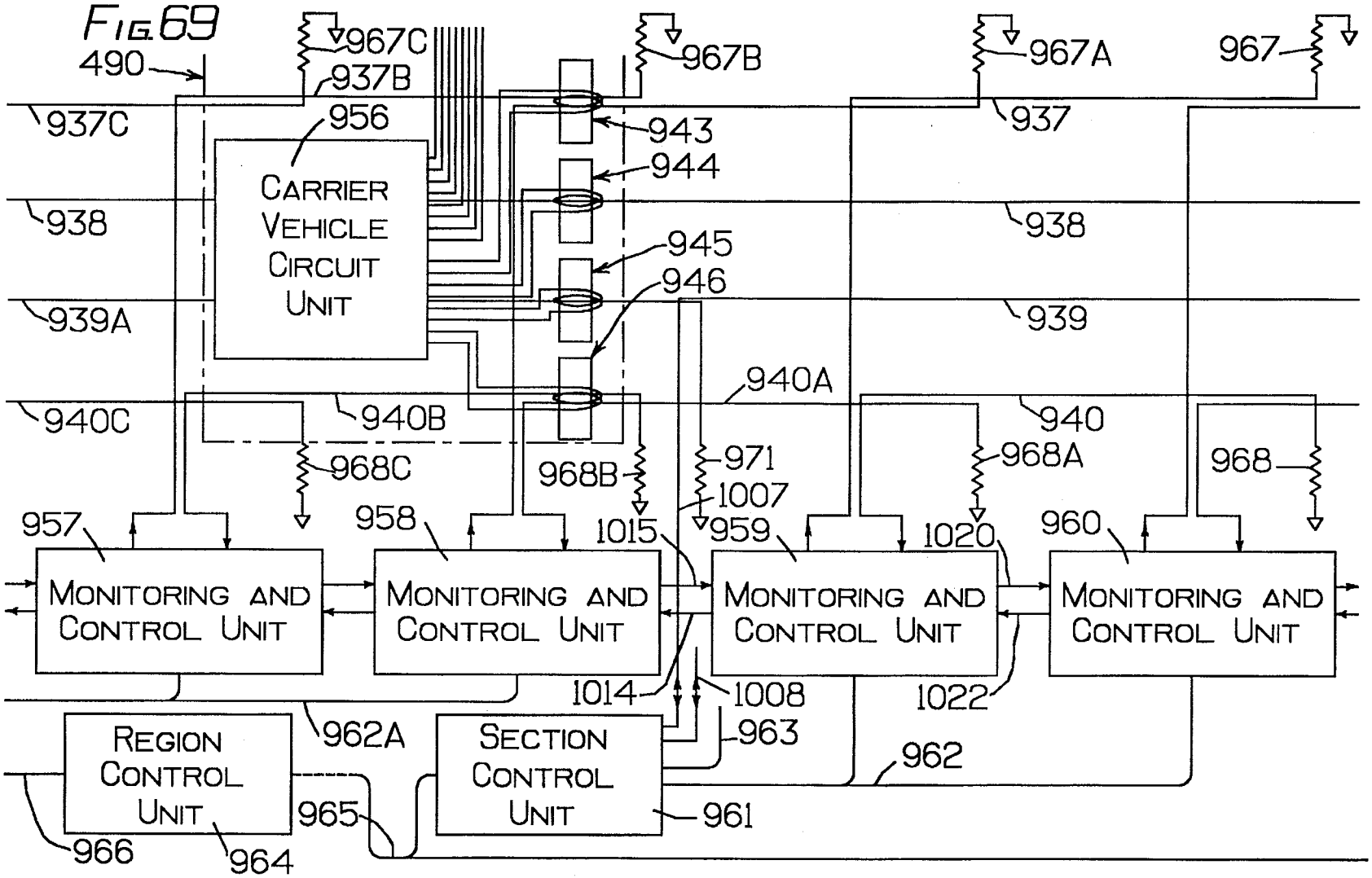
FIG. 69 is a diagrammatic plan view showing the inductive coupling devices of FIG. 68 coupled to a circuit unit of the carrier vehicle.

FIG. 69 is a diagrammatic plan view showing the inductive coupling devices 943–946 coupled to a circuit unit 956 of the carrier vehicle 490 which may be assumed to be moving to the right. Another group of four inductive coupling devices that are like devices 943–946 but on the left side of the carrier vehicle 490 are also coupled to the unit 956, as indicated by eight lines in FIG. 69.

FIG. 69 also shows four monitoring and control units 957–960 for conductors on the right side of the guideway. A section control unit 961 is coupled through a bus 962 to the monitoring and control units 959 and 960, monitoring and control units 957 and 958 being connected through a similar bus 962A to a section control unit for a preceding section along the guideway. The section control unit 961 is also connected through a bus 963 to monitoring and control units which are like units 959 and 960 but on the left side of the guideway 492.

The section control unit 961 is additionally coupled to a region control unit 964 through a bus 965 which is coupled a number of other section control units like the unit 961 including a section control unit to which monitoring and control units are connected through the bus 962A. The region control unit 964, in turn, is coupled to a central control unit, not shown, through a bus 966 which is coupled to other region control units in the system. Reports of activity in the region assigned to each region control unit are transmitted to the central control unit, which maintains current data as to the location of each carrier vehicle and each body being transmitted, as well as a history of movements thereof, to facilitate efficient performance of traffic control, billing, maintenance and other functions.

The monitoring and control units 957 and similar units for the left side of the guideway 492 are assigned to portions of the guideway 492 which may be of various lengths. For example, along a straight length of guideway in open country, a portion to which one unit is assigned may have a length of 15 feet or more while in parts of the guideway where loading and unloading operations take place, a portion to which one unit is assigned may have a length of one foot or less.

The section control unit 961 is typically connected to a considerable number of monitoring and control units and is operative with respect to a long length of a guideway in open country or with respect to a relatively short length where switching and/or loading and unloading operations take place. In general, one section control unit is assigned to each portion of a guideway in which either a switching operation or a loading/unloading operation takes place. For each direction of travel through the portion of the system illustrated in FIGS. 1 and 2, one region control unit such as unit 964 is provided, each region control unit being coupled to approximately 12 section control units.

In FIG. 69, the device 943 is a speed signal receiving device operating to transmit to the circuit unit 956 speed signals applied through transmission line conductors from a monitoring and control unit such as one of the monitoring and control units 957–960.

The device 944 is a general purpose communication device operating for transmission of various signals between a central control unit and the circuit unit 956 of the carrier vehicle 490.

The device 945 is an auxiliary signal device operating for transmission of signals between the unit 956 section control units such as the unit 961, transmitting such signals through guideway conductors in either direction and for various purposes. It is used, for example, to send data from a carrier vehicle to a section control unit which identifies the carrier vehicle, any body carried by the vehicle and the route to be followed by the vehicle through the system.

The device 946 is a speed and ID data transmitting device operative to transmit speed data from the carrier vehicle circuit unit 956 and through transmission line conductors of the guideway 492 to a monitoring and control unit such as one of the monitoring and control units 957–960, being also operative to transmit ID data temporarily assigned by a section unit to identify a particular carrier vehicle in its jurisdiction.

As shown diagrammatically in FIG. 69, the conductors 937 and 940 are positioned in alignment with the devices 943 and 946 to apply and receive signals therefrom and are shown having ends connected to outputs and inputs of the monitoring and control unit 959 and having opposite ends connected to ground through resistors 967 and 968.

Another pair of conductors 937A and 940A are shown positioned rearwardly with respect to conductors 937 and 940 and are connected to outputs and inputs of the monitoring and control unit 958, and still another pair of conductors 937B and 940B are shown positioned rearwardly with respect to conductors 937A and 940A and connected to outputs and inputs of the monitoring and control unit 957. In addition, portions of a pair of conductors 937C and 940C are shown positioned rearwardly with respect to conductors 937B and 940B, and portions of a pair of conductors 937D and 940D are shown positioned forwardly with respect to conductors 937 and 940 and connected to outputs and inputs of the monitoring and control unit 960. Resistors 967A–C and 968A–C are like resistors 967 and 968 and are used to terminate each of the illustrated transmission line conductors as shown. Each such terminating resistor preferably has a value equal to the characteristic impedance of the terminated transmission line.

To minimize the possibility of interference, different frequency channels are preferably used in transmitting signals from alternate ones of the monitoring and control units and through the device 943 to the carrier vehicle circuit unit 956. For example, in transmitting signals through device 943 to the unit 956, a channel designated as a #1 channel may be used in transmitting signals from monitoring and control units 957 and 959 and through conductors 937B and 937 while a #2 channel may be used in transmitting signals through monitoring and control units 958 and 960 and through conductors 937A and 937D.

To insure uninterrupted transmission of signals in both directions, there is preferably an overlap of the conductors aligned with units 943 and 946. For example, when the spacing distance of monitoring and control units is fifteen feet, each of the conductors 937, 940, 937A, 940A, 937B, 940B, 937C, 940C, 937D and 940D may have a length of sixteen feet to provide a one foot overlap. The conductor 938 which is used for communications between the general purpose communication device 944 and a central control center may extend for a long distance with repeater stations therealong if necessary. The section control unit 961 is connected through a line 969 to the conductor 939 and through a line 970 to a corresponding conductor on the left side of the guideway. Conductor 939 may extend for at least an initial portion and preferably for substantially the full length of the portion of the guideway to which section control unit 961 is assigned. A similar conductor 939A is connected to a section control unit for a preceding or rearward portion of the guideway and is terminated by a resistor 971.

Figure 70:
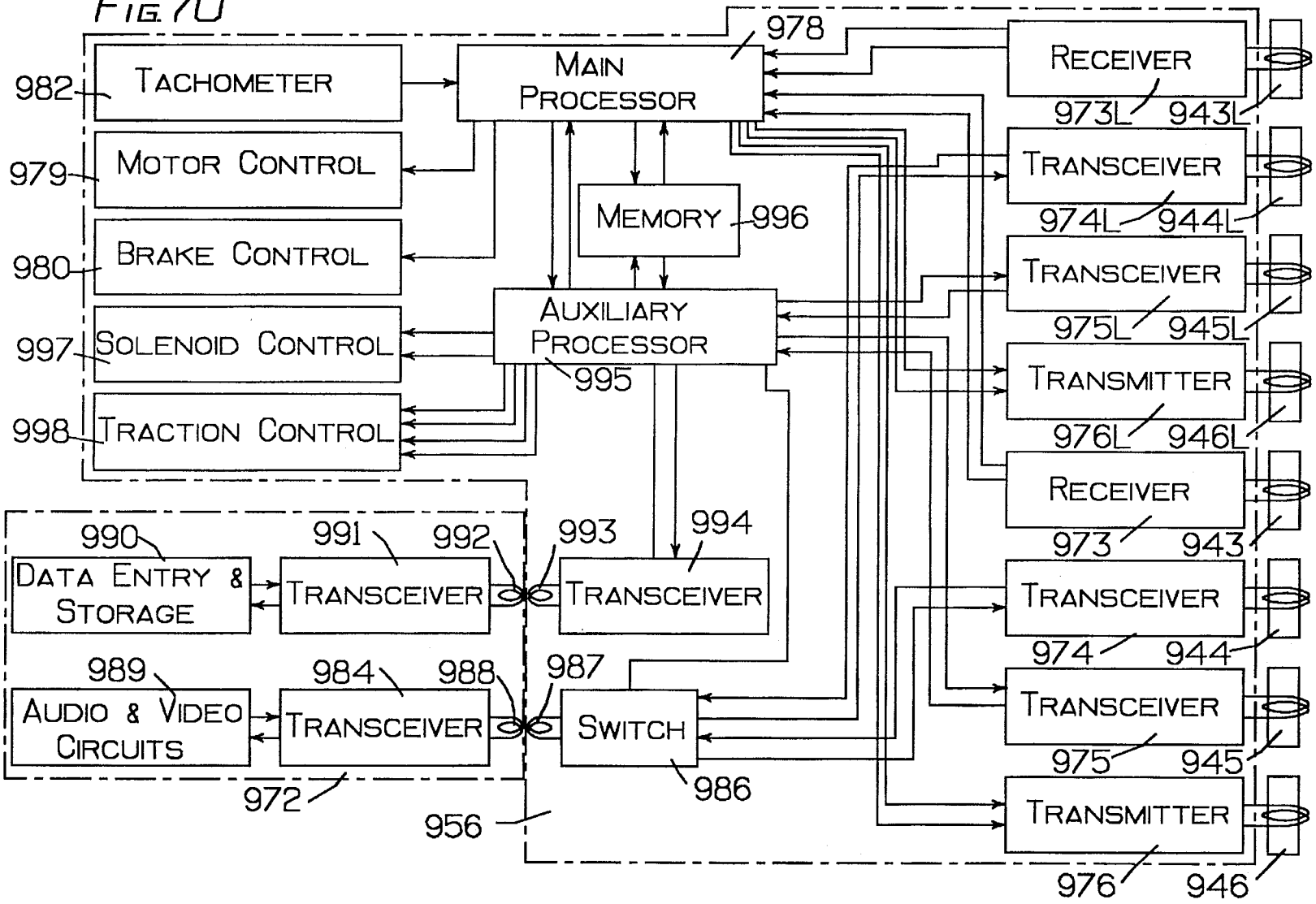
FIG. 70 is a block diagram of circuitry of the carrier vehicle and of a body carried by the carrier vehicle.

FIG. 70 is a block diagram of the circuitry of the carrier vehicle 490 and of a body 972 carried by the carrier vehicle 490. The inductor devices 943, 944, 945 and 946 of the right side of the carrier vehicle 490 are respectively connected to input terminals of a receiver 973, input/output terminals of a transceiver 974, input/output terminals of a transceiver 975 and output terminals of a transmitter 976. Similar inductor devices 943L, 944L, 945L and 946L for the left side of the carrier vehicle 490 are similarly connected to a receiver 973L, transceivers 974L and 975L and a transmitter 976L. Output terminals of the receivers 973 and 973L and input terminals of the transmitters 976 and 976L are connected to input and output ports of a microprocessor 978 which is referred to as the main processor because it performs the important function of controlling energization and braking of the drive motors, through motor control circuitry 979 and brake control circuitry 980.

Output ports of the main processor 978 are connected to inputs of the transmitters 976 and 976L. An input port of the main processor 978 is connected to the output of a tachometer 982 which is driven from the drive shaft of one of the drive motors to be driven at a speed proportional to the speed of movement of the carrier vehicle 490 along the guideway 492.

The main processor 978 repetitively develops a message for transmission to monitoring and control units along the guideway as the carrier vehicle 490 moves therealong. Each message includes digital data that correspond to the speed of movement of the carrier vehicle 490 and digital "ID" data that identify the carrier vehicle 490, such data being applied from output ports of the main processor 978 to inputs of the transmitters 976 and 976L. The transmitters 976 and 976L operate to serially transmit such digital data through the inductor devices 946 and 946L and through conductors of the transmission line conductors of the guideway 492 to be received by the monitoring and control units such as units 957–960 along the guideway 492.

For maximum reliability, it is desirable that monitoring and control units receive at least several complete messages during the time interval in which a carrier vehicle traveling at maximum speed passes through the length of the guideway which is assigned to one of the monitoring and control units. It is thus desirable to use a bit rate of serial transmission of the digital data which is as high as possible without sacrificing reliability and it is also desirable to minimize the length of the message. As hereinafter described, each section unit assigns identification data to each carrier vehicle entering the guideway section monitored by the unit for temporary use while the carrier vehicle moves through the section, and such temporary ID data are quite short in relation to complete identification data which distinguishes the carrier vehicle from all other carrier vehicles in the transportation system.

The monitoring and control units process the data received from carrier vehicles moving along the guideway and send messages to the carrier vehicles which include speed command data to be used by the vehicles in controlling the speeds of movement thereof. Such messages are transmitted serially in the form of signals modulated by digital data, being transmitted through guideway conductors such as conductor 937 and through the inductors 943 and 943L to the receivers 973 and 973L to be demodulated and converted to parallel data for processing by the main processor 978. The main processor compares speed command data with carrier vehicle speed data developed from the tachometer, and applies control data to the motor control circuit 979 to control the speed of movement of the carrier vehicle.

In sending messages to carrier vehicles, different communication channels, operative at differed carrier frequencies, for example, are used by adjacent monitoring and control units. As aforementioned, a channel designated as a #1 channel may be used in transmitting signals from monitoring and control units 957 and 959 and through conductors 937B and 937 while a #2 channel may be used in transmitting signals through monitoring and control units 958 and 960 and through conductors 937A and 937D. Each of the receivers 973 and 973L develops output data from both channels and applies such data to separate inputs of the main processor. With an overlap of conductors as aforementioned, data are received from one channel before data are no longer received by the other and information is provided to the carrier vehicle as to the location of the overlapping conductor portions. The data applied to the motor control are such that there is no attempt to abruptly accelerate or decelerate the vehicle in response a difference, which may sometimes be quite large, between new speed command data received from one channel and old speed command data received from the other. Instead, speed is changed at a rate which is a function of both the magnitude of the difference and the speed of travel of the vehicle.

The transceivers 974 and 974L are selectively coupled to a transceiver 984 on the body 972 which is carried by the vehicle 980 and which is diagrammatically indicated by broken lines. As shown the transceivers 974 and 974L are coupled through a switch 986 to a coil 987 on the vehicle 490 which is inductively coupled to a coil 988 on the body 972 when the body 972 is mounted on the vehicle 490. Coil 988 is connected to input/output terminals of the transceiver 984. Other interfaces including direct connections and optical couplings may be used in place of inductive coupling.

The transceiver 984 is shown connected to audio and video circuits 989 usable for receiving radio and television communications on the body 972 which may be a passenger carrying body, for example. Telephone communications and fax communications may also be accommodated.

As also shown, the body 972 also carries data entry and storage circuitry 990 which is coupled through a transceiver 991, a coil 992 on the body 972, a coil 993 on the vehicle 490 and a transceiver 994 to an auxiliary processor 995 on the vehicle 490. Data are transmitted to the auxiliary processor which include body ID data distinguishing the body 985 from other bodies of the transportation system and route data identifying the route to be followed by the vehicle 490 in moving through the system. A passenger on a passenger carrying body may enter data to change the route data to stop at a previously unscheduled stop, for example. Communications may also be transmitted from the auxiliary processor 995 to the data entry and storage circuitry, which may operate a digital display or an audible signalling device.

The auxiliary processor 995 stores data obtained from the data entry and storage circuitry 990 in a memory 996 which can be accessed by the processor 995 and sent to section control units such as unit 961 through the transceivers 995 and 995L, devices 945 and 945L and conductors of the guideway connected to the section control units. Memory 996 may also be accessed by the main processor 978 and signals may be sent between the two processors 978 and 995.

The auxiliary processor 995 has output ports coupled to solenoid control circuitry 997 for control of the solenoids 552 and 554 of the front bogie of the carrier vehicle 490 and similar solenoids of the rear bogie to control steering of the carrier vehicle 490. When the direction of steering is changed, the switch 986 is also operated to a corresponding position to appropriately couple either the right transceiver 975 or the left transceiver 975L to the transceiver 984 on the body.

The auxiliary processor 995 also has output ports connected to traction control circuitry 998 for control of the traction control motors 650 and 668 of the front bogie and the traction control motors 781 and 782 of the rear bogie.

Figures 71, 72:
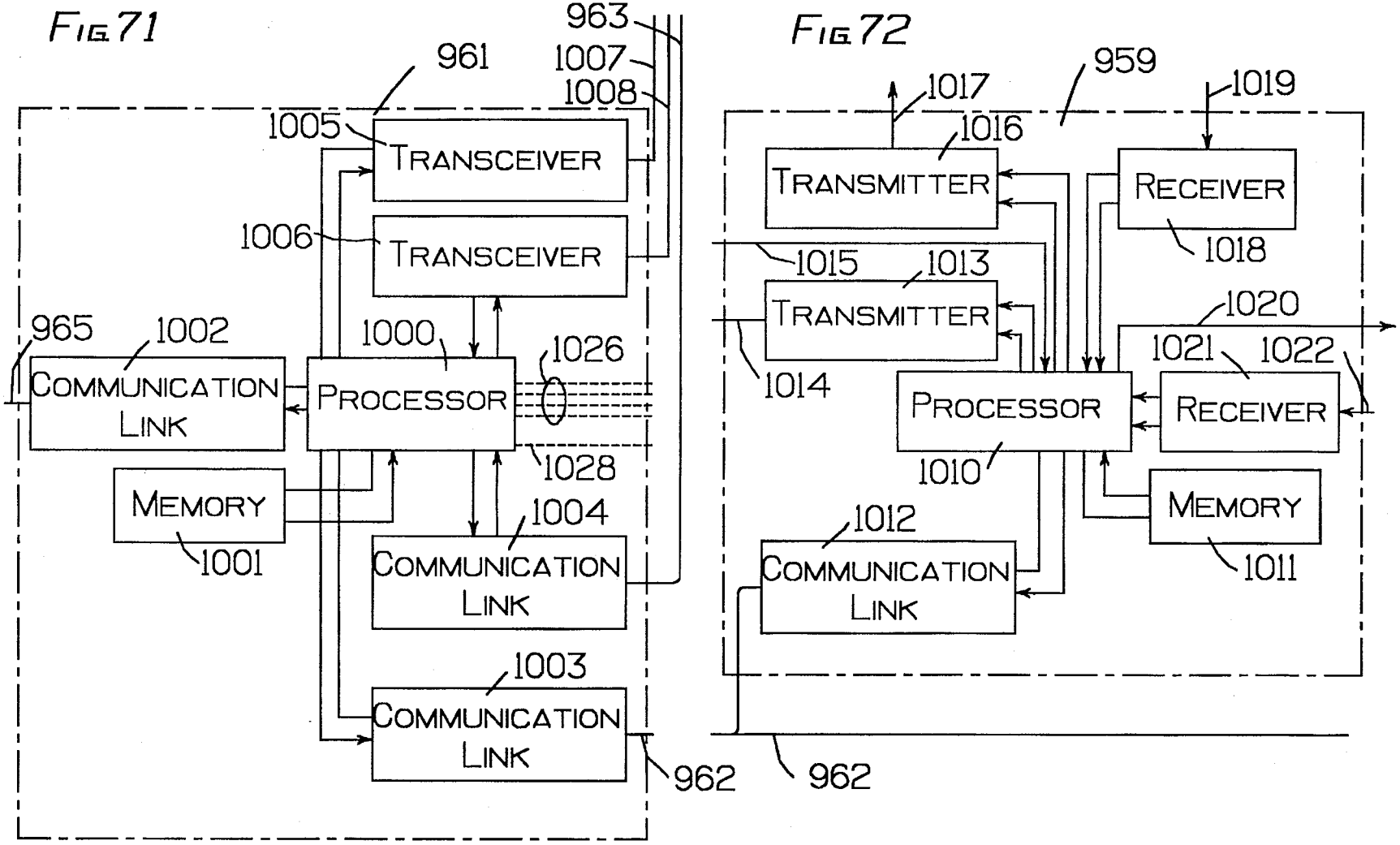
FIG. 71 is a block diagram of circuitry of a section control unit.
FIG. 72 is a block diagram of circuitry of a monitoring and control unit.

FIG. 71 is a block diagram of circuitry of the section control unit 961 which includes a processor 1000 connected to a memory 1001 and coupled through a communication link 1002 and the bus 965 to the region control unit 964, through communication links 1003 and 1004 and the buses 962 and 963 to monitoring and control units for the right and left sides of the guideway 492, and through transceivers 1005 and 1006 to lines 1007 and 1008 connected to the conductor 939 on the right side of the guideway and a corresponding conductor on the left side of the guideway.

FIG. 72 is a block diagram of circuitry of the monitoring and control unit 959 which includes a processor 1010 connected to a memory 1011 and coupled through a communication link 1012 and the bus 962 to the section control unit 961, through a transmitter 1013 and a line 1014, also directly through a line 1015, to the monitoring and control unit 958 which is behind the unit 959, through a transmitter 1016 and a line 1017 to the guideway conductor 937, through a receiver 1018 to a line 1019 connected to the guideway conductor 940, and also through a line 1020 and also through a receiver 1021 and a line 1022 to the monitoring and control unit 960 which is ahead of the unit 959.

The transmitter 1013 and receiver 1021 operate in transmitting and receiving serial data and each may be equivalent to one-half of a conventional UART, for example. More direct couplings may be used instead of serial transmitters and receivers, particularly when the distance between monitoring and control units is small as is the case in sections used for loading and unloading of vehicles.

Figure 73:
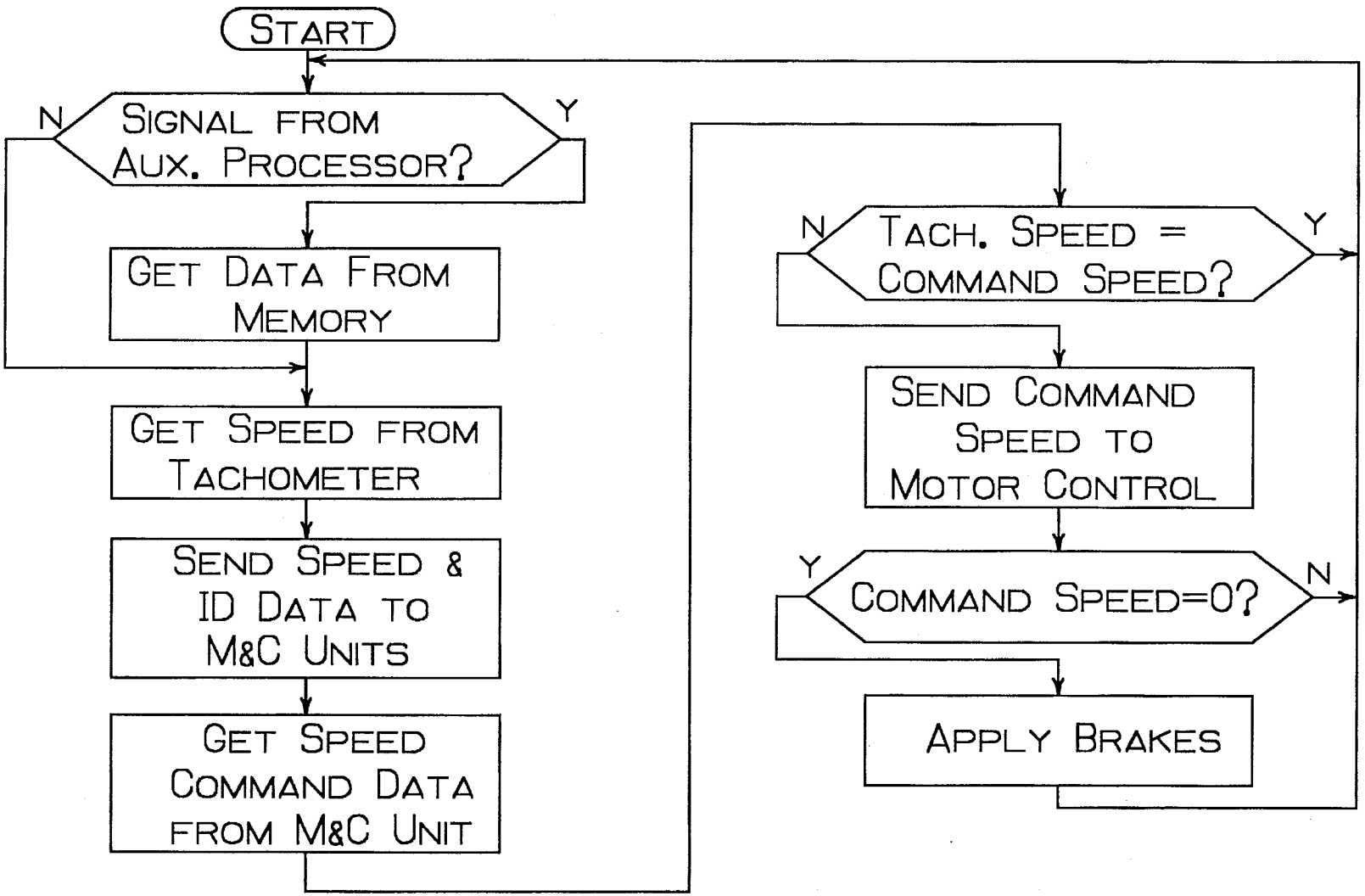
FIG. 73 is a flow diagram illustrating the operation of circuitry of the carrier vehicle.

FIG. 73 is a flow chart illustrating the operation of the main processor 978 of the carrier vehicle 490. At start, the processor checks for a signal from the auxiliary processor 995 which is applied when new data are available such as new temporary ID data to be used by the carrier vehicle 490 in continually sending data to monitoring and control units along the guideway.

After getting any new data which is available, data corresponding to the speed of the vehicle is obtained from the tachometer 982 and then speed and ID data are transmitted through one or both of the right and left transmitters 976 and 976L. Usually, both transmitters are used in transmitting redundant data which are compared by the monitoring and control units to detect possible errors and malfunctioning of equipment.

Next, speed command data are obtained from the nearest of the monitoring and control units along the guideway. Such data are compared with data obtained from the tachometer 982. If there is a difference or also if the command speed is zero, the command speed data are sent to the motor control circuitry 979 to correct the speed of the vehicle and if the command speed is zero, a signal is sent to the brake control circuitry 980 to energize the brakes 648 and 781 of the front and rear bogies.

Figure 74:
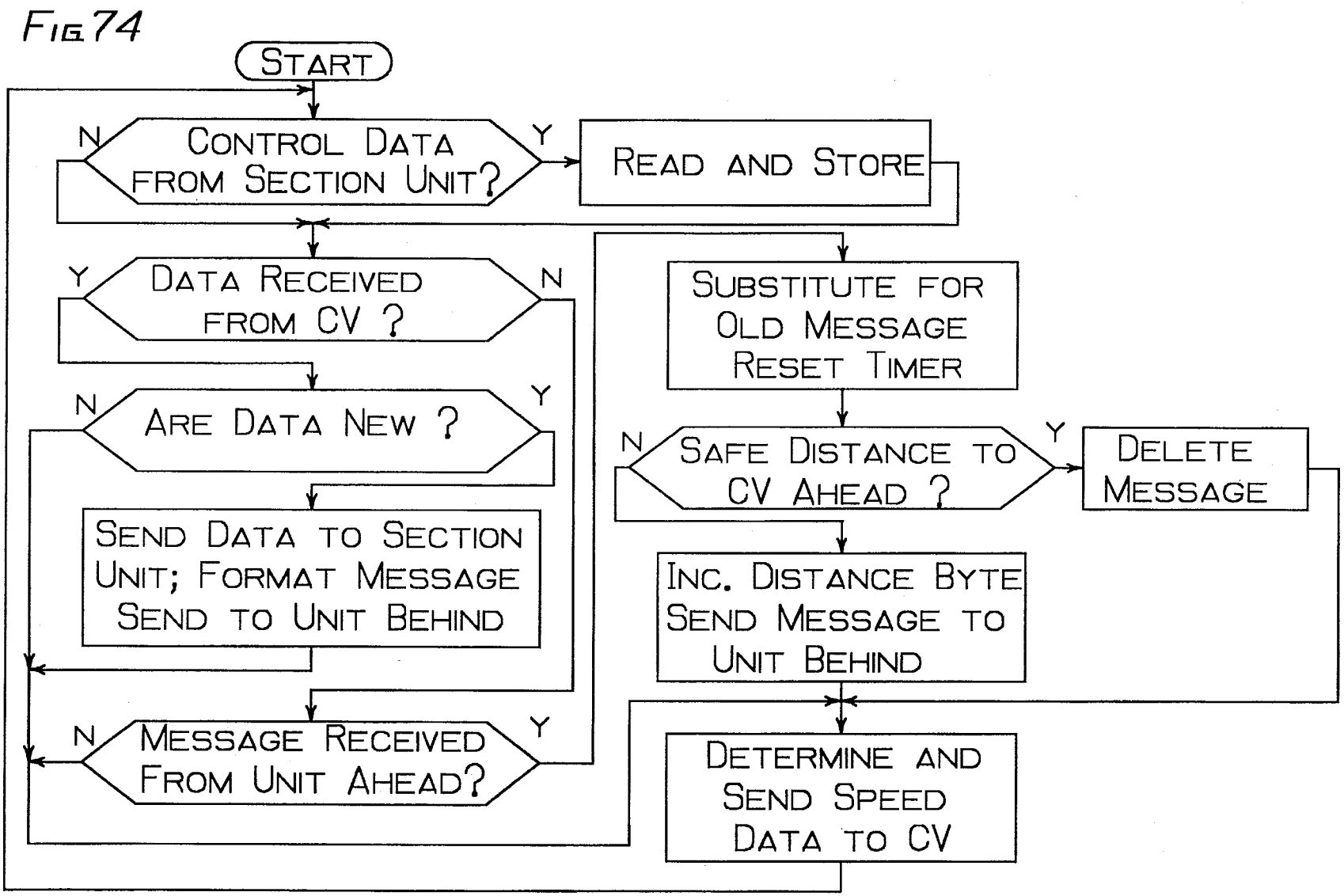
FIG. 74 is a flow diagram illustrating the operation of circuitry of a monitoring and control unit.

FIG. 74 is a flow diagram illustrating the operation of the processor 1010 of the monitoring and control unit 959. First, the processor obtains and stores any new control data which may be available from the section unit 961. Such data may include new maximum speed data which may dictate a lower speed of operation along a guideway when, for example, weather conditions are such that operation at high speeds is unsafe.

Next a check is made for new data from a passing carrier vehicle. If new data are obtained, a report thereof is sent to the section unit and then a message is formatted to send to the unit behind using the transmitter 1013 and line 1014. The message transmitted includes speed data which may be in the form a single 8-bit byte of data, but is preferably in the form of two 8-bit bytes of data for greater accuracy. The message also includes data which will be referred to as the distance byte and which is initially set at zero, or some other certain value, in the originating monitoring and control unit. The message is passed along serially in a rearward direction along the guideway and the distance byte is incremented each time the message is passed so that the distance byte identifies the originating unit. If, for example, the effective spacing between units is 15 feet and the byte which originally had a zero value has been incremented in one unit increments to five, the receiving unit is supplied with data indicating that the distance to the originating unit is the product of five plus one and fifteen or 90 feet. Preferably, any delays in passing the message along are insubstantial, but any substantial delays can be taken into account by a receiving unit.

As shown in the flow diagram, when a message is received, it is substituted for any old message that may exist and a timer which is placed in a reset condition. Then a determination is made as to whether, for the purpose of determining whether to pass on the message, there is a safe distance ahead to the carrier vehicle which was just detected to originate the message. The distance to the originating unit is determined as discussed above. Whether or not it is safe to avoid passing on the message depends upon the value of the speed data in the message. If the speed data shows that the detected carrier vehicle is travelling at a high speed, there may be no need to pass the message on even though the distance is relatively short. On the other hand, if the detected carrier vehicle is travelling at a low speed or is stopped, the distance must be quite large before it is safe to not pass the message. Accordingly, the safe value of the distance byte increases in inverse relation to the speed indicated by the speed data.

If it is determined that the message should be passed on, it is sent to the unit behind after incrementing the distance byte.

Finally, the processor 1010 of the monitoring and control unit 959 determines command speed data and sends it to any carrier vehicle that may be passing by the unit 959. The command speed data are determined either from maximum speed data or from data in a message from a unit ahead including data corresponding to the distance to and speed of a carrier vehicle ahead. When determined from data in a message, the command speed data will require a decreased speed when the vehicle is too close to the vehicle ahead and will require an increase in speed when the speed when the vehicle is too far behind the vehicle ahead, unless the speed is already at a speed set by the maximum speed data which may either have a default value or a value determined from data received from a section control unit.

The distance to a unit which has detected a carrier vehicle ahead is determined from the distance byte of a pending message in the manner as discussed above but does not indicate the distance to the vehicle which may have moved since the message was originated and received. To more accurately determine the distance to the vehicle a distance is added equal to the product of the speed of the vehicle and the elapsed time indicated by the aforementioned timer which was reset at the time when the pending message was originally received.

The command speed data are increased as a function of the maximum speed data, as a function of the speed of the vehicle ahead and as a function of the distance to the vehicle ahead, to obtain a certain following distance for each speed of the vehicle ahead. It is also dependent upon the capabilities of the carrier vehicle, including the responsiveness and reliability of its drive components and control circuitry and braking distances which can be safely and reliably obtained with all vehicles of the system. As examples of the considerations that are involved, if the maximum speed is 150 feet per second and the speed of the vehicle ahead is also 150 feet per second and the distance to the vehicle is 150 feet, a command speed of 150 feet per second might be quite safe. However, if the distance to the vehicle ahead is only 75 feet, it may be desirable that the command speed be reduced to less than 150 feet per second to slow down any passing carrier vehicle and increase its distance to the vehicle ahead. If the speed of the vehicle ahead is very low or if the vehicle ahead is stopped, it may not be safe to send a command speed equal to the maximum speed until the distance to the vehicle ahead is quite large and substantially greater than a braking distance which can be safely obtained with the vehicle.

FIG. 75 is a flow diagram illustrating the operation of the processor 1000 of the section control unit 961. The flow diagram as shown is for a general purpose processor for section units capable of four different modes of operation, including a standard mode in which no switching or loading/unloading operations may take place and a switch mode of operation in which the monitored and controlled section of the guideway controlled has a switch region in which the direction of travel of the vehicle may be selectively changed. It is also capable of two additional modes of operation for a section of a guideway constructed for loading/unloading operations. One of such additional modes is a load/unload mode for performance of such loading/unloading operations and the other being a "pass through" mode a vehicle passes through such a section but in which no loading/unloading operations take place therein.

The operation of the processor 1000 of the section control unit 961 starts with a determination of whether a carrier vehicle (CV) is entering a section, performed by monitoring data transmitted from the first monitoring and control unit of the section, for example by data transmitted through the bus 962 and from the unit 959 in FIG. 69. When such data are detected, control data are transmitted to the auxiliary processor 995 of the carrier vehicle through one or both of two channels formed by transceivers 1005 and 1006, lines 1007 and 1008, conductors of the guideway, devices 945 and 945L and transceivers 975 and 975L. The auxiliary processor 995 responds by sending through one of both of the same channels complete identification data for the carrier vehicle and for any body which may be carried by the vehicle, also route data defining the route which the vehicle is programmed to follow through the system. Then certain flags are cleared and, using one or both of the same channels, ID data which is usually not more than a single 8-bit byte of data is sent to the carrier vehicle to temporarily identify the vehicle while it is passing through the section to which the unit 959 is assigned. The auxiliary processor 995 then sends a signal to the main processor 978 to signal the existence of new temporary ID data in the memory 996. It is noted that the use of temporary ID data is desirable in guideway sections in which a number of vehicles may be present at the same time. However, the use of such data may not be required as to many sections such as loading/unloading sections and some switching sections which have a short length such that no more than one vehicle will normally be in the section at the same time.

After sending the temporary ID to the carrier vehicle, data are sent to the region control unit 964 through the communication link 1002 and bus 965 and control data may be received back through the same channel to be sent to the monitoring and control units through communication links 1003 and 1004 and buses 962 and 963 which may then be used in transmitting data to the section control unit 961 to be stored in the memory 1001.

As shown in the flow diagram, a series of test may then be made to determine modes of operation and the condition of certain flags and if the results of all such tests are negative, the operation of the processor 1000 returns to the start point. This is what may be described as the "normal" operation for sections of the guideway in which no switching or loading/unload operations are to take place. For such sections, the mode and flag tests and related operations are unnecessary and may be eliminated. Similarly, the switch mode test and related operations may be eliminated for a section designed for only loading/unloading operations and the loading/unloading, pass through and flag tests may be eliminated for a section designed for switching operations.

With respect to switching operations, a switch mode test may be made to determine whether any switching operation is necessary, determined from the route data obtained from the carrier vehicle and data obtained from the vehicle as to the condition of the guide wheel assemblies. If a switching operation is necessary, solenoid and switch control data are sent to the carrier vehicle, after first obtaining a positive response to a test to determine whether the carrier vehicle is approaching a switch region at which the vehicle is to be switched to from one path to another. Such a test is made from monitoring the data received from the monitoring and control units along the section and which show the positions of vehicles moving along the section. It is noted that in a section containing only a single switch, no test is necessary and the solenoid and switch control data may simply be sent to the carrier vehicle to effect energization of the proper solenoids and switching of the switch 986 to the proper condition.

Figure 75A:
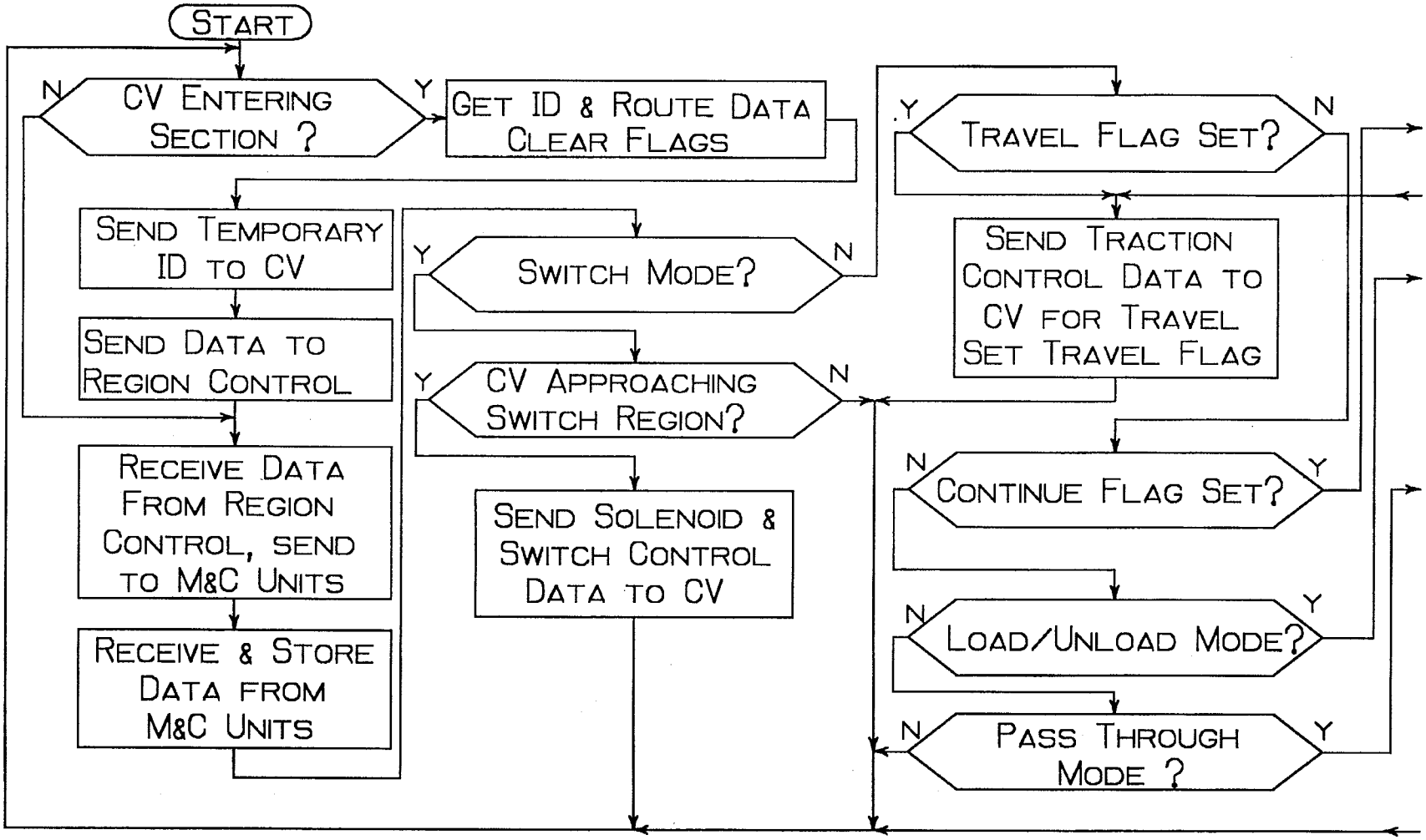
FIGS. 75A and 75B together form a flow diagram illustrating the operation of a section unit.
Figure 75B:
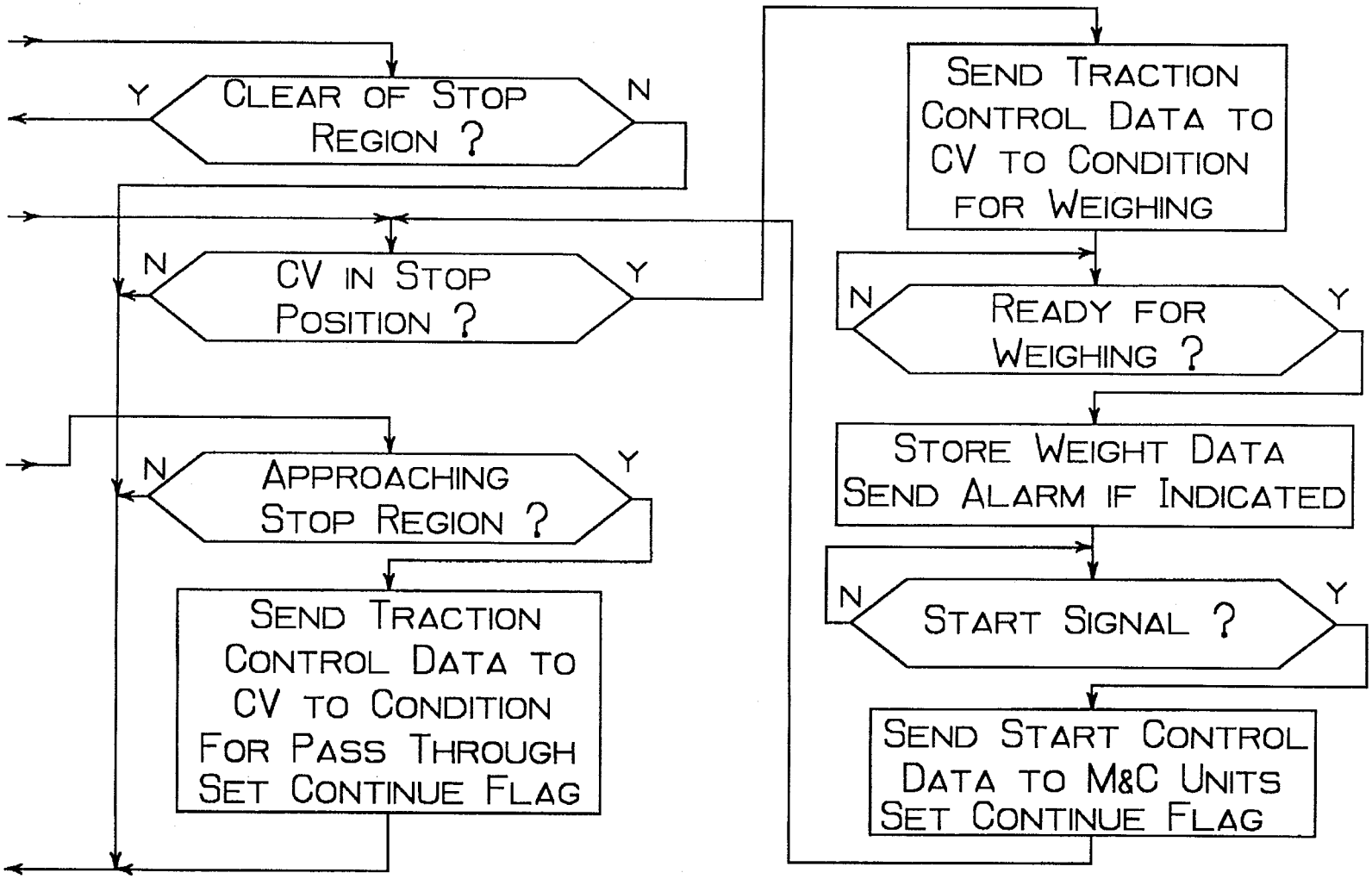
Figures 76, 77, 78:
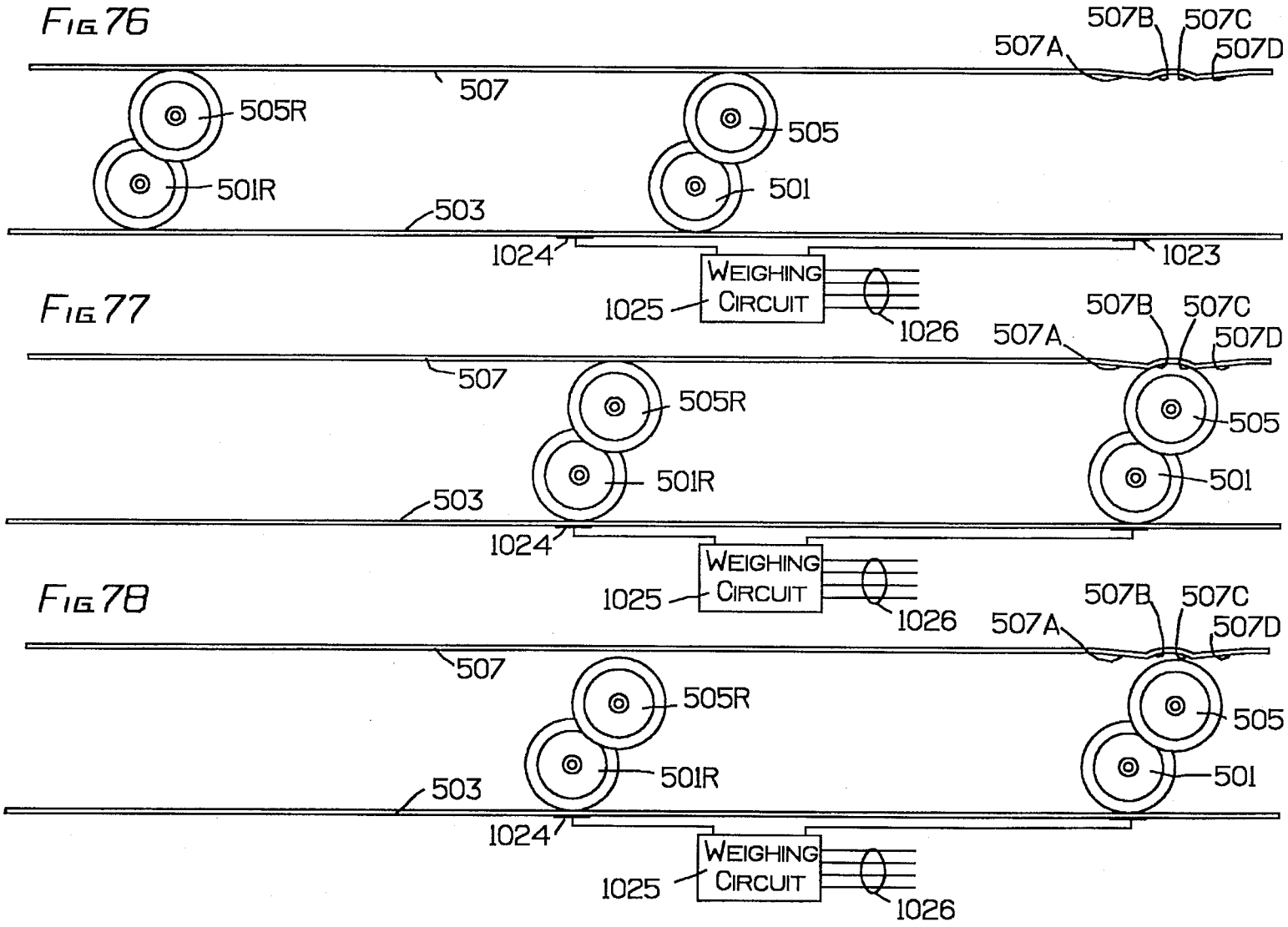
FIGS. 76–78 depict the positions of wheel structures of a carrier vehicle during loading/unloading operations in a region at which a body may be transferred between a transfer vehicle and the pads of a carrier vehicle positioned thereat or at which a passenger-carrying body is in a passenger loading/unloading position.

The loading/unloading and pass through modes of operation of FIG. 75 may be best understood by first considering FIGS. 76, 77 and 78 which depict the positions of wheel structures of a carrier vehicle during loading/unloading operations in a region such as the region 55 of FIG. 3 at which a body may be transferred between a transfer vehicle and the pads of a carrier vehicle positioned thereat or such as the region where passenger-carrying body 56 is shown located in FIG. 3 for pick-up and discharge of passengers.

In FIG. 76, the wheels 501 and 505 of the front bogie and wheels 501R and 505R of the rear bogie are shown in normal positions relative to lower and upper tracks 503 and 507 as the vehicle approaches a loading/unloading position. In FIG. 77, the wheels are shown in positions reached in the loading/unloading position of the vehicle. In FIG. 78, the wheels are shown in positions in which they are when the vehicle is ready to move out of the loading/unloading position, such positions being the same as they are when the vehicle moves through the loading/unloading position during a pass through mode of operation.

As shown the lower track 503 is level while the upper track 507 has a pair of downwardly extending portions along its length to provide a downwardly sloped surface portion 507A, followed by an upwardly sloped surface portion 507B, followed by another downwardly sloped surface portion 507C and finally by another upwardly sloped surface portion 507D. The spring 653 of the front bogie (FIGS. 45 and 52) functions to exert a force urging the support for the wheels 501 and 505 in a counter-clockwise direction about a horizontal axis midway between the axes of the wheels, normally overcoming the gravitational forces acting on the vehicle and urging the upper wheel 505 into engagement with the lower surface of the upper track 507. A similar spring performs similar functions with respect to the wheels 501R and 505R of the rear bogie. When the wheels 501 and 505 of the front bogie approach the position of FIG. 77 and the upper wheel 505 engages the surface portion 507A to be camned downwardly, the wheel support is rotated in a clockwise direction to compress the spring 653 and to develop a certain braking force on the vehicle. However, when the upper wheel 505 reaches the surface portion 507B, an opposite action takes place to develop a forward thrust moving the wheels to the position of FIG. 77. The vehicle is then accurately positioned for loading/unloading operations.

FIG. 78 shows the wheels in a position to permit weighing of the vehicle. After reaching the position of FIG. 77, the traction control motors 650, 668, 781 and 782 are energized in a direction to reduce the forces of the springs acting on the wheel supports, allowing rotation of the wheel supports in clockwise directions and allowing the upper wheels to move downwardly out of engagement with the upper tracks. With reference to FIG. 52, a pin 700 limits rotation in a clockwise direction of the wheel unit 681 which supports the wheels 501 and 505.

When the wheels 501, 505, 501R and 505R and those on the left side of the vehicle are in positions as shown in FIG. 78, the forces acting on the lower tracks are determined solely by the weight of the vehicle. To measure such forces, strain gauges 1023 and 1024 are attached to the undersides of the lower track 503 under the wheels 501 and 501R and similar strain gauges are attached to the undersides of the lower track on the other side of the guideway. All of such strain gauges are connected to a weighing circuit 1025 arranged to develop digital data on lines 1026 to be applied to the processor of a section control unit for the loading/unloading section. As indicated by dotted lines 1026 lines in FIG. 71, such data are applied to a processor like processor 1000 for the section control unit of the loading/unloading section. After proper calibration, the weight and weight distribution of the vehicle are determined, and are used in making certain that the weight of the vehicle is not excessive and that the weight distribution is safe. The weight data are also used in controlling acceleration of the vehicle to enter a main line guideway portion.

In addition, the weight data are used in adjusting the forces applied by the springs during travel in accordance with the weight and weight distribution of the vehicle. When the vehicle is heavily loaded, maintaining the upper wheels in pressure engagement with the upper track requires that the springs exert high forces which are excessive in the case of an unloaded or lightly loaded vehicle, imposing unnecessary stresses and unnecessarily high loads on bearings. The weight data are therefore used in setting the forces applied by the respective springs during travel of the vehicle, in accordance with the weight and weight distribution data developed by the weighing circuit 1025.

In moving forwardly out of the loading/unloading position, the wheels are maintained in the positions as shown in FIG. 78 until the wheels of the rear bogie are clear of the surfaces 507A–507D. Then the traction control motors 650, 668, 781 and 782 are energized in a direction to increase the forces of the springs acting on the wheel supports to values determined by the weight data and to obtain a condition for continued travel.

It is noted that when the upper tracks have configurations as shown, moving a vehicle at substantial speeds through the loading/unloading region will produce shocks and stresses of the upper tracks and of the wheel supports. To avoid this problem, the wheels are lowered to positions as shown in FIG. 78 during an initial portion of a pass through mode of operation and are raised to the travel position through operation of the traction motors only after the wheels of the rear bogie are ahead of the downwardly projecting portions of the upper tracks.

Referring again to the flow diagram of FIG. 75, if the route data requires a stop at the load/unload position, the section control unit for the loading/unloading section after receiving data from region control will initially send data the monitoring and control units such that the vehicle will be decelerated to reach zero velocity at the load/unload position. The lengths of the guideway conductors like conductors 937 and 940 of FIG. 69 are quite short in the load/unload section, six inches for example, to permit the of the vehicle to be gradually and accurately reduced and to reach zero shortly before reaching a position in which the upper wheel 505 of the forward bogie engages the surface 507B of the upper track.

As shown in the flow diagram of FIGS. 75A and 75B, if the test for the load/unload mode is positive, a test is made to determine whether the vehicle has reached the stop position, the test being made through examination of data from the monitoring and control unit which monitors a guideway conductor like conductor 94 at the load/unload position.

When the vehicle reaches the stop position, traction control data are sent by the processor 1000 to the carrier vehicle, through communication channels including transceivers 1005 and 1006 as aforementioned, to control the traction motors 650, 668, 781 and 782 and to place the wheels in positions as shown in FIG. 78. Then weight data obtained through lines 1026 from the weighing circuit 1025 are stored and also examined to send an alarm if the data indicate that either the total weight or the weight distribution is unacceptable.

The processor for the load/unload section then waits for a start signal which may come from a control system for the facility 15 of FIG. 3 and through the region control unit 964 or which may be applied through a line 1028 to a processor such as the processor 1000, as indicated by dotted line 1028 in FIG. 71. When the start signal is received, data are sent to the monitoring and control units which are connected to a guideway conductor like conductor 937 at the load/unload position and guideway conductors forwardly therefrom for acceleration of the vehicle forwardly out of the load/unload position. A continue flag is then set.

After determining that the vehicle is clear of the stop or load/unload region, i.e. after the wheels of the rear bogie pass under the downwardly projecting portions of the upper tracks, traction control data are sent to the carrier vehicle to energize the traction control motors 650, 668, 781 and 782 in a direction to increase the forces of the springs acting on the wheel supports to values determined by stored weight data and to obtain a condition for high speed travel. When the traction control data are received in the vehicle, they are preferably stored in the memory 996 by the auxiliary processor 995 to be available for subsequent pass through operations and also for maintenance, monitoring or other operations.

In the pass through mode, when the stop region is approached, for example when the wheels are in positions as shown in FIG. 76, traction control data are sent to the carrier vehicle to energize the traction control motor 650, 668, 781 and 782 in a direction to decrease the forces applied by the springs and to place the wheels in positions as shown in FIG. 78 well before the upper wheels of the front bogie are below the surface portion 507A of the right upper track and a corresponding surface portion of the left upper track. A continue flag is then set and in subsequent operations a test of the continue flag results in the aforementioned test to determine whether the vehicle is clear of the stop region. It is noted that in the pass through mode, the traction control data which are sent to the traction control motors are obtained from data previously stored in the memory 996 of the vehicle.

Figures 79, 80:
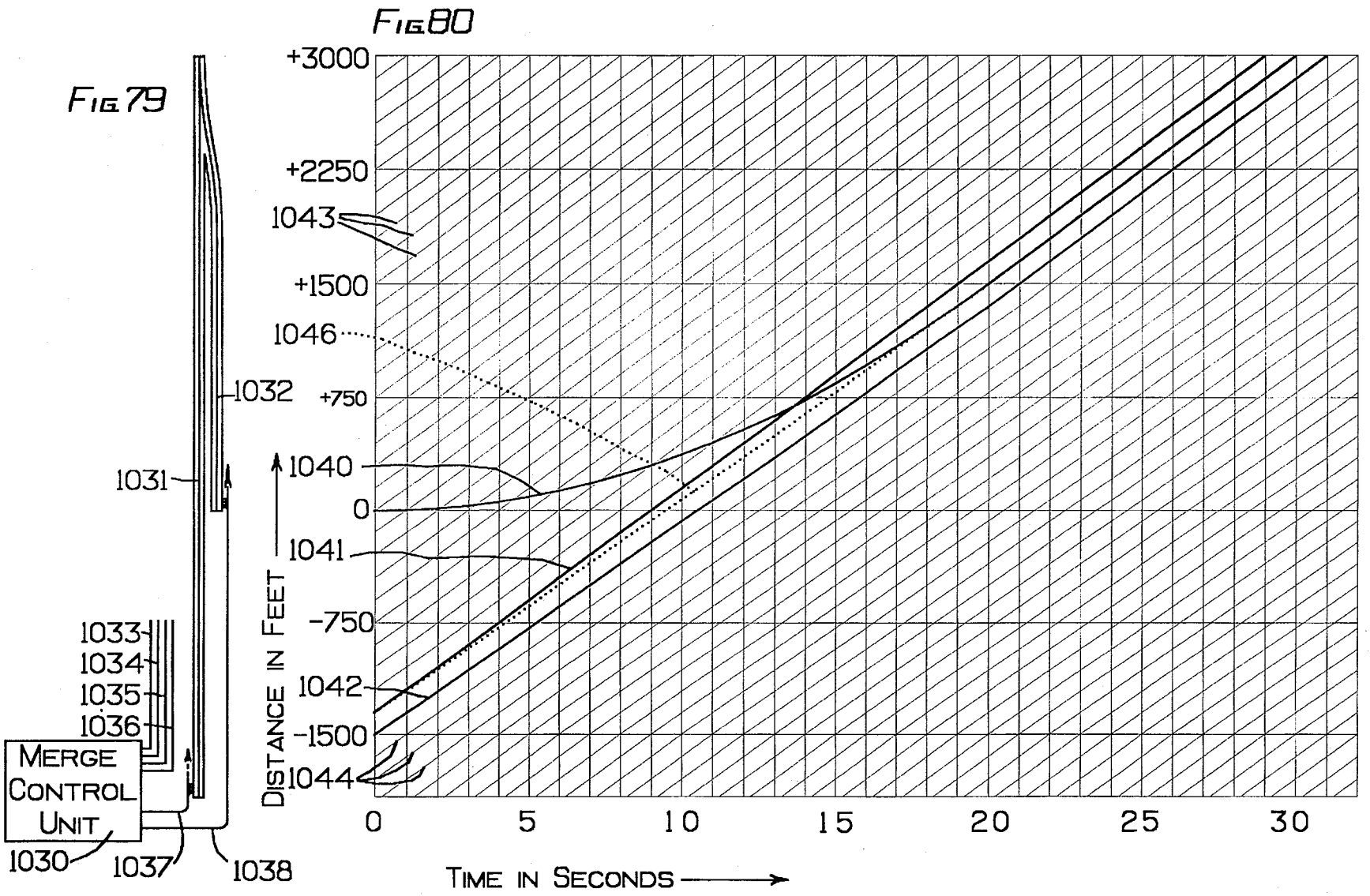
FIG. 79 diagrammatically illustrates a merge control unit which monitors and controls operations including merge operations along a main line guideway and a branch line guideway.
FIG. 80 is a graph provided to explain merging operations at relatively high speeds and shows the acceleration of a stopped vehicle on a branch line guideway of FIG. 79 to enter the main line guideway.

FIG. 79 diagrammatically illustrates a merge control unit 1030 which monitors and controls operations including merge operations along a main line guideway 1031 and a branch line guideway 1032. FIG. 80 is a graph provided to explain merging operations at relatively high speeds and shows the acceleration of a stopped vehicle on the branch line guideway to enter the main line guideway at a speed of 150 feet per second and after travelling a distance of on the order of one half of a mile. The unit 1030 is usable for low speed operations and a units like unit 1030 are used in the system as illustrated in FIGS. 1–3 to control operation of the branch line guideways 17 and 18 and portions of the main line guideways 11 and 12.

The unit 1030 is a specially programmed section control unit which has circuitry similar to the circuitry of the section control unit 961 shown in block form in FIG. 71. It is connected through lines 1033–1036 to conductors of the branch and main line guideways 1032 and 1031 and through buses 1037 and 1038 to monitoring and control units along the branch and main line guideways 1032 and 1031.

Figure 81A:
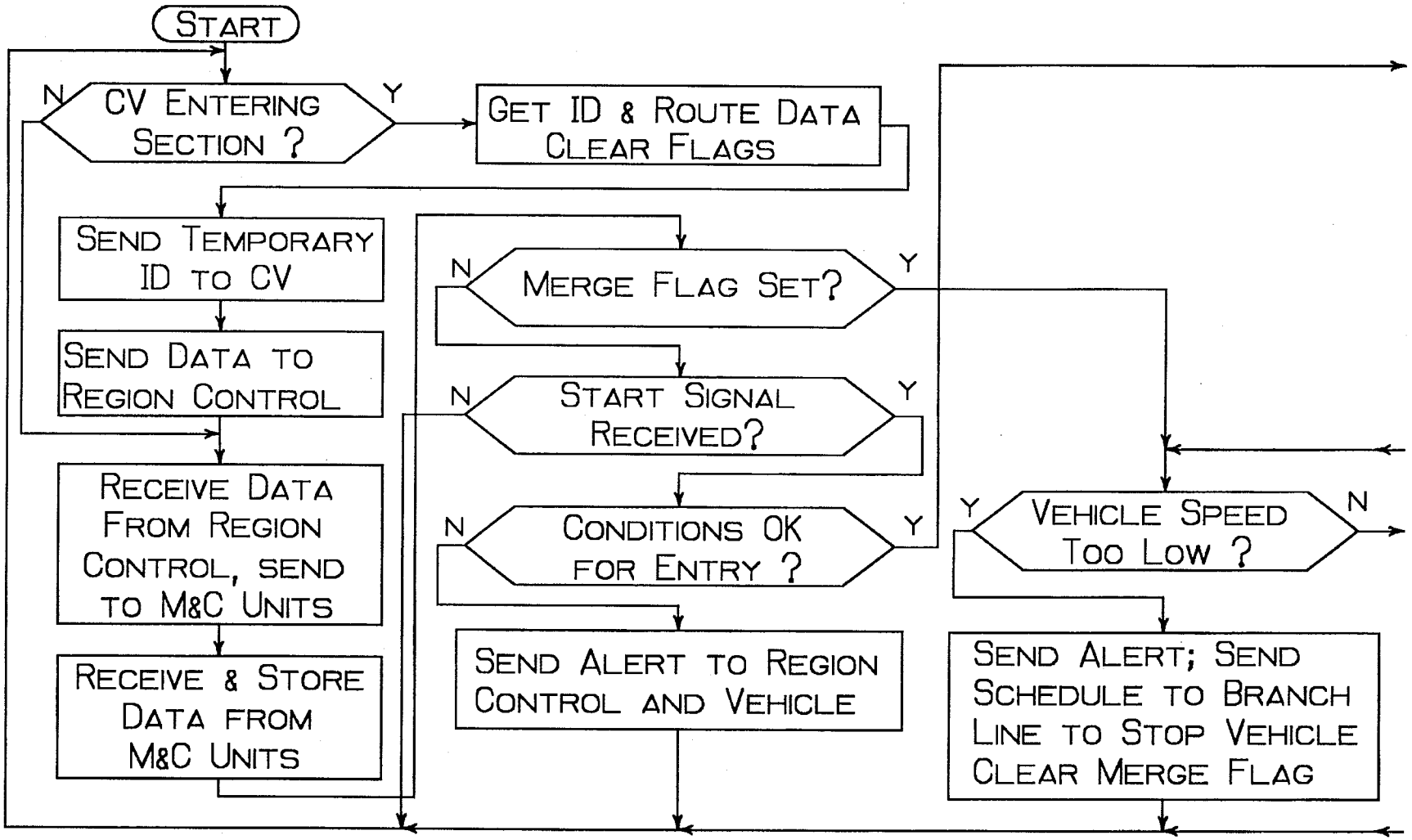
FIGS. 81A and 81B together form a flow diagram illustrating the operation of the merge control unit of FIG. 79.
Figure 81B:
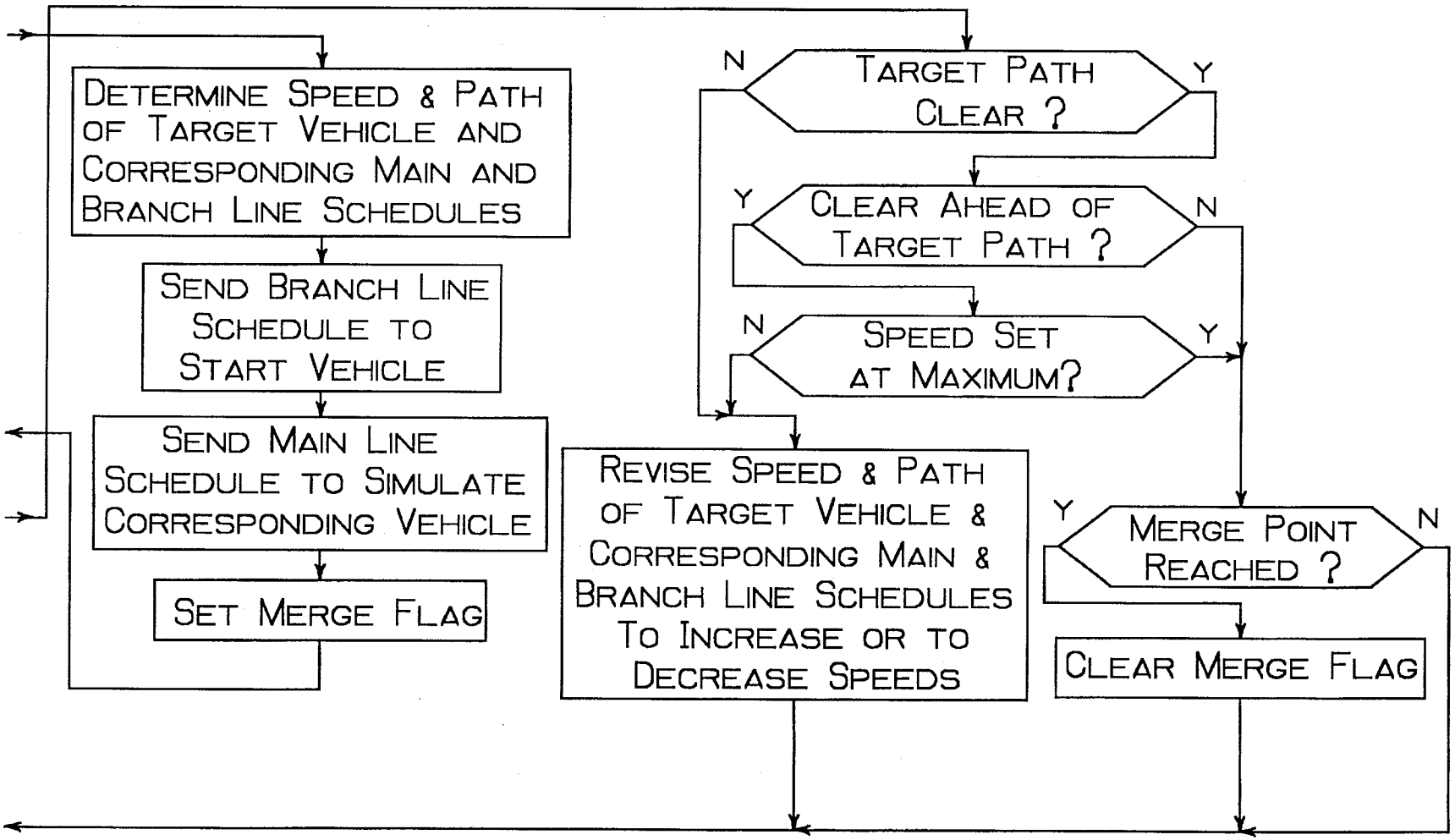
Figure 82:
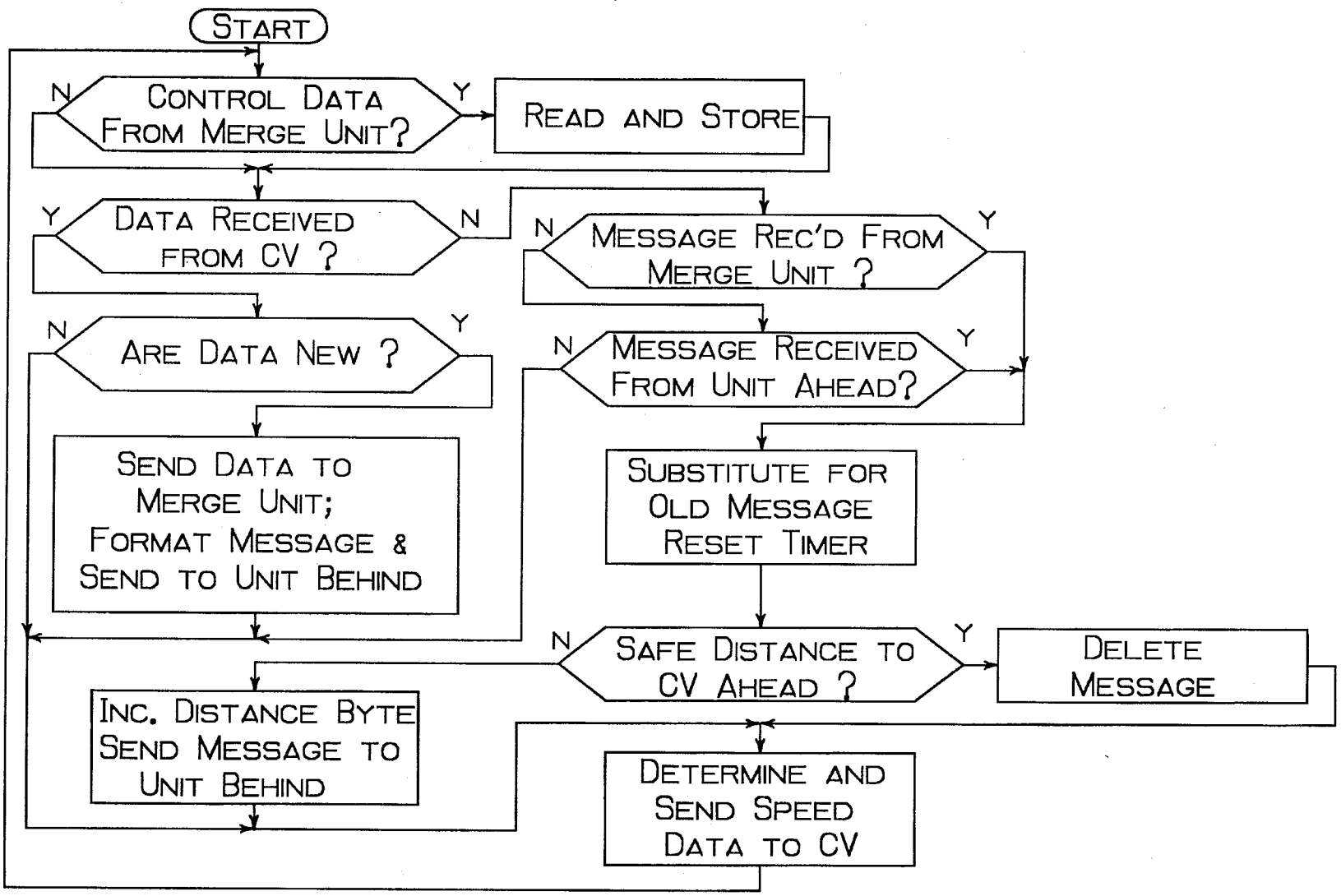
FIG. 82 is a flow diagram illustrating the operation of a monitoring and control unit for the main line guideway of the merge section shown in FIG. 79.
Figure 83:
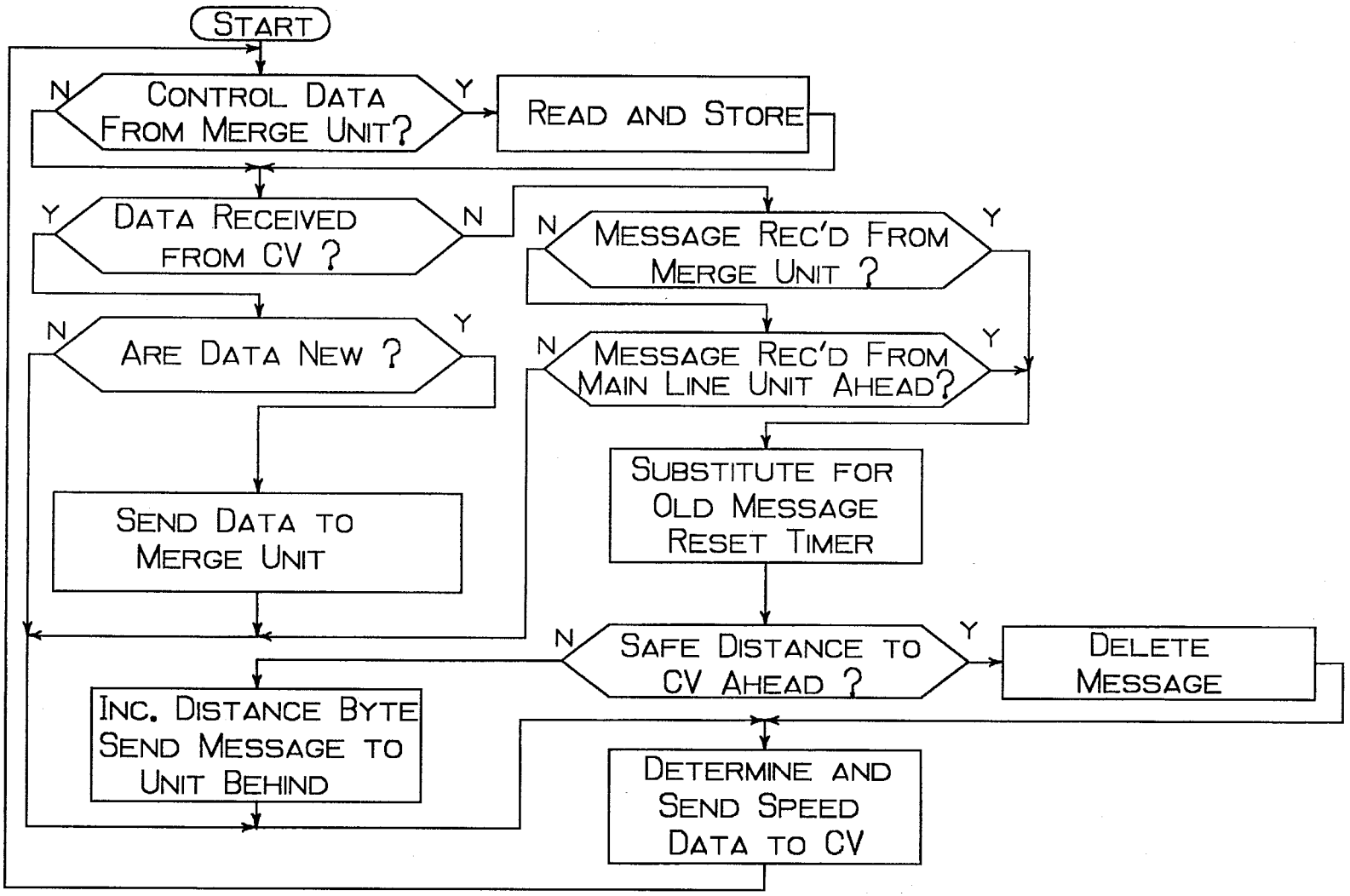
FIG. 83 is a flow diagram illustrating the operation of a monitoring and control unit for a branch line guideway of the merge section shown in FIG. 79.

The flow diagram of FIG. 81 illustrates the operation of the merge control unit 1030; the flow diagram of FIG. 82 illustrates the operation of monitoring and control units of the main line guideway 1031 and the flow diagram of FIG. 83 illustrates the operation of monitoring and control units of the branch line guideway 1032.

In the graph of FIG. 80, a heavier line 1040 shows the movement of a vehicle on the branch line guideway 1032 which in 20 seconds is accelerated from a speed of zero at 7.5 feet per second per second to reach a speed of 150 feet per second after travelling 1500 feet and to then travel at a constant speed of 150 feet per second while moving from the branch line guideway 1032 onto the main line guideway 1031. Such movement is obtained by scheduling signals to monitoring and control units along the branch line guideway 1032 to cause each of C such units to apply a certain command speed signal to a passing vehicle. For example, in obtaining a constant acceleration of 7.5 feet per second, each monitoring and control unit applies a command speed signal to obtain a speed equal to the square root of the product of twice the acceleration (15) and the distance of the unit from the start position. Thus at a distance of 90 feet, the speed may be the square root of 15 times 90, or 36.74 feet per second. At a distance of 900 feet, the speed may be 116.19 feet per second.

Another heavier line 1041 shows the movement of a vehicle on the main line guideway which travels at 150 feet per second and which overtakes the entering vehicle of line 1040 to be 150 feet ahead of the vehicle of line 1040 when the vehicle of line 1040 enters the main line guideway 1031.

A third heavier line 1042 shows the movement of a vehicle on the main line guideway 1031 which at zero time is traveling at 150 feet per second and which is behind the vehicle of line 1041 at a following distance of 150 feet. To permit entry of the branch line vehicle of line 1040, the vehicle of 1042 moves at a speed of 142.5 feet per second for 20 seconds to then be at a following distance of 150 feet per second behind the entering vehicle of line 1040, after which the vehicle of line 1042 moves at a speed of 150 feet per second.

A series of light lines 1043 show vehicles on the main line guideway 1031 which are ahead of the vehicle of line 1041 and which move at 150 feet per second with constant distances of 150 feet therebetween.

Another series of light lines 1044 show vehicles on the main line guideway which are behind the vehicle of line 1042 and which from time zero to the 20 second time move at constant speeds 142.5 feet per second, rather than 150 feet per second, to gradually increase the following distance behind the vehicle of line 1041 from 150 feet to 300 feet and to place the vehicle of line 1042 at 150 feet behind the entering vehicle of line 1040.

The message-passing operations as described above in connection with FIG. 74 are used in obtaining the following distances of 150 feet per second. To obtain the gradually increasing following distance of the main line guideway vehicle of line 1042 relative to the main line guideway vehicle of line 1041, appropriate speed commands may be applied directly to units along the main line guideway but the scheduling of such signals is relatively complicated since the movement of the vehicle of line 1041 must be taken into account. Preferably, however, the scheduling on the main line guideway is performed by creating a "phantom" vehicle and making use of the message-passing operations of monitoring and control units as described above in connection with FIG. 74. In the message passing operation, the detection of a signal from a vehicle results in the format and sending of a message to a unit behind, each unit responding to messages from units ahead to develop command speed signals for passing vehicles and to automatically operate each vehicle at a speed not greater than that of the vehicle ahead and at a certain following distance which may be proportional to the speed of the vehicle ahead.

To control the vehicle of line 1042 and temporarily operate it at the reduced speed of 142.5 feet per second, a phantom vehicle indicated by dotted line 1046 is created by the merge control unit 1030 which schedules signals to monitoring and control units along the main line guideway 1031 to simulate a vehicle ahead of the vehicle of line 1042. The scheduling of phantom vehicle control signals is such that in response to detection of the vehicle of line 1041 at time T0 by a certain monitoring and control unit, the units ahead of that unit are caused to sequentially develop signals in a timed relation corresponding to the times at which such units ahead would develop signals if a vehicle moved at a reduced speed, such as the 142.5 feet per second speed of the example, along the main line guideway 1031.

The merge control unit 1030 accommodates conditions of operation other than the condition depicted in FIG. 80 in which vehicles are moving uniformly at the relatively high speed of 150 feet per second. The vehicles may be commanded to move at a substantially lower speed such as 75 feet per second or less when weather conditions are difficult or in urban environments space or other factors dictate a lower speed. Also, although every effort may be made to avoid problems, it must be recognized that at times which may be highly inappropriate, vehicles may not move as fast as commanded or may stall.

FIG. 81 is a flow diagram showing the operation of the merge control unit 1030 which performs the operations shown in the graph of FIG. 80 and which also accommodates other conditions of operations. As shown in FIG. 81, initial operations are performed which are like those of the section unit 961 as depicted in FIG. 75. Then a test is made for a set condition of a merge flag which is set after setting up for merge operations. If the merge flag is not set, a test is made for a start signal which may be applied after a vehicle has arrived and is at a stop position at the entrance end of the branch line guideway 1032. If a start signal is then received, a check is made to see if conditions for entry are satisfactory. This check includes a check of all monitoring and control units along both the main line and branch line guideways, to determine among other things whether there are vehicles on the main line guideway which are stalled or moving too slowly and which would interfere with entrance of the waiting vehicle on the branch line guideway 1032. If conditions are not satisfactory, alerts are sent to region control and also to any occupants of the vehicle to inform them about the situation.

If conditions for entry are satisfactory, a determination is made as to the speed and path of a target vehicle on the main line guideway 1031 which may be a vehicle such as the vehicle of line 1041 moving at a high speed. The schedules such as discussed above are then determined, the branch line schedule being sent to monitoring and control units of the branch line guideway 1032 to start acceleration of the waiting vehicle and the main line schedule being sent to the monitoring and control units of the main line guideway to simulate a vehicle such as the vehicle of dotted line 1042 simulating the entering vehicle.

The target vehicle may be a vehicle moving at a slower speed. The path of a vehicle such as that of line 1041 then starts at zero time at a position closer to the reference zero position of the entering vehicle, the scheduled speed values sent to monitoring and control units of the branch line guideway 1032 may be reduced in proportion to speed and the main line guideway scheduling is also changed as appropriate to reflect the difference in starting position and speed of the target vehicle.

If traffic is lighter and there are spacing distances greater than the minimum following distance between vehicles moving on the main guideway at the time of the start signal, a target vehicle may be selected which is at the forward end of such a spacing distance. If traffic is very light and there are no spacing distances, a target vehicle is assumed to be moving at the maximum speed which is allowable.

After sending appropriate schedules, a merge flag is set. The next operation, which may also occur after a positive response to a test for a set condition of the merge flag, is a test to determine whether the speed of the entering vehicle is too low, an occurrence which however unlikely could cause problems. If the speed is too low, a signal is sent to monitoring and control units of the branch line guideway to bring the vehicle to a stop and appropriate alerts are sent, the merge flag being then cleared.

If the speed of the entering vehicle is satisfactory, a check is made determine whether the target path is clear. The target path is clear if there is no vehicle on the main line within a safe following distance behind a vehicle such as the vehicle of line 41 of FIG. 80, or behind a vehicle on an assumed and imaginary target line equivalent to the line 41. If the target path is not clear, the branch and main line schedules are revised to decrease speeds and the target path is changed. The target path might not be clear if, for example, the vehicle of line 41 has slowed down and its path has crossed the line 41 as shown.

If the target path is clear, a further check is made to determine whether the main line is clear for a certain distance ahead of the target path and whether the set speed is at a maximum. It the path is clear ahead and the set speed is not at a maximum, speed and path of the target vehicle and the branch and main line schedules are changed as appropriate.

If the target path is clear but the main line guideway is not clear ahead of the target path or if the speed has been set at a maximum, a check is made to determine whether the merge point has been reached, in which case the merge flag is cleared.

FIG. 82 is a flow diagram for a monitoring and control unit of the main line guideway 1031, which differs from that of FIG. 74 in that it provides for receipt of a message from the merge unit, such as a message as aforementioned, used in simulating the existence on the main line guideway 1031 of a vehicle corresponding to an entering vehicle on the branch line guideway 1032. It also differs from that of FIG. 74 in specifying the receipt and sending of data from and to the merge unit. In other respects the operation is the same as depicted in FIG. 74, the unit being operative with respect to all vehicles moving on the main line guideway 1031.

FIG. 83 is a flow diagram for a monitoring and control unit for the branch line guideway 1032, which is similar to that of FIG. 74 as well as that of FIG. 82. It differs from both in that there are no format and send operations for the reason that only one vehicle is in the branch line guideway 1032 at one time. The unit will receive messages either from the merge unit or from a unit ahead, a feature which is not used in the system as it has been described but which gives greater capabilities for controlling the operation of the unit.

Figure 84:
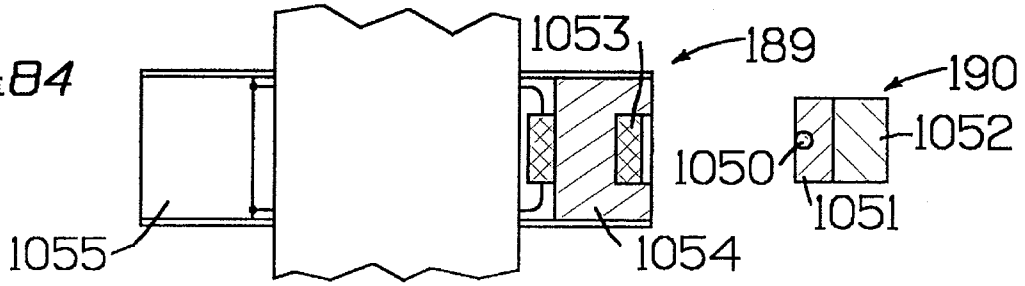
FIG. 84 is a sectional view showing the constructions and relationship of certain signal devices used in conjunction with a transfer vehicle.

FIG. 84 is a sectional view showing the constructions and relationships of an elongated signal device 188 carried by the transfer vehicle 90 and a stationary signal device 189. As indicated above in connection with FIG. 6, signals are transmitted from devices such as device 189 and through devices such as device 188 to control circuitry of the transfer vehicle 90 to provide the transfer vehicle 90 with accurate data as to its location and for otherwise controlling movement of the transfer vehicle 90 from one position to another.

The elongated signal device 188 extends along one side of the transfer vehicle, having one end supported in a groove 187A of the plate 187 at one corner of the vehicle, as shown in FIG. 6. As shown in the cross-sectional view of FIG. 84, device 188 includes a conductor 1050 which is supported in a groove in a member 1051 of insulating material, member 1051 being supported on a bar 1052 of conductive material. The conductor 1050 operates as a transmission line having a characteristic impedance determined by the dimensions and spacial relationships of the parts and by the dielectric constant of the member 1051.

The device 189 is in the form of a coil 1053 on a core 1054 of magnetic material, the coil 1053 being thereby inductively coupled to the conductor 1050 when the device 189 is at any point along the device 188. A unit 1055 contains circuitry for energizing the coil 1053 and may be supplied with power from supply rail 117 or 139.

Figure 85:
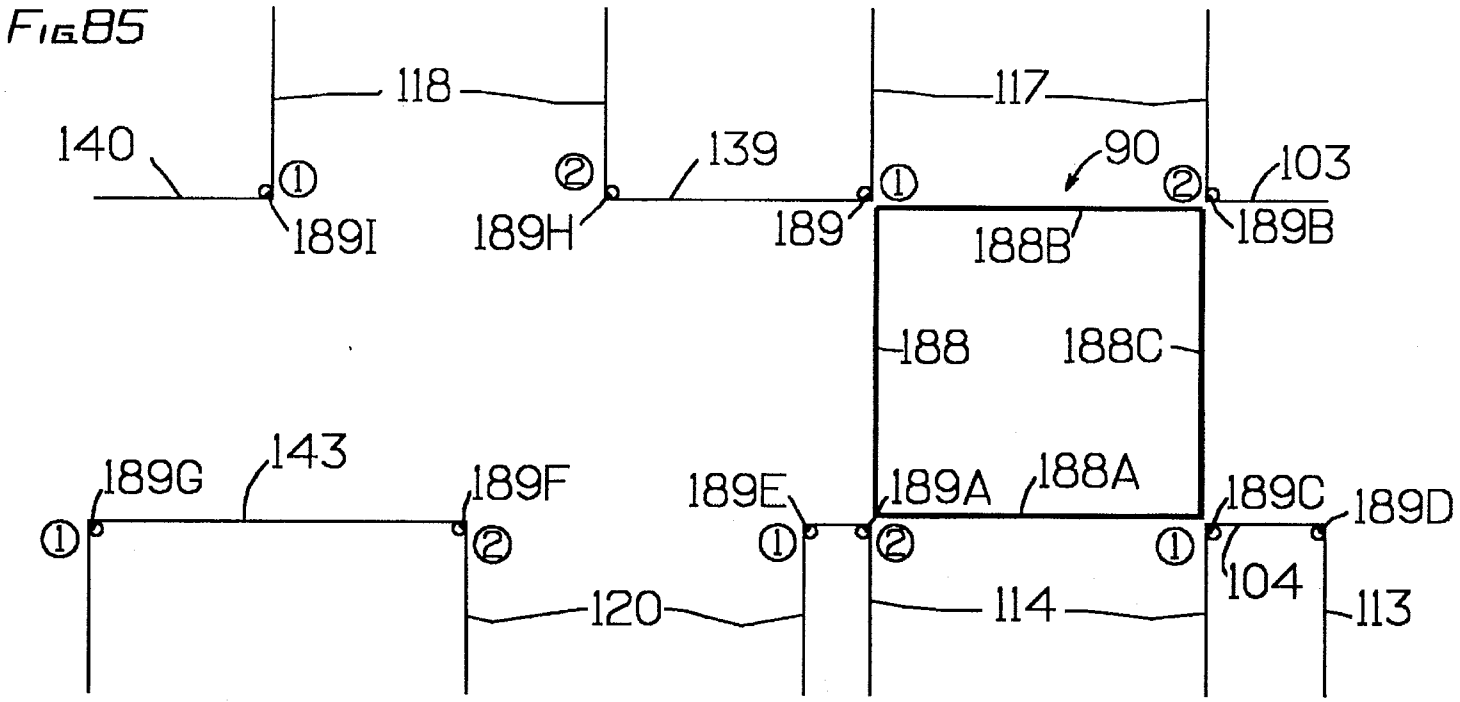
FIG. 85 is schematic diagram for illustrating the use and operation of the signal devices shown in FIG. 84.

The schematic diagram of FIG. 85 shows the elongated electrical signal device 188 and three similar devices 188A, 188B and 188C extend along the four sides of the transfer vehicle 90. FIG. 85 also indicates certain of the rails shown in FIG. 3 and shows the device 189 located at the junction between rail 139 and one of the rails 117 and devices similar to device 189 located at other junctions between rails, devices similar to device 189 being located at all points which are adjacent the four corners of the transfer vehicle when it is at a position at which it may be stopped for a load transfer, a change in direction of travel or a turntable operation. Thus, a device 189A similar to device 189 is located at the junction between rail 140 and one of the rails 114 and other devices 189B, 189C, 189D, 189E, 189F, 189G, 189H and 189I are at other junctions as shown.

The device 189 and each device similar thereto operates on either a No. 1 channel or a No. 2 channel, indicated in circles adjacent thereto in FIG. 85, operating on carriers at separate frequencies in or below the AM broadcast range, for example. Using FSK modulation, or the equivalent, each device continuously transmits unique digital data identifying its location, for reception through inductive coupling to one of the devices 188, 188A, 188B or 188C and for demodulation by circuitry carried by the transfer vehicle 90 to produce the unique digital data identifying the location of the device. In the position of the vehicle 90 shown in FIG. 85, the unique digital data of device 189 on channel No. 1 is received by both devices 188 and 188B, the unique digital data of device 189A on channel No. 2 is received by both devices 188 and 188A, the unique digital data of device 189B on Channel No. 2 is received by both devices 188B and 188C, and the unique digital data of device 189C on Channel No. 1 is received by both devices 188A and 188C.

The transmissions from device 189 and devices similar thereto are on carriers which are preferably at quite low power levels but at uniform amplitudes, such as to permit accurate location of the position of the vehicle through comparison of amplitudes of received carriers which decrease in proportion to movement of either end of a device such as device 188 away from a stationary device such as device 189. In the position of transfer vehicle 90 as shown, the amplitudes of two carriers received by each device 188 188A, 188B and 188C are equal, but any movement of the vehicle away from the position shown results in unbalance between the detected carriers.

It is not necessary that transmitting devices such as device 189 be located adjacent the four corners of the transfer vehicle at all possible stop locations, a situation which is not possible with the configuration of tracks and rails in FIG. 3. For example, when the vehicle 90 is to be moved to the left from the position shown in FIG. 85 and to a destination position for movement between rails 120, the destination position is determined by a balance between the channel No. 2 carrier received by both devices 188 and 188A from device 189F and the channel No. 1 carrier received by both devices 188A and 188C from device 189E.

Figure 86:
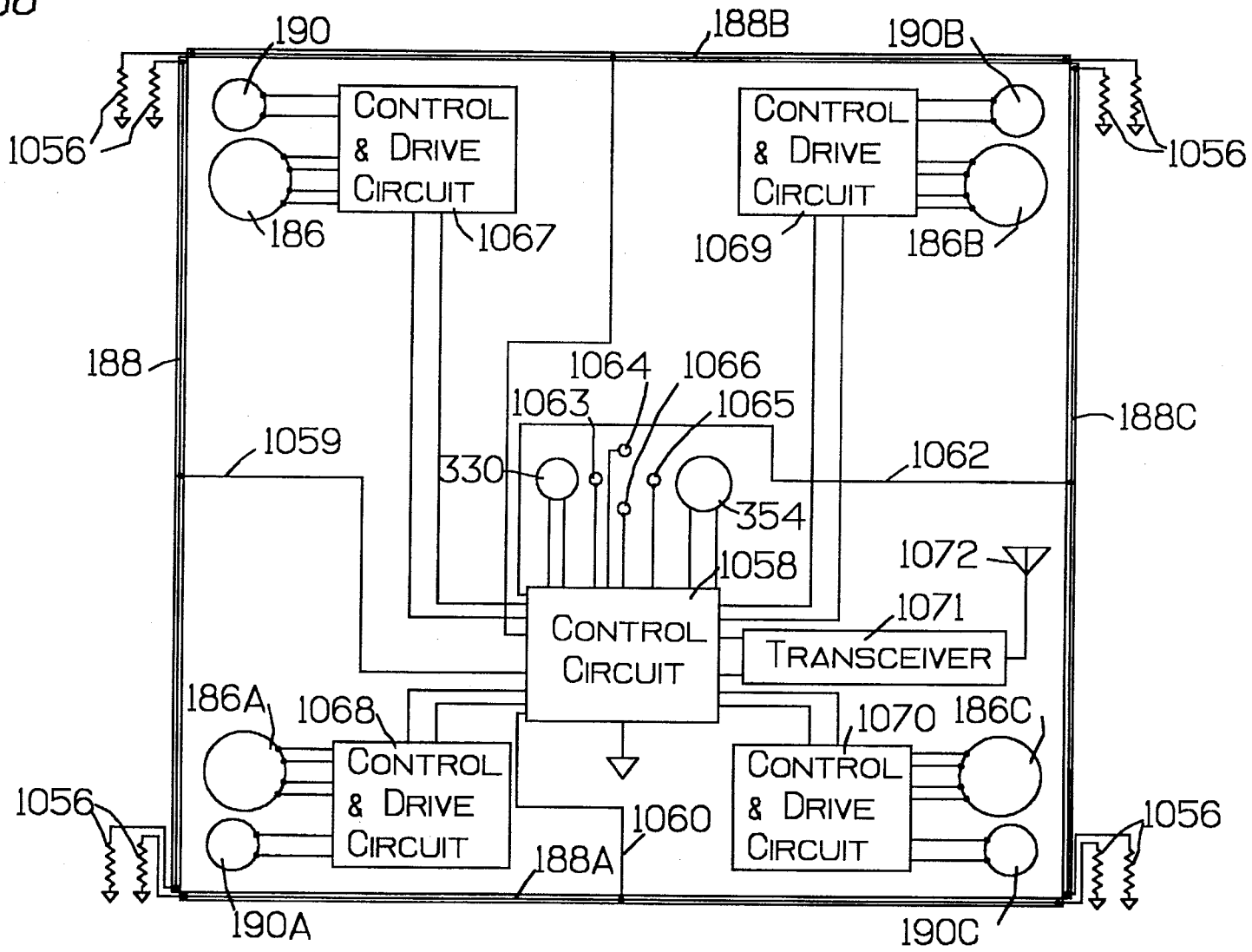
FIG. 86 is a schematic diagram of circuitry of a transfer vehicle.
Figure 87:
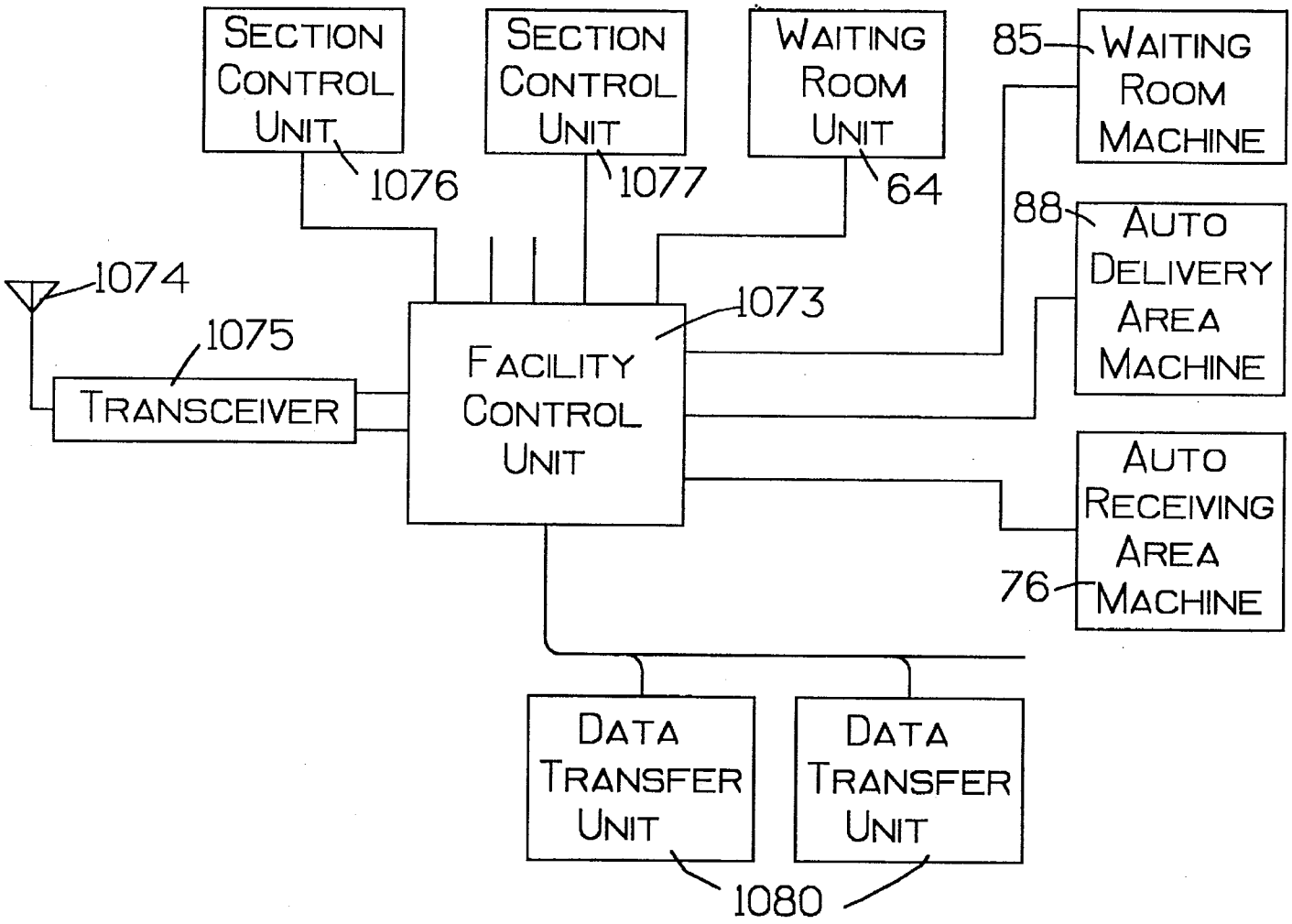
FIG. 87 is a schematic diagram showing a facility control unit its connections to units monitored and controlled therefrom.

FIG. 86 is a schematic diagram of circuitry of the transfer vehicle 90. Eight termination resistors 1056 are provided which connect each end of each of the devices 188, 188A, 188B and 188C to ground, each of the resistors 1056 preferably having a resistance equal to the characteristic impedance of the devices. Signals developed by the devices 188, 188A, 188B and 188C are applied from center points thereof to inputs of a control circuit 1058 through conductors 1059, 1060, 1061 and 1062 which are preferably shielded.

In the control circuit 1058, each of the conductors 1059–1062 is connected to receiving circuitry which separates the channel No. 1 and channel No. 2 signals, which develops analog signals proportional to the amplitudes of the two carriers and which demodulates the FSK modulation to produce serial digital signals which are converted to a parallel output and applied to a processor. The amplitudes of the two carriers may be compared in an analog circuit but are preferably converted to digital signals for processing by the processor of control circuit 1058.

The control circuit 1058 is also connected to four eddy current probes 1063–1066 which are located on the transfer vehicle at points which are at equal distances from and in equi-angularly spaced relation to a center point. Probes 1063–1066 are provided to detect metal objects which are embedded in the floor at center points of stop locations for the vehicle 90. The location of the vehicle is determined to a high degree of accuracy by comparing the outputs of the probes 1063–1066 which are preferably converted to digital signals for comparison by the processor of the control circuit.

The control circuit 1058 is also connected to control and drive circuits 1067–1070 for four steering control motors 190, 190A, 190B and 190C and four drive motors 186, 186A, 186B, and 186C, also to the jack mechanism motor 354 and the prong structure control motor 330. In response of applied command signals, preferably of digital form, each of the control and drive circuits 1067–1070 controls the associated one of the steering control motors 190–190C to position drive wheels in correct positions and then controls the associated one of the drive motor 186–186C to drive the motor in the proper direction and at the proper speed. The speed is changed in response to continuously applied command signals to obtain smooth accelerations and decelerations of the vehicle 90. In addition, the control and drive circuits 1067–1070 monitor rotation of the drive motor shafts and provide data to the control circuit as to distances of movement for control of acceleration and also for control of deceleration in approaching a stop position.

Control circuit 1058 is connected to a transceiver 1071 which is connected to an antenna 1072 for wireless communication with a facility control unit 1073 through an antenna 1074 and a transceiver 1075. Facility control unit 1073 is connected to section control units including a section control unit 1076 which is connected to monitoring and control units associated with the stopping position of passenger carrying vehicles opposite the waiting room 60, and a section control unit 1077 which is connected to monitoring and control units of the loading/unloading position 55.

In addition, facility control unit 1073 is connected to the waiting room unit 64, the machine 76 in the automobile receiving area, the waiting room machine 85 and the automobile delivery area machine 88. It is also connected to a bus 1079 which is connected to a plurality of units 1080 for locations of the facility at which a vehicle may be stored or temporarily reside, each unit 1080 being operative through a link such as provided by transceiver 994 and auxiliary processor 995 shown in FIG. 70, for obtaining any identification or other data available from a body at a location. In addition to or in place of a down load of electronic data from a memory of a body, optical or other means may be provided for obtaining identification or other data, as through reading of bar codes, for example.

In operation, the facility control unit 1073 maintains data as to the status and requests for service of all units or devices which it monitors or controls and makes appropriate responses thereto. For example, if a carrier vehicle enters the section which includes the loading/unloading position 55 and the vehicle carries a body which has reached its destination, as determined from route data in its memory, the section control unit 1077 will send a first signal to the facility control unit 1073 indicating that a move of the transfer vehicle 90 to the position 55 will be required and will then operate to bring the vehicle to a stop, then sending a second signal to the unit 1073 to indicate that unloading may proceed. In response to the first signal the unit 1073 then communicates with the transfer vehicle 90 to send a program as to the one or more moves which vehicle 90 must make to reach a waiting position adjacent the loading/unloading position. If the vehicle 90 is at the position shown in FIG. 3, the program will call for a single move to the waiting position, by sending data including the unique data developed by transmitting devices along the path and at the destination position and data as to the actual distance to the destination point. If the second signal is received in time, indicates that conditions are ready for an unloading operation, the facility control unit may modify the program to command a move directly to the position 55 rather than to a waiting position. Otherwise, the second signal will result in a move to the position 55, followed by operations of the prong structure control motor 330 and the jack mechanism motor 354, to engage the prong structures with the connectors of the body while releasing the locking bars and to then lift the connectors to positions above the pads of the carrier vehicle.

It will be understood that modifications and variations may be effected without departing from the spirit and scope of the novel concepts of this invention.

I claim:

1. A transportation system, comprising: a plurality of carrier vehicles, a guideway for guiding said carrier vehicles for movement therealong and having stop positions therealong, drive means carried by said carrier vehicles for coaction with said guideway for effecting movement of said carrier vehicles along said guideway, control means for controlling said drive means to effect automated movement of each of said carrier vehicles from any one of said stop positions to another of said stop positions, a plurality of bodies of various types each specially adapted to carry a particular type of load, connector means on said bodies and support pad means on said carrier vehicles arranged for interengagement to provide an interconnection between any of said bodies and any of said carrier vehicles, transfer means for effecting guided movement of one of said bodies between a storage position spaced from said guideway and a loading position adjacent one of said carrier vehicles positioned at one of said stop positions, means operable at said one of said positions for interconnecting said connector means of said one of said bodies and said support pad means of said one of said carrier vehicles, releasable locking means for effecting a secure locking interengagement between said connector means and said support pad means to securely connect said one of said bodies and said one of said carrier vehicles, said transfer means including a support element movable horizontally between a first position in supporting relation to said connector means and a second position clear of said supporting relation to said connector means, and said releasable locking means including a locking element operable to a released condition when said support element of said transfer means is moved to said first position and operable to a locked position when said support element of said transfer means is moved to said second position.

2. A transportation system as defined in claim 1, wherein a first of said various types of bodies is specially adapted to carry at least one passenger, a second of said various types of bodies is specially adapted to carry automobiles and a third of said various types of bodies is specially adapted to carry freight loads other than automobiles.

3. A transportation system as defined in claim 1, latch means for latching said locking element in said locked position thereof, and means for releasing said latch means when said support element of said transfer means is moved from said second position thereof and toward said first position thereof.

4. A transportation system as defined in claim 1, said locking element being movable horizontally in a direction parallel to the direction of movement of said support element of said transfer means, and means associated with said support element for interengaging said locking element and moving said locking element from said released condition to said locked position when said support element is moved from said first position thereof to said second position thereof.

5. A transportation system, comprising: a plurality of carrier vehicles, a guideway for guiding said carrier vehicles for movement therealong and having stop positions therealong, drive means carried by said carrier vehicles for coaction with said guideway for effecting movement of said carrier vehicles along said guideway, control means for controlling said drive means to effect automated movement of each of said carrier vehicles from any one of said stop positions to another of said stop positions, a plurality of bodies of various types each specially adapted to carry a particular type of load, connector means on said bodies and support pad means on said carrier vehicles arranged for interengagement to provide an interconnection between any of said bodies and any of said carrier vehicles, transfer means for effecting guided movement of one of said bodies between a storage position spaced from said guideway and a loading position adjacent one of said carrier vehicles positioned at one of said stop positions, means operable at said one of said positions for interconnecting said connector means of said one of said bodies and said support pad means of said one of said carrier vehicles, and means associated with said connector means and said support pad means for effecting electrical connections between electrical circuit means in said one of said bodies and electrical circuit means in said one of said carrier vehicles.

6. A transportation system, comprising: a plurality of carrier vehicles, a guideway for guiding said carrier vehicles for movement therealong and having stop positions therealong, drive means carried by said carrier vehicles for coaction with said guideway for effecting movement of said carrier vehicles along said guideway, control means for controlling said drive means to effect automated movement of each of said carrier vehicles from any one of said stop positions to another of said stop positions, a plurality of bodies of various types each specially adapted to carry a particular type of load, connector means on said bodies and support pad means on said carrier vehicles arranged for interengagement to provide an interconnection between any of said bodies and any of said carrier vehicles, transfer means for effecting guided movement of one of said bodies between a storage position spaced from said guideway and a loading position adjacent one of said carrier vehicles positioned at one of said stop positions, means operable at said one of said positions for interconnecting said connector means of said one of said bodies and said support pad means of said one of said carrier vehicles, said control means including electrical circuit means in said one of said carrier vehicles, said one of said bodies including destination selection means operative for selecting a destination position from among a number of said stop positions, and means for transmitting signals between said destination selection means and said control means.

7. A transportation system as defined in claim 6, wherein said destination selection means are provided for operation by a passenger in bodies which are specially adapted to carry passengers to constitute one of said various types of bodies.

8. A transportation system as defined in claim 6, wherein said destination selection means are provided for operation by a dispatcher in bodies which are specially adapted to carry a freight load to constitute one of said various types of bodies.

9. A transportation system, comprising: a plurality of bodies each including first and second connector means secured in spaced relation thereto, means defining a plurality of locations at which support pad means may be located for support of said bodies through engagement with said connector means thereof, a transfer vehicle including transfer means for coaction with said connector means of any of said bodies and for actuation between a first condition in which said connector means are supported by said support pad means and a second condition in which said connector means are separated from said support pad means and supported by said transfer vehicle, said transfer vehicle with said transfer means in said second condition being movable between one of said positions and another of said positions to move one of said bodies between said positions, said first and second connector means being secured in spaced relation along an underside portion of each of said body means, and said transfer vehicle being movable to position said transfer means between said first and second connector means for actuation between said first and second conditions with said connector means being elevated during actuation of said transfer means from said first condition to said second condition, said first and second connector means being secured in longitudinally spaced relation and forwardly and rearwardly with respect to a center of gravity of each of said bodies and each of said first and second connector means including transversely spaced portions on opposite sides of a longitudinally extending vertical plane through said center of gravity, and said transfer means including a first pair of engagement means movable in one longitudinal direction into supporting engagement with said transversely spaced portions of said first connector means and a second pair of engagement means movable in an opposite longitudinal direction for supporting engagement with said transversely spaced portions of said second connector means.

10. A transportation system as defined in claim 9, said transfer vehicle including a frame, first pair of wheel means supporting portions of said frame in generally underlying relation to said first pair of engagement means and a second pair of wheel means supporting portions of said frame in generally underlying relation to said second pair of engagement means.

11. A transportation system as defined in claim 10, each of said wheel means including a wheel, bearing means journaling said wheel, and steering means supporting a portion of said frame on said bearing means and arranged for rotation about a vertical steering axis relative to said frame to position said wheel for movement of said transfer vehicle in a selected direction.

12. A transportation system as defined in claim 11, said steering means of all of said wheel means being rotatable between positions in which said transfer vehicle is movable in one direction and positions in which said transfer vehicle is moved in a direction perpendicular to said one direction.

13. A transportation system as defined in claim 11, said steering means of all of said wheel means being rotatable to positions such as to allow a turntable movement of said transfer vehicle about a central vertical axis.

14. A transportation system, comprising: body support means at each of a plurality of body support locations for supporting a body thereat, transfer vehicle means movable horizontally in certain paths for removing a body from one of said body support locations and depositing said body at another of said locations, said paths including a plurality of first paths in directions parallel to a first direction and at least one second path intersecting said first paths and in a second direction normal to said first direction, said transfer vehicle means including frame means, a plurality of wheel assembly means supporting spaced portions of said frame means, each of said wheel assembly means including a first structure connected to said frame means, a second structure supporting said first structure and rotatable about a vertical axis relative to said first strucure, a wheel, bearing means on said second structure for journaling said wheel for rotation about a horizontal axis, electric drive motor means supported on said second structure and coupled to said wheel, said drive motor means being selectively energizable to rotate said wheel in either direction, and steering control means operative for rotating said second structures of all of said wheel assembly means about said vertical steering axes and between first positions in which said wheels are positioned for movement of said transfer vehicle means in one of said first paths and second positions in which said wheels are positioned for movement of said transfer vehicle means in said second path.

15. A transportation system as defined in claim 14, said first structure including a portion having an opening therein and disposed in generally surrounding relation to said bearing means and in overlying relation to a peripheral portion of said second structure, and ball bearing means between an upper side of said peripheral portion of said second structure and said overlying portion of said first structure.

16. A transportation system as defined in claim 15, said portion of said first structure having a cylindrical internal surface about said vertical axis and defining said opening, and roller means supported on said second structure and engaged with said cylindrical internal surface.

17. A transportation system as defined in claim 14, said steering control means being also operative for rotating said second structures to positions such that said wheels are positioned for movement of said transfer vehicle means about a central vertical axis and for controlling said said electric drive motor means of said wheel assemblies to rotate all of said wheels in proper directions to rotate said transfer vehicle means about said central vertical axis.

18. A transportation system as defined in claim 14, electric supply rail means extending along opposite sides of each of said paths, said transfer vehicle means including electric contact means for engaging said supply rail means to obtain power for energization of said electric drive motor means.

19. A transportation system as defined in claim 18, said wheel assemblies being located at four corner portions of said transfer vehicle means, said electric supply rail means including portions meeting at a right angle corners which are opposite said corner portions of said transfer vehicle means when said transfer vehicle means are located at an intersection between said first and second paths, and said contact means including corner contacts extending from said corner portions of said transfer vehicle means.

20. A transportation system as defined in claim 19, said corner contacts being supported for rotation about a vertical axis, and said steering control means being operative for rotating said corner contacts about said vertical axis to position said corner contacts in accordance with the direction of movement of said transfer vehicle means.

21. A transportation system as defined in claim 20, said electrical supply rail means including portions extending arcuately about a central vertical axis of said transfer vehicle means, said steering control means being also operative for rotating said second structures to positions such that said wheels are positioned for movement of said transfer vehicle means about said central vertical axis, for controlling said said electric drive motor means of said wheel assemblies to rotate all of said wheels in proper directions to rotate said transfer vehicle means about said central vertical axis, and for rotating said corner contacts into positions for engagement with said arcuately extending portions of said supply rail means.

22. A transportation system, comprising: body support means at each of a plurality of body support locations for supporting a body thereat, transfer vehicle means movable horizontally in certain paths for removing a body from one said body support locations and depositing said body at another of said locations, said paths including a plurality of first paths in directions parallel to a first direction and at least one second path intersecting said first paths and in a second direction normal to said first direction, said transfer vehicle means including frame means, a plurality of wheel assembly means supporting spaced portions of said frame means for movements in said paths and including wheels and electric motor means for rotating said wheels, control means for controlling directions of movement of said transfer vehicle means and for controlling energization of said electric motor means, a plurality of first signal devices positioned at points along said paths each operative to transmit a unique signal identifying its location, and second signal devices on said transfer vehicle means for receiving signals from said first signal devices and applying signals to said control means for control of movements of said transfer vehicle means along said paths, said first signal devices being positioned at points opposite four corner portions of said transfer vehicle means when located at intersections between said first paths and said second path.

23. A transportation system as defined in claim 22, said first and second signal devices including conductors that are inductively coupled when brought into proximity to each other.

24. A transportation system as defined in claim 23, said conductors of said first signal devices being in the form of coils, and said conductors of said second signal devices being in the form of straight conductors extending along four sides of said transfer vehicle means and providing four transmission lines coupled to said control means.

25. A transportation system, comprising: a plurality of passenger bodies each arranged for supporting at least one passenger, a plurality of automobile platform bodies each arranged for supporting an automobile thereon, a plurality of freight bodies each arranged for supporting a freight load other than an automobile, a plurality of carrier vehicles separate from said passenger bodies, said automobile platform bodies and freight bodies, each of said carrier vehicles including support pad means thereon, each of said bodies including connector means arranged for engagement with said support pad means of any of said carrier vehicles, locking means operable between released and locking conditions and operable in said locking condition to securely connect interengaged connector means and support pad means and to prevent relative movement thereof in any direction, a guideway for guiding said carrier carrier vehicles for movement therealong and having stop positions therealong, drive means carried by said carrier carrier vehicles for coaction with said guideway for effecting movement of said carrier carrier vehicles along said guideway, control means for controlling said drive means to effect automated movement of each of said carrier vehicles from any one of said stop positions to another of said stop positions, said stop positions including passenger pick-up and discharge positions at which passengers may enter and leave passenger bodies secured to carrier vehicles positioned thereat, said stop positions further including body loading/unloading positions at which bodies may be transferred between a carrier vehicle positioned thereat and one or more body support positions in the vicinity thereof, said body support positions including automobile receiving and delivery positions at which automobiles may be driven onto and off of said automobile platform bodies, transfer means for effecting guided movement of bodies between said body loading/unloading positions and said body support positions in the vicinity thereof, and operating means at each of said body loading/unloading positions for selectively operating said locking means between said released and locking conditions to selectively connect and disconnect said connector means and said support pad means of a body and a carrier vehicle positioned thereat so as to allow selective loading and loading of bodies on said carrier vehicle positioned thereat, each carrier vehicle after unloading of a body therefrom at one of said body loading/unloading positions being subsequently usable for loading of any type of body thereon at any of said body loading/unloading positions.

* * * * *